US008182335B2

(12) United States Patent
Ajiro et al.

(10) Patent No.: US 8,182,335 B2
(45) Date of Patent: May 22, 2012

(54) GAMING MACHINE HAVING A PLURALITY OF CONSOLES AND PLAYING METHOD THEREOF

(75) Inventors: Arata Ajiro, Tokyo (JP); Yoichi Kato, Tokyo (JP); Kenta Sugano, Tokyo (JP)

(73) Assignee: Universal Entertainment Corporation, Tokyo (JP)

( * ) Notice: Subject to any disclaimer, the term of this patent is extended or adjusted under 35 U.S.C. 154(b) by 450 days.

(21) Appl. No.: 12/467,961

(22) Filed: May 18, 2009

(65) Prior Publication Data

US 2009/0291753 A1 Nov. 26, 2009

Related U.S. Application Data

(60) Provisional application No. 61/054,675, filed on May 20, 2008, provisional application No. 61/054,702, filed on May 20, 2008, provisional application No. 61/054,719, filed on May 20, 2008, provisional application No. 61/056,334, filed on May 27, 2008.

(51) Int. Cl.
*A63F 9/24* (2006.01)

(52) U.S. Cl. ..... 463/25

(58) Field of Classification Search ..... 463/16–25
See application file for complete search history.

(56) References Cited

U.S. PATENT DOCUMENTS

| | | | | |
|---|---|---|---|---|
| 4,283,709 | A | 8/1981 | Lucero et al. | |
| 5,820,459 | A | 10/1998 | Acres et al. | |
| 6,003,013 | A | 12/1999 | Boushy et al. | |
| 6,142,872 | A | 11/2000 | Walker et al. | |
| 6,312,332 | B1 | 11/2001 | Walker et al. | |
| 6,361,441 | B1 | 3/2002 | Walker et al. | |
| 6,375,569 | B1 * | 4/2002 | Acres | 463/27 |
| 6,733,390 | B2 | 5/2004 | Walker et al. | |
| 2002/0042296 | A1 | 4/2002 | Walker et al. | |
| 2002/0151367 | A1 | 10/2002 | Ishida | |
| 2006/0166731 | A1 * | 7/2006 | Yoshimi et al. | 463/20 |
| 2006/0178203 | A1 * | 8/2006 | Hughes et al. | 463/20 |
| 2007/0060316 | A1 * | 3/2007 | O'Halloran | 463/25 |
| 2007/0173316 | A1 * | 7/2007 | Cowan et al. | 463/25 |
| 2007/0265066 | A1 * | 11/2007 | Curry et al. | 463/26 |
| 2008/0113708 | A1 | 5/2008 | Beadell et al. | |
| 2009/0075739 | A1 * | 3/2009 | Richardson | 463/42 |
| 2009/0137307 | A1 * | 5/2009 | Yoshizawa | 463/20 |
| 2009/0233677 | A1 * | 9/2009 | Oomori | 463/20 |
| 2009/0239655 | A1 * | 9/2009 | Yoshizawa | 463/25 |
| 2009/0286603 | A1 * | 11/2009 | Mori | 463/42 |
| 2009/0291737 | A1 * | 11/2009 | Ajiro et al. | 463/20 |
| 2009/0291753 | A1 * | 11/2009 | Ajiro et al. | 463/27 |
| 2009/0305763 | A1 * | 12/2009 | Kato et al. | 463/20 |
| 2009/0305764 | A1 * | 12/2009 | Kato et al. | 463/20 |
| 2011/0130192 | A1 * | 6/2011 | Englman et al. | 463/20 |

FOREIGN PATENT DOCUMENTS

| | | |
|---|---|---|
| CA | 2278897 | 7/1999 |

* cited by examiner

*Primary Examiner* — Ha Tran T Nguyen
*Assistant Examiner* — Vongsavanh Sengdara
(74) *Attorney, Agent, or Firm* — Sheppard, Mullin, Richter & Hampton LLP

(57) ABSTRACT

In each gaming terminal, the base game is run independently from the other gaming terminals and the payout is awarded according to a predetermined winning. The bonus game is run based on a predetermined condition. When a predetermined winning is met in any of the gaming terminals, the state of the light emitting portions in the corresponding path having straight and bent portions is changed toward the bonus payout indicator, in numbers fewer in the straight portion than in the bent portion. The bonus payout is awarded in the gaming terminal corresponding to a path in which the light emitting portions underwent state changes up to the bonus payout indicator.

5 Claims, 82 Drawing Sheets

FIG. 9

| | DISPLAY WINDOW151 | DISPLAY WINDOW152 | DISPLAY WINDOW153 | DISPLAY WINDOW154 | DISPLAY WINDOW155 |
|---|---|---|---|---|---|
| CODE NO. | SYMBOL | SYMBOL | SYMBOL | SYMBOL | SYMBOL |
| 00 | Angelfish | Tuna | Tuna | Coelacanth | Clownfish |
| 01 | Clownfish | Coelacanth | Tuna | Angelfish | Tuna |
| 02 | Angelfish | Tuna | Angelfish | Clownfish | Angelfish |
| 03 | Clownfish | Coelacanth | Tuna | BONUS | Coelacanth |
| 04 | Angelfish | Tuna | Angelfish | Coelacanth | Clownfish |
| 05 | Clownfish | Angelfish | Clownfish | Clownfish | 7 |
| 06 | Angelfish | Clownfish | Angelfish | Tuna | Angelfish |
| 07 | Clownfish | Tuna | Clownfish | 7 | Tuna |
| 08 | 7 | Coelacanth | Angelfish | Clownfish | Clownfish |
| 09 | Tuna | Tuna | Clownfish | Angelfish | Coelacanth |
| 10 | Angelfish | Coelacanth | Angelfish | Coelacanth | Tuna |
| 11 | Coelacanth | BONUS | Clownfish | Angelfish | Clownfish |
| 12 | Angelfish | Clownfish | Coelacanth | Clownfish | Coelacanth |
| 13 | BONUS | 7 | BONUS | Tuna | Angelfish |
| 14 | 7 | Coelacanth | 7 | Tuna | Tuna |
| 15 | Angelfish | Tuna | Coelacanth | BONUS | Clownfish |
| 16 | Tuna | Coelacanth | Tuna | Tuna | Tuna |
| 17 | Clownfish | BONUS | Clownfish | Coelacanth | Angelfish |
| 18 | Angelfish | Clownfish | Angelfish | Clownfish | Coelacanth |
| 19 | Clownfish | Tuna | Clownfish | Angelfish | Angelfish |
| 20 | 7 | Coelacanth | Angelfish | Tuna | Clownfish |
| 21 | Tuna | Tuna | Clownfish | Clownfish | BONUS |

FIG. 10

EMISSION CONTROL TABLE FOR BENT PORTION

| WINNING COMBINATION | NUMBER OF LEDs TURNED ON |
|---|---|
| Clownfish | 2 |
| Coelacanth | 4 |
| Angelfish | 6 |
| Tuna | 8 |
| BONUS | 10 |
| 7 | 12 |

FIG. 11

EMISSION CONTROL TABLE FOR STRAIGHT PORTION

| WINNING COMBINATION | NUMBER OF LEDs TURNED ON |
|---|---|
| Clownfish | 1 |
| Coelacanth | 2 |
| Angelfish | 3 |
| Tuna | 4 |
| BONUS | 5 |
| 7 | 6 |

FIG. 12

TABLE OF PROGRESSIVE VALUES FOR EACH GAMING TERMINAL

| GAMING TERMINAL | PROGRESSIVE VALUE |
|---|---|
| GAMING TERMINAL10a | 50 |
| GAMING TERMINAL10b | 15 |
| GAMING TERMINAL10c | 25 |
| ⋮ | ⋮ |
| GAMING TERMINAL10i | 100 |
| GAMING TERMINAL10j | 10 |

INITIAL PROCESS

FIG.20

BASE GAME PAYOUT TABLE

| NUMBER OF BETS | WINNING | AMOUNT OF PAYOUT |
|---|---|---|
| 1 | BAR BAR BAR / BAR BAR BAR / BAR BAR BAR | 60 |
| 1 | BAR BAR BAR / BAR BAR BAR | 40 |
| 1 | BAR BAR BAR | 20 |
| 1 | ANY BAR ANY BAR ANY BAR | 10 |
| 1 | BLANK BLANK BLANK | 1 |
| 2 | BAR BAR BAR / BAR BAR BAR / BAR BAR BAR | 120 |
| 2 | BAR BAR BAR / BAR BAR BAR | 80 |
| 2 | BAR BAR BAR | 40 |
| 2 | ANY BAR ANY BAR ANY BAR | 20 |
| 2 | BLANK BLANK BLANK | 2 |
| 3 | 7 7 7 | 1800 |
| 3 | 7 7 7 | 100 |
| 3 | ANY ANY ANY | 100 |

FIG.22

BONUS GAME PAYOUT TABLE

| WINNING | PAYOUT POINTS |
|---|---|
| 7 7 7 | 7000 |
| 7 | 300 |
| 7 | 150 |
| BAR BAR BAR | 30 |
| BAR BAR | 20 |
| BAR | 10 |

FIG. 29

| | DISPLAY WINDOW151 | DISPLAY WINDOW152 | DISPLAY WINDOW153 | DISPLAY WINDOW154 | DISPLAY WINDOW155 |
|---|---|---|---|---|---|
| CODE No. | SYMBOL | SYMBOL | SYMBOL | SYMBOL | SYMBOL |
| 00 | Angelfish | Tuna | Tuna | Coelacanth | Clownfish |
| 01 | Clownfish | Coelacanth | Tuna | Angelfish | Tuna |
| 02 | Angelfish | Tuna | Angelfish | Clownfish | Angelfish |
| 03 | Clownfish | Coelacanth | Tuna | BONUS | Coelacanth |
| 04 | Angelfish | Tuna | Angelfish | Coelacanth | Clownfish |
| 05 | Clownfish | Angelfish | Clownfish | Clownfish | 7 |
| 06 | Angelfish | Clownfish | Angelfish | Tuna | Angelfish |
| 07 | Clownfish | Tuna | Clownfish | 7 | Tuna |
| 08 | 7 | Coelacanth | Angelfish | Clownfish | Clownfish |
| 09 | Tuna | Tuna | Clownfish | Angelfish | Coelacanth |
| 10 | Angelfish | Coelacanth | Angelfish | Coelacanth | Tuna |
| 11 | Coelacanth | BONUS | Clownfish | Angelfish | Clownfish |
| 12 | Angelfish | Clownfish | Coelacanth | Clownfish | Coelacanth |
| 13 | BONUS | 7 | BONUS | Tuna | Angelfish |
| 14 | 7 | Coelacanth | 7 | Tuna | Tuna |
| 15 | Angelfish | Tuna | Coelacanth | BONUS | Clownfish |
| 16 | Tuna | Coelacanth | Tuna | Tuna | Tuna |
| 17 | Clownfish | BONUS | Clownfish | Coelacanth | Angelfish |
| 18 | Angelfish | Clownfish | Angelfish | Clownfish | Coelacanth |
| 19 | Clownfish | Tuna | Clownfish | Angelfish | Angelfish |
| 20 | 7 | Coelacanth | Angelfish | Tuna | Clownfish |
| 21 | Tuna | Tuna | Clownfish | Clownfish | BONUS |

FIG. 30

EMISSION LIGHT MANAGEMENT TABLE

| GAMING TERMINAL | EMISSION COLOR |
|---|---|
| 1 | BLUE |
| 2 | RED |
| 3 | WHITE |
| 4 | YELLOW |
| ... | ... |

FIG. 31

PATH UNIT ACTIVATION STATE TABLE

| PATH UNIT | NUMBER OF ACTIVATED LIGHT EMITTING PORTIONS | NUMBER OF INACTIVATED LIGHT EMITTING PORTIONS |
|---|---|---|
| 301a | 10 | 90 |
| 301b | 0 | 110 |
| 301c | 100 | 20 |
| 301d | 30 | 70 |
| ... | ... | ... |

FIG. 32

CONTRIBUTION AMOUNT MANAGEMENT TABLE

| GAMING TERMINAL | CONTRIBUTION AMOUNT |
|---|---|
| 10a | 130 |
| 10b | 26 |
| 10c | 86 |
| 10d | 112 |
| ... | ... |

INITIAL SETTING ROUTINE

RUNNING BASE GAME

FIG.43

BASE GAME PAYOUT TABLE

| BET VALUE | WINNING | PAYOUT VALUE |
|---|---|---|
| 1 | BAR BAR BAR<br>BAR BAR BAR<br>BAR BAR BAR | 60 |
| 1 | BAR BAR BAR<br>BAR BAR BAR | 40 |
| 1 | BAR BAR BAR | 20 |
| 1 | ANY BAR ANY BAR ANY BAR | 10 |
| 1 | BLANK BLANK BLANK | 1 |
| 2 | BAR BAR BAR<br>BAR BAR BAR<br>BAR BAR BAR | 120 |
| 2 | BAR BAR BAR<br>BAR BAR BAR | 80 |
| 2 | BAR BAR BAR | 40 |
| 2 | ANY BAR ANY BAR ANY BAR | 20 |
| 2 | BLANK BLANK BLANK | 2 |
| 3 | 7 7 7 | 1800 |
| 3 | 7 7 7 | 100 |
| 3 | ANY ANY ANY | 100 |

FIG.45

BONUS GAME PAYOUT TABLE

| WINNING | PAYOUT POINT |
|---|---|
| 7 7 7 | 7000 |
| 7 | 300 |
| 7 | 150 |
| BAR BAR BAR | 30 |
| BAR BAR | 20 |
| BAR | 10 |

FIG. 52

| | DISPLAY WINDOW151 | DISPLAY WINDOW152 | DISPLAY WINDOW153 | DISPLAY WINDOW154 | DISPLAY WINDOW155 |
|---|---|---|---|---|---|
| CODE No. | SYMBOL | SYMBOL | SYMBOL | SYMBOL | SYMBOL |
| 00 | Angelfish | Tuna | Tuna | Coelacanth | Clownfish |
| 01 | Clownfish | Coelacanth | Tuna | Angelfish | Tuna |
| 02 | Angelfish | Tuna | Angelfish | Clownfish | Angelfish |
| 03 | Clownfish | Coelacanth | Tuna | BONUS | Coelacanth |
| 04 | Angelfish | Tuna | Angelfish | Coelacanth | Clownfish |
| 05 | Clownfish | Angelfish | Clownfish | Clownfish | 7 |
| 06 | Angelfish | Clownfish | Angelfish | Tuna | Angelfish |
| 07 | Clownfish | Tuna | Clownfish | 7 | Tuna |
| 08 | 7 | Coelacanth | Angelfish | Clownfish | Clownfish |
| 09 | Tuna | Tuna | Clownfish | Angelfish | Coelacanth |
| 10 | Angelfish | Coelacanth | Angelfish | Coelacanth | Tuna |
| 11 | Coelacanth | BONUS | Clownfish | Angelfish | Clownfish |
| 12 | Angelfish | Clownfish | Coelacanth | Clownfish | Coelacanth |
| 13 | BONUS | 7 | BONUS | Tuna | Angelfish |
| 14 | 7 | Coelacanth | 7 | Tuna | Tuna |
| 15 | Angelfish | Tuna | Coelacanth | BONUS | Clownfish |
| 16 | Tuna | Coelacanth | Tuna | Tuna | Tuna |
| 17 | Clownfish | BONUS | Clownfish | Coelacanth | Angelfish |
| 18 | Angelfish | Clownfish | Angelfish | Clownfish | Coelacanth |
| 19 | Clownfish | Tuna | Clownfish | Angelfish | Angelfish |
| 20 | 7 | Coelacanth | Angelfish | Tuna | Clownfish |
| 21 | Tuna | Tuna | Clownfish | Clownfish | BONUS |

FIG. 54

PATH UNIT TABLE

| PATH UNIT | QUANTITY OF LIGHT EMITTING PORTIONS |
|---|---|
| 301a | 100 |
| 301b | 110 |
| 301c | 120 |
| 301d | 100 |
| ... | ... |

FIG. 55

PATH UNIT ACTIVATION STATE TABLE

| PATH UNIT | QUANTITY OF ACTIVATED LIGHT EMITTING PORTIONS | QUANTITY OF INACTIVATED LIGHT EMITTING PORTIONS |
|---|---|---|
| 301a | 57 | 43 |
| 301b | 0 | 110 |
| 301c | 100 | 20 |
| 301d | 30 | 70 |
| ... | ... | ... |

RUNNING BASE GAME

BASE GAME AWARD TABLE

| BET VALUE | WINNING | PAYOUT VALUE |
|---|---|---|
| 2 | BAR BAR BAR / BAR BAR BAR / BAR BAR BAR | 120 |
| 2 | BAR BAR BAR / BAR BAR BAR | 80 |
| 2 | BAR BAR BAR | 40 |
| 2 | ANY BAR ANY BAR ANY BAR | 20 |
| 2 | BLANK BLANK BLANK | 2 |
| ..... | ..... | .... |

FIG.64

BASE GAME PAYOUT TABLE

| BET VALUE | WINNING | PAYOUT VALUE |
|---|---|---|
| 1 | BAR BAR BAR<br>BAR BAR BAR<br>BAR BAR BAR | 60 |
| 1 | BAR BAR BAR<br>BAR BAR BAR | 40 |
| 1 | BAR BAR BAR | 20 |
| 1 | ANY BAR ANY BAR ANY BAR | 10 |
| 1 | BLANK BLANK BLANK | 1 |
| 2 | BAR BAR BAR<br>BAR BAR BAR<br>BAR BAR BAR | 120 |
| 2 | BAR BAR BAR<br>BAR BAR BAR | 80 |
| 2 | BAR BAR BAR | 40 |
| 2 | ANY BAR ANY BAR ANY BAR | 20 |
| 2 | BLANK BLANK BLANK | 2 |
| 3 | 7 7 7 | 1800 |
| 3 | 7 7 7 | 100 |
| 3 | ANY ANY ANY | 100 |

FIG.66

BONUS GAME PAYOUT TABLE

| WINNING | PAYOUT POINT |
|---|---|
| 7 7 7 | 7000 |
| 7 | 300 |
| 7 | 150 |
| BAR BAR BAR | 30 |
| BAR BAR | 20 |
| BAR | 10 |

FIG. 72

BASE GAME WINNING COMBINATION LOTTERY TABLE

130

| WINNING COMBINATION | RANDOM NUMBER VALUE |
|---|---|
| ☀×5 | 0～29 |
| ♥×5 | 30～51 |
| ☾×5 | 52～107 |
| K×5 | 108～207 |
| A×5 | 208～407 |
| Q×5 | 408～807 |
| J×5 | 808～1477 |
| 10×5 | 1478～1807 |
| LOSS | 1808～5998 |

FIG. 73

BASE GAME PAYOUT TABLE

131

| WINNING COMBINATION | PAYOUT (PAYING OUT COINS) |
|---|---|
| ☀ × 5 | 70COINS |
| ♥ × 5 | 50COINS |
| ☾ × 5 | 30COINS |
| K × 5 | 25COINS |
| A × 5 | 20COINS |
| Q × 5 | 15COINS |
| J × 5 | 10COINS |
| 10 × 5 | 5COINS |
| LOSS | 0COIN |

FIG. 74

JACKPOT POINT TABLE

132

| THE NUMBER OF SYMBOLS OF SUN (THE NUMBER OF JACKPOT POINT SYMBOLS) | THE NUMBER OF POINTS OBTAINED |
|---|---|
| 0 | 0PT |
| 1 | 1PT |
| 2 | 2PT |
| 3 | 3PT |
| 4 | 4PT |
| 5 | 5PT |
| 6 | 6PT |
| 7 | 7PT |
| 8 | 8PT |
| 9 | 9PT |

FIG. 77

| | SYMBOL LINE A | SYMBOL LINE B | SYMBOL LINE C | SYMBOL LINE D | SYMBOL LINE E |
|---|---|---|---|---|---|
| CODE NO. | SYMBOL | SYMBOL | SYMBOL | SYMBOL | SYMBOL |
| 00 | SUN | J | J | HEART | 10 |
| 01 | 10 | HEART | MOON | SUN | J |
| 02 | SUN | J | SUN | 10 | SUN |
| 03 | A | HEART | J | K | HEART |
| 04 | SUN | 10 | A | HEART | J |
| 05 | 10 | SUN | 10 | A | Q |
| 06 | SUN | A | SUN | J | SUN |
| 07 | A | MOON | K | Q | J |
| 08 | Q | HEART | A | 10 | A |
| 09 | MOON | J | K | SUN | HEART |
| 10 | SUN | HEART | SUN | HEART | Q |
| 11 | HEART | K | 10 | SUN | 10 |
| 12 | SUN | MOON | HEART | 10 | HEART |
| 13 | K | Q | Q | MOON | SUN |
| 14 | Q | HEART | SUN | J | J |
| 15 | SUN | J | HEART | K | A |
| 16 | J | HEART | MOON | MOON | MOON |
| 17 | K | K | 10 | HEART | SUN |
| 18 | SUN | 10 | SUN | 10 | HEART |
| 19 | 10 | MOON | 10 | SUN | SUN |
| 20 | Q | HEART | SUN | MOON | 10 |
| 21 | MOON | SUN | Q | A | K |

EXECUTION OF BASE GAME

FIG.84

SECOND BASE GAME PAYOUT TABLE

| NUMBER OF BETS | WINNING | AMOUNT OF PAYOUT |
|---|---|---|
| 1 | BAR BAR BAR<br>BAR BAR BAR<br>BAR BAR BAR | 60 |
| 1 | BAR BAR BAR<br>BAR BAR BAR | 40 |
| 1 | BAR BAR BAR | 20 |
| 1 | ANY BAR ANY BAR ANY BAR | 10 |
| 1 | BLANK BLANK BLANK | 1 |
| 2 | BAR BAR BAR<br>BAR BAR BAR<br>BAR BAR BAR | 120 |
| 2 | BAR BAR BAR<br>BAR BAR BAR | 80 |
| 2 | BAR BAR BAR | 40 |
| 2 | ANY BAR ANY BAR ANY BAR | 20 |
| 2 | BLANK BLANK BLANK | 2 |
| 3 | 7 7 7 | 1800 |
| 3 | 7 7 7 | 100 |
| 3 | ANY ANY ANY | 100 |

FIG.86

BONUS GAME PAYOUT TABLE

| WINNING | PAYOUT-POINTS |
|---|---|
| 7 7 7 | 7000 |
| 7 | 300 |
| 7 | 150 |
| BAR BAR BAR | 30 |
| BAR BAR | 20 |
| BAR | 10 |

GAMING MACHINE HAVING A PLURALITY OF CONSOLES AND PLAYING METHOD THEREOF

CROSS REFERENCE TO RELATED APPLICATION

The present application claims priority from U.S. Provisional Application No. 61/054,675, which was filed on May 20, 2008, U.S. provisional application No. 61/054,702, which was filed on May 20, 2008, U.S. provisional application No. 61/054,719, which was filed on May 20, 2008, and U.S. Provisional Application No. 61/056,334, which was filed on May 27, 2008, the entire disclosure of which is herein incorporated by reference.

BACKGROUND OF THE INVENTION

1. Field of the Invention

The present invention relates to a gaming machine and a playing method thereof.

2. Description of Related Art

Among existing gaming machines, there is a gaming machine including: two or more gaming terminals; terminal controllers respectively provided to the gaming terminal, each of which controllers causes associated one of the gaming terminals to run a game; a center controller for controlling all the terminal controllers.

Such gaming machines are disclosed in, for example, specifications of U.S. Patent Application No. 2002/0042296, U.S. Pat. No. 6,733,390, U.S. Pat. No. 6,312,332, U.S. Pat. No. 6,142,872, U.S. Pat. No. 6,361,441, U.S. Pat. No. 5,820,459, U.S. Pat. No. 4,283,709, and U.S. Pat. No. 6,003,013.

A terminal controller of a gaming terminal runs a game and awards a payout based on the result of the game independently from another terminal controller of another gaming terminal.

The center controller provides a bonus game, in which two or more players compete against one another for various jackpots, such as progressive jackpots or mystery jackpots, through the gaming terminals.

An object of the invention is to provide a gaming machine providing a new kind of entertainment which is not brought about by the above mentioned prior art, and a playing method thereof.

SUMMARY OF THE INVENTION

The present invention is a gaming machine including: a base game that awards a payout according to a predetermined winning; a plurality of gaming terminals each including a terminal controller programmed to perform operations (a1) and (a2); a bonus game that awards a bonus payout more rewarding than the payout in the base game; a bonus payout indicator that displays the bonus payout; a center controller programmed to perform operations (b1) through (b3); and a plurality of paths formed from a plurality of light emitting portions connecting each of the gaming terminal to the bonus payout indicator, and including a bent portion provided on the side of the gaming terminal, and a straight portion provided in parallel configuration on the side of the bonus payout indicator, the terminal controller in each gaming terminal (a1) running the base game independently from the other gaming terminals and awarding the payout according to a predetermined winning, and (a2) awarding the bonus payout based on an instruction from the center controller, and the center controller (b1) running the bonus game based on a predetermined condition, (b2) causing the light emitting portions to undergo state changes toward the bonus payout indicator, in numbers fewer in the straight portion than in the bent portion, when a predetermined winning is met in any of the gaming terminals, and (b3) instructing the terminal controller of the gaming terminal, corresponding to a path in which the light emitting portions underwent state changes up to the bonus payout indicator, to award the bonus payout.

According to this configuration, each gaming terminal runs the base game independently from the other gaming terminals, and awards the payout according to a predetermined winning. The bonus game that awards a bonus payout more rewarding than the payout in the base game is run based on a predetermined condition. Every time a predetermined winning is met in a gaming terminal, the light emitting portions are caused to undergo state changes toward the bonus payout indicator in a path corresponding to the gaming terminal in which the winning has occurred. Emission is controlled such that the number of light emitting portions that undergo state changes in the path when a winning is met is fewer in the straight portion than in the bent portion. A bonus payout is awarded in the gaming terminal corresponding to the path including the light emitting portions that underwent state changes all the way up to the bonus payout indicator. The bent portion of the paths differs between the gaming terminals, and the players cannot easily find their positions relative to the other players. However, since the paths are straight and in parallel configuration in portions from the bonus payout indicator to a predetermined position, the positions of the players become clearly visible at a final phase of the game. This stimulates the competition between the players and makes the game more exciting. Further, since fewer numbers of light emitting portions undergo state changes in the straight portion in response to a winning, the players can compete for extended time periods in the straight portion with sustained interest.

As used herein, the "state of light emitting portions" means a non-lighting state, a lighting state, a non-flashing state, a flashing state, a color-lighting state, or a state of emitted brightness.

The present invention is a gaming machine including: a base game that awards a payout according to a predetermined winning; a plurality of gaming terminals each including a terminal controller programmed to perform operations (c1) through (c3); a bonus game that awards a bonus payout more rewarding than the payout in the base game; a bonus payout indicator that displays the bonus payout; a center controller programmed to perform operations (d1) through (d4); and a plurality of paths formed from a plurality of light emitting portions connecting each of the gaming terminal to the bonus payout indicator, and including a bent portion provided on the side of the gaming terminal, and a straight portion provided in parallel configuration on the side of the bonus payout indicator, the terminal controller in each gaming terminal (c1) running the base game independently from the other gaming terminals and awarding the payout according to a predetermined winning, (c2) sending a progressive value, corresponding to a bet, to the center controller, and (c3) awarding the bonus payout based on an instruction from the center controller, and the center controller (d1) running the bonus game based on a predetermined condition, (d2) causing the light emitting portions at a start of the bonus game to assume a state that is based on the progressive value sent from each gaming terminal, (d3) causing the light emitting portions to undergo state changes toward the bonus payout indicator, in numbers fewer in the straight portion than in the bent portion, when a predetermined winning is met in any of the gaming terminals, and (d4) instructing the terminal controller of the gaming terminal, corresponding to a path in which the light emitting portions underwent state changes up to the bonus payout indicator, to award the bonus payout.

According to this configuration, each gaming terminal runs the base game independently from the other gaming terminals, and awards the payout according to a predetermined winning. The bonus game that awards a bonus payout more rewarding than the payout in the base game is run based on a predetermined condition. At the start of the bonus game, the light emitting portions are caused to assume a state that is based on a progressive value sent from each gaming terminal. Every time a predetermined winning is met in a gaming terminal, the light emitting portions are caused to undergo state changes toward the bonus payout indicator in a path corresponding to the gaming terminal in which the winning has occurred. Emission is controlled such that the number of light emitting portions that undergo state changes in the path when a winning is met is fewer in the straight portion than in the bent portion. A bonus payout is awarded in the gaming terminal corresponding to the path including the light emitting portions that underwent state changes all the way up to the bonus payout indicator. The bent portion of the paths differs between the gaming terminals, and the players cannot easily find their positions relative to the other players. However, since the paths are straight and in parallel configuration in portions from the bonus payout indicator to a predetermined position, the positions of the players become clearly visible at a final phase of the game. This stimulates the competition between the players and makes the game more exciting. Further, since fewer numbers of light emitting portions undergo state changes in the straight portion in response to a winning, the players can compete for extended time periods in the straight portion with sustained interest. At the start of a bonus game, the light emitting portions assume a state that is based on the level of contribution made by the bet placed in the base game. In this way, a player making more bets in a base game is able to start a bonus game from a more advantageous position. Thus, the players play a base game with the bonus game in mind, and therefore can sustain their interest.

The present invention is a playing method of a gaming machine that includes: a base game that awards a payout according to a predetermined winning; a plurality of gaming terminals each including a terminal controller; a bonus game that awards a bonus payout more rewarding than the payout in the base game; a bonus payout indicator that displays the bonus payout; a center controller; and a plurality of paths formed from a plurality of light emitting portions connecting each of the gaming terminal to the bonus payout indicator, and including a bent portion provided on the side of the gaming terminal, and a straight portion provided in parallel configuration on the side of the bonus payout indicator, the terminal controllers each including the steps of: running the base game independently from the other gaming terminals; awarding the payout according to a predetermined winning; and awarding the bonus payout based on an instruction from the center controller, the center controller including the steps of: running the bonus game based on a predetermined condition; causing the light emitting portions to undergo state changes toward the bonus payout indicator, in numbers fewer in the straight portion than in the bent portion, when a predetermined winning is met in any of the gaming terminals; and instructing the terminal controller of the gaming terminal, corresponding to a path in which the light emitting portions underwent state changes up to the bonus payout indicator, to award the bonus payout.

According to this configuration, the bent portion of the paths differs between the gaming terminals, and the players cannot easily find their positions relative to the other players. However, since the paths are straight and in parallel configuration in portions from the bonus payout indicator to a predetermined position, the positions of the players become clearly visible at a final phase of the game. This stimulates the competition between the players and makes the game more exciting. Further, since fewer numbers of light emitting portions undergo state changes in the straight portion in response to a winning, the players can compete for extended time periods in the straight portion with sustained interest.

The present invention relates to a gaming machine including: a base game which awards a payout according to a predetermined winning; a plurality of gaming terminals each having a first light emitting portion which is activated to light, and a terminal controller programmed to carry out the following steps of (a1) to (a3); a bonus game configured to award a bonus payout greater than the payout awarded in the base game; a bonus payout display unit which displays the bonus payout; a plurality of path units respectively associated with the plurality of gaming terminals, each of the path units having one end provided to a nearby portion of associated one of the gaming terminals, and the other end provided to a nearby portion of the bonus payout display unit, wherein the each of the path units has a plurality of second light emitting portions aligned along the path unit, and is capable of lighting in the same color as the first light emitting portion of the associated gaming terminal; and a center controller programmed to carry out the following steps of (b1) to (b3), wherein the terminal controller carries out the steps of: (a1) activating the first light emitting portion to light in a predetermined color; (a2) running the base game independently of another gaming terminal, and awarding a payout according to a predetermined winning; and (b3) awarding the bonus payout based on a command from the center controller, and wherein the center controller carries out the steps of: (b1) running the bonus game based on a predetermined condition; (b2) for each of the gaming terminals, additionally activating one or more second light emitting portions of associated one of the path units according to a predetermined winning, sequentially from one end of the path unit closer to the associated gaming terminal, so as to light in the same color as the first light emitting portion of the gaming terminal, each time a winning is resulted in the gaming terminal; and (b3) when the path unit is activated up to a second light emitting portion at an end of the path unit closer to the bonus payout display unit, commanding the terminal controller of the gaming terminal associated with the path unit to award a bonus payout.

According to the above structure, the first light emitting portion of the each of the gaming terminals is activated to light in a predetermined color. A base game is run in the each of the gaming terminals independently of another gaming terminal, and a payout according to a predetermined winning is awarded. Further, a bonus game is run based on a predetermined condition. For each of the gaming terminals, one or more second light emitting portions of associated one of the path units are additionally activated according to a predetermined winning, sequentially from one end of the path unit closer to the associated gaming terminal, so as to light in the same color as the first light emitting portion of the gaming terminal, each time a winning is resulted in the gaming terminal. When the path unit is activated up to a second light emitting portion at an end of the path unit closer to the bonus payout display unit, a bonus payout is awarded through a gaming terminal associated with the path unit.

Thus, each of the path units is activated to light in the same color as the first light emitting portion of the associated one of the gaming terminals. As a result, the plurality of gaming terminals are easily associated with the plurality of path units, respectively. This realizes a new entertainment characteristic.

The present invention relates to a gaming machine including: a base game which awards a payout according to a predetermined winning; a plurality of gaming terminals each having a first light emitting portion which is activated to light, and a terminal controller programmed to carry out the following steps of (c1) to (c3); a bonus game configured to award a bonus payout greater than the payout awarded in the base game; a bonus payout display unit which displays a bonus payout; a plurality of path units respectively associated with the plurality of gaming terminals, each of the path units having one end provided to a nearby portion of associated one of the gaming terminals, and the other end provided to a nearby portion of the bonus payout display unit, wherein each of the path units has a plurality of second light emitting portions aligned along the path unit, and is capable of lighting in the same color as the first light emitting portion of the associated gaming terminal; and a center controller programmed to carry out the following steps of (d1) to (d3), wherein the terminal controller carries out the steps of: (c1) activating the first light emitting portion to light in a color determined in each bonus game; (c2) running a base game independently of another gaming terminal, and awarding a payout according to a predetermined winning; and (c3) awarding the bonus payout based on a command from the center controller, and wherein the center controller carries out the steps of: (d1) running a bonus game based on a predetermined condition; (d2) for each of the gaming terminals, additionally activating one or more second light emitting portions of associated one of the path units according to a predetermined winning, sequentially from one end of the path unit closer to the associated gaming terminal, so as to light in the same color as the first light emitting portion of the gaming terminal, each time a winning is resulted in the gaming terminal; and (d3) when the path unit is activated up to a second light emitting portion at an end of the path unit closer to the bonus payout display unit, commanding the terminal controller of the gaming terminal to award a bonus payout.

According to the above structure, each of the first light emitting portions is activated to light in a color determined in each bonus game. A base game is run in the each of the gaming terminals independently of another gaming terminal, and a payout according to a predetermined winning is awarded. Further, a bonus game is run based on a predetermined condition. For each of the gaming terminals, one or more second light emitting portions of associated one of the path units are additionally activated according to a predetermined winning, sequentially from one end of the path unit closer to the associated gaming terminal, so as to light in the same color as the first light emitting portion of the gaming terminal, each time a winning is resulted in the gaming terminal. When the path unit is activated up to a second light emitting portion at an end of the path unit closer to the bonus payout display unit, a bonus payout is awarded through a gaming terminal associated with the path unit.

Thus, the path unit is activated to light in the same color as the first light emitting portion of the associated one of the gaming terminals. As a result, the plurality of gaming terminals are easily associated with the plurality of path units, respectively. It is determined in each bonus game a color in which the first light emitting portion lights, as well as a color in which the associated one or more second light emitting portions light (hereinafter, refer to as emission color). Thus, it is possible to provide a new entertainment characteristic.

The present invention relates to a gaming machine including; a base game which is started in response to a bet from outside, and awards a payout according to a predetermined winning; a plurality of gaming terminals each having a first light emitting portion which is activated to light, an input device capable of receiving an input from outside, and a terminal controller programmed to carry out the following steps of (e1) to (e4); a bonus game configured to award a bonus payout which is an accumulation of a part of a value entered as a bet; a bonus game configured to award a bonus payout which is an accumulated part of a value entered as a bet; a contribution amount memory which stores how much each of the gaming terminals contribute to the bonus payout, associating with each of the gaming terminals; a bonus payout display unit which displays the bonus payout; a plurality of path units respectively associated with the plurality of gaming terminals, each of the path units having one end provided to a nearby portion of associated one of the gaming terminals, and the other end provided to a nearby portion of the bonus payout display unit, wherein each of the path units has a plurality of second light emitting portions aligned along the path unit, which is capable of lighting in the same color as the first light emitting portion of the associated gaming terminal; and a center controller programmed to carry out the following steps of (f1) to (f3), wherein the terminal controller carries out the steps of: (e1) allowing the gaming terminal to receive an input through the input device at a timing such that the gaming terminals receive an input in descending order of how much each of the gaming terminals have contributed to the bonus payout (contribution amount); (e2) activating the first light emitting portion to light in a color associated with an input through the input device, at a predetermined timing; (e3) running the base game independently of another gaming terminal in response to the bet, and awarding a payout according to a predetermined winning; and (e4) awarding the bonus payout based on an command from the center controller, and wherein the center controller carries out the steps of: (f1) running the bonus game based on a predetermined condition; (f2) for each of the gaming terminals, additionally activating one or more second light emitting portions of associated one of the path units according to a predetermined winning, sequentially from one end of the path unit closer to the associated gaming terminal, so as to light in the same color as the first light emitting portion of the gaming terminal, each time a winning is resulted in the gaming terminal, and (f3) when the path unit is activated up to a second light emitting portion at an end of the path unit closer to the bonus payout display unit, commanding the terminal controller of the gaming terminal associated with the path unit to award a bonus payout.

According to the above structure, each of the gaming terminals are allowed to receive an input through the input device in descending order of how much value each of the gaming terminals have entered as a bet, which is stored in the contribution amount memory. The first light emitting portion is activated to light in a color associated with an input through the input device, at a predetermined timing. A base game is run in response to the bet in the each of the gaming terminals, independently of another gaming terminal, and a payout according to a predetermined winning is awarded. Further, a bonus game is run based on a predetermined condition. For each of the gaming terminals, one or more second light emitting portions of associated one of the path units are additionally activated according to a predetermined winning, sequentially from one end of the path unit closer to the associated gaming terminal, so as to light in the same color as the first light emitting portion of the gaming terminal, each time a winning is resulted in the gaming terminal. When the path unit is activated up to a second light emitting portion at an end of the path unit closer to the bonus payout display unit, a bonus payout is awarded through a gaming terminal associated with the path unit.

Thus, the path unit is activated to light in the same color as the first light emitting portion of the associated one of the gaming terminals. As a result, the plurality of gaming terminals are respectively associated with the plurality of path units easily. It is determined an emission color of the first light emitting portion as well as that of the second light emitting portion according to an input through the input device. Further, an emission color of the first light emitting portion of the gaming terminal, and an emission color of the second light emitting portions associated with the gaming terminal, are determined such that the gaming terminals determine the emission colors in descending order of the contribution amount of each of the gaming terminals to the bonus payout. Thus, it is possible to provide a new entertainment characteristic.

The present invention relates to a playing method of a gaming machine including the steps of: (g1) activating first light emitting portions of gaming terminals so as to light each of the first light emitting portions in a predetermined color, running a base game independently of another gaming terminal, and awarding a payout according to a predetermined winning resulted; (g2) running a bonus game configured so that, according to a predetermined condition, a bonus payout which is a higher payout than one awarded as a result of the base game is awarded; (g3) among a plurality of path units respectively associated with the gaming terminals, each of which units having (i) second light emitting portions aligned therein, (ii) one end provided to a nearby portion of associated one of the gaming terminals, and (iii) another end provided to a nearby portion of a bonus payout display unit displaying an effect image, activating at least one path unit by activating one or more second light emitting portions according to a predetermined winning each time the winning is resulted, so that a predetermined number of second light emitting portions light in the same color as the first light emitting portion of the gaming terminal with which the path unit is associated; (g4) when the path unit is activated up to a second light emitting portion at an end of the path unit closer to the bonus payout display unit, awarding a bonus payout through a gaming terminal associated with the path unit.

According to the above structure, a path unit is activated to light in the same color as the first light emitting portion of the associated one of the gaming terminals. As a result, the plurality of gaming terminals are easily associated with the plurality of path units, respectively. This realizes a new entertainment characteristic.

The present invention deals with a gaming machine including: a base game which awards a payout according to a predetermined winning; a plurality of gaming terminals each having a display which displays an effect image, and a terminal controller programmed to carry out the following steps of (a1) to (a2); a bonus game configured to award a bonus payout greater than the payout awarded in the base game; a bonus payout display unit which displays the bonus payout; a plurality of path units respectively associated with the plurality of gaming terminals, each of the path units having one end provided to a nearby portion of associated one of the gaming terminals, and the other end provided to a nearby portion of the bonus payout display unit, wherein the each of the path units has a plurality of light emitting portions activated to light aligned along the path unit; A light emission mode obtain unit which obtains a light emission mode of each of the plurality of path units; and a center controller programmed to carry out the following steps of (b1) to (b5), wherein the terminal controller carries out the steps of: (a1) running the base game independently of another gaming terminal, and awarding a payout according to a predetermined winning; (a2) awarding a bonus payout based on a command from the center controller, and wherein the center controller carries out the steps of: (b1) running the bonus game based on a predetermined condition; (b2) for each of the gaming terminals, additionally activating one or more of the associated light emitting portions according to a predetermined winning, sequentially from a light emitting portion closest to the associated gaming terminal each time a winning is resulted in the gaming terminal. (b3) having the light emission mode obtain unit obtain a light emission mode of the each of the path unit; (b4) displaying, on the display of each of the gaming terminal, a light emission mode image based on the light emission mode; (b5) when the path unit is activated up to a light emitting portion at an end of the path unit closer to the bonus payout display unit, commanding the terminal controller of the gaming terminal associated with the path unit to award a bonus payout.

According to the above structure, a base game is run in response to the bet in the each of the gaming terminals, independently of another gaming terminal, and a payout according to a predetermined winning is awarded. Further, a bonus game is run based on a predetermined condition. For each of the gaming terminals, one or more of the associated light emitting portions are additionally activated according to a predetermined winning, sequentially from a light emitting portion closest to the gaming terminal, each time a winning is resulted in the gaming terminal. The light emission mode obtain unit obtains a light emission mode of each of the path units. A light emission mode image based on a light emission mode is displayed on the display. When the path unit is activated up to a light emitting portion at an end of the path unit closer to the bonus payout display unit, a bonus payout is awarded through a gaming terminal associated with the path unit. Thus, a state of the bonus game configured to award a bonus payout greater than the payout awarded in the base game is exhibited by displaying a light emission mode of each of the path units as a light emission mode image. Thus, a new entertainment characteristic is realized.

An "activation state" is a state where a light emitting portion is turned on, or blinking.

The present invention deals with a gaming machine, including: a base game which awards a payout according to a predetermined winning; a plurality of gaming terminals each having a display which displays an effect image, and a terminal controller programmed to carry out the following steps of (c1) to (c2); a bonus game configured to award a bonus payout greater than the payout awarded in the base game; a bonus payout display unit which displays the bonus payout; a plurality of path units respectively associated with the plurality of gaming terminals, each of the path units having one end provided to a nearby portion of associated a of the gaming terminals, and the other end provided to a nearby portion of the bonus payout display unit, wherein the each of the path units has a plurality of light emitting portions activated to light aligned along the path unit: a light emission mode obtain unit which obtains a light emission mode of each of the path units; and the center controller which is programmed to carry out the following steps of (d1) to (d6), wherein the terminal controller carries out the steps of: (c1) running the base game independently of another gaming terminal, and awarding a payout according to a predetermined winning; (c2) awarding the bonus payout based on a command from the center controller, and wherein the center controller carries out the steps of: (d1) running a bonus game based on a predetermined condition; (d2) for each of the gaming terminals, additionally activating one or more of the associated light emitting portions according to a predetermined winning, sequentially from a light emitting portion closest to the associated gaming terminal each time a winning is resulted in the gaming terminal. (d3) having the light emission mode obtain unit obtain an emission mode of each of the path units; (d4) displaying, on the display of each of the gaming terminals, a light emission mode image indicating the plurality of path units based on the light emission mode; (d5) highlighting a part of the light emission mode image indicating a path unit of the associated one of the gaming terminals; and (d6) when the path unit is activated up to a light emitting portion at an end of the path unit closer to the bonus payout display unit, commanding the terminal controller of the gaming terminal associated with the path unit to award a bonus payout.

According to the above structure, a base game is run in response to the bet in the each of the gaming terminals, independently of another gaming terminal, and a payout according to a predetermined winning is awarded. Further, a bonus game is run based on a predetermined condition. For each of the gaming terminals, one or more of the associated light emitting portions are additionally activated according to a predetermined winning, sequentially from a light emitting portion closest to the associated gaming terminal each time a winning is resulted in the gaming terminal. The light emission mode obtain unit obtains a light emission mode of each of the path units. A light emission mode image based on the light emission mode is displayed on the display. When the path unit is activated up to a light emitting portion at an end of the path unit closer to the bonus payout display unit, a bonus payout is awarded through a gaming terminal associated with the path unit. Thus, a status of the bonus game configured to award a bonus payout greater than the payout awarded in the base game, by displaying on the display a light emission mode of each of the path units as a light emission mode image. In addition, a part of the displayed light emission mode image indicating a path unit associated with a gaming terminal which has the display where the image is displayed, is highlighted. As a result, a new entertainment characteristic is realized.

The present invention deals with a gaming machine including: a base game which awards a payout according to a predetermined winning; a display which displays an effect image; a plurality of gaming terminals each having a terminal controller programmed to carry out the following steps of (e1) to (e2); a bonus game configured to award a bonus payout greater than the payout awarded in the base game; a bonus payout display unit which displays the bonus payout; a plurality of path units respectively associated with the plurality of gaming terminals, each of the path units having one end provided to a nearby portion of associated one of the gaming terminals, and the other end provided to a nearby portion of the bonus payout display unit, wherein the each of the path units has a plurality of light emitting portions activated to light aligned along the path unit; a light emission mode obtain unit which obtains a light emission mode of each of the path units; a center controller programmed to carry out the following steps of (f1) to (f5), wherein the terminal controller carries out the steps of: (e1) running the base game independently of another gaming terminal, and awarding a payout according to a predetermined winning; (e2) awarding the bonus payout based on a command from the center controller, wherein the center controller carries out the steps of: (f1) running a bonus game based on a predetermined condition; (f2) for each of the gaming terminals, additionally activating one or more of the associated light emitting portions according to a predetermined winning, sequentially from a light emitting portion closest to the associated gaming terminal, each time a winning is resulted in the gaming terminal; (f3) having the light emission mode obtain unit obtain a light emission mode of each of the path units; (f4) displaying, on the display of each of the gaming terminals, the light emission mode image and the number of inactivated light emitting portions of the corresponding one of the path units; (f5) when the path unit is activated up to a light emitting portion at an end of the path unit closer to the bonus payout display unit, commanding the terminal controller of the gaming terminal associated with the path unit to award a bonus payout.

According to the above structure, a base game is run in response to the bet in the each of the gaming terminals, independently of another gaming terminal, and a payout according to a predetermined winning is awarded. Further, a bonus game is run based on a predetermined condition. For each of the gaming terminals, one or more of the associated light emitting portions are additionally activated according to a predetermined winning, sequentially from a light emitting portion closest to the associated gaming terminal each time a winning is met in the gaming terminal. The light emission mode obtain unit obtains a light emission mode of each of the path units. A light emission mode image based on the light emission mode is displayed on the display. When the path unit is activated up to a light emitting portion at an end of the path unit closer to the bonus payout display unit, a bonus payout is awarded through a gaming terminal associated with the path unit. Thus, a state of a bonus game configured to award a bonus payout greater than the payout awarded in the base game is exhibited by displaying on the display a light emission mode of each of the path unit as a light emission mode image. In addition, the number of inactivated light emitting portions of a path unit of the associated one of the gaming terminals is displayed on the display. As a result, a new entertainment characteristic is realized.

The present invention deals with a playing method of a gaming machine having a plurality of gaming terminals, the playing method comprising the steps of: (g1) running the base game independently of another gaming terminal in response to the bet, and awarding a payout according to a predetermined winning; (g2) running a bonus game configured so that, according to a predetermined condition, a bonus payout which is a greater payout than the payout awarded in the base game is awarded; (g3) among a plurality of path units respectively associated with the gaming terminals, each of which units having (i) light emitting portions aligned therein, (ii) one end provided to a nearby portion of associated one of the gaming terminals, and another end provided to a nearby portion of a bonus payout display unit, additionally activating one or more light emitting portions according to a predetermined winning sequentially from a light emitting portion closest to the associated gaming terminal, each time winning is resulted in the gaming terminal; (g4) obtaining a light emission mode of each of the path units, and displaying, on each of the display of the gaming terminal, a light emission mode image based on the light emission mode; (g5) when the path unit is activated up to a light emitting portion at an end of the path unit closer to the bonus payout display unit, awarding a bonus payout through a gaming terminal associated with the path unit.

According to the above structure, state of the bonus game configured to award a bonus payout greater than the payout awarded in the base game is exhibited, by displaying on the display a light emission state of each of the path units as a light emission mode image. Thus, a new entertainment characteristic is realized.

The present invention provides a gaming machine including: a plurality of terminal devices each of which executes a base game with a game value being bet and awards a prize according to a predetermined winning; a common display which displays thereon a predetermined content; a plurality of routes each of which is formed from a plurality of route light emitters disposed continuously from a corresponding terminal device out of the terminal devices to the common display; and a jackpot controller. The jackpot controller is programmed to execute the following steps of: (a1) accumulating a percentage of a game value which is bet in each base game executed at each of the terminal devices; (a2) causing the common display to display an amount of accumulated game values; (a3) after the amount of accumulated game values reaches a predetermined value, and every time a predetermined winning is achieved at a terminal device, causing a predetermined number of route light emitters, which are disposed along a route corresponding to the terminal device at which the predetermined winning is achieved, to be turned on toward the common display so as to emit light; (a4) when a predetermined number of route light emitters disposed along any one of the plurality of routes are turned on so as to emit light, causing all the route light emitters, which are disposed along each of the routes and are turned on, to blink; and (a5) when all route light emitters disposed along any one of the plurality of routes are turned on, awarding the accumulated game values to a terminal device corresponding to the one of the routes along which all route light emitters are turned on.

With this structure, after the amount of accumulated game values reaches a predetermined value, and every time a predetermined winning is achieved at a terminal device, a predetermined number of route light emitters, which are disposed along a route corresponding to the terminal device at which the predetermined winning is achieved, are turned on toward the common display so as to emit light. When a predetermined number of route light emitters disposed along any one of the plurality of routes are turned on so as to emit light, all the route light emitters, which are disposed along each of the routes and are turned on, are caused to blink. For example, when a player who plays at a terminal device achieves the predetermined winning in a base game with the result that the predetermined number of route light emitters along a route are turned on so as to emit light, all the route light emitters, which are disposed along each of the routes and are turned on, are caused to blink. This enables players and an audience around the gaming machine to be aware that there is a player who almost obtains the accumulated game values displayed on the common display. In addition, the arrangement above enables the player who almost obtains the accumulated game values to increase an expectation for obtaining the accumulated game values. Also, the arrangement urges one or more players other than that player to achieve the predetermined winning early because the other players may fail to obtain the accumulated game values. Further, this arrangement can provide the audience with an excitement caused by predicting who obtains the accumulated game values displayed on the common display. That is, the players and the audience around the gaming machine may be more excited.

The present invention provides the above-described gaming machine, in which the jackpot controller generates an effect sound when, in (a4), the predetermined number of route light emitters disposed along any one of the plurality of routes are turned on so as to emit light.

With this structure, it is possible to generate an effect sound when the predetermined number of route light emitters disposed along any one of the plurality of routes are turned on so as to emit light. This enables the players and the audience to be aware that there is a player who almost obtains the accumulated game values displayed on the common display. Accordingly, it is possible to grab the attention of the players and the audience around the gaming machine.

The present invention provides a gaming machine including: a plurality of terminal devices each of which executes a base game with a game value being bet and awards a prize according to a predetermined winning; a common display which displays thereon a predetermined content; a plurality of routes each of which is formed from a plurality of route light emitters disposed continuously from a corresponding terminal device out of the terminal devices to the common display; and a jackpot controller. The jackpot controller is programmed to execute the following steps of: (b1) accumulating a percentage of a game value which is bet in each base game executed at each of the terminal devices; (b2) causing the common display to display an amount of accumulated game values; (b3) after the amount of accumulated game values reaches a predetermined value, and every time a predetermined winning is achieved at a terminal device, causing a predetermined number of route light emitters, which are disposed along a route corresponding to the terminal device at which the predetermined winning is achieved, to be turned on toward the common display so as to emit light; (b4) when a predetermined number of route light emitters disposed along a route are turned on so as to emit light, causing the route light emitters, which are disposed along that route and are turned on, to blink; and (b5) when all route light emitters disposed along any one of the plurality of routes are turned on, awarding the accumulated game values to a terminal device corresponding to the one of the routes along which all route light emitters are turned on.

With this structure, after the amount of accumulated game values reaches a predetermined value, and every time a predetermined winning is achieved at a terminal device, a predetermined number of route light emitters, which are disposed along a route corresponding to the terminal device at which the predetermined winning is achieved, are turned on toward the common display so as to emit light. When a predetermined number of route light emitters disposed along a route are turned on so as to emit light, the route light emitters, which are disposed along that route only and are turned on, are caused to blink. For example, when a player who plays at a terminal device achieves the predetermined winning with the result that the predetermined number of route light emitters, disposed along a route corresponding to the terminal device at which the predetermined winning is achieved, are turned on, only the route light emitters, which are turned on and disposed along the route corresponding to the terminal device having the predetermined winning, are caused to blink. This enables players and an audience around the gaming machine to know the terminal device of the player who almost obtains the accumulated game values displayed on the common display. In addition, the arrangement above enables the player who almost obtains the accumulated game values to increase an expectation for obtaining the accumulated game values. Also, the arrangement urges one or more players other than that player to achieve the predetermined winning in a base game early because the other players may fail to obtain the accumulated game values. Further, this arrangement can provide the audience with more interest in the player who almost obtains the accumulated game values displayed on the common display. That is, the players and the audience around the gaming machine may be more excited.

The present invention provides the above-described gaming machine, in which the jackpot controller generates an effect sound when, in (b4), the predetermined number of route light emitters disposed along a route are turned on so as to emit light.

With this structure, it is possible to generate an effect sound when the predetermined number of route light emitters disposed along each route are turned on so as to emit light. This enables the players and the audience to be aware that there is a player who almost obtains the accumulated game values displayed on the common display. Accordingly, it is possible to grab the attention of the players and the audience around the gaming machine.

The present invention provides a playing method of a gaming machine including: a plurality of terminal devices each of which executes a base game with a game value being bet and awards a prize according to a predetermined winning; a common display which displays thereon a predetermined content; and a plurality of routes each of which is formed from a plurality of route light emitters disposed continuously from a corresponding terminal device out of the terminal devices to the common display; the playing method including the steps of: accumulating a percentage of a game value which is bet in each base game executed at each of the terminal devices; causing the common display to display an amount of accumulated game values; after the amount of accumulated game values reaches a predetermined value, and every time a predetermined winning is achieved at a terminal device, causing a predetermined number of route light emitters, which are disposed along a route corresponding to the terminal device at which the predetermined winning is achieved, to be turned on toward the common display so as to emit light; when a predetermined number of route light emitters disposed along any one of the plurality of routes are turned on so as to emit light, causing all the route light emitters, which are disposed along each of the routes and are turned on, to blink; and when all route light emitters disposed along any one of the plurality of routes are turned on, awarding the accumulated game values to a terminal device corresponding to the one of the routes along which all route light emitters are turned on.

According to the playing method of the gaming machine, after the amount of accumulated game values reaches a predetermined value, and every time a predetermined winning is achieved at a terminal device, a predetermined number of route light emitters, which are disposed along a route corresponding to the terminal device at which the predetermined winning is achieved, are turned on toward the common display so as to emit light. When a predetermined number of route light emitters disposed along any one of the plurality of routes are turned on so as to emit light, all the route light emitters, which are disposed along each of the routes and are turned on, are caused to blink. For example, when a player who plays at a terminal device achieves the predetermined winning in a base game with the result that the predetermined number of route light emitters along a route are turned on so as to emit light, all the route light emitters, which are disposed along each of the routes and are turned on, are caused to blink. This enables players and an audience around the gaming machine to be aware that there is a player who almost obtains the accumulated game values displayed on the common display. In addition, the arrangement above enables the player who almost obtains the accumulated game values to increase an expectation for obtaining the accumulated game values. Also, the arrangement urges one or more players other than that player to achieve the predetermined winning early because the other players may fail to obtain the accumulated game values. Further, this arrangement can provide the audience with an excitement caused by predicting who obtains the accumulated game values displayed on the common display. That is, the players and the audience around the gaming machine may be more excited.

BRIEF DESCRIPTION OF THE DRAWINGS

FIG. 9 is an explanatory diagram illustrating a symbol column of symbols rearranged on a terminal display.

FIG. 10 is a diagram showing an emission control table for a bent portion.

FIG. 11 is a diagram showing an emission control table for a straight portion.

FIG. 12 is a diagram showing a progressive value table of each gaming terminal.

FIG. 20 is a diagram showing a base game payout table in a gaming machine according to the other version of Embodiment 1 of the present invention.

FIG. 22 is an explanatory diagram showing a bonus game payout table in a gaming machine according to the other version of Embodiment 1 of the present invention.

FIG. 29 is an explanatory diagram illustrating a symbol column of symbols rearranged on a terminal display.

FIG. 30 illustrates an emission color control table.

FIG. 31 illustrates a path unit activation state table.

FIG. 32 illustrates a contribution level management table.

FIG. 43 illustrates a base game payout table according to the other version of Embodiment 2 of the present invention.

FIG. 45 is an explanatory diagram illustrating a bonus game payout table according to the other version of Embodiment 2 of the present invention.

FIG. 52 is an explanatory diagram illustrating a symbol column of symbols rearranged on a terminal display.

FIG. 54 is a path unit table.

FIG. 55 is a path unit activation state table.

FIG. 64 is a base game payout table according to the other version of Embodiment 3 of the present invention.

FIG. 66 is an explanatory diagram illustrating a bonus game payout table according to the other version of Embodiment 3 of the present invention.

FIG. 72 is an explanatory view showing a base game winning combination lottery table.

FIG. 73 is an explanatory view showing a base game payout table.

FIG. 74 is an explanatory view showing a jackpot point table.

FIG. 77 is a table showing symbol columns and code numbers of respective symbols.

FIG. 84 is a view showing a second base game payout table of the slot machine according to the other version of Embodiment 4 of the present invention.

FIG. 86 is an explanatory view showing a bonus game payout table in the slot machine according to the other version of Embodiment 4 of the present invention.

DESCRIPTION OF THE PREFERRED EMBODIMENTS

Embodiment 1

Figure 1:
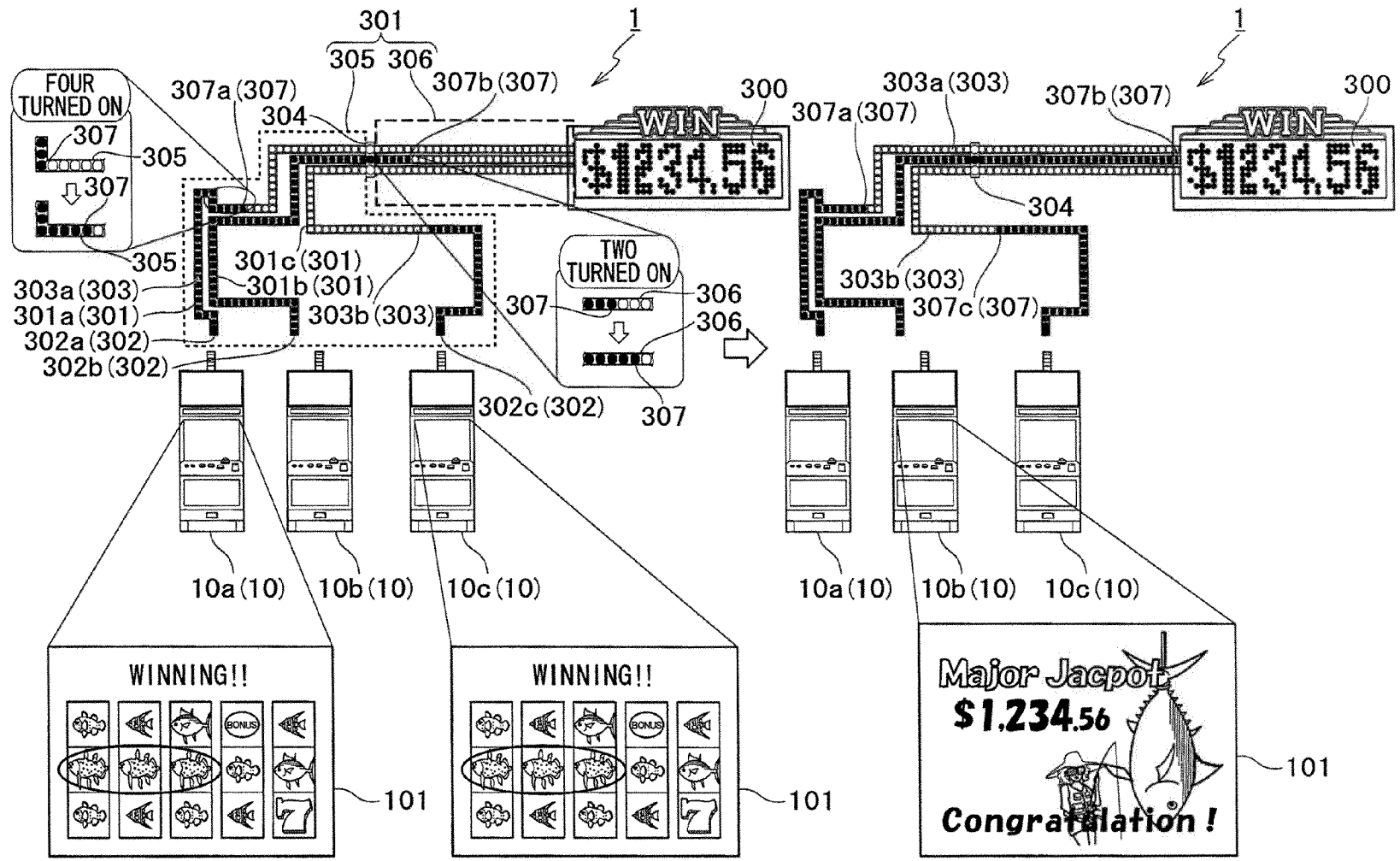
FIG. 1 is an explanatory diagram illustrating a gaming machine and a playing method thereof, according to Embodiment 1 of the present invention.

The following describes Embodiment 1 of a gaming machine and a playing method thereof according to the present invention. Note that reference numerals respectively given to members in the figures referred to in this embodiment, reference symbols (such as "S") respectively representing steps in flowcharts in the figures, and description using these reference numerals and reference symbols are effective only in this embodiment. Each of these numerals and symbols does not represent a member or step in other embodiments.

As illustrated in FIG. 1, a gaming machine 1 performs a playing method that includes the steps of: running a base game in which a payout according to a predetermined winning is awarded, independently in each gaming terminal 10, and awarding the payout according to a predetermined winning; based on a predetermined condition, running a bonus game which awards a bonus payout more rewarding than the payout in the base game; causing light emitting portions 303 in a straight portion 306 to undergo state changes toward a bonus payout indicator 300, in numbers fewer than in a bent portion 305, when a predetermined winning is met in any of the gaming terminals 10; instructing a terminal controller 100 of a gaming terminal 10, corresponding to a path 301 in which the light emitting portions 303 underwent state changes up to the bonus payout indicator 300, to award the bonus payout; and awarding the bonus payout based on the instruction from the center controller 200.

Figure 2:
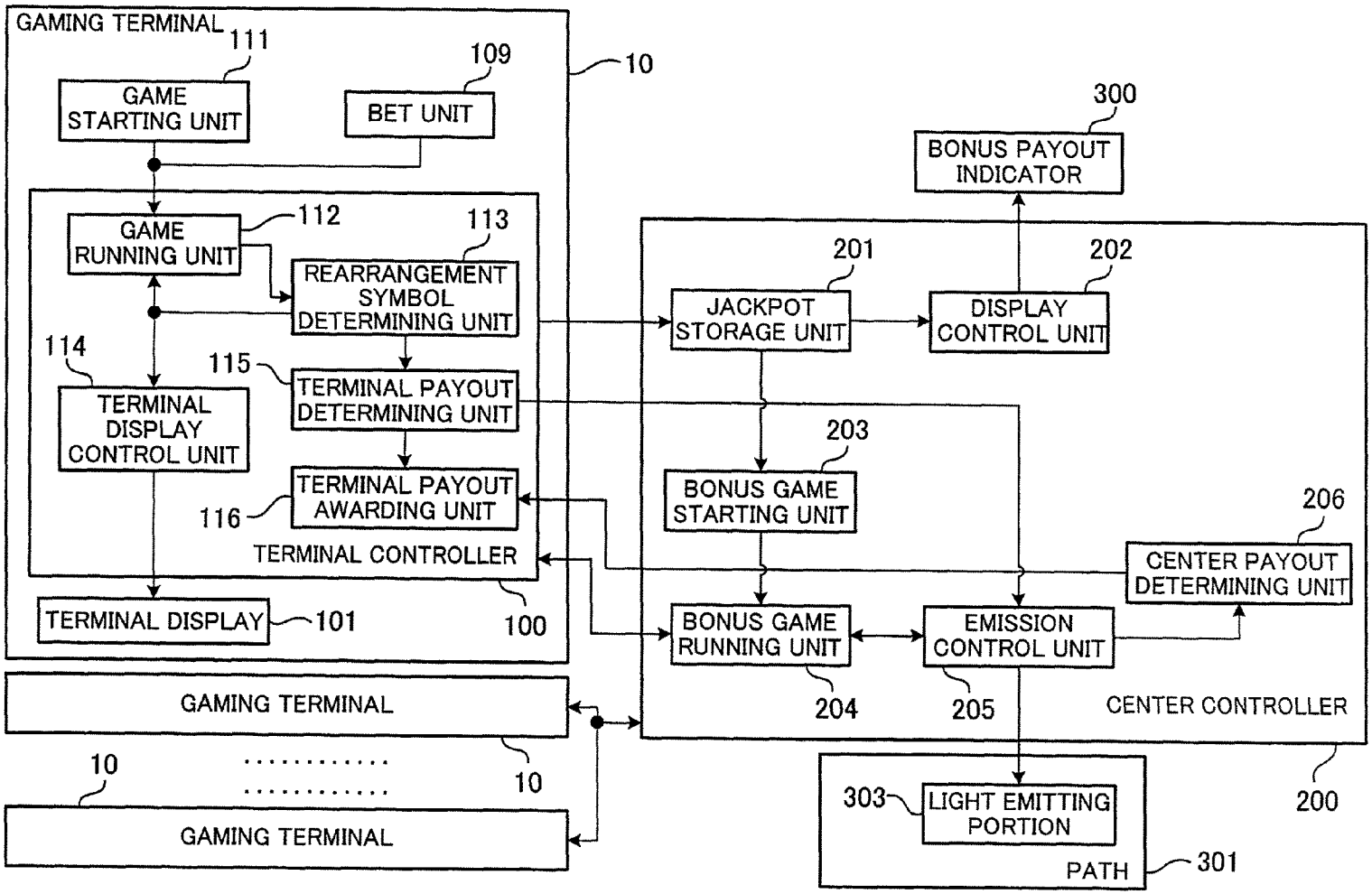
FIG. 2 is a block diagram of the gaming machine.

As illustrated in FIG. 2, the gaming machine 1 which executes the playing method has a bonus payout indicator 300, a center controller 200, gaming terminals 10, and paths 301. The paths 301 include light emitting portions 303. Each of the gaming terminals 10 includes a terminal display 101 and a terminal controller 100.

Figure 3:
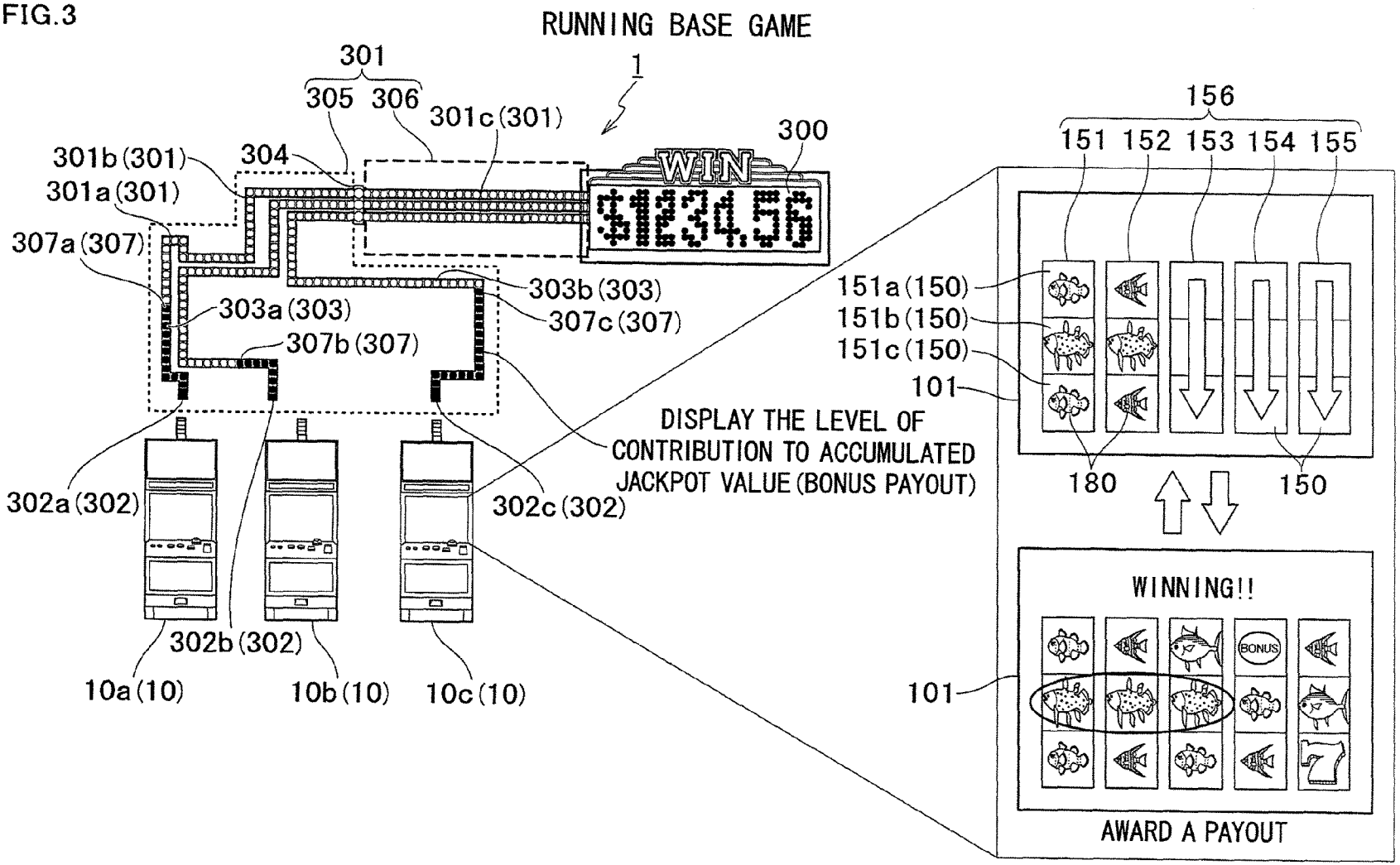
FIG. 3 is an explanatory diagram concerning a base game.

As illustrated in FIG. 3, the terminal display 101 has the arrangement areas 150, and symbols 180 are arranged in the arrangement areas 150.

The "arranging" in this specification means a state where the symbols 180 can be visually observed by a player. That is, the wording means a state where the symbols 180 are displayed in the arrangement areas 150, in FIG. 3. Arranging the symbols 180 again after dismissing the symbols 180 is referred to as "rearranging".

The terminal display 101 may have a mechanical structure adopting a reel device which rotates a reel to arrange the symbols 180. Alternatively, the terminal display 101 may have an electrical structure in which a video reel is displayed as an image and symbols 180 on a video reel are arranged in the form of an image. Further, the terminal display 101 may adopt a combination of the mechanical structure (reel) and the electrical structure (video reel). Examples of the electrical structure include a liquid crystal display device, a CRT (cathode-ray tube), a plasma display device, or the like. Further, the number of arrangement areas 150 is not limited. A specific structure of the terminal display 101 will be detailed later.

The bonus payout indicator 300 displays the amount of bonus payout awarded in a bonus game. In the example shown in FIG. 3, the bonus payout is displayed as a progressive jackpot amounting $1234.56. In Embodiment 1, the bonus payout indicator 300 is structured to include arrays of LEDs provided as light emitters. However, the bonus payout indicator 300 may be structured as a single liquid crystal display. The light emitters are not limited to LEDs (light-emitting diodes) so long as light is emitted.

The paths 301 are realized by arrays of light emitting portions 303 connecting each gaming terminal 10 to the bonus payout indicator 300. The paths 301 include a bent portion 305, provided on the side of the gaming terminals 10, and a straight portion 306, provided on the side of the bonus payout indicator 300 in parallel configuration. The bent portion 305 and the straight portion 306 are separated by an emission control switching point 304, and are controlled differently to emit light. As illustrated in FIG. 3, a path 301*a* extends from a position 302*a*, corresponding to a gaming terminal 10*a*, to the bonus payout indicator 300. Other paths 301*c* to 301*j* are formed in the same manner. In this manner, the paths 301 are provided to correspond to the gaming terminals 10. The paths in the bent portion 305 are different for different gaming terminals. In the straight portion 306, the paths from different gaming terminals are parallel to one another.

The light emitting portions 303 are realized by LEDs (light-emitting diodes), and are capable of emitting light in different colors. The light emitting portion 303 that has undergone a change from a non-lighting state to a lighting state is indicated as a light emitting portion 303*a*. The light emitting portion 303 that has not undergone a state change is indicated as a light emitting portion 303*b*. The light emitting portions 303 are controlled to change states one after another, from the position 302 of each gaming terminal 10 to the bonus payout indicator 300.

The light emitting portions 303 are not limited to LEDs as long as light is emitted. A state change in the light emitting portions 303 is not limited to from non-lighting to lighting, but may be from non-flashing to flashing, or may be a change to any different level of brightness. The light emitting portions 303 may be adapted to emit only one color; however, it is preferable that the light emitting portions 303 be capable of emitting more than one color to provide a wide variety of effects.

A current-position displaying light emitting portion 307 is one of the light emitting portions 303 that have undergone a state change in each path, closest to the bonus payout indicator 300. The current-position displaying light emitting portion 307 indicates the progress of a game played by each player during a bonus game. The current-position displaying light emitting portion 307 may also indicate the contribution of each player to a jackpot in a base game.

[Terminal Controller 100]

A terminal controller 100 is configured to perform a first process and a second process. In the first process, a base game that awards a payout according to a predetermined winning is run in each gaming terminal 10, independently from the other gaming terminals 10, and the payout according to a predetermined winning is awarded. In the second process, a bonus payout is awarded according to an instruction from the center controller 200. In other words, the terminal controller 100 has a first processing unit and a second processing unit.

The terminal controller 100 is connected to the center controller 200 and is in communication with the center controller 200.

As illustrated in FIG. 2, the terminal controller 100 is connected to a game starting unit 111. The game starting unit 111 has a function of outputting a game start signal, in response to an operation by the player. The game start signal output is then input to a later-described game running unit 112.

Further, the terminal controller 100 is connected to a BET unit 109. The BET unit 109 has functions of receiving a bet entered through an operation by the player, and outputting a BET signal in response to the bet entered. The BET signal output is input to a later-described game running unit 112.

The terminal controller 100 includes: a game running unit 112, a rearrangement symbol determining unit 113, a terminal display control unit 114, a payout determining unit 115, and a payout awarding unit 116. The game running unit 112 runs a base game, triggered by a game start signal from the game starting unit 111. In the base game, symbols 180 are rearranged in the arrangement areas 150 of the terminal display 101. Further, the terminal controller 100 outputs a progressive signal, triggered by the game start signal. The progressive signal is a signal indicating a game value.

The rearrangement symbol determining unit 113 determines, based on the state of game run by the game running unit 112, a plurality of symbols 180 to be rearranged in the arrangement areas 150.

The terminal display control unit 114 displays the symbols 180 on the terminal display 101 under control of the game running unit 112 and on the basis of a determination of the rearrangement symbol determining unit 113. A detailed display state will be detailed later.

Further, the terminal controller 100 includes a terminal payout award determining unit 115 and a terminal payout awarding unit 116. The terminal payout award determining unit 115 determines whether to award a payout, based on a relation among the symbols 180 rearranged in the arrangement areas 150 of the terminal display 101. That is, the terminal payout award determining unit 115 determines whether a predetermined winning has been met. The terminal payout awarding unit 116 awards a payout based on the determination by the terminal payout award determining unit 115. The terminal payout awarding unit 116 also awards a payout based on an instruction from the center controller 200.

Meanwhile, each block of the terminal controller 100 may be realized with hardware, or with software as needed.

[Operation of Terminal Controller 100]

The following describes an operation of the terminal controller 100 in the above structure. First, the BET unit 109 accepts a BET entered through an operation by a player. Then, in response to the operation, the game starting unit 111 outputs a game start signal to cause the game running unit 112 to start a base game. When the base game is started, the rearrangement symbol determining unit 113 determines symbols 180 to be rearranged in the arrangement areas 150. The symbols 180 to be rearranged are determined at every base game. The symbols 180 determined by the rearrangement symbol determining unit 113 undergo an image processing in the terminal display control unit 114, and are displayed on the terminal display 101. The terminal display control unit 114 rearranges the symbols 180 in the arrangement areas 150, according to the arrangement determined.

The terminal payout award determining unit 115 determines whether a predetermined winning has been met, based on the relation between the symbols 180 rearranged in the arrangement areas 150. If it is determined that a predetermined winning has been met, the terminal payout awarding unit 116 awards a payout. In this manner, the terminal controller 100 in each gaming terminal 10 executes the first process, in which a base game that awards a payout according to a predetermined winning is run independently from the other gaming terminals 10, and in which the payout according to a predetermined winning is awarded.

Further, when a predetermined winning has been met, the terminal controller 100 transmits a winning signal, indicating that a predetermined winning has been met, to the center controller 200, based on a predetermined condition such as running of a bonus game as a shared game.

The terminal payout awarding unit 116 awards a bonus payout when instructed by the center controller 200 to award a bonus payout. In this manner, the terminal controller 100 executes the second process, in which a bonus payout is awarded based on an instruction from the center controller 200.

[Center Controller 200]

The center controller 200 is configured to perform a third process, a fourth process, and a fifth process. In the third process, a bonus game is run in which a bonus payout more rewarding than a base game payout is awarded, based on a predetermined condition. In the fourth process, the light emitting portions 303 are caused to undergo state changes toward the bonus payout indicator 300, in numbers fewer in the straight portion 306 than in the bent portion 305, when a predetermined winning is met in the gaming terminal 10. In the fifth process, an instruction to award a bonus payout is sent to the terminal controller 100 of the gaming terminal 10 corresponding to the path 301 including the light emitting portions 303 that have undergone state changes all the way up to the bonus payout indicator 300. In other words, the center controller 200 includes a third process unit, a fourth process unit, and a fifth process unit.

As illustrated in FIG. 2, the center controller 200 is connected to the terminal controller 100 and is in communication with the terminal controller 100.

The center controller 200 includes a jackpot storage unit 201, a display control unit 202, a bonus game starting unit 203, a bonus game running unit 204, an emission control unit 205, and a center payout determining unit 206.

The jackpot storage unit 201 stores and sums up a game value indicated by a progressive signal received from the terminal controller 100. The bonus game starting unit 203 outputs a bonus game start signal, when a predetermined condition is met. The bonus game start signal output is then input to a later-described bonus game running unit 204. For example, meeting the predetermined condition means a situation where a game value stored in the jackpot storage unit 201 sums up to a predetermined value or greater.

Triggered by a bonus game start signal received from the bonus game starting unit 203, the bonus game running unit 204 runs a bonus game, in which two or more players compete against one another for a jackpot through the gaming terminals.

The display control unit 202 causes the bonus payout indicator 300 to display the sum of jackpot values stored in the jackpot storage unit 201.

The emission control unit 205 causes the light emitting portions 303 to undergo state changes toward the bonus payout indicator 300, in numbers fewer in the straight portion 306 than in the bent portion 305, when a predetermined winning is met in a bonus game. The emission control unit 205 may control the light emitting portions 303 such that the contribution of each gaming terminal 10 to the jackpot values summed in the jackpot storage unit 201 is displayed in the form of the state changes of the light emitting portions 303.

The center payout determining unit 206 determines whether the light emitting portions 303 in each path 301 have undergone state changes all the way up to the bonus payout indicator 300. The center payout determining unit 206, when it is determined that the light emitting portions 303 have undergone state changes all the way up to the bonus payout indicator 300, sends an instruction to award a bonus payout, to the terminal controller 100 of the gaming terminal 10 corresponding to the path 301 in which the state changes have occurred up to the bonus payout indicator 300.

Meanwhile, each block of the center controller 200 may be realized with hardware, or with software as needed.

[Operation of Center Controller 200]

The following describes an operation of the center controller 200 in the above structure. First, the game value is accumulatively stored in the jackpot storage unit 201. A bonus game starts when the stored game value sums up to a predetermined value or greater. In this manner, based on a predetermined condition, the center controller 200 executes the third process that runs a bonus game in which a bonus payout more rewarding than a base game payout is awarded.

The center controller 200 receives a winning signal from the terminal controller 100, every time a predetermined winning is met in the gaming terminal 10. Upon receipt of the winning signal, the fourth process is executed in which the light emitting portions 303 are caused to undergo state changes toward the bonus payout indicator 300, in numbers fewer in the straight portion 306 than in the bent portion 305.

When the state changes have occurred in the light emitting portions 303 all the way up to the bonus payout indicator 300, the center payout determining unit 206 sends an instruction to award a bonus payout, to the terminal controller 100 of the gaming terminal 10 corresponding to the path 301 in which the state changes have occurred up to the bonus payout indicator 300. In this manner, the center controller 200 performs the fifth process, in which an instruction to award a bonus payout is sent to the terminal controller 100 of the gaming terminal 10 corresponding to the path 301 including the light emitting portions 303 that have undergone state changes all the way up to the bonus payout indicator 300.

As is clear from the description of the foregoing operations, the gaming machine 1 realizes a playing method including: a step in which a base game that awards a payout according to a predetermined winning is run in each gaming terminal 10, independently from the other gaming terminals 10, and in which the payout according to a predetermined winning is awarded; a step in which bonus game is run that awards a bonus payout more rewarding than a base game payout, based on a predetermined condition; a step in which, when a predetermined winning is met in the gaming terminal 10, the light emitting portions 303 are caused to undergo state changes toward the bonus payout indicator 300, in numbers fewer in the straight portion 306 than in the bent portion 305; a step in which an instruction to award a bonus payout is sent to the terminal controller 100 of the gaming terminal 10 corresponding to the path 301 including the light emitting portions 303 that have undergone state changes all the way up to the bonus payout indicator 300; and a step in which a bonus payout is awarded based on the instruction from the center controller 200.

According to this playing method, the base game is run in each gaming terminal 10, independently from the other gaming terminals 10, and the payout according to a predetermined winning is awarded. The bonus game that awards a bonus payout more rewarding than a base game payout is run based on a predetermined condition. When a predetermined winning is met, the light emitting portions 303 are caused to undergo state changes toward the bonus payout indicator 300, in numbers fewer in the straight portion 306 than in the bent portion 305. A bonus payout is awarded in the gaming terminal 10 corresponding to the path 301 including the light emitting portions 303 that have undergone state changes all the way up to the bonus payout indicator 300. The bent portion of the paths differs between the gaming terminals, and the players cannot easily find their positions relative to the other players. However, since the paths are straight and in parallel configuration in portions from the bonus payout indicator to a predetermined position, the positions of the players become clearly visible at a final phase of the game. This stimulates the competition between the players and makes the game more exciting. Further, since fewer numbers of light emitting portions undergo state changes in the straight portion in response to a winning, the players can compete for extended time periods in the straight portion with sustained interest.

(Running Base Game)

The following specifically describes an example of a base game in the gaming machine 1 and the playing method. Note that the following example deals with a case where the terminal display 101 adopts a video reel and arranges symbols on a video reel, as illustrated in FIG. 3.

As illustrated in FIG. 3, a matrix 156 is in the center of the terminal display 101. The matrix 156 includes symbols 180, which are scroll displayed. The display windows 151 to 155 are respectively divided into upper stages 151*a* to 155*a*, central stages 151*b* to 155*b*, and lower stages 151*c* to 155*c*. The symbols 180 are stopped (arranged) in the stages 151*a* to 155*a*, 151*b* to 155*b*, and 151*c* to 155*c*, respectively. The matrix 156 is a symbol matrix including five columns/three rows. The matrix 156 however is not limited to the one with the five-columns/three-rows.

As illustrated in FIG. 3, the terminal display 101 variably displays symbols 180 when a base game is started in the gaming terminal 10. When this variable-displaying of symbols 180 stops, symbols 180 are rearranged in the arrangement areas 150. Then, when a winning is met according to a relation among the rearranged symbols 180, a payout according to this winning is awarded.

Note that, part of the bet made by the player is accumulated in the form of a jackpot value, every time a base game is started. The jackpot value so accumulated is displayed in the bonus payout indicator 300, as illustrated in FIG. 3. As also shown in FIG. 3, the accumulation of jackpot values may be displayed, for example, by changing the state of the light emitting portions 303 in each path 301 according to the level of contribution to the accumulated jackpot value, so that the players can visually observe extent of their contribution.

(Running Bonus Game)

The following specifically describes an example of a bonus game in the gaming machine 1 and the playing method.

A bonus game is started when the accumulated jackpot value exceeds a certain value. In a bonus game, the symbols 180 are rearranged in the matrix 156 in each gaming terminal 10. When a predetermined winning is met by the rearrangement of the symbols 180, the state of the light emitting portions 303 is changed one after another, from the position 302 corresponding to the gaming terminal 10 in which the winning has occurred, toward the bonus payout indicator 300. The number of light emitting portions 303 that undergo state changes is fewer in the straight portion 306 than in the bent portion 305. This operation is repeated until the light emitting portions 303 in any of the paths 301 complete the state changes all the way up to the bonus payout indicator 300.

Figure 4B:
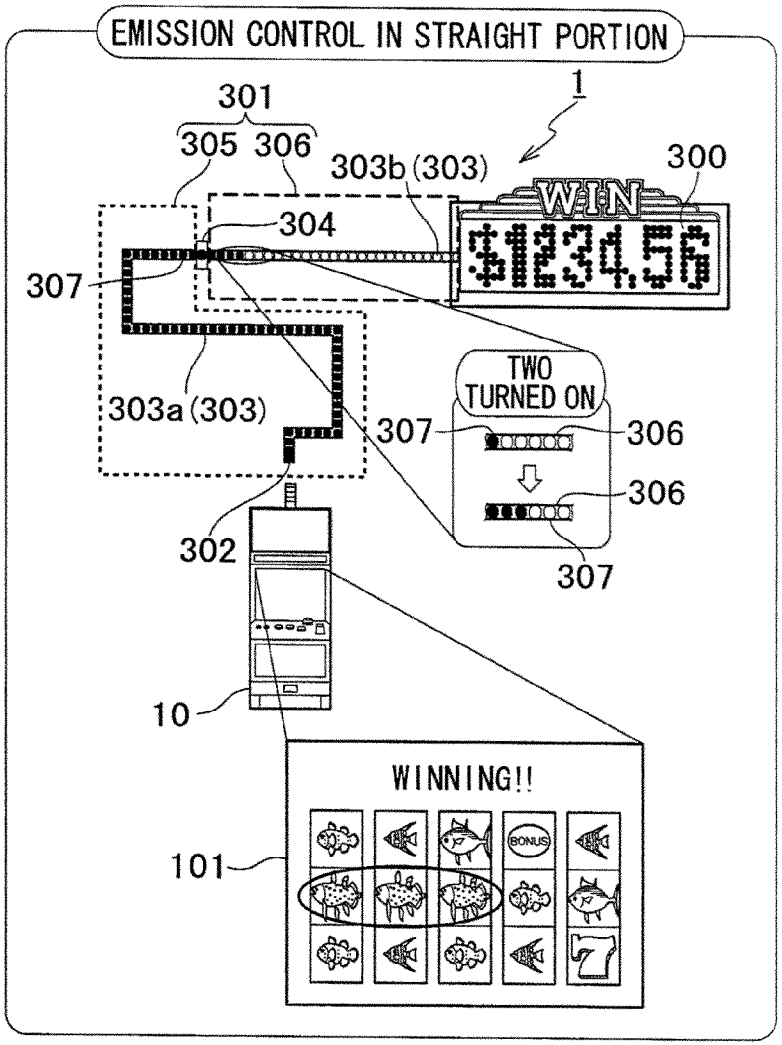
FIG. 4B is an explanatory diagram concerning changes in the state of light emitting portions in the straight portion when a winning is met in a bonus game.
Figure 4A:
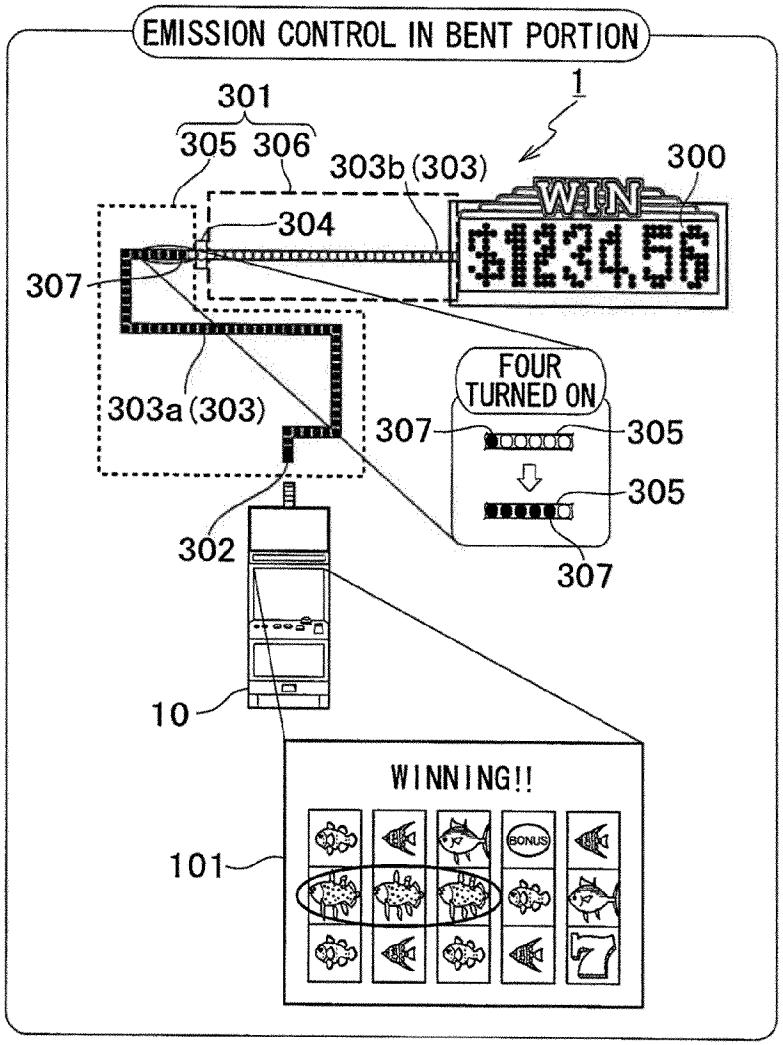
FIG. 4A is an explanatory diagram concerning changes in the state of light emitting portions in the bent portion when a winning is met in a bonus game.

For example, when a predetermined winning is met, four additional light emitting portions 303 undergo state changes in the bent portion 305, as illustrated in FIG. 4A. On the other hand, in the straight portion 306, two additional light emitting portions 303 undergo state changes when a predetermined winning is met, as illustrated in FIG. 4B. In this manner, in response to a predetermined winning, fewer light emitting portions 303 undergo state changes in the straight portion 306 than in the bent portion 305.

Figure 5:
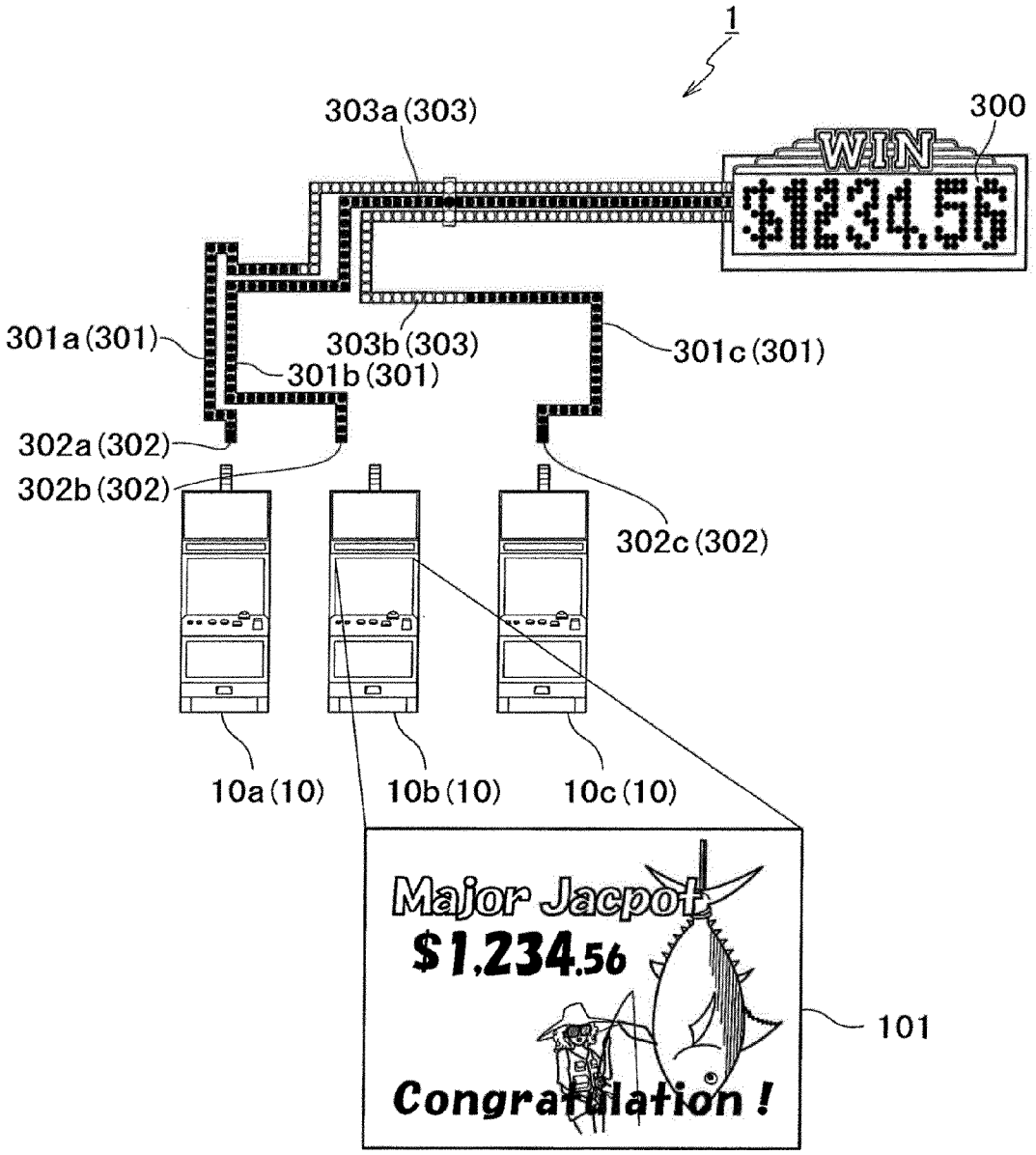
FIG. 5 is an explanatory diagram concerning awarding a jackpot in a bonus game.

When the light emitting portions 303 complete state changes all the way up to the bonus payout indicator 300 as shown in FIG. 5, a jackpot is awarded as a bonus payout in the gaming terminal 10 corresponding to the path 301 in which the state changes have completed. In the example shown in FIG. 5, the light emitting portions 303 in the path 301*b* (301) have undergone state changes up to the bonus payout indicator 300. As such, the jackpot is awarded in the gaming terminal 10*b* (10) corresponding to the path 301*b* (301).

Figure 6:
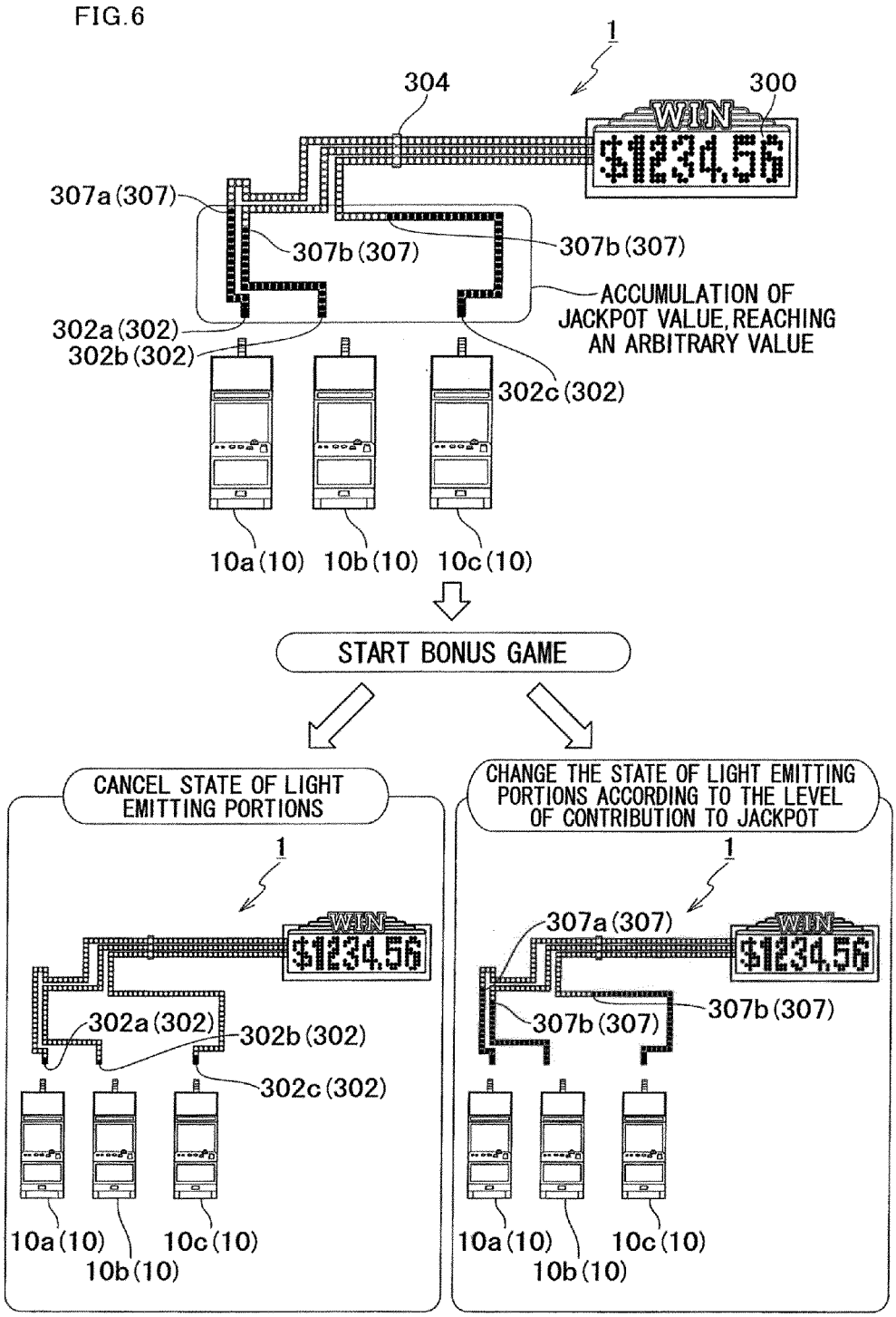
FIG. 6 is an explanatory diagram concerning the state of the light emitting portions at the start of a bonus game.

In Embodiment 1 of the present invention, the state of the light emitting portions 303 is changed every time a predetermined winning is met, from the position 302 corresponding to each gaming terminal 10 toward the bonus payout indicator 300. As such, the difficulty of hitting a jackpot (winning percentage of a bonus game) is the same for all paths 301. However, the invention is not limited to this particular example. For example, as illustrated in FIG. 6, a bonus game may be started in a state where the light emitting portions 303 reflect the contribution to a jackpot in a base game. More specifically, a bonus game may be started in a state where the current-position displaying light emitting portion 307 has approached the bonus payout indicator 300, i.e., a state more advantageous to hit a jackpot. In this way, a player making more bets in a base game is able to start a game from the position more advantageous to hit a jackpot, which is awarded as a bonus payout in a bonus game. Thus, the players play a base game with the bonus game in mind, and therefore can sustain their interest.

[Symbol, Combination, or the Like]

A terminal display 101 has a matrix 156 including symbol columns each having twenty two symbols 180 as illustrated in FIG. 9. To each of the symbols constituting the columns is given one of code numbers 0 to 21. Each symbol column is made from a combination of "Angelfish", "Clownfish", "7", "Tuna", "Coelacanth", and "Bonus".

Of the symbols in the symbol columns, the display windows 151 to 155 each displays (arranges) three successive symbols. The symbols arranged in the upper stages 151*a* to 155*a*, the central stages 151*b* to 155*b*, and the lower stages 151*c* to 155*c* form a symbol matrix having five columns and three rows. When a BET button and a start button are sequentially pressed in this order to start a game, symbols constituting the symbol matrix start to scroll. This scrolling of the symbols stops (rearrangement) after a predetermined period from the beginning of the scrolling.

Further, for each symbol, a predetermined scatter symbol is determined in advance. Scatter symbols are such symbols that a player is put in an advantageous position when a predetermined number or more of them are displayed in the matrix 156. For example, the advantages include: a state where coins corresponding to the scatter symbols are paid out, a state where the number of coins to be paid out is added to a credit, a state where a bonus game is started.

Here, a bonus game is a gaming state which provides a larger advantage than a base game. In Embodiment 1, the bonus game is a jackpot game. No particular limitation is put on the bonus game, as long as it is a gaming state advantageous to the player, that is, it is more advantageous than the base game. For example, the bonus game may include a state where more game media are obtainable than in the base game, a state where a game medium is obtainable with higher probability than in the base game, a state where a game medium is less consumed than in the base game, and the like. Specifically, a free game, a second game, a feature game, and the like may be mentioned as examples of the bonus game.

[Mechanical Structure of Gaming Machine 1]

Next, the following describes a specific example of mechanical and electrical structures of the gaming machine 1 thus structured.

This gaming machine 1 is placed in a gaming facility such as a casino. This gaming machine 1 runs a unit game which involves a game medium. The game medium is a coin, bill, or a value in the form of electronic information. However, the game medium in the present invention is not particularly limited. For example, a medal, token, electronic money, ticket or the like are also possible. Further, the ticket is not particularly limited and may be a later-described ticket with a barcode or the like ticket.

Figure 7:
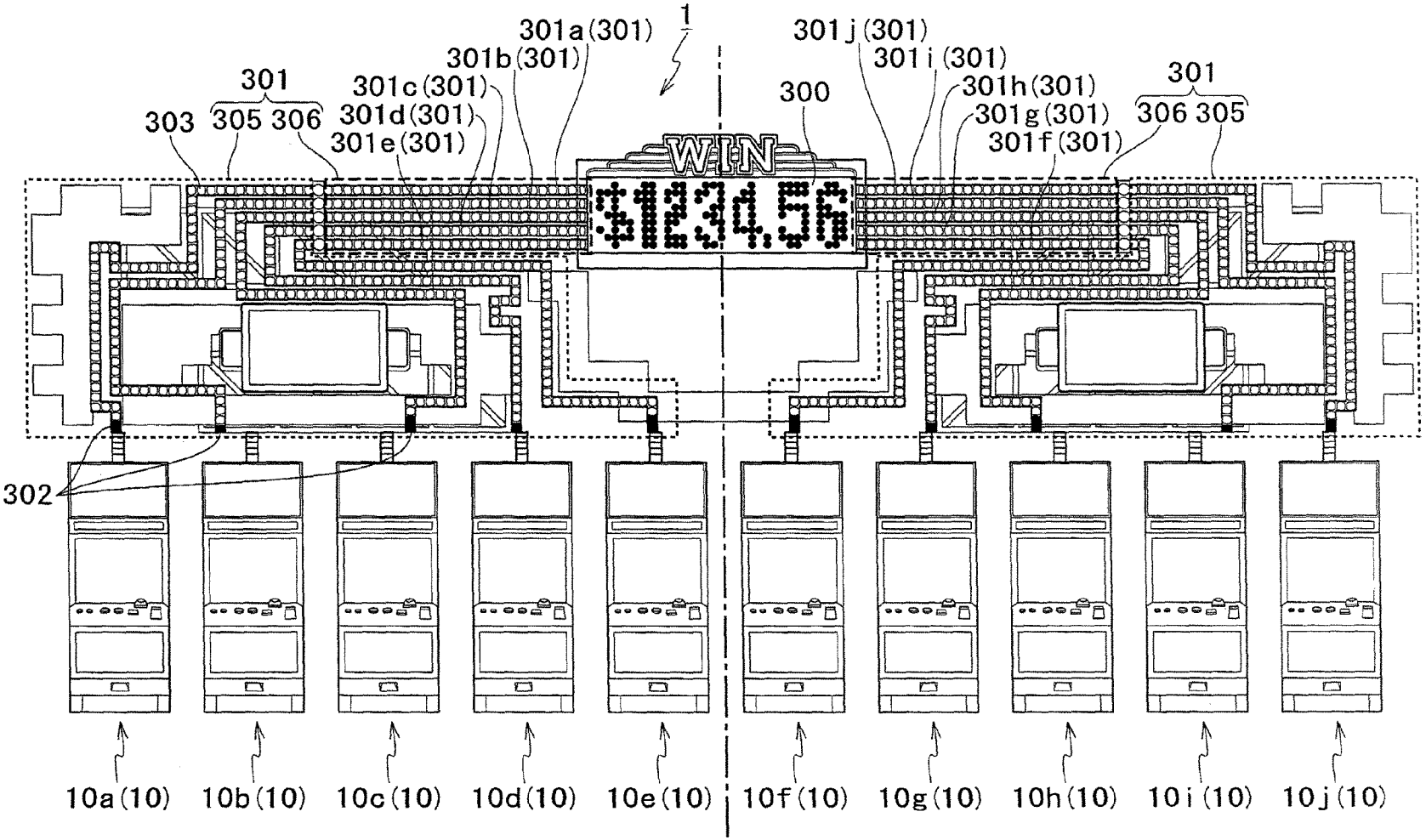
FIG. 7 is a front view illustrating an external appearance of the gaming machine.

As illustrated in FIG. 7, the gaming machine 1 includes: a gaming terminal 10 that independently runs a base game; a center controller 200, connected to and in communication with the gaming terminal 10, that runs a bonus game; a bonus payout indicator 300 that displays the amount of a bonus payout awarded in a bonus game; and paths 301 including a bent portion 305 provided on the side of the gaming terminal 10, and a straight portion 306 provided on the side of the bonus payout indicator 300 in parallel configuration, the bent portion 305 and the straight portion 306 including light emitting portions 303 connecting each gaming terminal 10 to the bonus payout indicator 300. For example, in the bent portion 305, the path 301*a* corresponding to the gaming terminal 10*a* differs in shape from the paths 301*b*, 301*c*, 301*d*, and 301*f* corresponding to the other gaming terminals. However, these paths are parallel to one another in the straight portion 306. Further, as illustrated in FIG. 7, there are provided paths 301*f*, 301*g*, 301*h*, and 301*i*, bilaterally symmetrical to their counterparts about the central axis passing through the bonus payout indicator 300. For example, the path 301*j* and the path 301*a* are bilaterally symmetrical to each other about the central axis of the bonus payout indicator 300. Similarly, the paths 301*i* and 301*b*, the paths 301*h* and 301*c*, the paths 301*g* and 301*d*, and the paths 301*f* and path 301*e* are bilaterally symmetrical to each other about the central axis of the bonus payout indicator 300.

Figure 8:
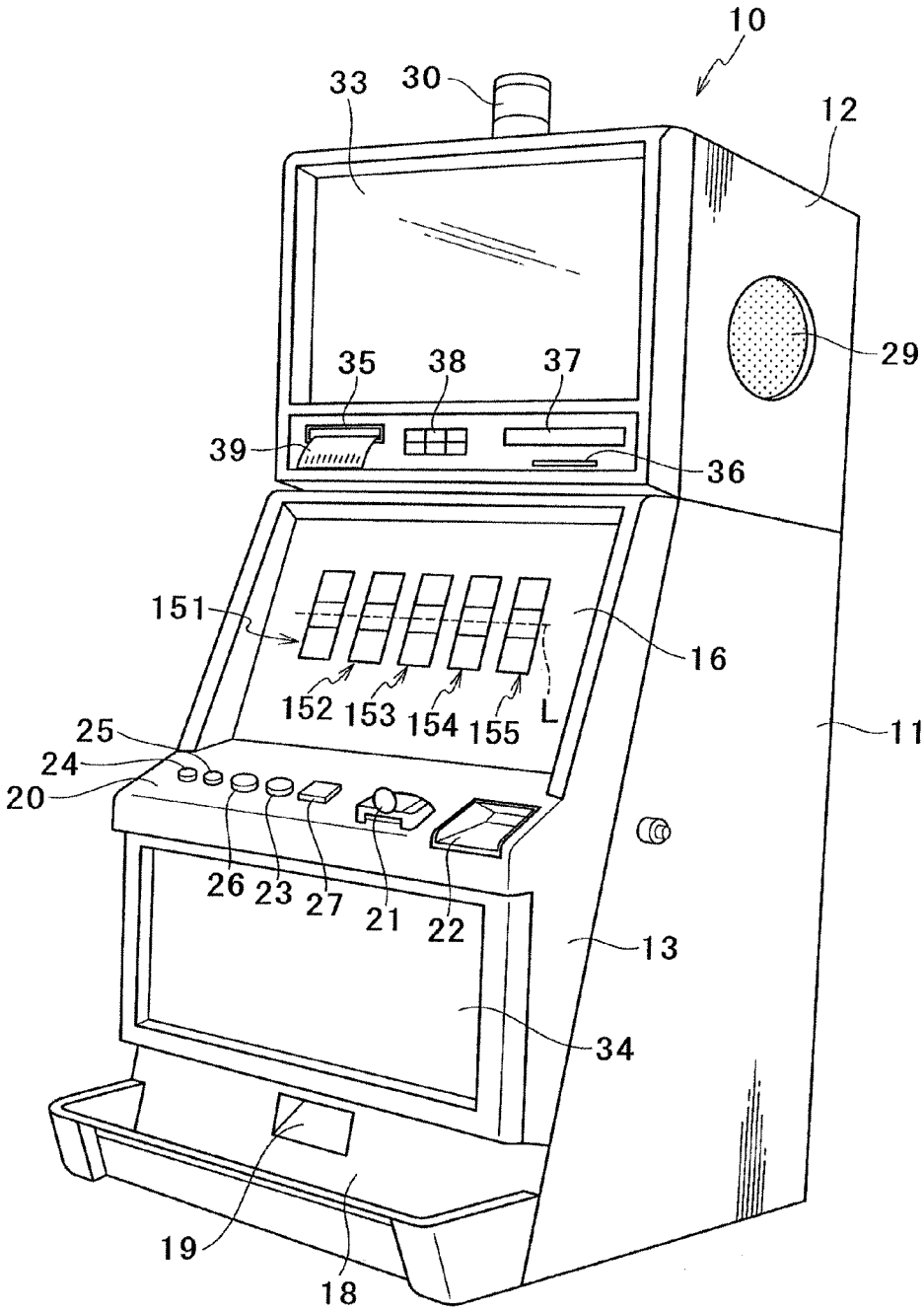
FIG. 8 is a perspective view illustrating an external appearance of the gaming terminal.

As illustrated in FIG. 8, the gaming terminal 10 includes: a cabinet 11, a top box 12 provided above the cabinet 11, and a main door 13 provided on the front surface of the cabinet 11. The main door 13 has a lower image display panel 16. The lower image display panel 16 has a transparent liquid crystal panel for displaying various information. The lower image display panel 16 displays display windows 151 to 155 (matrix 156) for arranging therein symbols 180. Further, the lower image display panel 16 displays as needed various information and effect images related to a game.

Embodiment 1 deals with a case where the lower image display panel 16 electrically displays symbols 180 arranged in five rows/three columns. However, the present invention is not limited to this.

The lower image display panel 16 displays a single activated payline L. Note that the number of pay lines L may be two or more. When the number of pay lines L is two or more, the number of pay lines L activated may be determined according to a predetermined condition, such as the number of coins placed as a BET.

Note that the lower image display panel 16 may have a credit value indicator and a payout value indicator. The credit value indicator displays a total value (hereinafter also referred to as total credit value) which a gaming terminal 10 can pay out to a player. When symbols stopped along a pay line L form a winning combination, the payout value indicator displays the number of coins to be paid out.

Further, scatter symbols may be adopted, and the number of coins to be paid out may be determined, according to the number of scatter symbols displayed on the matrix 156. Note that the pay line L does not necessarily have to be displayed.

Below the lower image display panel 16 provided are a control panel 20, a coin insertion slot 21, and a bill validator 22. The control panel 20 is provided with various buttons 23 to 27. These buttons 23 to 27 allow a player to input instructions related to a game played by the player. Through the coin insertion slot 21, a coin is received in the cabinet 11.

The control panel 20 includes: a spin button 23, a change button 24, a cashout button 25, a 1-BET button 26, and a maximum BET button 27. The spin button 23 is for inputting an instruction to start symbol scrolling. The change button 24 is used to ask a staff person in the gaming facility for exchange of money. The cashout button 25 is for inputting an instruction to pay out coins corresponding to the total credit-value into the coin tray 18.

The 1-BET button 26 is used for betting one coin out of those corresponding to the total credit value. The maximum BET button 27 is used for betting, out of those corresponding to the total credit value, a maximum number of coins (e.g., fifty coins) which can be bet in one game.

The bill validator 22 validates whether bill is genuine or not and receives the genuine bill into the cabinet 11. Note that the bill validator 22 is capable of reading a barcode attached to a later-mentioned ticket 39 having a barcode (hereinafter simply referred to as ticket 39). When the bill validator 22 reads the ticket 39, it outputs to the main CPU 41 a read signal representing information having read from the barcode.

On the lower front surface of the main door 13, that is, below the control panel 20, a belly glass 34 is provided. On the belly glass 34, a character of a gaming terminal 10 or the like is drawn. On the front surface of top box 12 is provided an upper image display panel 33. The upper image display panel 33 has a liquid crystal panel and displays an effect image, introduction to the game, rules of the game, or the like.

Further, the top box 12 has a speaker 29 for performing an audio output. Below the upper image display panel 33 are provided a ticket printer 35, a card reader 36, a data displayer 37, and a keypad 38. The ticket printer 35 prints, onto a ticket, a barcode having encoded data containing credit-value, date and time, identification number of a gaming terminal 10 or the like, thereby issuing a ticket 39 having a barcode attached thereto. A player can play a game in another gaming terminal 10 with the ticket 39 having the barcode, or exchange the ticket 39 having the barcode with bill or the like at a change booth or the like of the game arcade.

The card reader 36 reads/writes data from/into a smart card. The smart card is carried by a player, and stores therein data for identifying the player, data relating to a history of games played by the player, or the like.

The data displayer 37 includes a fluorescent display or the like, and displays the data read by the card reader 36 and the data input by the player through the keypad 38, for example. The keypad 38 is for entering instructions or data relating to issuing of a ticket or the like.

[Electrical Structure of Gaming Machine 1]

Figure 13:
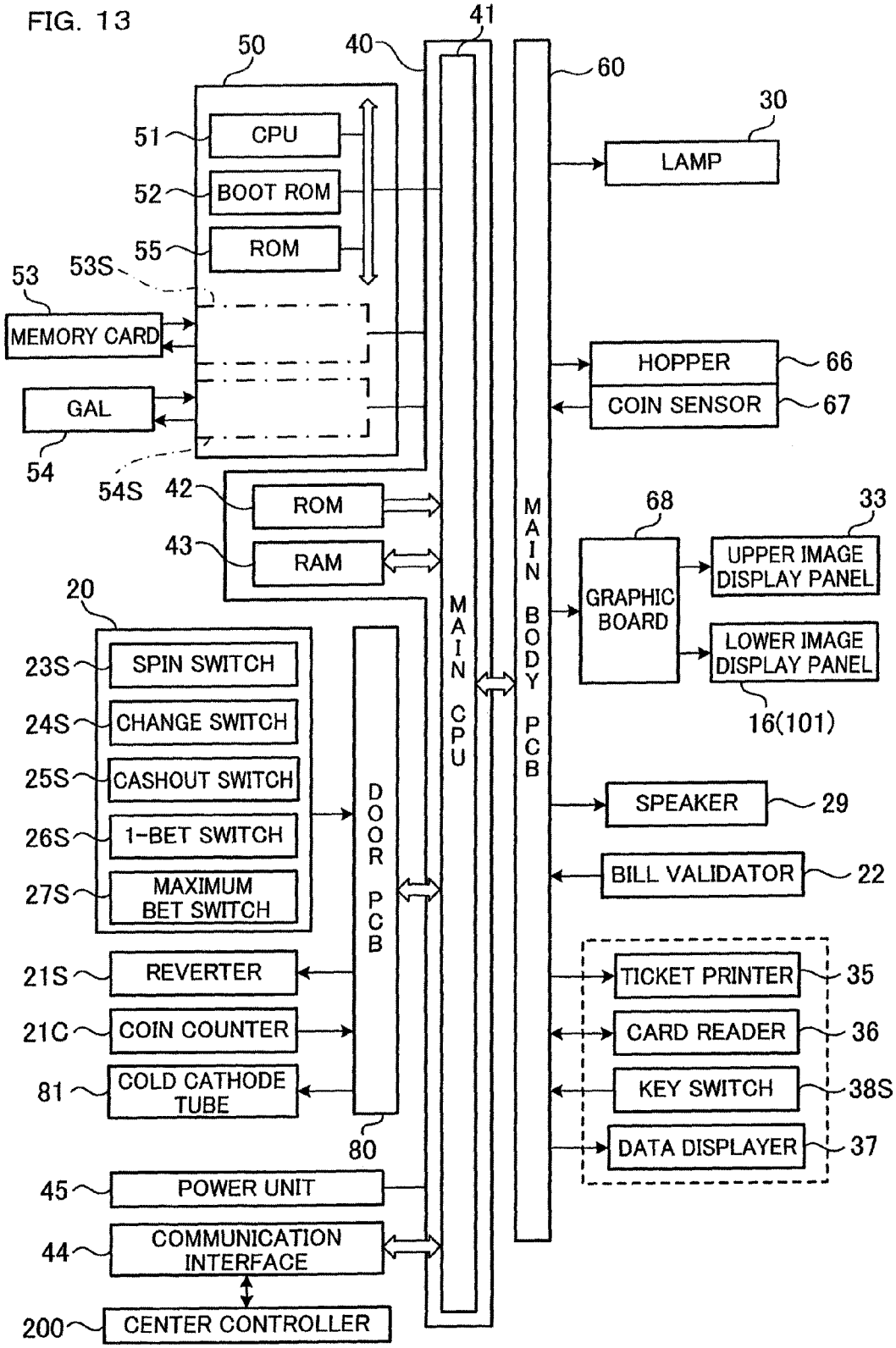
FIG. 13 is a block diagram illustrating an electrical structure of the gaming terminal.
Figure 14:
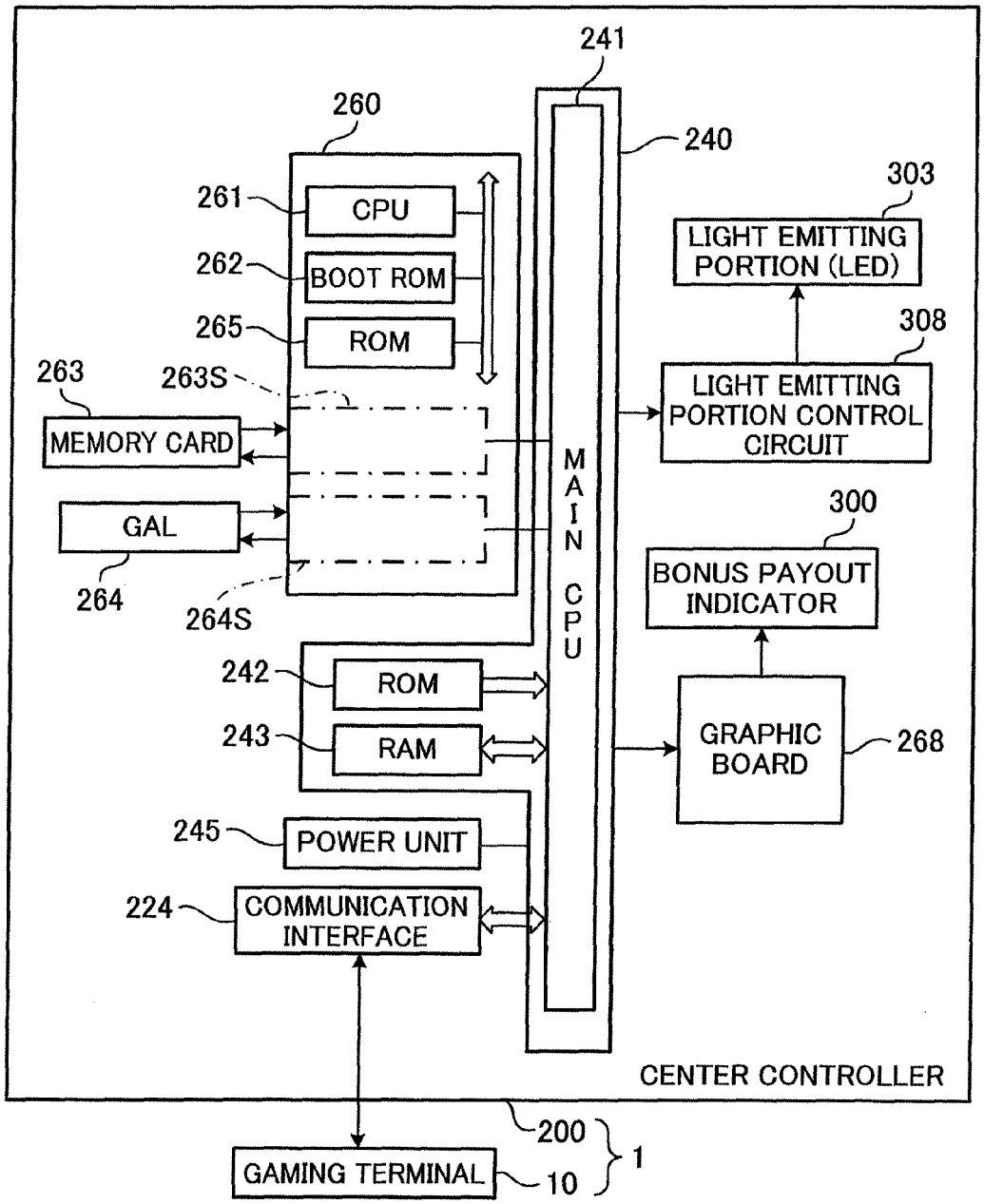
FIG. 14 is a block diagram illustrating an electrical structure of a center controller.

FIGS. 13 and 14 are block diagrams each illustrating an electrical structure of the entire gaming machine 1.

[Electrical Structure of Gaming Terminal 10]

FIG. 13 is a block diagram showing an electrical structure of the gaming terminal 10. As illustrated in FIG. 13, the cabinet 11 includes a control unit having a terminal controller 100. As illustrated in FIG. 13, the control unit includes a motherboard 40, a main body PCB (Printed Circuit Board) 60, a gaming board 50, a door PCB 80, various switches, sensors, or the like.

The gaming board 50 is provided with a CPU (Central Processing Unit) 51, a ROM 55, a boot ROM 52, a card slot 53S corresponding to a memory card 53, and an IC socket 54S corresponding to a GAL (Generic Array Logic) 54. The CPU 51, the ROM 55, and the boot ROM 52 are connected to one another through an internal bus.

The memory card 53 stores therein a game program and a game system program. The game program contains a stop symbol determining program. The stop symbol determining program determines symbols (code number corresponding to the symbol) to be stopped in the arrangement areas 150. This stop symbol determining program contains sets of symbol weighting data respectively corresponding to various payout rates (e.g., 80%, 84%, 88%). Each set of the symbol weighting data indicates, for each of the display windows 151 to 155, a code number of each symbol and at least one random numerical value allotted to the code number. The numerical value is a value within a predetermined range of 0 to 256 for example.

The payout rate is determined based on payout rate setting data output from the GAL 54. Based on a set of the symbol weighting data corresponding to the payout rate determined, a symbol to be stopped is determined.

The memory card 53 stores therein various types of data for use in the game programs and the game system programs. For example, the memory card 53 stores a table listing combinations of a symbol 180 to be displayed on the display windows 151 to 155 of FIG. 3 and an associated range of random numerical values. This data is transferred to the RAM 43 of the motherboard 40, at the time of running a game programs.

The card slot 53S is structured so as to allow the memory card 53 to be attached/detached to/from the card slot 53S. This card slot 53S is connected to the motherboard 40 through an IDE bus. Thus, the type and content of a game run by a gaming terminal 10 can be modified by detaching the memory card 53 from the card slot 53S, writing a different game program and a different game system program into the memory card 53, and inserting the memory card 53 back into the card slot 53S.

Each of the game programs includes a program related to the progress of the game and/or a program for causing a transition to a bonus game. Each of the game programs includes image data and audio data output during the game.

The GAL 54 has input and output ports. When the GAL 54 receives data via the input port, it outputs data corresponding to the input data from its output port. This data from the output port is the payout rate setting data described above.

IC socket 54S is structured so as to allow the GAL 54 to be attached/detached to/from the IC socket 54S. The IC socket 54S is connected to the motherboard 40, via a PCI bus. Thus, the payout rate setting data to be output from GAL 54 can be modified by: detaching the GAL 54 from the IC socket 54S, overwriting the program stored in the GAL 54, and attaching the GAL 54 back to the IC socket 54S.

The CPU 51, the ROM 55 and the boot ROM 52 connected through an internal bus are connected to the motherboard 40 through the PCI bus. The PCI bus communicates signals between the motherboard 40 and the gaming board 50 and supplies power from the motherboard 40 to the gaming board 50. The ROM 55 stores country identification information and an authentication program. The boot ROM 52 stores a preliminary authentication program and a program (boot code) for enabling the CPU 51 to run the preliminary authentication program.

The authentication program is a program (falsification check program) for authenticating the game program and the game system program. The authentication program is a program for confirming and verifying that the game program and the game system program are not falsified. In other words, the authentication program is described in accordance with a procedure for authenticating the game program and the game system program. The preliminary authentication program is a program for authenticating the authentication program. The preliminary authentication program is described in accordance with a procedure for verifying that the authentication program to be authenticated is not falsified. In short, the preliminary authentication program authenticates the authentication program.

The motherboard 40 is provided with a main CPU 41 (terminal controller 100), a ROM (Read Only Memory) 42, a RAM (Random Access Memory) 43, and a communication interface 44.

The main CPU 41 serves as a terminal controller 100 and has a function of controlling the entire gaming terminal 10. In particular, the main CPU 41 controls the following operations: an operation of outputting a signal instructing variable-displaying of symbols 180 to the graphic board 68, which is performed in response to pressing of the spin button 23 after betting of credit; an operation of determining symbols 180 to be stopped after the variable-displaying of symbols 180; and an operation of stopping the symbols 180 thus determined in the display windows 151 to 155.

In other words, the main CPU 41 serves as an arrangement controller which arranges symbols to form a new symbol matrix through scrolling of symbols displayed on the lower image display panel 16. This main CPU 41 therefore determines symbols to be arranged in a symbol matrix by selecting symbols to be arranged from various kinds of symbols. Then, the main CPU 41 executes arrangement control to stop scrolling the symbols to present the symbols thus determined.

The ROM 42 stores a program such as BIOS (Basic Input/Output System) run by the main CPU 41, and permanently-used data. When the BIOS is run by the main CPU 41, each of peripheral devices is initialized and the game program and the game system program stored in the memory card 53 are read out through the gaming board 50. The RAM 43 stores data or a program used for the main CPU 41 to perform a process.

The communication interface 44 is provided to communicate with a host computer and the like equipped in the gaming facility, through the network (communication line). The communication interface 44 is also for communicating with the center controller 200 through a communication line. Further, a main body PCB (Printed Circuit Board) 60 and a door PCB 80 are connected to the motherboard 40, through USB (Universal Serial Bus). Further, the motherboard 40 is connected to a power unit 45. The power unit 45 supplies power to the motherboard 40 to boot the main CPU 41 thereof. Meanwhile, the power unit 45 supplies power to the gaming board 50 through the PCI bus to boot the CPU 51 thereof.

The main body PCB 60 and door PCB 80 are connected to various devices or units which generate signals to be input to the main CPU 41, and various devices or units whose operations are controlled by signals from the main CPU 41. Based on a signal input to the main CPU 41, the main CPU 41 runs the game program and the game system program stored in the RAM 43, to perform an arithmetic process. Then, the CPU 41 stores the result of the arithmetic process in the RAM 43, or transmits a control signal to the various devices and units to control them based on the result.

The main body PCB 60 is connected with a lamp 30, a hopper 66, a coin sensor 67, a graphic board 68, the speaker 29, a bill validator 22, a ticket printer 35, a card reader 36, a key switch 38S, and a data displayer 37.

The lamp 30 is turned on/off on the basis of a control signal from the main CPU 41.

The hopper 66 is mounted in the cabinet 11 and pays out a predetermined number of coins from a coin outlet 19 to the coin tray 18, based on a control signal from the main CPU 41. The coin sensor 67 is provided inside the coin outlet 19, and outputs a signal to be input to the main CPU 41 upon sensing that a predetermined number of coins have been delivered from the coin outlet 19.

The graphic board 68 controls image displaying of upper image display panel 33 and the lower image display panel 16, based on a control signal from the main CPU 41. Further, the graphic board 68 is provided with a VDP (Video Display Processor) for generating image data on the basis of a control signal from the main CPU 41, a video RAM for temporarily storing the image data generated by the VDP, or the like. Note that image data used at the time of generating the image data by the VDP is in a game program which is read out from the memory card 53 and stored in the RAM 43.

The bill validator 22 reads an image on the bill and takes only those recognized as to be genuine into the cabinet 11. When taking in a genuine bill, the bill validator 22 outputs an input signal indicating the value of the bill to the main CPU 41. The main CPU 41 stores into the RAM 43 a credit-value corresponding to the value of the bill indicated by the signal.

The ticket printer 35 prints a barcode onto a ticket to issue a ticket 39 having the barcode. The barcode contains encoded data such as credit-value stored in the RAM 43, date and time, identification number of the gaming terminal 10, or the like, based on a control signal from the main CPU 41.

The card reader 36 reads out data from the smart card and transmits the data to the main CPU 41. Further, the card reader 36 writes data into the smart card based on the control signal output from the main CPU 41. The key switch 38S is mounted to the keypad 38, and outputs a signal to the main CPU 41 in response to an operation of the keypad 38 by the player. The data displayer 37 displays, based on a control signal from the main CPU 41, the data read by the card reader 36 or the data input by the player through the key pad 38.

The door PCB 80 is connected to a control panel 20, a reverter 21S, a coin counter 21C, and a cold cathode tube 81. The control panel 20 is provided with: a spin switch 23S associated with the spin button 23; a change switch 24S associated with the change button 24; a cashout switch 25S associated with the cashout button 25; a 1-BET switch 26S associated with the 1-BET button 26; and a maximum BET switch 27S associated with the maximum BET button 27. Each of the switches 23S to 27S outputs a signal to the main CPU 41, when a player presses the associated button.

The coin counter 21C is provided within the coin insertion slot 21, and identifies whether the coin inserted into the coin insertion slot 21 by the player is genuine. A coin except the genuine coin is discharged from the coin outlet 19. In addition, the coin counter 21C outputs an input signal to the main CPU 41 upon detection of a genuine coin.

The reverter 21S is operated on the basis of the control signal output from the main CPU 41 and distributes a coin, which is recognized as a genuine coin by the coin counter 21C, to a not-shown cash box or hopper 66 mounted in the gaming terminal 10. In other words, when the hopper 66 is full of the coins, the genuine coin is distributed into the cash box by the reverter 21S. On the other hand, when the hopper 66 is not yet full with the coins, the genuine coin is distributed into the hopper 66. The cold cathode tube 81 functions as a backlight mounted to rear sides of the lower image display panel 16 and the upper image display panel 33. This cold cathode tube 81 turns on according to a control signal from the main CPU 41.

[Electrical Structure of Center Controller 200]

FIG. 14 is a block diagram illustrating an electrical structure of the center controller 200. The center controller 200 is provided therein with a control unit. As illustrated in FIG. 11, the control unit includes a motherboard 240, a gaming board 260, an actuator, or the like.

The gaming board 260 has the same structure as that of the gaming board 50. The motherboard 240 has the same structure as that of the motherboard 40. The communication interface 244 communicates with the terminal controller 100 through a communication line.

The graphic board 268 has the same structure as that of the graphic board 68, except that the graphic board 268 controls displaying of the bonus payout indicator 300 based on a control signal from the main CPU 241.

A light emitting portion control circuit 308 controls the operation of the LEDs provided as the light emitting portions 303, and changes the state of the light emitting portions 303 based on the control signal output from the main CPU 241.

(Emission Control Table for Bent Portion)

FIG. 10 is a diagram showing an emission control table for the bent portion. The emission control table for the bent portion is stored in the ROM 242, and indicates the number of light emitting portions 303 that undergo state changes in the bent portion 305 when a predetermined winning is met. For example, the emission control table indicates that the state change will occur in two, four, six, eight, ten, and twelve light emitting portions 303 in the bent portion 305 when a winning is met with "Clownfish", "Coelacanth", "Angelfish", "Tuna", "BONUS", and "7", respectively.

(Emission Control Table for Straight Portion)

FIG. 11 is a diagram showing an emission control table for the straight portion. The emission control table for the straight portion is stored in the ROM 242, and indicates the number of light emitting portions 303 that undergo state changes in the straight portion 306 when a predetermined winning is met. For example, the emission control table indicates that the state change will occur in one, two, three, four, five, and six light emitting portions 303 in the straight portion 306 when a winning is met with "Clownfish", "Coelacanth", "Angelfish", "Tuna", "BONUS", and "7", respectively. Note that, the number of light emitting portions 303 that undergo state changes when a predetermined winning is met is fewer in the emission control table for the straight portion than in the emission control table for the bent portion. Accordingly, when a predetermined winning is met, fewer light emitting portions 303 will undergo state changes in the straight portion 306 than in the bent portion 305.

(Progressive Value Table for Gaming Terminal)

FIG. 12 is a diagram showing a progressive value table provided for each gaming terminal. The progressive value table of each gaming terminal is stored in the RAM 243, and indicates the level of contribution to a jackpot in the gaming terminal. Larger progressive values mean more contribution to a jackpot. For example, the progressive value table indicates that the progressive values are 10, 15, 25, 100, and 10 for the gaming terminals 10*a*, 10*b*, 10*c*, 10*i*, and 10*j*, respectively.

[Operation of Gaming Machine 1: Boot Process]

The following describes a boot process routine which takes place in the gaming machine 1. Upon powering on the gaming machine 1, a boot process routine shown in FIG. 15 starts in: the mother board 240 and gaming board 260 in the center controller 200, and in the mother board 40 and the gaming board 50 in the terminal controller 100. The memory cards 53 and 263 are assumed to be inserted into the card slots 53S and 263S of the gaming boards 50 and 260, respectively. Further, the GALs 54 and 264 are assumed to be attached to the IC sockets 54S and 264S, respectively.

First, turning on the power switch of (powering on) the power units 45 and 245 boots the motherboards 40 and 240, and the gaming boards 50 and 260. Booting the motherboards 40 and 240 and the gaming boards 50 and 260 starts separate processes in parallel. Specifically, the CPUs 51 and 261 read out preliminary authentication programs stored in the boot ROMs 52 and 262, respectively. Then, preliminary authentication is performed according to the read out programs so as to confirm and authenticate that no modification is made to authentication programs, before reading them in the motherboards 40 and 240, respectively (S1). Meanwhile, the main CPUs 41 and 241 of the motherboards 40 and 240 run BIOS stored in the ROMs 42 and 242 to load into the RAMs 43 and 243 compressed data built in the BIOS, respectively (S2). Then, the main CPUs 41 and 241 run a procedure of the BIOS according to the data loaded into the RAMs 43 and 243 so as to diagnose and initialize various peripheral devices (S3).

The main CPUs 41 and 241, which are respectively connected to the ROMs 55 and 265 of the gaming boards 50 and 260 via PCI buses, read out authentication programs stored in the ROMs 55 and 265 and stores them in the RAMs 43 and 243 (S4). During this step, the main CPUs 41 and 241 each derive a checksum through ADDSUM method (a standard check function) which is adopted in a standard BIOS, and store the authentication programs into RAMs 43 and 243 while confirming if the operation of storing is carried out without an error.

Next, the main CPUs 41 and 241 each check what connects to the IDE bus. Then, the main CPUs 41 and 241 access, via the IDE buses, to the memory cards 53 and 263 inserted into the card slots 53S and 263S, and read out game programs and game system programs from the memory cards 53 and 263, respectively. In this case, the CPUs 41 and 241 each read out four bytes of data constituting the game program and the game system program at one time. Next, according to the authentication programs stored in the RAMs 43 and 243, the CPUs 41 and 241 authenticate the game program and the game system program read out to confirm and prove that these programs are not modified (S5).

When the authentication properly ends, the main CPUs 41 and 241 write and store the authenticated game programs and game system programs in RAMs 43 and 243 (S6).

Next, the main CPUs 41 and 241 access, via the PCI buses, to the GALs 54 and 264 attached to the IC socket 54S·264S, and read out payout rate setting data from the GALs 54 and 264, respectively. The payout rate setting data read out is then written and stored in the RAMs 43 and 243 (S7).

Next, the main CPUs 41 and 241 read out, via the PCI buses, country identification information stored in the ROMs 55 and 265 of the gaming boards 50 and 265, respectively. The country identification information read out is then stored in the RAMs 43 and 243 (S8).

Figure 16:
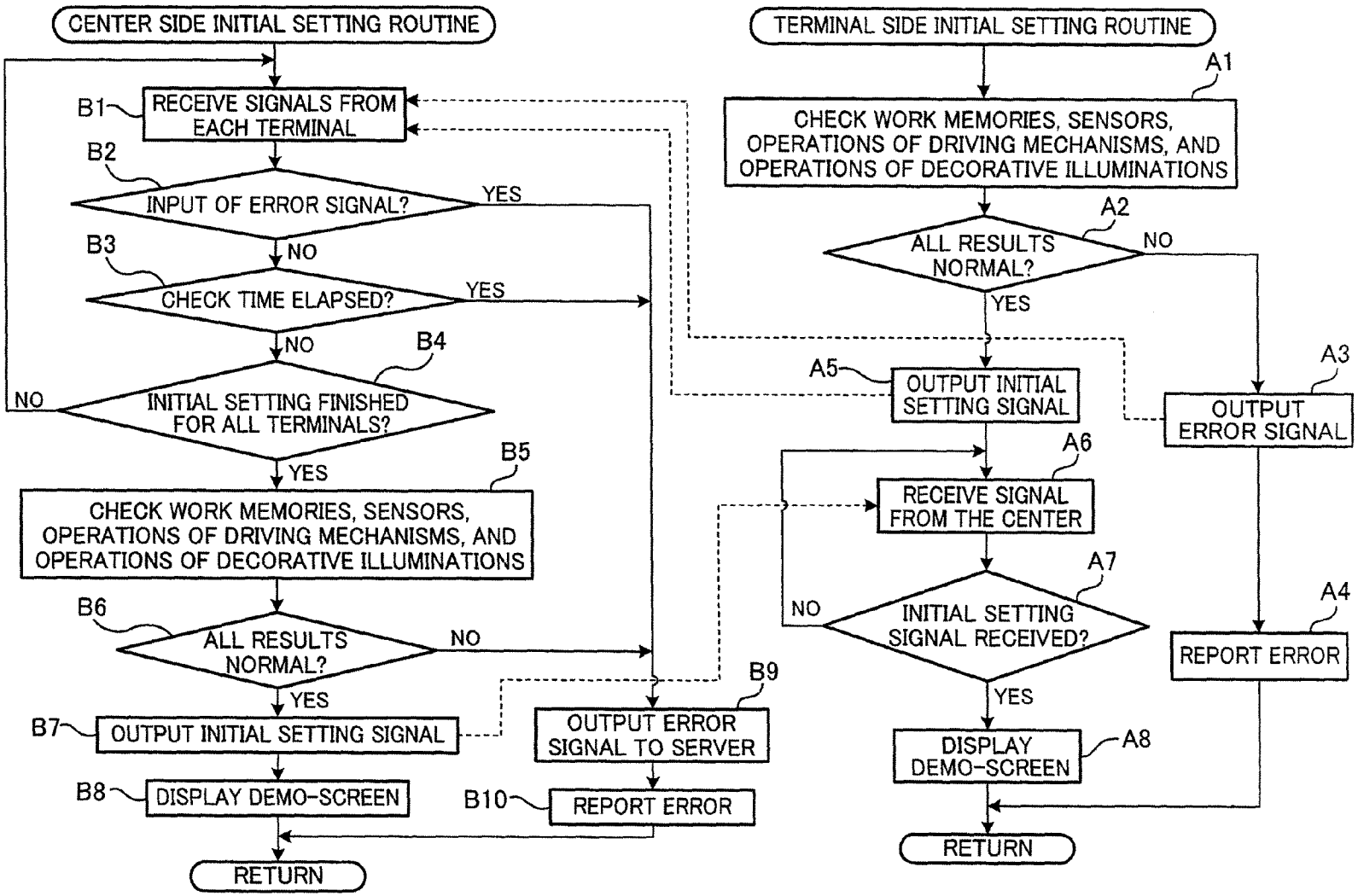
FIG. 16 is a flowchart illustrating an initial process executed by the gaming terminal and the center controller.

After this, the main CPUs 41 and 241 each perform an initial process of FIG. 16.

[Operation of Gaming Machine 1: Initial Process]

Figure 15:
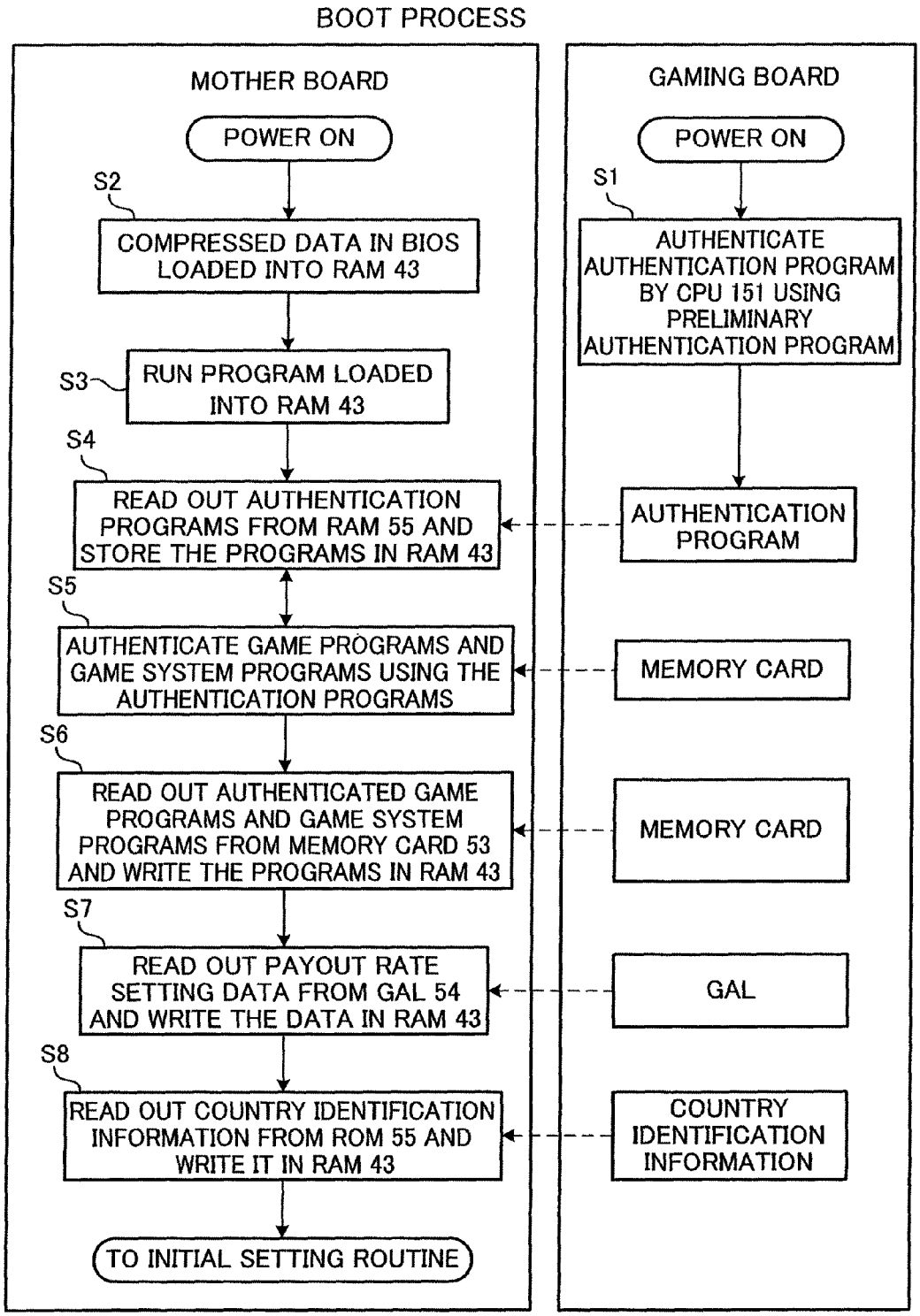
FIG. 15 is a flowchart illustrating a boot process executed by the gaming terminal and the center controller.

The following describes an initial process which takes place in the gaming machine 1. When the boot process of FIG. 15 is completed, the center controller 200 reads out from the RAM 243 a center side initial setting routine illustrated in FIG. 16 and executes the routine. Meanwhile, the gaming terminal 10 reads out from the RAM 43 a terminal side initial setting routine illustrated in FIG. 16 and executes the routine. The center side and terminal side initial setting routines are executed in parallel.

First, the main CPU 41 of each of the gaming terminals 10 checks operations of work memories such as the RAM 43, various sensors, various driving mechanisms, and various decorative illuminations (A1). Then, the main CPU 41 determines if all the check results are normal (A2). If the main CPU 41 determines that the check results contains an error (A2: NO), the main CPU 41 outputs a signal notifying the error (hereinafter, error signal) to the center controller 200 (A3). Further, the main CPU 41 reports the error in the form of illuminating the lamp 30 or the like (A4), and then ends the routine.

On the other hand in A2, if the main CPU 41 determines that all the check results are normal (A2: YES), an initial setting signal is output to the center controller 200 (A5). Then, an initial setting signal is waited from the center controller 200 (A6, A7: NO).

The main CPU 241 of the center controller 200 receives signals from each of the terminals (B1). Then, the main CPU 241 determines whether a signal received is an error signal (B2). If the main CPU 241 determines that the signal is an error signal (B2: YES), the main CPU 241 outputs the error signal to a server of a not-shown host computer or the like (B9) to report the error (B10), and ends the routine.

On the other hand in B2, if the main CPU 241 determines that the signal is not an error signal (B2:NO), the main CPU 241 determines whether a predetermined time (check time) has elapsed from the time of powering on (B3). If the main CPU 241 determines that the check time has elapsed (B3: YES), B9 is executed. On the other hand, if the main CPU 241 determines that the check time has not yet elapsed (B3: NO), it is determined whether an initial setting signal is received from each of the gaming terminals 10 (B4). If the main CPU 241 determines that an initial setting signal from any one of the gaming terminals 10 is not received (B4: NO), the process returns to B1. On the other hand, if it is determined that initial setting signals from all the gaming terminals 10 are received (B4: YES), the main CPU 241 checks operations of work memories such as RAM 243, various sensors, various driving mechanisms, and various decorative illuminations (B5). Then, the main CPU 241 determines whether all the check results are normal (B6). If the main CPU 241 determines the check results contain an error (B6: NO), the main CPU 241 executes B9.

On the other hand in B6, if the main CPU 241 determines that all the check results are normal (B6: YES), the main CPU 241 outputs an initial setting signal to all the gaming terminals 10 (B7), and causes the shared display 102 to display a demo-screen (B8). Then, the main CPU 241 ends the routine.

In A7, the main CPU 41 of each of the gaming terminals 10 determines that an initial setting signal is received from the center controller 200 (A7: YES), and causes the terminal display 101 to display a demo-screen (A7). The main CPU 41 then ends the routine.

[Operation of Gaming Terminal 10: Terminal Process Routine]

Figure 17:
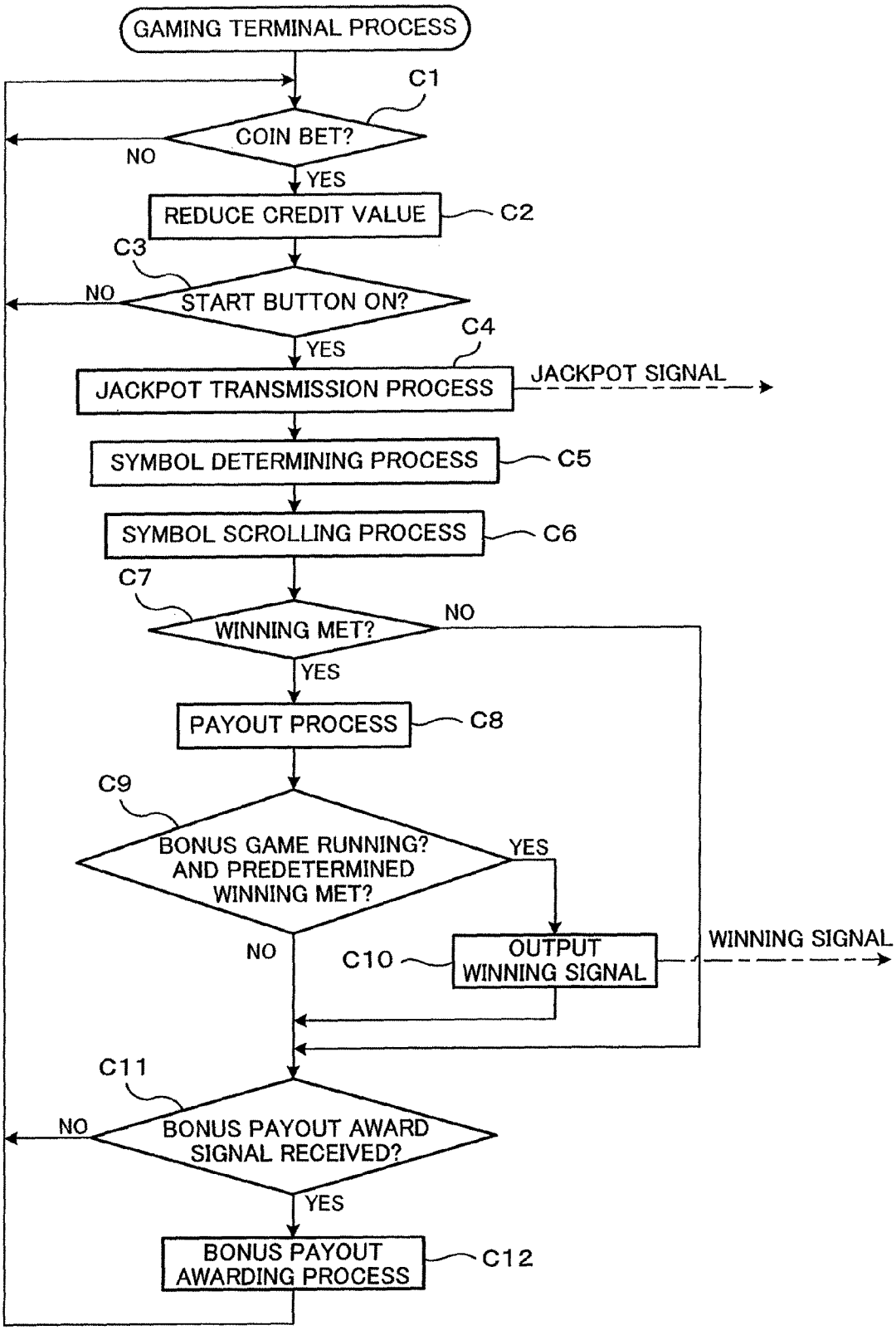
FIG. 17 is a flowchart illustrating a terminal process routine executed in the gaming terminal.

After the terminal side initial setting routine of FIG. 16, the main CPU 41 of the gaming terminal 10 performs a terminal process routine of FIG. 17. Through this terminal process routine, a game is run.

As illustrated in FIG. 17, in the terminal process routine, it is determined whether a coin is bet (C1). In this step, it is determined whether a signal from the 1-BET switch 26S entered by pressing of the 1-BET button 26 is received. Meanwhile, it is determined whether a signal from the maximum BET switch 27S entered by pressing of the maximum BET button 27 is received. If no coin is BET (C1: NO), C1 is repeated until a coin is bet.

On the other hand, if a coin is bet (C1: YES), the credit value stored in the RAM 43 is reduced according to the number of coins bet (C2). When the number of coins bet surpasses the number of coins equivalent to the credit value stored in the RAM 43, the process goes to a later-described step C3 without the reduction of the credit value. When the number of coins bet exceeds the maximum number of coins bettable one game (50 pieces in Embodiment 1), the process goes to a later-described step C3 without the reduction of the credit value.

Then, it is determined whether a spin button 23 is pressed (C3). If the spin button 23 is not pressed (C3: NO), the process returns to C1. Here, if the spin button 23 is not pressed (for example, the spin button 23 is not pressed but a command to end the game is input), the reduction of the credit value in C2 is canceled.

On the other hand, if the spin button 23 is pressed (C3: YES), a jackpot transmission process is executed (C4). In other words, a jackpot signal indicating a part of the game value bet is transmitted to the center controller 200.

Next executed is a symbol determining process (C5). That is, the stop symbol determining program stored in the RAM 43 is run to determine symbols 180 to be arranged in the matrix 156. Through this, a symbol combination to be formed along the payline L is determined.

Then, the scrolling process is executed to scroll symbols 180 on the terminal display 101 (C6). The scrolling process is a process in which the symbols 180 determined in C5 are stopped (rearranged) in the matrix 156 after scrolling of symbols 180 in a direction indicated by an arrow symbol.

Next, it is determined whether symbols 180 rearranged in the matrix 156 form a winning combination (C7). If the symbols 180 form a winning combination (C7: YES), a payout process is executed (C8). More specifically, when a winning combination is formed, the number of coins according to the combination is calculated. On the other hand in C7, if it is determined that no winning combination is formed (C7: NO), C11 is executed.

After the execution of the payout process in C8, the main CPU 41 determines whether a bonus game is running and whether a predetermined winning is met (C9). If a bonus game start signal is received from the center controller 200, the main CPU 41 determines that the bonus game is running. If it is determined that the bonus game is running and a predetermined winning is met (C9: YES), a winning signal is output to the center controller 200 (C10) and the process of C11 is executed. On the other hand, if it is determined that the bonus game is not running or a predetermined winning is not met (C9: NO), the process of C11 is executed.

Next, the main CPU 41 determines whether a bonus award signal is received from the center controller 200 (C11). If the main CPU 41 determines that a bonus award signal is received (C11: YES), a payout is awarded according to the bonus award signal (C12). The process then returns to C1. On the other hand in C11, if the main CPU 41 determines that no bonus award signal is received (C11: NO), the process returns to C1.

[Operation of Center Controller 200: Center Process Routine]

Figure 18:
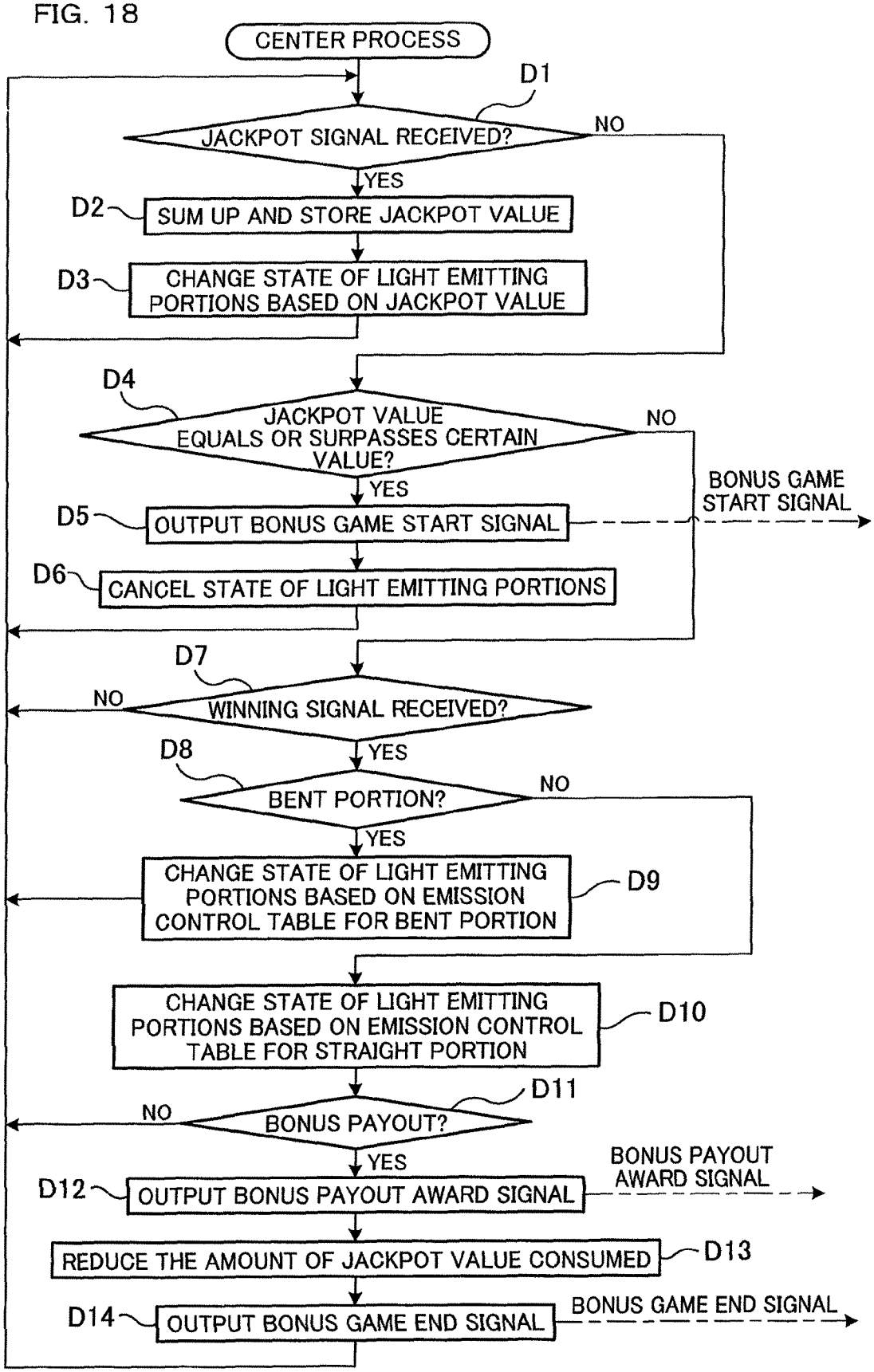
FIG. 18 is a flowchart illustrating a center process routine executed in the center controller.

After the center side initial setting routine of FIG. 16, the main CPU 241 of the center controller 200 executes a center process routine of FIG. 18. The main CPU 241 performs the center process routine to run a bonus game.

As illustrated in FIG. 18, in the center process routine, the main CPU 241 determines whether a jackpot signal is received from a gaming terminal 10 (D1). If it is determined that a jackpot signal is received (D1: YES), the game value indicated by the jackpot signal is stored cumulatively (D2), and the state of the light emitting portions 303 is changed according to the contribution of each gaming terminal 10 to the jackpot value accumulated in the jackpot storage unit 201 (D3). The process then returns to D1.

On the other hand in D1, if the main CPU 241 determines no jackpot signal is received (D1: NO), the main CPU 241 determines if the jackpot value equals or surpasses a predetermined value (D4). If it is determined that the jackpot value equals or surpasses a predetermined value (D4: YES), a bonus game start signal is output to each gaming terminal 10 (D5), and the state change in the light emitting portions 303 is cancelled (D6). Then, the process of D1 is executed.

If it is determined that the jackpot value does not equal or surpass a predetermined value (D4: NO), the main CPU 241 determines whether a winning signal is received from the terminal controller 100 (D7). If the main CPU 241 determines that a winning signal is not received (D7: NO), the process returns to D1. On the other hand, if it is determined that a winning signal is received (D7: YES), it is determined whether the winning is in the bent portion (D8). If it is determined that the winning is in the bent portion (D8: YES), the state of the light emitting portions 303 is changed toward the bonus payout indicator, based on the emission control table for the bent portion (D9). Then, the process of D1 is executed.

If it is determined that the winning is not in the bent portion (D8: NO), the state of the light emitting portions 303 is changed toward the bonus payout indicator, based on the emission control table for the straight portion (D10). In D8, the state of the light emitting portions 303 is changed based on the emission control table 305.

Then, it is determined whether a path 301 exists in which the light emitting portions 303 have undergone state changes up to the bonus payout indicator 300, so as to determine whether conditions are met for awarding a bonus payout (D11). If it is determined that conditions for awarding a bonus payout are not met (D11: NO), the process returns to D1. On the other hand, if it is determined that conditions for awarding a bonus payout are met (D11: YES), a bonus award process is executed to award a bonus payout, and a bonus award signal is output to the gaming terminal 10 subject to the bonus payout (D12). Then, the amount of jackpot value consumed is reduced from the RAM243 (D13), and a bonus game end signal is output to each gaming terminal 10 (D14). The process then returns to D1.

In this manner, a base game is run in each gaming terminal, independently from the other gaming terminals, and the payout according to a predetermined winning is awarded. Based on a predetermined condition, a bonus game is run that awards a bonus payout more rewarding than the payout awarded in the base game. Every time a predetermined winning is met in a gaming terminal, the light emitting portions are caused to undergo state changes toward the bonus payout indicator in the path corresponding to the gaming terminal in which the winning has occurred. Emission is controlled such that the number of light emitting portions that undergo state changes in the path when a winning is met is fewer in the straight portion than in the bent portion. A bonus payout is awarded in the gaming terminal corresponding to the path including the light emitting portions that underwent state changes all the way up to the bonus payout indicator. The bent portion of the paths differs between the gaming terminals, and the players cannot easily find their positions relative to the other players. However, since the paths are straight and in parallel configuration in portions from the bonus payout indicator to a predetermined position, the positions of the players become visible at a final phase of the game. This stimulates the competition between the players and makes the game more exciting. Further, since fewer numbers of light emitting portions undergo state changes in the straight portion in response to a winning, the players can compete for extended time periods in the straight portion with sustained interest.

In this manner, abase game is run in each gaming terminal, independently from the other gaming terminals, and the payout according to a predetermined winning is awarded. Based on a predetermined condition, a bonus game is run that awards a bonus payout more rewarding than the payout awarded in the base game. At the start of a bonus game, the light emitting portions assume a state that is based on the progressive value sent from their respective gaming terminals. Every time a predetermined winning is met in a gaming terminal, the light emitting portions are caused to undergo state changes toward the bonus payout indicator in a path corresponding to the gaming terminal in which the winning has occurred. Emission is controlled such that the number of light emitting portions that undergo state changes in the path when a winning is met is fewer in the straight portion than in the bent portion. A bonus payout is awarded in the gaming terminal corresponding to the path including the light emitting portions that underwent state changes all the way up to the bonus payout indicator. The bent portion of the paths differs between the gaming terminals, and the players cannot easily find their positions relative to the other players. However, since the paths are straight and in parallel configuration in portions from the bonus payout indicator to a predetermined position, the positions of the players become visible at a final phase of the game. This stimulates the competition between the players and makes the game more exciting. Further, since fewer numbers of light emitting portions undergo state changes in the straight portion in response to a winning, the players can compete for extended time periods in the straight portion with sustained interest. At the start of a bonus game, the light emitting portions assume a state that is based on the level of contribution made by the bet placed in the base game. In this way, a player making more bets in a base game is able to start a bonus game from a more advantageous position. Thus, the players play a base game with the bonus game in mind, and therefore can sustain their interest.

The foregoing described Embodiment 1 of the present invention. The present invention, however, is not limited to the embodiment described above. Another version of Embodiment 1 of the invention is also possible, as described below. The following will describe a base game in a gaming machine according to the other version of Embodiment 1 of the present invention.

Figure 19:
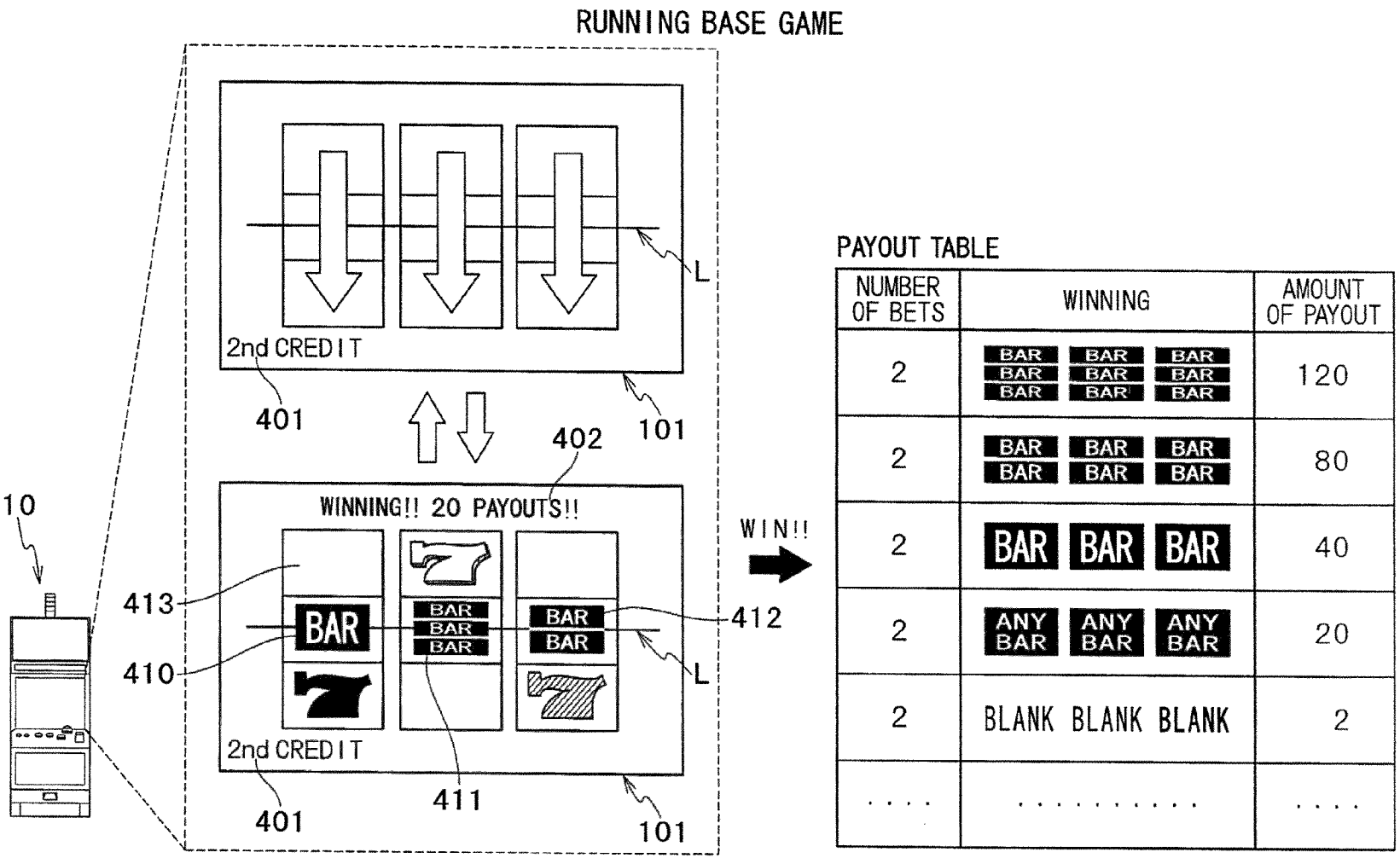
FIG. 19 is an explanatory diagram concerning a base game in a gaming machine according to another version of Embodiment 1.

A terminal display 101 according to the other version of Embodiment 1 includes arrangement areas having three rows and three columns, as shown in FIG. 19. The arrangement areas in the middle row make up the payline L. When a predetermined winning is met by the relation between the symbols rearranged in the payline L, a payout is awarded according to the winning combination. The terminal display 101 displays a credit 401 indicative of the game value bet.

In the example shown in FIG. 19, the credit 401 indicates "2st CREDIT", meaning that the game value bet is equivalent of two coins. As a result of symbol rearrangement, symbols 410, 411, and 412 are rearranged as "1BAR", "3BAR", and "2BAR", respectively, in the payline L. These symbols make "ANY-BAR" "ANY-BAR" "ANY-BAR", which is a winning combination for credit 401 equivalent of two coins. As a payout for this winning, twenty coins are awarded.

FIG. 20 is a diagram showing a base game payout table. The base game payout table is used when the main CPU 41 determines a winning in a base game, and when the main CPU 41 awards a payout according to the winning. The base game payout table contains fields for the number of bets, winning, and the amount of payout. In the field for the number of bets, the number of coins bet is shown. In the field for winning, combinations of symbols rearranged in the payline L are shown, which are conditions necessary for meeting a winning. The field for the amount of payout shows the number of coins paid out when a winning is met. An example shown in FIG. 18 is described below. When the symbols "3BAR" "3BAR" "3BAR" are rearranged in the payline L, the amount of payout is 60 when the number of bet is 1, and 120 when the number of bet is 2. When the symbols "2BAR" "2BAR" "2BAR" are rearranged in the payline L, the amount of payout is 40 when the number of bet is 1, and 80 when the number of bet is 2. When the symbols "1BAR" "1BAR" "1BAR" are rearranged in the payline L, the amount of payout is 20 when the number of bet is 1, and 40 when the number of bet is 2. When the symbols "ANY-BAR" "ANY-BAR" "ANY-BAR" are rearranged in the payline L, the amount of payout is 10 when the number of bet is 1, and 20 when the number of bet is 2. When the symbols "BLANK" "BLANK" "BLANK" are rearranged in the payline L, the amount of payout is 1 when the number of bet is 1, and 2 when the number of bet is 2. When the symbols "Blue 7" "Blue 7" "Blue 7" are rearranged in the payline L, the amount of payout is 1800 when the number of bet is 3. When the symbols "Red 7" "Red 7" "Red 7" are rearranged in the payline L, the amount of payout is 100 when the number of bet is 3. When the symbols "ANY-7" "ANY-7" "ANY-7" are rearranged in the payline L, the amount of payout is 100 when the number of bet is 3. In this manner, the amount of payout awarded when a winning is met increases as the number of bets is increased. This can increase the game value (number of bets) made by players.

In the following, description is made as to a bonus game in a gaming machine according to the other version of Embodiment 1 of the present invention. In a bonus game according to the other version of Embodiment 1, points are awarded that reflect a predetermined winning. The light emitting portions 303 undergo state changes toward the bonus payout indicator 300, in numbers based on a sum of the points awarded.

Figure 21:
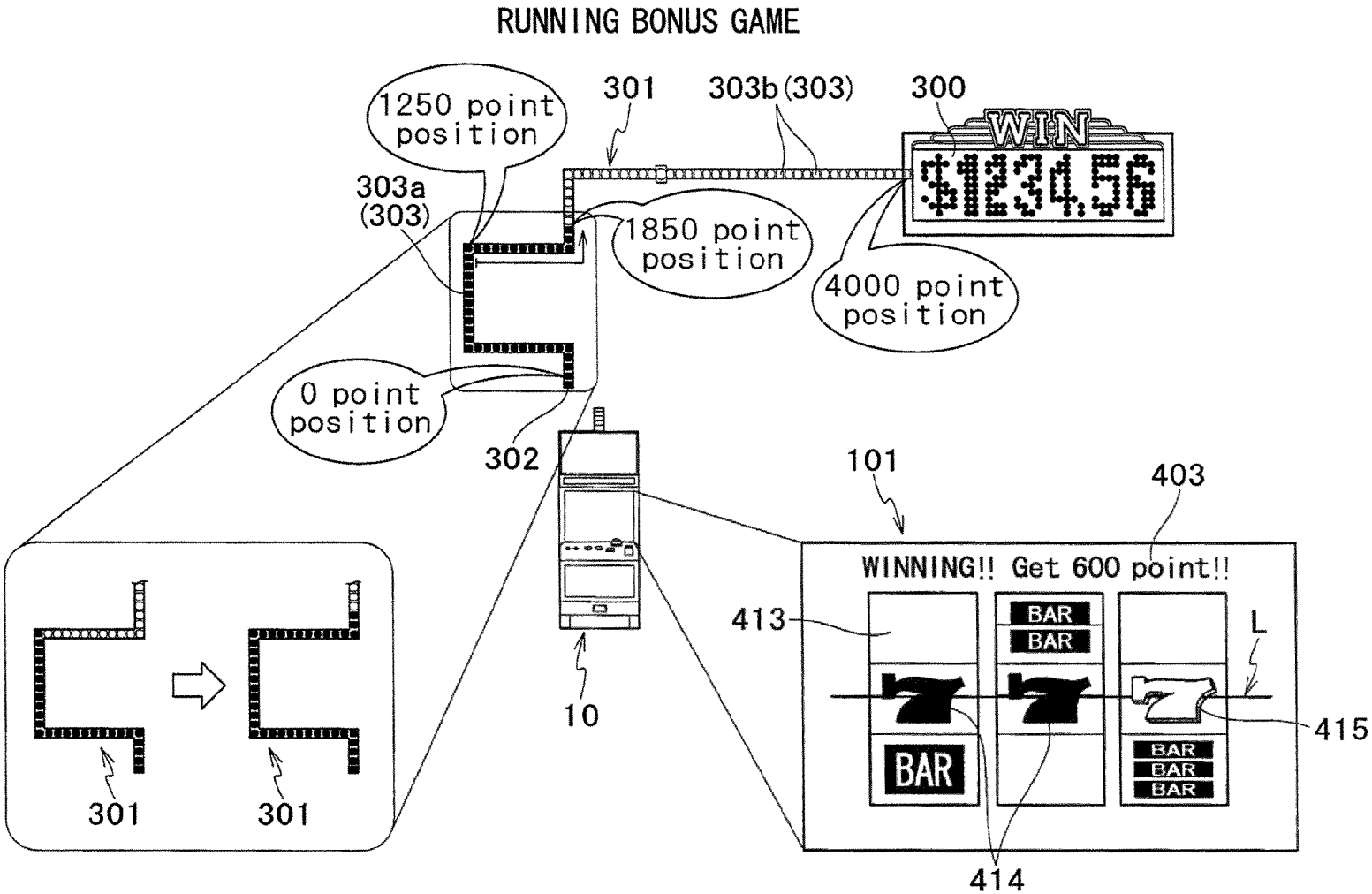
FIG. 21 is an explanatory diagram concerning a bonus game in a gaming machine according to the other version of Embodiment 1 of the present invention.

This is described below based on the example shown in FIG. 21. The position 302 corresponding to the gaming terminal 10 has an associated value of 0 point, and the position at the bonus payout indicator 300 has an associated value of 4000 points. In the gaming terminal 10, 1250 points have been awarded and accumulated, and the state of the light emitting portions 303 in the path 301 has been changed all the way up to the position corresponding to 1250 points. Here, winnings are met by the rearrangement of symbol 414, symbol 414, and symbol 415 as "Red 7", "Blue 7", and "Blue 7", respectively, in the pay line L. Three winning are met. Rearrangement of the symbols 414 in the payline L makes two winnings, and rearrangement of the symbol 415 in the payline L makes one winning. The payout for the winning met by each symbol 414 is 150 points, and the payout for the winning met by the symbol 415 is 300 points. Accordingly, the three winnings make a total payout of 600 points. Awarding 600 points to the gaming terminal 10 makes the cumulative points of 1250+600=1850 points. As a result, the light emitting portions 303 undergo state changes to the position corresponding to 1850 points. In this manner, during a bonus game, points are awarded according to a predetermined winning, and a jackpot is awarded when the points accumulate to a predetermined value (4000 points).

FIG. 22 is a diagram showing a bonus game payout table. The bonus game payout table is used when the main CPU 41 determines a winning in a bonus game, and when the main CPU 241 awards payout points according to the winning. The bonus game payout table contains fields for winning and payout points. In the field for winning, combinations of symbols rearranged in the payline L are shown, which are conditions necessary for meeting a winning. The field for payout points indicates the number of points paid out when a winning is met. This is described below based on the example shown in FIG. 22. When symbols "Blue 7" "Blue 7" "Blue 7" are rearranged in the payline L, 7000 points are paid out. When a symbol "Blue 7" is rearranged in the payline L, 300 points are paid out. When a symbol "Red 7" is rearranged in the payline L, 150 points are paid out. When a symbol "3BAR" is rearranged in the payline L, 30 points are paid out. When a symbol "2BAR" is rearranged in the payline L, 20 points are paid out. When a symbol "1BAR" is rearranged in the payline L, 10 points are paid out.

The foregoing described a gaming machine according to the other version of Embodiment 1 of the present invention. In a gaming machine according to yet another version of Embodiment 1 of the present invention, a bonus game is started when the accumulated jackpot value surpasses a certain value. However, the invention is not limited to this example. For example, the gaming machine may be adapted so that the threshold jackpot value triggering the bonus game is varied at random within a predetermined range (for example, $200 to $300) for each bonus game.

In yet other version of Embodiment 1 of the present invention, the gaming machine is described that awards a jackpot when the awarded points have accumulated to a predetermined value (for example, a fixed value of $200). However, the invention is not limited to this example. For example, the gaming machine may be adapted so that the threshold accumulated value for awarding a jackpot is varied at random within a predetermined range (for example, 3000 to 5000 points) for each bonus game.

The gaming machine may be configured so that any value can be selected and set for the points required to award a jackpot in the gaming terminal. Specifically, in the gaming machine, the points required to award a jackpot may be selected from externally input values (for example, selection from 3000 points, 4000 points, and 5000 points).

Embodiment 2

The following describes Embodiment 2 of a gaming machine and a playing method thereof according to the present invention. Note that reference numerals respectively given to members in the figures referred to in this embodiment, reference symbols (such as "S") respectively representing steps in flowcharts in the figures, and description using these reference numerals and reference symbols are effective only in this embodiment. Each of these numerals and symbols does not represent a member or step in other embodiments.

Figure 23:
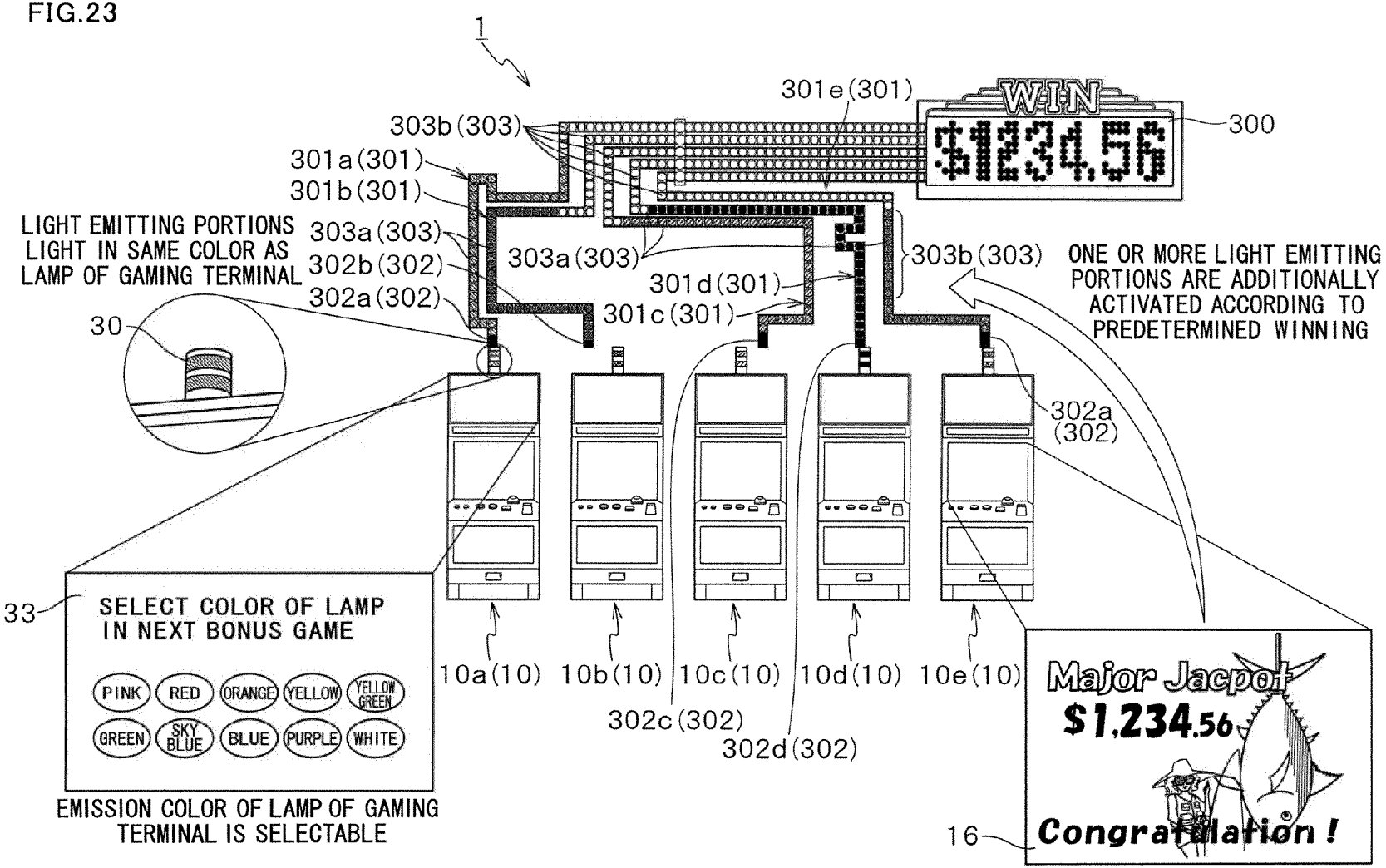
FIG. 23 is an explanatory diagram illustrating a gaming machine and a playing method thereof, according to Embodiment 2 of the present invention.

As illustrated in FIG. 23, a playing method of the present invention is carried out by a gaming machine 1 including: a plurality of gaming terminals 10 each having a lamp 30 which is activated to light; a bonus payout display unit 300 which displays an effect image; a plurality of path units 301 respectively associated with the plurality of gaming terminals 10, each of the path units 301 having one end provided to a nearby portion of associated one of the gaming terminals 10, and the other end provided to a nearby portion of the bonus payout display unit 300, wherein the each of the path units 301 has a plurality of light emitting portions 303 aligned along the path unit 301, and is capable of lighting in the same color as the lamp 30 of the associated gaming terminal. The playing method carried out by such gaming machine 1 in each of the gaming terminals 10 includes the steps of: activating the lamp 30 to light in a predetermined color, running a base game independently of another gaming terminal 10, and awarding a payout according to a predetermined winning; running a bonus game configured to award a bonus payout greater than a payout awarded in the base game; when each time a winning is resulted in the gaming terminal 10, additionally activating one or more light emitting portions 303 of the associated one of the path units 301 according to a predetermined winning, sequentially from one end of the path unit 301 closer to the gaming terminal 10, so as to light in the same color as the lamp 30 of the gaming terminal 10; and when the path unit 301 is activated up to a light emitting portion 303 at an end of the path unit 301 closer to the bonus payout display unit 300, awarding a bonus payout through the gaming terminal 10.

Figure 24:
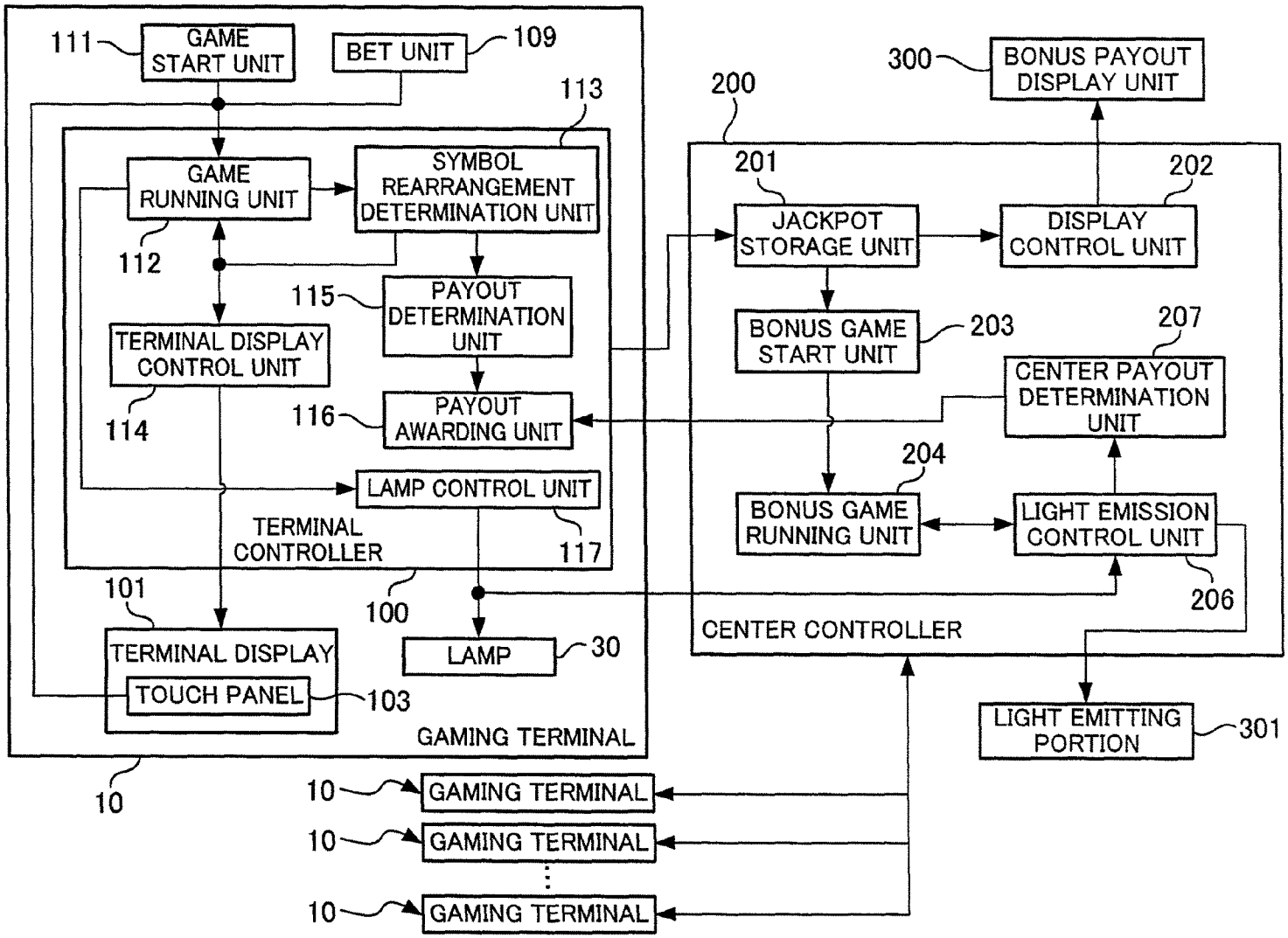
FIG. 24 is a block diagram of the gaming machine.

As illustrated in FIG. 24, the gaming machine 1 which executes the above playing method has the bonus payout display unit 300, a center controller 200, the gaming terminals 10, and the path units 301. Each of the gaming terminals 10 has a lamp 30, a terminal display 101, a touch panel 103 as an input device, and a terminal controller 100.

The lamp 30 has an LED (light-emitting diode), and is controlled to light in plural colors. The lamp 30 turns off when not activated, and turns on when activated.

Figure 25:
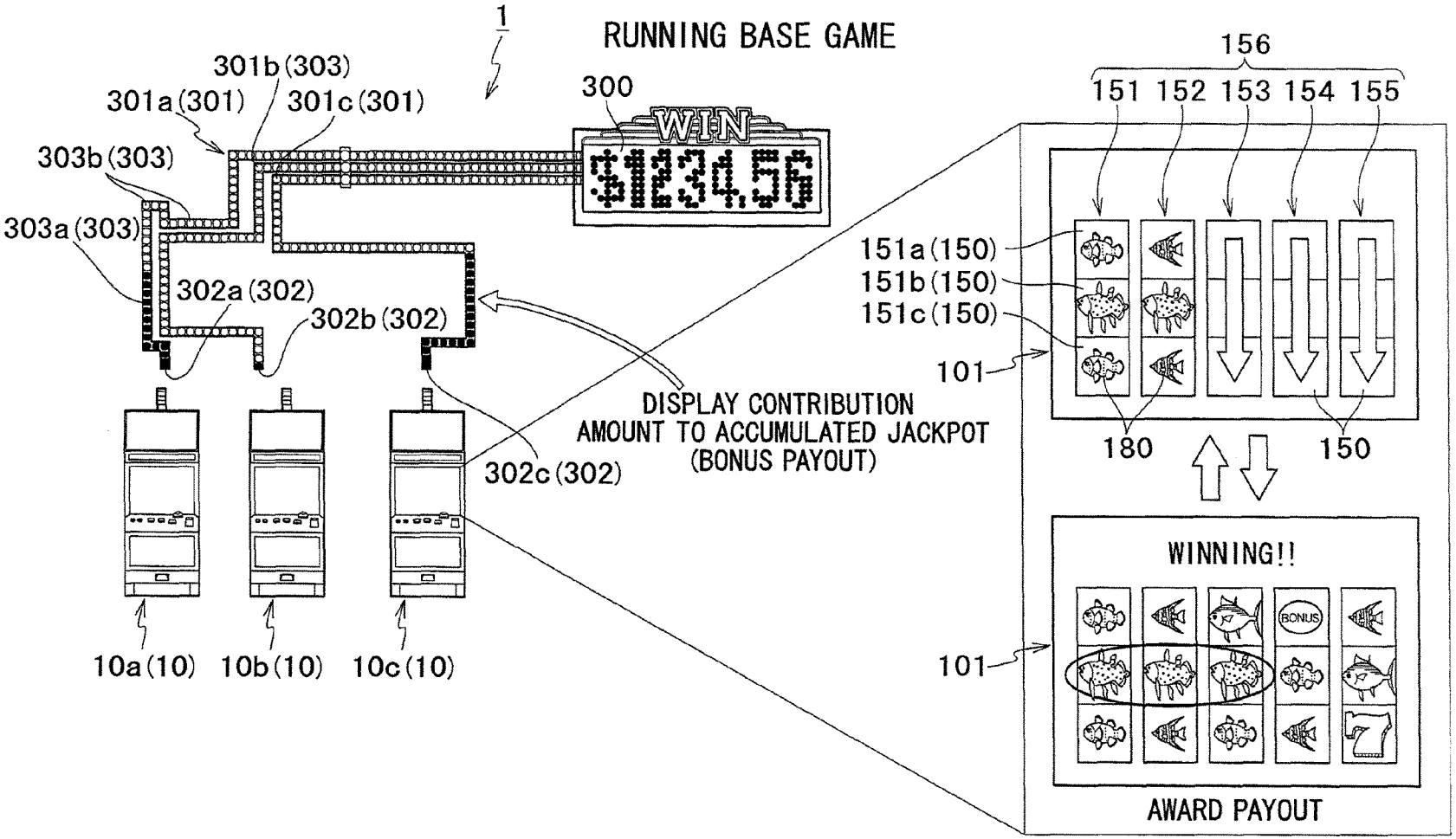
FIG. 25 is an explanatory diagram of a base game.

As illustrated in FIG. 25, the terminal display 101 has arrangement areas 150, and symbols 180 are arranged in the arrangement areas 150.

The "arranging" in this specification means a state where the symbols 180 can be visually observed by a player. That is, the wording means a state where the symbols 180 are displayed in the arrangement areas 150, in FIG. 23. Arranging the symbols 180 again after releasing the symbols 180 is referred to as "rearranging".

The terminal display 101 may have a mechanical structure adopting a reel device which rotates a reel to arrange the symbols 180. Alternatively, the terminal display 101 may have an electric structure in which a video reel is displayed as an image and symbols 180 on the video reel are arranged in the form of an image. Further, the terminal display 101 may adopt a combination of the mechanical structure (reel) and the electrical structure (video reel). Examples of the electrical structure include a liquid crystal display device, a CRT (cathode-ray tube), a plasma display device, or the like. Further, the number of arrangement areas 150 is not limited. A specific structure of the terminal display 101 will be detailed later.

The touch panel 103 functions as an input device capable of receiving an input from outside. The touch panel 103 is provided on the terminal display 110. Note that an input device is not limited to the touch panel 103. A button or a pointing device may be applied as an input device.

The bonus payout display unit 300 displays an amount of a bonus payout to be awarded in the bonus game. An example shown in FIG. 25 illustrates that an amount of a progressive jackpot is $1,234.56. The bonus payout display unit 300 has an arrangement of a plurality of LEDs as illuminants in Embodiment 2; however, the bonus payout display unit 300 may be one liquid crystal display. Note that an illuminant is not limited to an LED, as long as the illuminant emits light.

The path units 301 are respectively associated with the gaming terminals 10. Specifically, each of the path units 301 having an alignment of light emitting portions 303 has one end provided to a nearby portion of associated one of the gaming terminals 10, and the other end provided to a nearby portion of the bonus display unit 300. That is, one path unit 301 has light emitting portions 303 aligned to form a path from the associated gaming terminal 10 to the bonus payout display unit 300.

Further, the light emitting portions 303 of one path unit 301 are activated to light in the same color as the lamp 30 of the associated gaming terminal 10.

An example shown in FIG. 25 illustrates that a path unit 301*a* forms a path from a position 302*a* of a nearby portion of a gaming terminal 10*a* to the bonus payout display unit 300. Likewise, a path unit 301*b* forms a path from a position 302*b* of a nearby portion of a gaming terminal 10*b* to the bonus payout display unit 300. Other path units 301*c* to 301*j* are formed in the same manner. Thus, the path units 301 are respectively associated with the gaming terminals 10.

Each of the light emitting portions 303 is an LED (light-emitting diode), and controlled to light in plural colors. The each of the light emitting portions 303 turns off when inactivated, and turns on when activated. In FIG. 25, activated light emitting portions 303 are shown as light emitting portions 303*a*, and inactivated light emitting portions 303 as light emitting portions 303*b*. The light emitting portions 303 are controlled to be sequentially activated from the light emitting portion 303 of one end of one path unit closer to the associated one of the gaming terminals 10, to the light emitting portion 303 of the other end of the path unit closer to the bonus payout display unit 300. That is, the path unit 301 is controlled so that one or more of the light emitting portions 303 are additionally activated sequentially from the gaming terminal 10 to the bonus payout display unit 300.

Further, as mentioned above, the activated light emitting portions 303 of the path unit 301 are controlled to light in the same color as the lamp 30 of the associated gaming terminal 10.

Note that a light emitting portion 303 is not limited to an LED as long as the light emitting portion 303 emits light. Further, activation of a light emitting portion 303 is not limited to turning on the light emitting portion 303. The activation may be blinking the light emitting portion 303 or the like.

(Terminal Controller 100)

The terminal controller 100 of each of the gaming terminals 10 is configured to execute: a first process of activating the lamp 30 to light in a predetermined color; a second process of running a base game independently of another gaming terminal 10, and awarding a payout according to a predetermined winning; and a third process of awarding a bonus payout based on a command from the center controller 200. In other words, the terminal controller 100 has a first processing unit, a second processing unit, and a third processing unit.

The terminal controller 100 is connected to the center controller 200 and is in communication with the center controller 200.

As illustrated in FIG. 24, the terminal controller 100 is connected to a game starting unit 111. The game starting unit 111 has a function of outputting a game start signal in response to an operation by a player. The game start signal output is then input to a later-described game running unit 112.

Further, the terminal controller 100 is connected to a bet unit 109. The bet unit 109 has functions of receiving a bet entered through an operation by the player, and outputting a BET signal in response to the bet entered. The BET signal output is input to a later-described game running unit 112.

The terminal controller 100 is connected to the touch panel 103. The touch panel 103 has functions of receiving a player's input therethrough, and outputs an input signal in response to the input. The bet signal output is input to a later-described game running unit 112.

The terminal controller 100 has a game running unit 112, a symbol rearrangement determination unit 113, and a terminal display control unit 114. The game running unit 112 runs a base game, triggered by a game start signal from the game starting unit 111. In the base game, symbols 180 are rearranged in the arrangement areas 150 of the terminal display 101. Further, the terminal controller 100 outputs a progressive signal, triggered by the game start signal. The progressive signal indicates a game value.

Further, the progressive signal indicates a part of a game value entered as a bet through a player's operation. The progressive signal is transmitted to a later-described jackpot storage unit 201. A game value indicated by the progressive signal is stored and summed up as a contribution amount, associated with each of the gaming terminal 10 having transmitted the progressive signal.

The symbol rearrangement determination unit 113 determines, based on the state of game run by the game running unit 112, symbols 180 to be rearranged in the arrangement areas 150.

The terminal display control unit 114 displays the symbols 180 on the terminal display 101 under control of the game running unit 112 and on the basis of a determination of the symbol rearrangement determination unit 113. A specific display state will be detailed later.

Further, the terminal controller 100 has a payout determination unit 115 and a payout awarding unit 116. The payout determination unit 115 determines whether or not to award a payout, based on a relation among the symbols 180 rearranged in the arrangement areas 150 of the terminal display 101. The payout awarding unit 116 awards a payout on the basis of a determination of the payout determination unit 115. In short, the payout determination unit 115 determines whether a predetermined winning is resulted. The payout awarding unit 116 awards a payout on the basis of a determination of the payout determination unit 115. Further, the payout awarding unit 116 awards a payout based on a command from the center controller 200.

The terminal controller 100 has a lamp control unit 117. The lamp control unit 117 controls, based on a command from the game running unit 112, turning on and off of the lamp 30, and an emission color of the lamp 30. Note that a preferable control of an emission color of the lamp 30 is, for example, in response to a player's input through the touch panel 103. However, the control is not limited to this.

Meanwhile, each block of the terminal controller 100 may be realized with hardware or with software as needed.

(Operation of Terminal Controller 100)

The following describes an operation of the terminal controller 100 in the above structure. First, the game running unit 112 receives an emission color selection authorization signal transmitted from the center controller 200 at a timing of, for example, when a bonus game ends. The emission color selection authorization signal is transmitted to the terminal controller 100 and another terminal controller 100 in descending order of a contribution amount stored in the jackpot storage unit 201. The game running unit 112 of the terminal controller 100 having received the emission color selection authorization signal performs control to allow an input through the touch panel 103. Thus, the terminal controller 100 executes the first process of allowing the gaming terminal 10 to receive an input through the touch panel 103 at a timing such that the gaming terminal 10 and another gaming terminal 10 receive an input in descending order of the contribution amount of each of the gaming terminals 10 stored in the jackpot storage unit 201.

The lamp control unit 117 performs control to activate the lamp 30 to light in a color associated with an input through the touch panel 103, based on a control signal from the game running unit 112. Thus, the game terminal controller 100 executes the second process of activating the lamp 30 to light in a color associated with an input through the touch panel 103, at a predetermined timing.

Note that activation of the lamp 30 to light in a predetermined color is not limited to the above operation. In other words, for instance, an emission color of the lamp 30 may be randomly determined for each bonus game, or the lamp 30 may be activated to light in a color which is set in advance.

The bet unit 109 receives a bet entered through an operation by a player. Then, in response to the operation, the game starting unit 111 outputs a game start signal to cause the game running unit 112 to start a base game. When the base game is started, the symbol rearrangement determination unit 113 determines symbols 180 to be rearranged in the arrangement areas 150. The symbols 180 determined by the symbol rearrangement determination unit 113 undergo an image processing in the terminal display control unit 114, and are displayed on the terminal display 101. The terminal display control unit 114 rearranges the symbols 180 in the arrangement areas 150, according to the arrangement determined.

The payout determination unit 115 determines whether a predetermined winning has been resulted, based on a relation among the symbols 180 rearranged in the arrangement areas 150. When it is determined that a predetermined winning has been resulted, the payout awarding unit 116 awards a payout. Thus, the terminal controller 100 of the gaming terminal 10 executes the third process of, running a base game which awards a payout according to a predetermined winning, independently of another gaming terminal 10, and awarding a payout according to a predetermined winning.

Further, when a predetermined winning is resulted, the terminal controller 100 transmits, to the center controller 200, a winning signal indicating that a predetermined winning has been resulted, based on a predetermined condition that a bonus game as a shared game is being run, or the like.

The payout awarding unit 116 awards a bonus payout when receiving a command from the center controller 200 to award a bonus payout. Thus, the terminal controller 100 executes the fourth process of awarding a bonus payout based on a command from the center controller 200.

(Center Controller 200)

The center controller 200 is configured to execute: a fifth process of running a bonus game configured to award a bonus payout greater than a payout awarded in a base game, based on a predetermined condition; a sixth process of additionally activating one or more of the light emitting portions 303 of one path unit 301 according to a predetermined winning, sequentially from one end of the path unit 301 closer to the associated gaming terminal 10 so as to light in the same color as the lamp 30 of the gaming terminal 10; a seventh process of, when the path unit 301 is activated up to a light emitting portion 303 at an end of the path unit 301 closer to the bonus payout display unit 300, commanding the terminal controller 100 of the gaming terminal 10 associated with the path unit 301 to award a bonus payout. In other words, the center controller 200 has a fifth processing unit, a sixth processing unit, and a seventh processing unit.

As illustrated in FIG. 24, the center controller 200 is connected to the terminal controller 100 and is in communication with the terminal controller 100.

The center controller 200 has the jackpot storage unit 201, a display control unit 202, a bonus game start unit 203, a bonus game running unit 204, a light emission control unit 206, and a center payout determination unit 207.

The jackpot storage unit 201 stores and sums up a game value indicated by a progressive signal received from the terminal controller 100. As described above, the jackpot storage unit 201 stores and sums up a part of game value entered as a bet indicated by the progressive signal, as a contribution amount associated with the gaming terminal 10. Note that the sum of the contribution amount is a jackpot value. A part of or the entire jackpot value is awarded as a bonus payout. The bonus game starting unit 203 outputs a bonus game start signal, when the predetermined condition is met. The game start signal output is then input to a later-described bonus game running unit 204. An example of meeting the predetermined condition is a situation where a game value stored in the jackpot storage unit 201 sums up to a predetermined value or greater.

The bonus game running unit 204 runs a bonus game where players compete against one another for a jackpot, triggered by a bonus game start signal received from the bonus game start unit 203.

The display control unit 202 displays, on the bonus payout display unit 300, the sum of the value of the jackpot stored in the jackpot storage unit 201.

The light emission control unit 206 activates, based on a control signal from the bonus game running unit 204, one or more of the light emitting portions 303 in the same color as the lamp 30 of the associated gaming terminal 10. The light emission control unit 206 may activate the one or more light emitting portions 303 so as to indicate the contribution amount of the gaming terminal 10 stored in the jackpot storage unit 201, in a form of the number of the light emitting portions 303 activated.

The center payout determination unit 207 determines, for each of the path units 301, whether the light emitting portions 303 are activated up to the bonus payout display unit 300. When the center payout determination unit 207 determines that the light emitting portions 303 of a path unit 301 are activated up to the bonus payout display unit 300, the center payout determination unit 207 commands the terminal controller 100 of the game terminal 10 associated with the path unit 301 to award a bonus payout.

Meanwhile, each block of the center controller 200 may be realized with hardware or with software as needed.

(Operation of Center Controller 200)

The following describes an operation of the center controller 200 in the above structure. First, a game value is stored and summed up in the jackpot storage unit 201 as a contribution amount associated with each of the game terminals 10. A bonus game is started based on a predetermined condition. Thus, the center controller 200 executes the fifth process of running a bonus game configured to award a bonus payout greater than the payout awarded in the base game, based on a predetermined condition.

The center controller 200 receives a winning signal from the terminal controller 100 each time a predetermined winning is resulted in a gaming terminal 10. When the center controller 200 receives a winning signal, the bonus game running unit 204 determines, based on a predetermined winning, the number of the light emitting portions 303 to be activated. Then, the light emission control unit 206 activates the determined number of light emitting portions 303 in addition to the one or more light emitting portions 303 which have been activated. Thus, the center controller 200 executes the sixth process of, when each time a predetermined winning is resulted in a gaming terminal 10, additionally activating one or more of the light emitting portions 303 of the associated path unit 301 according to a predetermined winning, sequentially from one end of the path unit closer to the gaming terminal 10 so as to light in the same color as the lamp 30 of the gaming terminal 10.

When the light emitting portions 303 light up to the bonus payout display unit 300, the center payout determination unit 207 commands the terminal controller 100 of the gaming terminal 10 associated with the path unit 301 to award a bonus payout. Thus, the center controller 200 executes the seventh process of, when a path unit 301 is activated up to a light emitting portion 303 at an end of the path unit 301 closer to the bonus payout display unit 300, commanding the terminal controller 100 of the gaming terminal 10 associated with the path unit 301 to award a payout.

As illustrated above, the gaming machine 1 includes: a plurality of gaming terminals 10 each having a lamp 30 which is activated to light; a bonus payout display unit 300 which displays an effect image; a plurality of path units 301 respectively associated with the plurality of gaming terminals 10, each of the path units 301 having one end provided to a nearby portion of associated one of the gaming terminals 10, and the other end provided to a nearby portion of the bonus payout display unit 300, wherein the each of the path units 301 has a plurality of light emitting portions 303 aligned along the path unit 301, and is capable of lighting in the same color as the lamp 30 of the associated gaming terminal 10. Such gaming machine 1 realizes, in each of the gaming terminals 10, a playing method including the steps of: activating the lamp 30 to light in a predetermined color, running a base game independently of another gaming terminal 10, and awarding a payout according to a predetermined winning; running a bonus game configured to award a bonus payout greater than a payout awarded in the base game; when each time a winning is resulted in a gaming terminal 10, additionally activating one or more light emitting portions 303 of the associated one of the path units 301 according to a predetermined winning, sequentially from one end of the path unit 301 closer to the gaming terminal 10, so as to light in the same color as the lamp 30 of the gaming terminal 10; and when the path unit 301 is activated up to a light emitting portion 303 at an end of the path unit 301 closer to the bonus payout display unit 300, awarding a bonus payout through the gaming terminal 10.

According to the playing method, the lamp 30 of each of the gaming terminals is activated to light in a predetermined color. A base game is run in the each of the gaming terminals 10 independently of another gaming terminal 10, and a payout according to a predetermined winning is awarded. Further, a bonus game is run based on a predetermined condition. For the each of the gaming terminals 10, one or more light emitting portions 303 of associated one of the path units 301 are additionally activated according to a predetermined winning, sequentially from one end of the path unit 301 closer to the associated gaming terminal 10, so as to light in the same color as the lamp 30 of the gaming terminal 10, each time a winning is resulted in the gaming terminal 10. When the path unit 301 is activated up to the light emitting portions 303 at an end of the path unit 301 closer to the bonus payout display unit 300, a bonus payout is awarded through the gaming terminal 10 associated with the path unit 301.

Thus, a path unit 301 is activated to light in the same color as the lamp 30 of the associated gaming terminal 10. As a result, the gaming terminals 10 are respectively associated with the path units 301. This realizes a new entertainment characteristic.

The above playing method of the gaming machine 1 may further include the step of activating the lamp 30 in a color determined for each bonus game. Thus, an emission color of the light emitting portions 303 is determined in addition to the emission color of the lamp 30. This realizes a new entertainment characteristic.

The above playing method of the gaming machine 1 may further include the steps of: allowing each of the gaming terminals 10 to receive an input through the touch panel 103 at a timing such that the gaming terminals 10 receive an input in descending order of a contribution amount of the each of the gaming terminals 10 stored in the jackpot storage unit 201; and activating the lamp 30 to light in a color according to an input through the touch panel 103, at a predetermined timing. Thus, an emission color of the light emitting portions 303 in addition to the emission color of the lamp 30 are determined according to an input through the touch panel 103. Further, an emission color of the lamp 30 and an emission color of the one or more light emitting portions 303 associated are determined in descending order of the contribution amount to the bonus payout. Thus, it is possible to provide a new entertainment characteristic.

(Running Base Game)

The following specifically describes an example of a base game of the gaming machine and the playing method thereof. Note that the following example deals with a case where the terminal display 101 adopts a video reel and arranges symbols on a video reel, as illustrated in FIG. 25.

As illustrated in FIG. 25, a matrix 156 is in the center of the terminal display 101. The matrix 156 includes a symbol column having symbols 180 which is scroll-displayed. The display windows 151 to 155 are respectively divided into upper stages 151*a* to 155*a*, central stages 151*b* to 155*b*, and lower stages 151*c* to 155*c*. The symbols 180 are stopped (arranged) in the stages 151*a* to 155*a*, 151*b* to 155*b*, and 151*c* to 155*c*, respectively. The matrix 156 is a symbol matrix including five columns/three rows. The matrix 156 however is not limited to the one with five-columns/three-rows.

As is illustrated in FIG. 25, the terminal display 101 variably displays symbols 180 when a base game is started in the gaming terminal 10. When this variable-displaying of symbols 180 stops, symbols 180 are rearranged in the arrangement areas 150. A winning is resulted based on a relation among the symbols 180, and a payout according to the winning is awarded.

Note that a part of a bet entered by a player is accumulated, associated with each of the gaming terminals 10, each time a bonus game is started. A jackpot value, which is a sum of the accumulated contribution amount, is displayed on the bonus payout display unit 300, as illustrated in FIG. 25. Further, one or more light emitting portions 303 of the path unit 301 may be activated in accordance with the amount of the accumulated distribution amount to the jackpot.

(Running Bonus Game)

The following specifically describes an example of a bonus game of the gaming machine 1 and the playing method thereof.

When an accumulated jackpot value exceeds a certain amount, a bonus game is started. Symbols 180 are rearranged in the matrix 156 in each of the gaming terminals 10 during the bonus game. When a winning is resulted in a gaming terminal 10 with the rearranged symbols 180, the number of the light emitting portions 303 of the associated path unit 301 corresponding to the winning are activated. These operations are repeated until the light emitting portions 303 of any one of the path units 301 are activated up to the bonus payout display unit 300.

Figure 26:
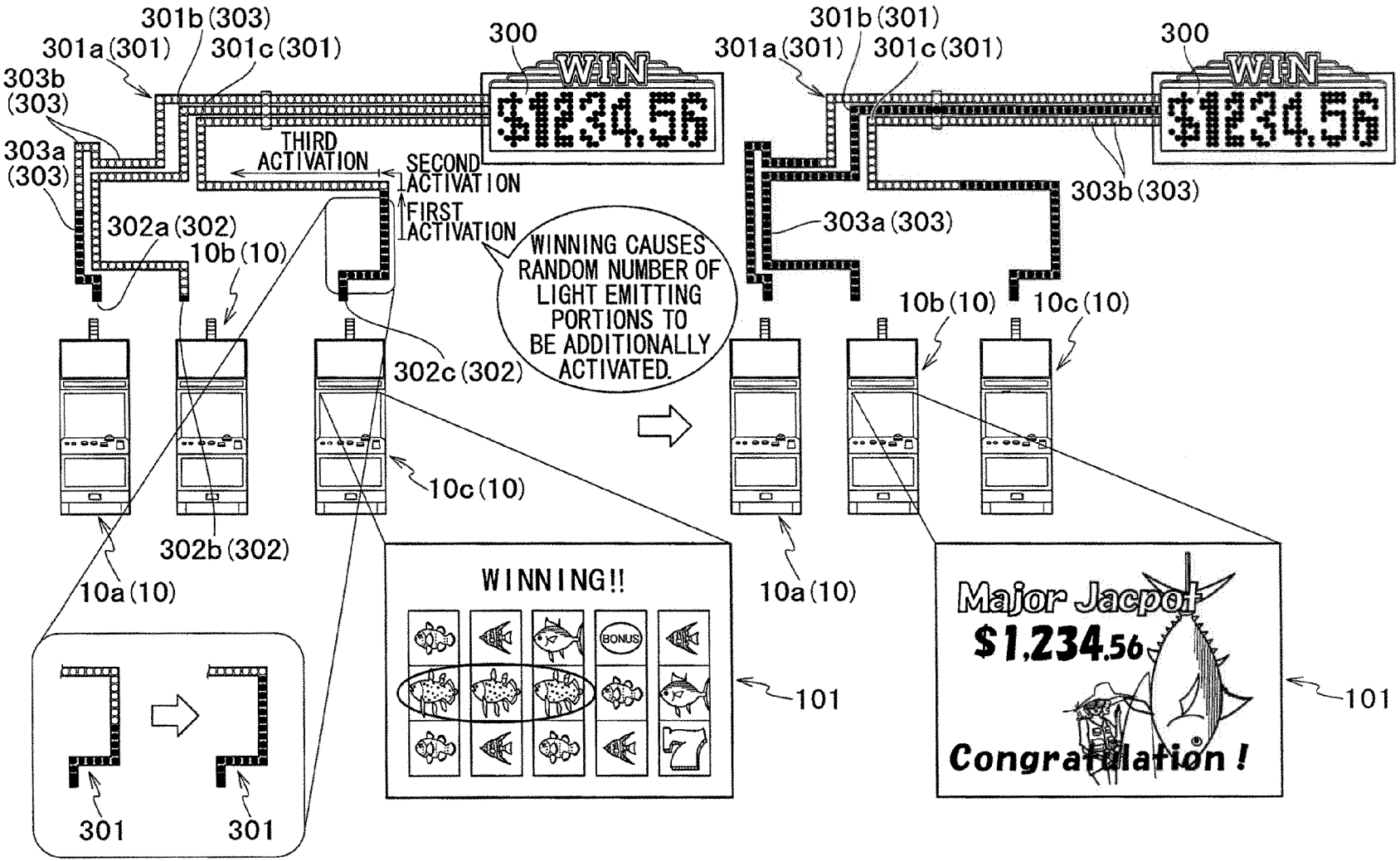
FIG. 26 is an explanatory diagram of a bonus game.

As illustrated in FIG. 26, for instance, when a predetermined winning is resulted in the gaming terminal 10*c* (10), six additional light emitting portions 303 are activated. Then, when another winning is resulted in the same gaming terminal 10*c* (10), one additional light emitting portion 303 is activated. Then, when yet another predetermined winning is resulted in the same gaming terminal 10*c* (10), eighteen additional light emitting portions 303 are activated. Thus, the number of light emitting portions 303 corresponding to a winning are activated towards the bonus payout display unit 300 each time a winning is resulted.

When the light emitting portions 303 of a path unit 301 are activated up to the bonus payout display unit 300, a jackpot as a bonus payout is awarded through the gaming terminal 10 associated with the path unit 301. In the example illustrated in FIG. 26, a jackpot is awarded through the gaming terminal 10*b* (10) associated with the path unit 301*b* (301) whose light emitting portions 303 are activated up to the bonus payout display unit 300.

(Symbol, Combination, or the Like)

A terminal display 101 has a matrix 156 including symbol columns each having twenty two symbols 180 as illustrated in FIG. 29. To each of the symbols constituting the columns is given one of code numbers 0 to 21. Each symbol column has a combination of symbols of "Angelfish," "Clownfish," "7," "Tuna," "Coelacanth," and "Bonus."

Of the symbols in the symbol columns, the display windows 151 to 155 each displays (arranges) three successive symbols. The symbols arranged in the upper stages 151*a* to 155*a*, the central stages 151*b* to 155*b*, and the lower stages 151*c* to 155*c* form a symbol matrix having five columns and three rows. When a bet button and a start button are sequentially pressed in this order to start a game, symbols constituting the symbol matrix start scrolling. This scrolling of the symbols stops (rearrangement) after a predetermined period from the beginning of the scrolling.

Further, for each symbol, a predetermined scatter symbol is determined in advance. Scatter symbols are such symbols that a player is put in an advantageous position when a predetermined number or more of them are displayed in the matrix 156. For example, the advantages includes: a state where coins corresponding to the scatter symbols are paid out, a state where the number of coins to be paid out is added to a credit, a state where a bonus game is started.

To be more specific, when three or more symbols of "BONUS" are rearranged in the matrix 156, a bonus is triggered and a gaming state shifts from a base game to a bonus game. Further, when four or more symbols of "BONUS" are displayed in the matrix 156, twenty coins (game medium) are paid out for one bet.

Here, a bonus game is a gaming state which provides a larger advantage than a base game. In Embodiment 2, the bonus game is a jackpot game. No particular limitation is put on the bonus game, as long as it is a gaming state advantageous to the player, that is, it is more advantageous than the base game. For example, the bonus game may include a state where more game media are obtainable than in the base game, a state where a game medium is obtainable with higher probability than in the base game, a state where a game medium is less consumed than in the base game, and the like. The free game is a game allowing a player to play a game a predetermined number of times without betting a coin.

(Mechanical Structure of Gaming Machine 1)

Next, the following describes a specific example of mechanical and electrical structures of the gaming machine 1 thus structured.

A gaming machine 1 is placed in a gaming facility such as a casino. This gaming machine 1 runs a unit game which involves a game medium. The game medium is a coin, bill, or a value in the form of electronic information. However, the game medium in the present invention is not particularly limited. For example, a medal, token, electronic money, ticket or the like are also possible. Further, the ticket is not particularly limited and may be a later-described ticket with a barcode or the like ticket.

Figure 27:
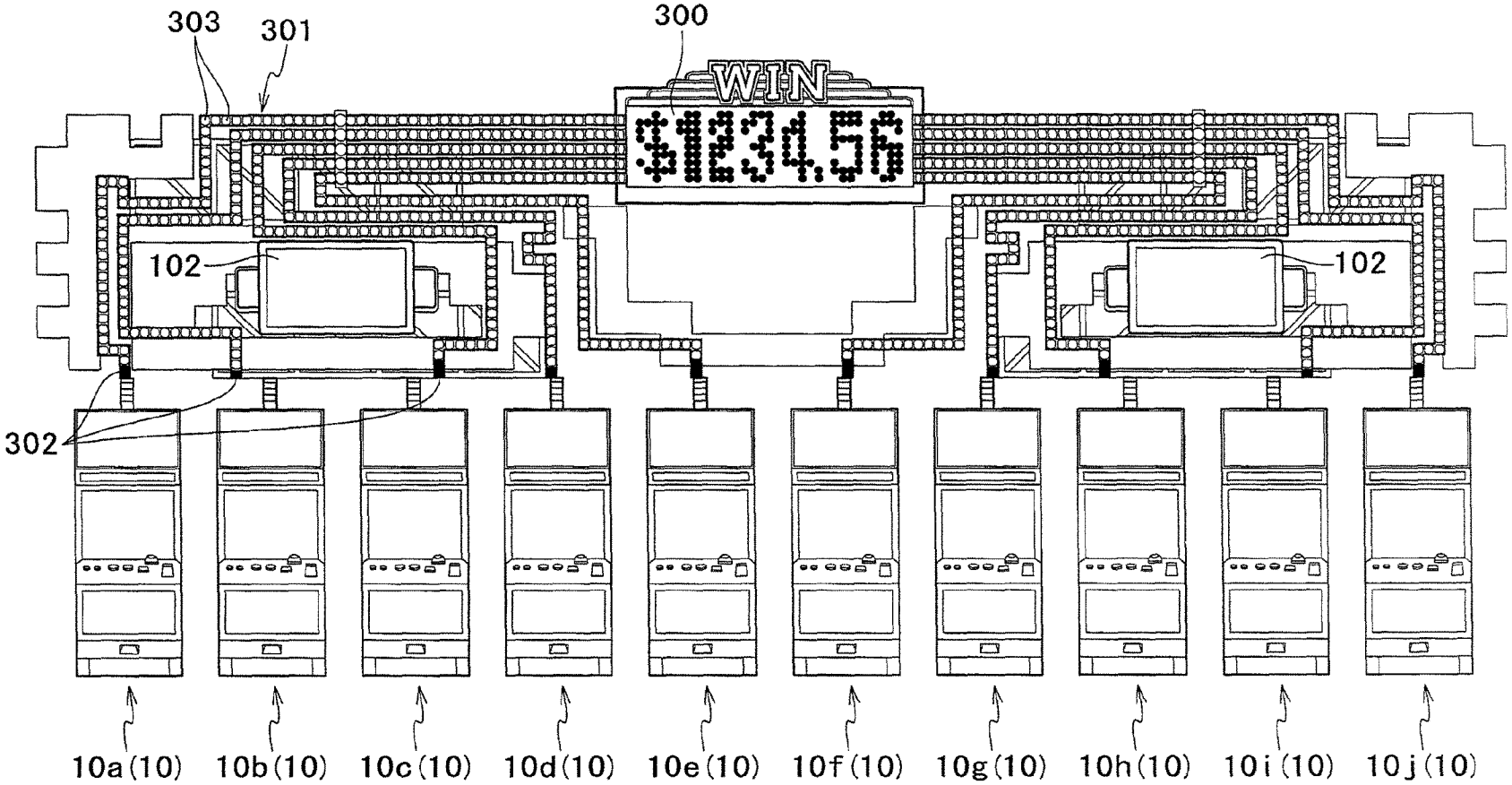
FIG. 27 is a front view illustrating an external appearance of the gaming machine.

As illustrated in FIG. 27, the gaming machine 1 has: gaming terminals 10 which runs a base game independently of one another; a center controller 200 which runs a bonus game, is connected to the gaming terminals 10 and is in communication with the gaming terminals 10; a bonus payout display unit 300 which displays an amount of a bonus payout awarded in a bonus game; path units 301 respectively associated with the gaming terminals 10, each path unit 301 having light emitting portions 303 aligned to form a path from a corresponding position 302 allotted to the associated one of the gaming terminals 10 to the bonus payout display unit 300.

Figure 28:
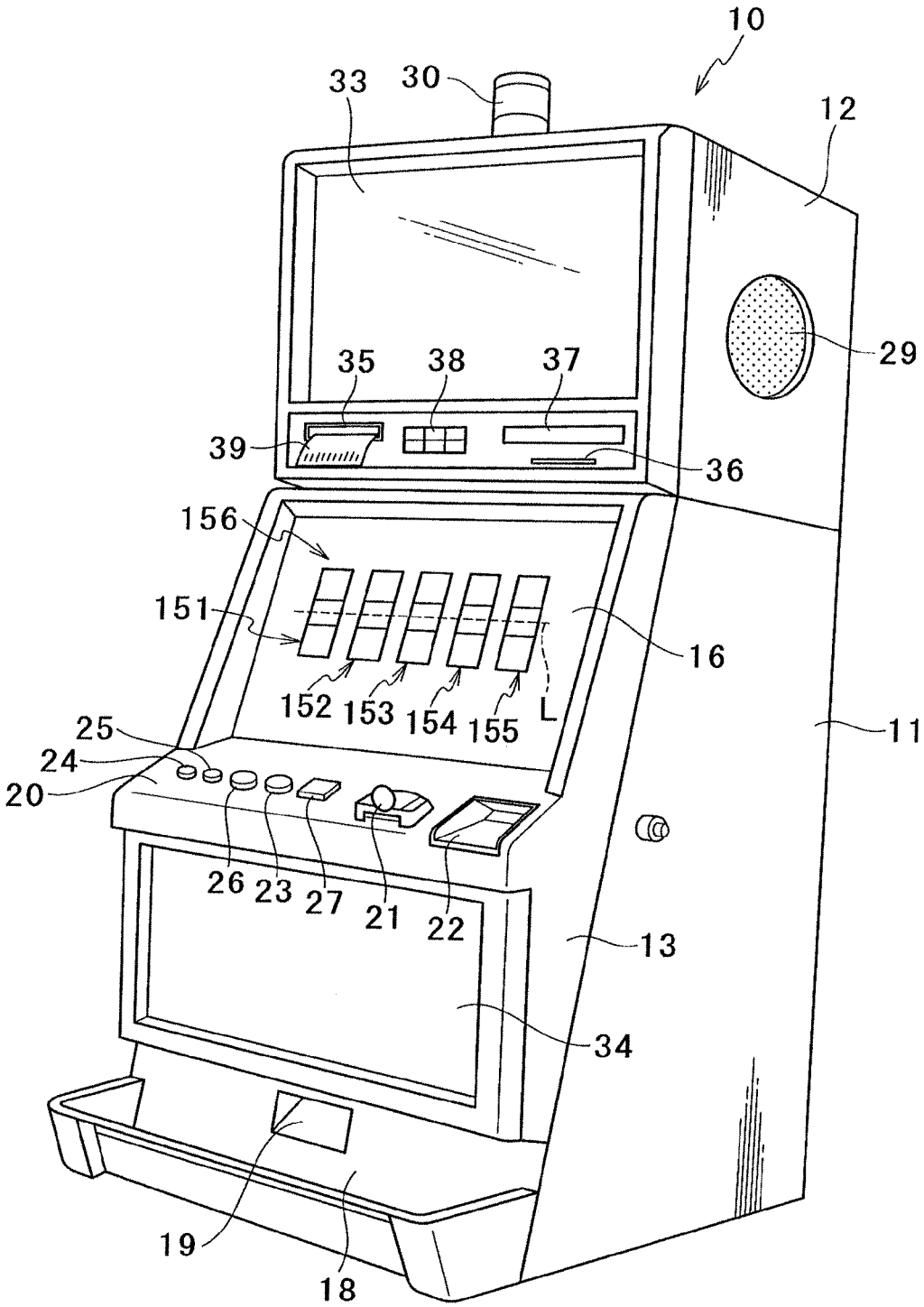
FIG. 28 is a perspective view illustrating an external appearance of a gaming terminal.

As illustrated in FIG. 28, the gaming terminal 10 has: a cabinet 11, a top box 12 provided above the cabinet 11, and a main door 13 provided on the front surface of the cabinet 11. The main door 13 has a lower image display panel 16. The lower image display panel 16 has a transparent liquid crystal panel for displaying various kinds of information. The lower image display panel 16 displays display windows 151 to 155 and a matrix 156 for arranging therein symbols 180. Further, the lower image display panel 16 displays as needed various information and effect images related to a game.

Embodiment 2 deals with a case where the lower image display panel 16 electrically displays symbols 180 arranged in five rows/three columns. However, the present invention is riot limited to this.

The lower image display panel 16 displays a single activated payline L. Note that the number of pay lines L may be two or more. When the number of pay lines L is two or more, the number of pay lines L to be activated may be determined according to a predetermined condition, such as the number of coins placed as a bet.

Note that the lower image display panel 16 may have a credit value indicator and a payout value indicator. The credit value indicator displays a total value (hereinafter also referred to as total credit value) which a gaming terminal 10 can pay out to a player. When symbols stopped along a pay line L form a winning combination, the payout value indicator displays the number of coins to be paid out.

Further, a scatter symbol may be adopted, and the number of coins to be paid out may be determined, according to the number of scatter symbols displayed on the matrix 156. Note that the pay line L does not necessarily have to be displayed.

Below the lower image display panel 16 provided are a control panel 20, a coin insertion slot 21, and a bill validator 22. The control panel 20 is provided with various buttons 23 to 27. These buttons 23 to 27 allow a player to input instructions related to a game played by the player. Through the coin insertion slot 21, a coin is received in the cabinet 11.

The control panel 20 has: a spin button 23, a change button 24, a cashout button 25, a 1-bet button 26, and a maximum bet button 27. The spin button 23 is for inputting an instruction to start symbol scrolling. The change button 24 is used to ask a staff in the gaming facility for exchange of money. The cash out button 25 is for inputting an instruction to pay out coins corresponding to the total credit-value into the coin tray 18.

The 1-bet button 26 is used for betting one coin out of those corresponding to the total credit value. The maximum bet button 27 is used for betting, out of those corresponding to the total credit value, a maximum number of coins (e.g., fifty coins) which can be bet in one game.

The bill validator 22 validates whether a bill is genuine or not and receives the genuine bill into the cabinet 11. Note that the bill validator 22 is capable of reading a barcode attached to a later-mentioned ticket 39 having a barcode (hereinafter simply referred to as ticket 39). When the bill validator 22 reads the ticket 39, it outputs to the main CPU 41 a read signal representing information having read from the barcode.

On the lower front surface of the main door 13, that is, below the control panel 20, a belly glass 34 is provided. On the belly glass 34, a character of a gaming terminal 10 or the like is drawn. On the front surface of top box 12 is provided an upper image display panel 33. The upper image display panel 33 has a liquid crystal panel and displays an effect image, introduction to the game, rules of the game, or the like.

Further, the top box 12 has a speaker 29 for performing an audio output. Below the upper image display panel 33 are provided a ticket printer 35, a card reader 36, a data displayer 37, and a keypad 38. The ticket printer 35 prints, on to a ticket, a barcode having encoded data containing credit-value, date and time, identification number of a gaming terminal 10 or the like, thereby issuing a ticket 39 having a barcode attached thereto. A player can play a game in another gaming terminal 10 with the ticket 39 having the barcode, or exchange the ticket 39 having the barcode with bill or the like at a change booth or the like of the game arcade.

The card reader 36 reads/writes data from/into a smart card. The smart card is carried by a player, and stores therein data for identifying the player, data relating to a history of games played by the player, or the like.

The data displayer 37 includes a fluorescent display or the like, and displays the data read by the card reader 36 and the data input by the player through the keypad 38. The keypad 38 is for entering instructions or data relating to issuing of a ticket or the like.

(Electrical Structure of Gaming Machine 1)

Figure 33:
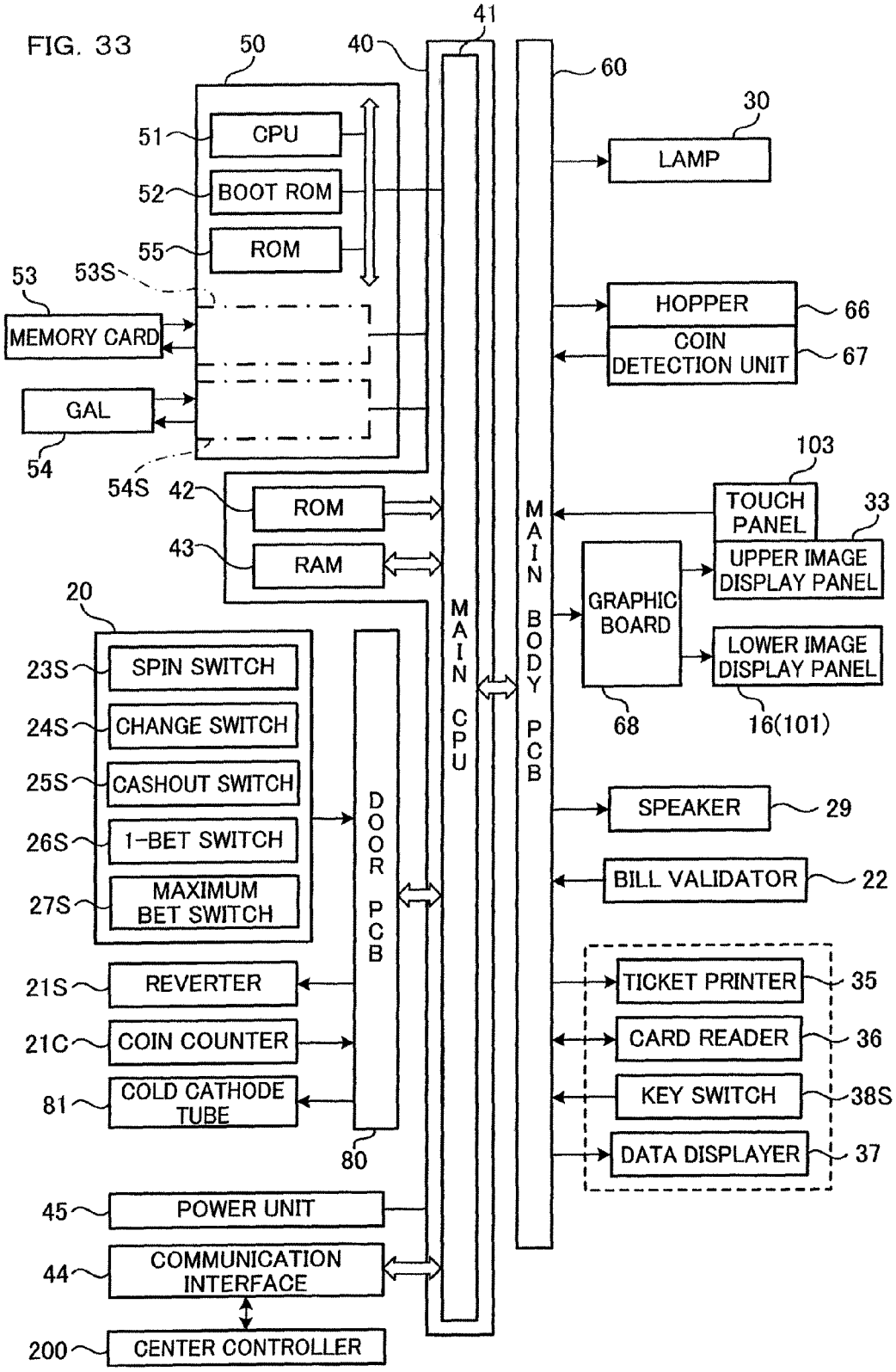
FIG. 33 is a block diagram illustrating an electrical structure of the gaming terminal.
Figure 34:
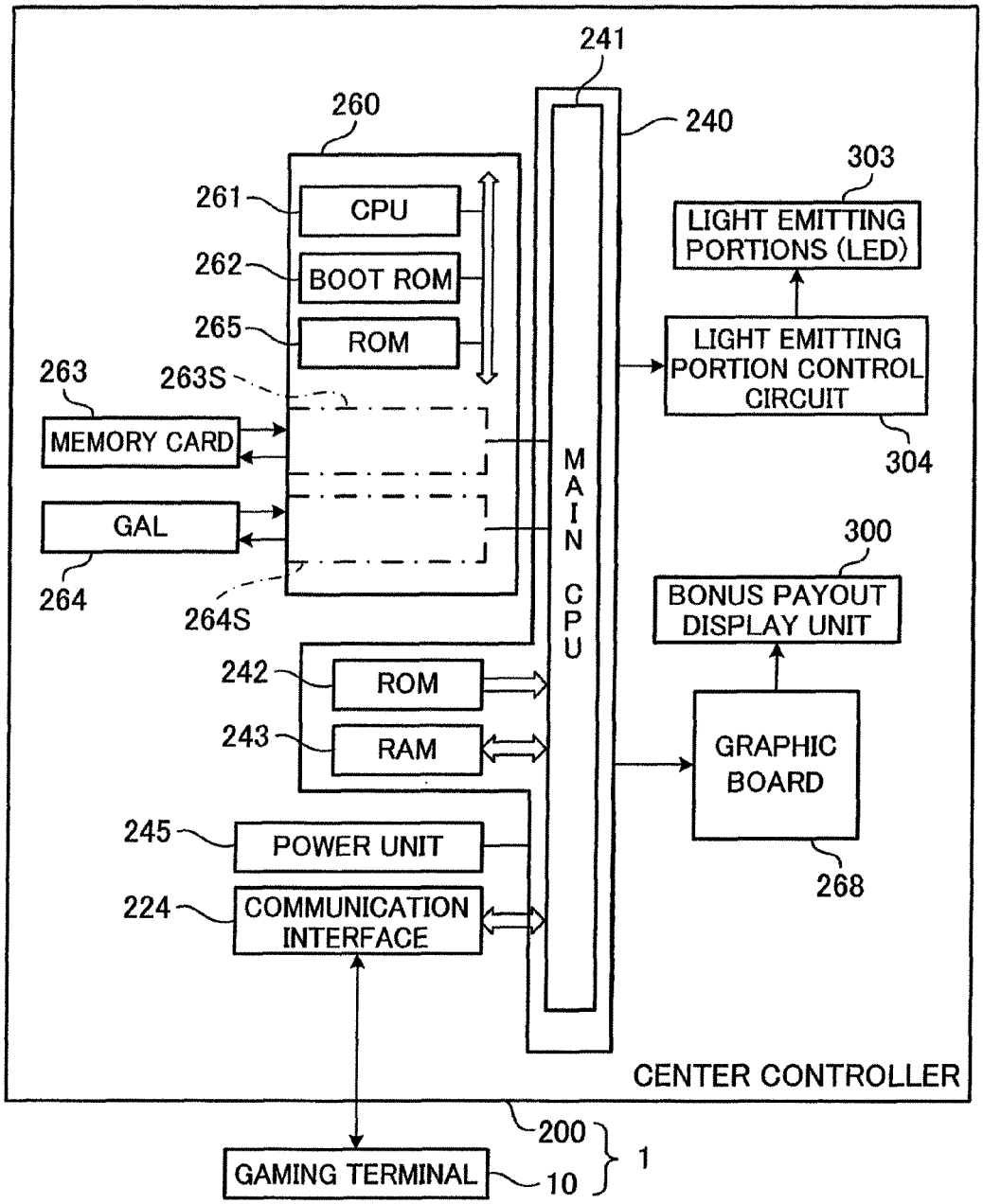
FIG. 34 is a block diagram illustrating an electrical structure of a center controller.

FIGS. 33 and 34 are block diagrams each illustrating an electrical structure of the entire gaming machine 1.

(Electrical Structure of Gaming Terminal 10)

FIG. 33 is a block diagram illustrating an electrical structure of a gaming terminal 10. As illustrated in FIG. 33, the cabinet 11 includes a control unit having a terminal controller 100. As illustrated in FIG. 33, the control unit includes a motherboard 40, a main body PCB (Printed Circuit Board) 60, a gaming board 50, a door PCB 80, various switches, sensors, or the like.

The gaming board 50 is provided with a CPU (Central Processing Unit) 51, a ROM 55, a boot ROM 52, a card slot 53S corresponding to a memory card 53, and an IC socket 54S corresponding to a GAL (Generic Array Logic) 54. The CPU 51, the ROM 55, and the boot ROM 52 are connected to one another through an internal bus.

The memory card 53 stores therein a game program and a game system program. The game program contains a stop symbol determining program. The stop symbol determining program determines symbols (code number corresponding to the symbol) to be stopped in the arrangement areas 150. This stop symbol determining program contains sets of symbol weighting data respectively corresponding to various payout rates (e.g., 80%, 84%, 88%). Each set of the symbol weighting data indicates, for each of the display windows 151 to 155, a code number of each symbol and at least one random numerical value allotted to the code number. The numerical value is a value within a predetermined range of 0 to 256 for example.

The payout rate is determined based on payout rate setting data output from the GAL 54. Based on a set of the symbol weighting data corresponding to the payout rate determined, a symbol to be stopped is determined.

The memory card 53 stores therein various types of data for use in the game programs and the game system programs. For example, the memory card 53 stores a table listing combinations of a symbol 180 to be displayed on the display windows 151 to 155 of FIG. 23 and an associated range of random numerical values. This data is transferred to the RAM 43 of the motherboard 40, at the time of running a game program.

The card slot 53S is structured so as to allow the memory card 53 to be attached/detached to/from the card slot 53S. This card slot 53S is connected to the motherboard 40 through an IDE bus. Thus, the type and content of a game run by a gaming terminal 10 can be modified by detaching the memory card 53 from the card slot 53S, write a different game program and a different game system program into the memory card 53, and inserting the memory card 53 back into the card slot 53S.

Each of the game programs includes a program related to the progress of the game and/or a program for causing a transition to a bonus game. Each of the game programs includes image data and audio data output during the game.

The GAL 54 has input and output ports. When the GAL 54 receives data via an input port, it outputs data corresponding to the input data from its output port. This data from the output port is the payout rate setting data described above.

IC socket 54S is structured so as to allow the GAL 54 to be attached/detached to/from the IC socket 54S. The IC socket 54S is connected to the motherboard 40, via a PCI bus. Thus, the payout rate setting data to be output from GAL 54 can be modified by: detaching the GAL 54 from the IC socket 54S, overwriting the program stored in the GAL 54, and attaching the GAL 54 back to the IC socket 54S.

The CPU 51, the ROM 55 and the boot ROM 52 connected through an internal bus are connected to the motherboard 40 through the PCI bus. The PCI bus communicates signals between the motherboard 40 and the gaming board 50 and supplies power from the motherboard 40 to the gaming board 50. The ROM 55 stores country identification information and an authentication program. The boot ROM 52 stores a preliminary authentication program and a program (boot code) for enabling the CPU 51 to run the preliminary authentication program.

The authentication program is a program (falsification check program) for authenticating the game program and the game system program. The authentication program is a program for confirming and verifying that the game program and the game system program are not falsified. In other words, the authentication program is described in accordance with a procedure for authenticating the game program and the game system program. The preliminary authentication program is a program for authenticating the authentication program. The preliminary authentication program is described in accordance with a procedure for verifying that the authentication program to be authenticated is not falsified. In short, the preliminary authentication program authenticates the authentication program.

The motherboard 40 is provided with a main CPU 41 (terminal controller 100), a ROM (Read Only Memory) 42, a RAM (Random Access Memory) 43, and a communication interface 44.

The main CPU 41 serves as a terminal controller 100 and has a function of controlling the entire gaming terminal 10. In particular, the main CPU 41 controls the following operations: an operation of outputting a signal instructing variable-displaying of symbols 180 to the graphic board 68, which is performed in response to pressing of the spin button 23 after betting of credit; an operation of determining symbols 180 to be stopped after the variable-displaying of symbols 180; and an operation of stopping the symbols 180 thus determined in the display window 151 to 155.

In other words, the main CPU 41 serves as an arrangement controller which arranges symbols to form a new symbol matrix through scrolling of symbols displayed on the lower image display panel 16. This main CPU 41 therefore determines symbols to be arranged in a symbol matrix by selecting symbols to be arranged from various kinds of symbols. Then, the main CPU 41 executes arrangement control to stop scrolling the symbols to present the symbols thus determined.

The ROM 42 stores a program such as BIOS (Basic Input/Output System) run by the main CPU 41, and permanently-used data. When the BIOS is run by the main CPU 41, each of peripheral devices is initialized and the game program and the game system program stored in the memory card 53 are read out through the gaming board 50. The RAM 43 stores data or a program used for the main CPU 41 to perform a process.

The communication interface 44 is provided to communicate with a host computer or the like equipped in the gaming facility, through the network (communication line). The communication interface 44 is also for communicating with the center controller 200 through a communication line. Further, a main body PCB (Printed Circuit Board) 60 and a door PCB 80 are connected to the motherboard 40, through USB (Universal Serial Bus). Further, the motherboard 40 is connected to a power unit 45. The power unit 45 supplies power to the motherboard 40 to boot the main CPU 41 thereof. Meanwhile, the power unit 45 supplies power to the gaming board 50 through the PCI bus to boot the CPU 51 thereof.

The main body PCB 60 and door PCB 80 are connected to various devices or units which generate signals to be input to the main CPU 41, and various devices or units whose operations are controlled by signals from the main CPU 41. Based on a signal input to the main CPU 41, the main CPU 41 runs the game program and the game system program stored in the RAM 43, to perform an arithmetic process. Then, the CPU 41 stores the result of the arithmetic process in the RAM 43, or transmits a control signal to the various devices and units to control them based on the result.

The main body PCB 60 is connected with the lamp 30, a hopper 66, a coin sensor 67, the graphic board 68, the speaker 29, the bill validator 22, the ticket printer 35, the card reader 36, a key switch 38S, and the data displayer 37.

The lamp 30 is turned on/off on the basis of a control signal from the main CPU 41. The lamp 30 is capable of lighting in multicolor. Specifically, the lamp 30 has red LEDs, green LEDs, and blue LEDs which respectively light in red, green, and blue upon a power supply. The lamp 30 is capable of lighting in any color by turning on and off LEDs under the control of the main PCB 60.

The hopper 66 is mounted in the cabinet 11 and pays out a predetermined number of coins from a coin outlet 19 to the coin tray 18, based on a control signal from the main CPU 41. The coin sensor 67 is provided inside the coin outlet 19, and outputs a signal to be input to the main CPU 41 upon sensing that a predetermined number of coins have been delivered from the coin outlet 19.

The graphic board 68 controls image displaying of the upper image display panel 33 and the lower image display panel 16, based on a control signal from the main CPU 41. Further, the graphic board 68 is provided with a VDP (Video Display Processor) for generating image data on the basis of a control signal from the main CPU 41, a video RAM for temporarily storing the image data generated by the VDP, or the like. Note that image data used at the time of generating the image data by the VDP is in a game program which is read out from the memory card 53 and stored in the RAM 43.

The bill validator 22 reads an image on a bill and takes only those recognized as genuine into the cabinet 11. When taking in a genuine bill, the bill validator 22 outputs an input signal indicating the value of the bill to the main CPU 41. The main CPU 41 stores into the RAM 43 a credit-value corresponding to the value of the bill indicated by the signal.

The ticket printer 35 prints a barcode on to a ticket to issue a ticket 39 having the barcode. The barcode contains encoded data such as credit-value stored in the RAM 43, date and time, identification number of the gaming terminal 10, or the like, based on a control signal from the main CPU 41.

The card reader 36 reads out data from the smart card and transmits the data to the main CPU 41. Further, the card reader 36 writes data into the smart card based on the control signal output from the main CPU 41. The key switch 38S is mounted to the keypad 38, and outputs a signal to the main CPU 41 in response to an operation of the keypad 38 by the player. The data displayer 37 displays, based on a control signal from the main CPU 41, the data read by the card reader 36 or the data input by the player through the key pad 38.

The door PCB 80 is connected to the control panel 20, a reverter 21S, a coin counter 21C, and a cold cathode tube 81. The control panel 20 is provided with: a spin switch 23S associated with the spin button 23; a change switch 24S associated with the change button 24; a cashout switch 25S associated with the cashout button 25; a 1-bet switch 26S associated with the 1-bet button 26; and a maximum bet switch 27S associated with the maximum bet button 27. Each of the switches 23S to 27S outputs a signal to the main CPU 41, when a player presses the associated button.

The coin counter 21C is provided within the coin insertion slot 21, and identifies whether the coin inserted into the coin insertion slot 12 by the player is genuine. A coin except the genuine coin is discharged from the coin outlet 19. In addition, the coin counter 21C outputs an input signal to the main CPU 41 upon detection of a genuine coin.

The reverter 21S is operated on the basis of the control signal output from the main CPU 41 and distributes a coin, which is recognized as a genuine coin by the coin counter 21C, to a not-shown cash box or hopper 66 mounted in the gaming terminal 10. In other words, when the hopper 66 is full of the coins, the genuine coin is distributed into the cash box by the reverter 21S. On the other hand, when the hopper 66 is not yet full of the coins, the genuine coin is distributed into the hopper 66. The cold cathode tube 81 functions as a backlight mounted to rear sides of the lower image display panel 16 and the upper image display panel 33. This cold cathode tube 81 turns on according to a control signal from the main CPU 41.

(Electrical Structure of Center Controller 200)

FIG. 34 is a block diagram illustrating an electrical structure of the center controller 200. The center controller 200 is provided therein with a control unit. As illustrated in FIG. 34, the control unit includes a motherboard 240, a gaming board 260, an actuator, or the like.

The gaming board 260 has the same structure as that of the gaming board 50. The motherboard 240 has the same structure as that of the motherboard 40. The communication interface 244 communicates with the terminal controller 100 through a communication line.

The graphic board 268 has the same structure as that of the graphic board 68, except in that the graphic board 268 controls displaying of the bonus payout display unit 300 based on a control signal from the main CPU 241.

A light emitting portion control circuit 304 controls an activation of an LED as a light emitting portion 303. Specifically, the light emitting portion control circuit 304 activates and inactivates the light emitting portions 303 based on a control signal output from the main CPU 241.

The light emitting portions 303 are capable of lighting in multicolor like the lamp 30. Specifically, the light emitting portions 303 have red LEDs, green LEDs, and blue LEDs which respectively light in red, green, and blue upon a power supply. The light emitting portions 303 are capable of lighting in any color by turning on and off the LEDs under the control of the light emitting portion control circuit 304.

(Emission Color Control Table)

FIG. 30 illustrates an emission color control table. The emission color control table is stored in a RAM 243. The emission color control table illustrates an emission color of the lamp 30 of each of the gaming terminals 10. An emission color of the light emitting portions 303 of each path unit 301 is determined based on the emission color control table. When the emission color of a gaming terminal 10 is blue, for example, the light emitting portions 303 of the path unit 301 associated with the gaming terminal 10 light in blue.

(Path Unit Activation State Table)

FIG. 31 shows a path unit activation state table. The path unit activation state table is stored in the RAM 243. The path unit activation state table illustrates the number of activated light emitting portions 303, and the number of inactivated light emitting portions 303, for each of the path units 301. For instance, there are ten activated light emitting portions 303 and ninety inactivated light emitting portions 303 on the path unit 301*a*.

(Contribution Level Management Table)

FIG. 32 illustrates a contribution level management table. The contribution level management table is stored in the RAM 243. The contribution level management table indicates an accumulated contribution amount of each gaming terminal 10 to the jackpot value. For example, the contribution level management table indicates that the contribution amount of the gaming terminal 10*a* is $130.

(Operation of Gaming Machine 1: Boot Process)

The following describes a boot process routine which takes place in the gaming machine 1. Upon powering on the gaming machine 1, a boot process routine illustrated in FIG. 35 starts in: the mother board 240 and gaming board 260 in the center controller 200, and in the mother board 40 and the gaming board 50 in the terminal controller 100. The memory cards 53 and 263 are assumed to be inserted into the card slots 53S and 263S of the gaming boards 50 and 260, respectively. Further, the GALs 54 and 264 are assumed to be attached to the IC sockets 54S and 264S, respectively.

First, turning on the power switch of (powering on) the power units 45 and 245 boots the motherboards 40 and 240, and the gaming boards 50 and 260. Booting the motherboards 40 and 240 and the gaming boards 50 and 260 starts separate processes in parallel. Specifically, the CPUs 51 and 261 read out preliminary authentication programs stored in the boot ROMs 52 and 262, respectively. Then, preliminary authentication is performed according to the read out programs so as to confirm and verify that no falsification is made to authentication programs, before reading them in the motherboards 40 and 240, respectively (S1). Meanwhile, the main CPUs 41 and 241 of the motherboards 40 and 240 run BIOS stored in the ROMs 42 and 242 to load into the RAMs 43 and 243 compressed data built in the BIOS, respectively (S2). Then, the main CPUs 41 and 241 run a procedure of the BIOS according to the data loaded into the RAMs 43 and 243 so as to diagnose and initialize various peripheral devices (S3).

The main CPUs 41 and 241, which are respectively connected to the ROMs 55 and 265 of the gaming boards 50 and 260 via PCI buses, read out authentication programs stored in the ROMs 55 and 265 and stores them in the RAMs 43 and 243 (S4). During this step, the main CPUs 41 and 241 each derives a checksum through ADDSUM method (a standard check function) which is adopted in a standard BIOS, and store the authentication programs into RAMs 43 and 243 while confirming if the operation of storing is carried out without an error.

Next, the main CPUs 41 and 241 each checks what connects to the IDE bus. Then, the main CPUs 41 and 241 access, via the IDE buses, to the memory cards 53 and 263 inserted into the card slots 53S and 263S, and read out game programs and game system programs from the memory cards 53 and 263, respectively. In this case, the CPUs 41 and 241 each reads out four bytes of data constituting the game program and the game system program at one time. Next, the CPUs 41 and 241 authenticate the game program and the game system program read out to confirm and verify that these programs are not falsified (S5).

When the authentication properly ends, the main CPUs 41 and 241 write and store the authenticated game programs and game system programs in RAMs 43 and 243 (S6).

Next, the main CPUs 41 and 241 access, via the PCI buses, to the GALs 54 and 264 attached to the IC socket 54S·264S, and read out payout rate setting data from the GALs 54 and 264, respectively. The payout rate setting data read out is then written and stored in the RAMs 43 and 243 (S7).

Next, the main CPUs 41 and 241 read out, via the PCI buses, country identification information stored in the ROMs 55 and 265 of the gaming boards 50 and 265, respectively. The country identification information read out is then stored in the RAMs 43 and 243 (S8).

Figure 36:
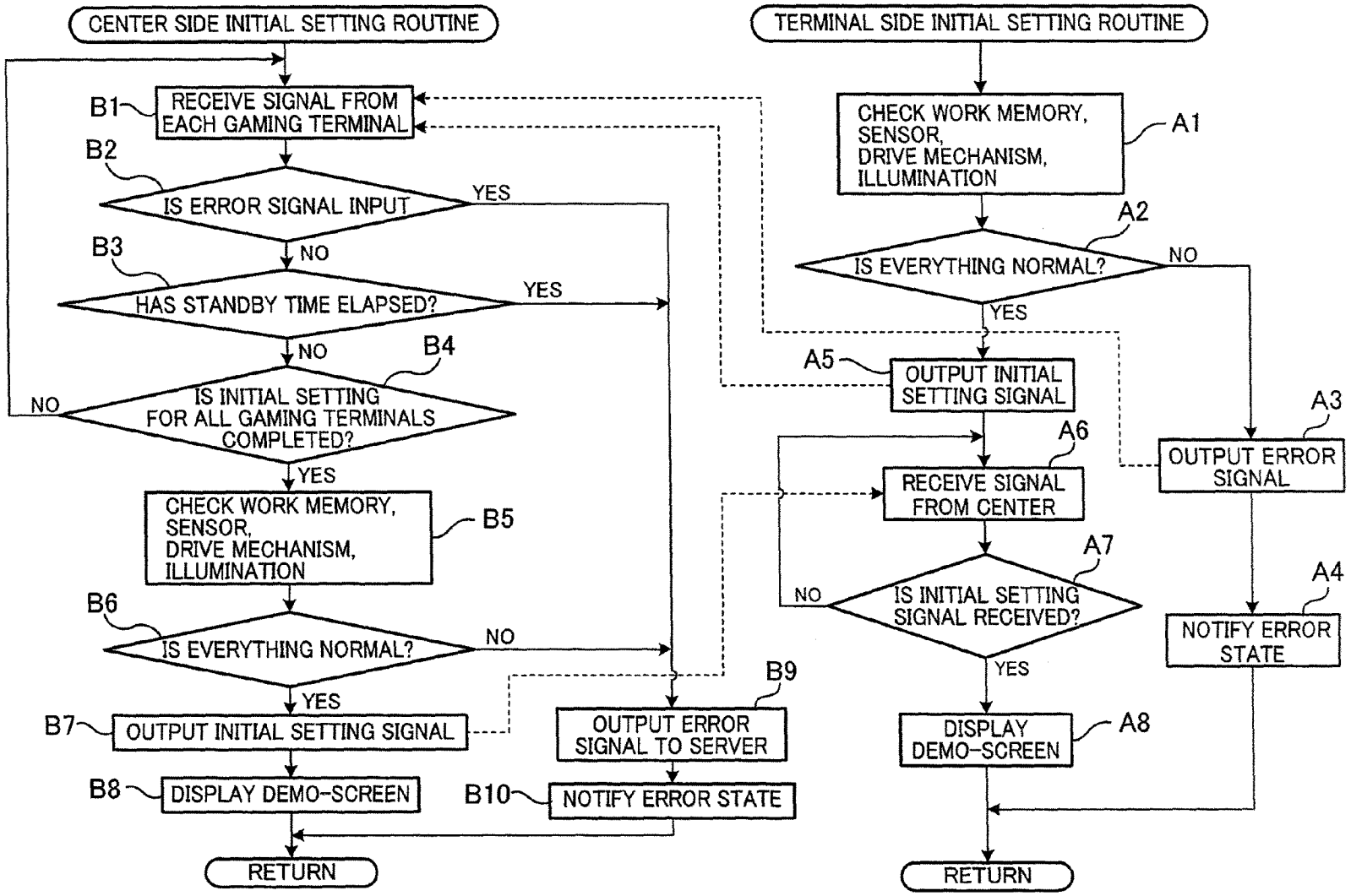
FIG. 36 is a flowchart illustrating an initial process executed in the gaming terminal and the center controller.

After this, the main CPU 41 and 241 each performs an initial process of FIG. 36.

(Operation of Gaming Machine 1: Initial Process)

Figure 35:
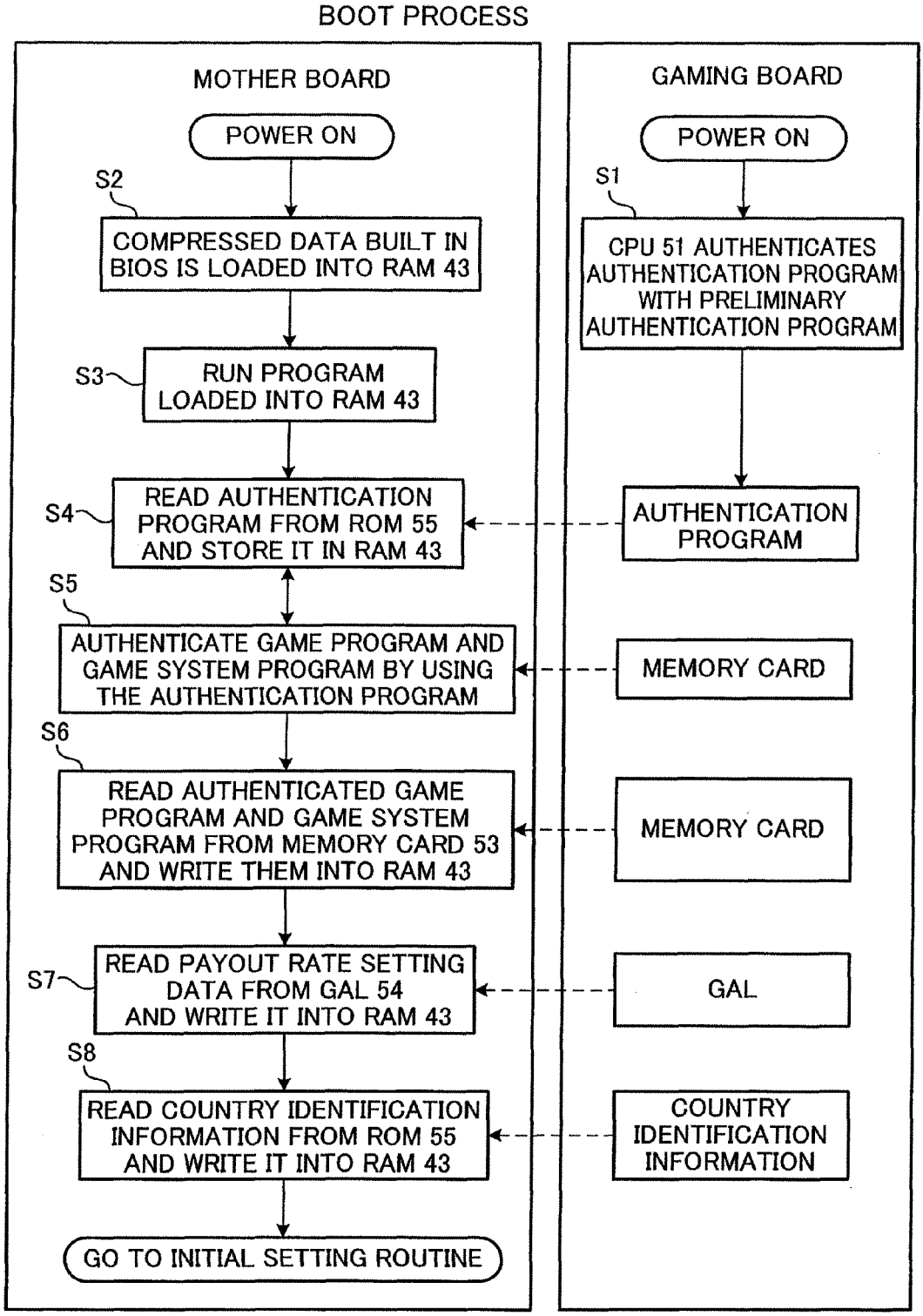
FIG. 35 is a flowchart illustrating a boot process executed in the gaming terminal and the center controller.

The following describes an initial process which takes place in the gaming machine 1. When the boot process of FIG. 35 is completed, the center controller 200 reads out from the RAM 243 a center side initial setting routine illustrated in FIG. 36 and executes the routine. Meanwhile, the gaming terminal 10 reads out from the RAM 43 a terminal side initial setting routine illustrated in FIG. 36 and executes the routine. The center side and terminal side initial setting routines are executed in parallel.

First, the main CPU 41 of each of the gaming terminals 10 checks operations of work memories such as the RAM 43, various sensors, various driving mechanisms, and various decorative illuminations (A1). Then, the main CPU 41 determines if all the check results are normal (A2). If the main CPU 41 determines that the check results contains an error (A2: NO), the main CPU 41 outputs a signal notifying the error (hereinafter, error signal) to the center controller 200 (A3). Further, the main CPU 41 reports the error in the form of illuminating the lamp 30 or the like (A4), and then ends the routine.

On the other hand in A2, if the main CPU 41 determines that all the check results are normal (A2: YES), an initial setting signal is output to the center controller 200 (A5). Then, an initial setting signal is waited from the center controller 200 (A6, A7: NO).

The main CPU 241 of the center controller 200 receives signals from each of the terminals (B1). Then, the main CPU 241 determines whether a signal received is an error signal (B2). If the main CPU 241 determines that the signal is an error signal (B2: YES), the main CPU 241 outputs the error signal to a server of a not-shown host computer or the like (B9) to report the error (B10), and ends the routine.

On the other hand in B2, if the main CPU 241 determines that the signal is not an error signal (B2: NO), the main CPU 241 determines whether a predetermined time (check time) has elapsed from the time of powering on (B3). If the main CPU 241 determines that the check time has elapsed (B3: YES), B9 is executed. On the other hand, if the main CPU 241 determines that the check time has not yet elapsed (B3: NO), it is determined whether an initial setting signal is received from each of the gaming terminals 3 (B4). If the main CPU 241 determines that an initial setting signal from any one of the gaming terminals 10 is not received (B4: NO), the process returns to B1. On the other hand, if it is determined that initial setting signals from all the gaming terminals 10 are received (B4: YES), the main CPU 241 checks operations of work memories such as RAM 243 or the like, various sensors, various driving mechanisms, and various decorative illuminations (B5). Then, the main CPU 241 determines whether all the check results are normal (B6). If the main CPU 241 determines the check results contain an error (B6: NO), the main CPU 241 executes B9.

On the other hand in B6, if the main CPU 241 determines that all the check results are normal (B6: YES), the main CPU 241 outputs an initial setting signal to all the gaming terminals 10 (B7), and causes the shared display 102 to display a demo-screen (B8). Then, the main CPU 241 ends the routine.

In A7, the main CPU 41 of each of the gaming terminals 10 determines that an initial setting signal is received from the center controller 200 (A7: YES), and causes the terminal display 101 to display a demo-screen (A8). The main CPU 41 then ends the routine.

(Operation of Gaming Terminal 10: Terminal Process Routine)

Figure 37:
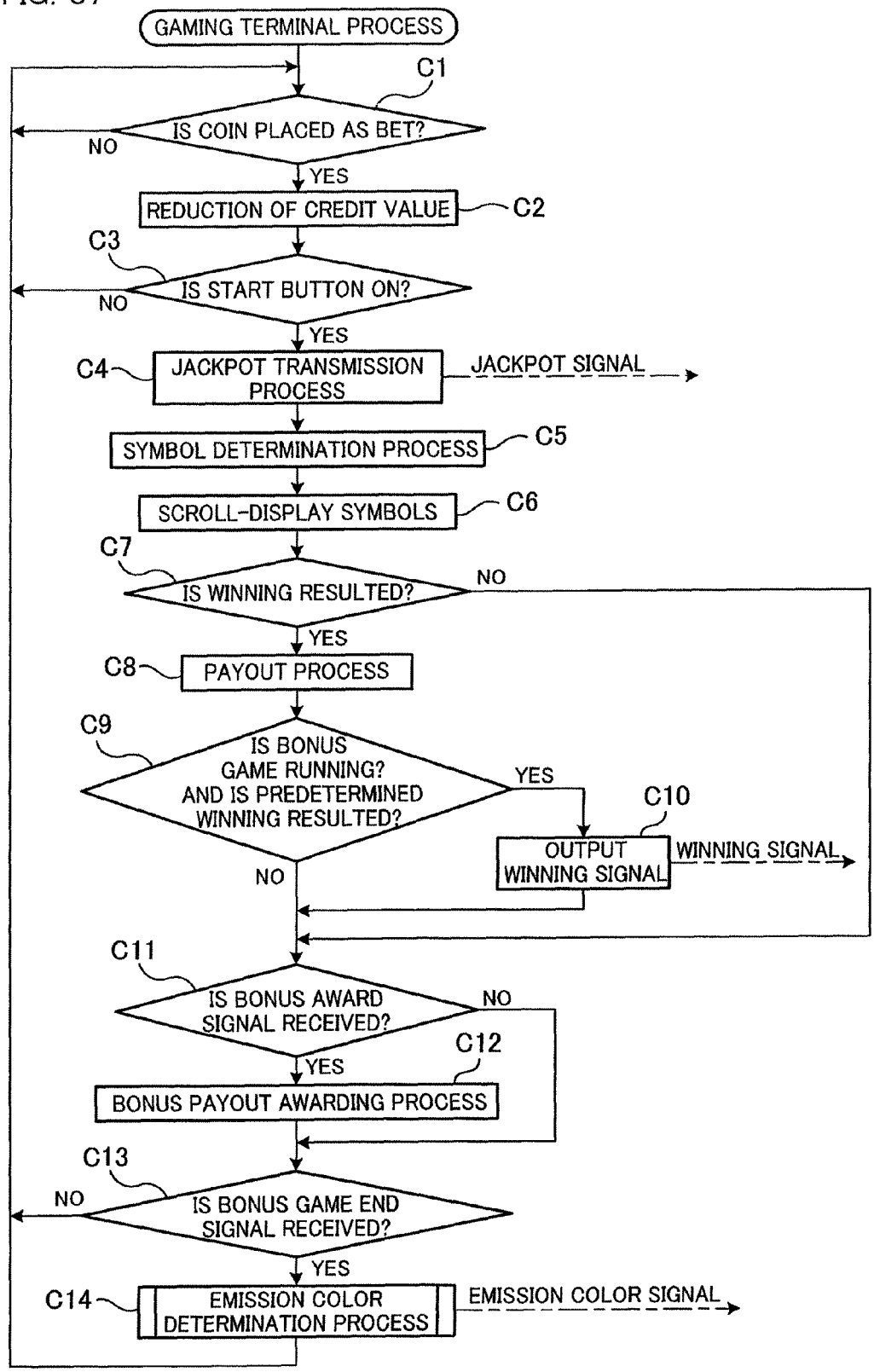
FIG. 37 is a flowchart illustrating a terminal process routine executed in the gaming terminal.

After the terminal side initial setting routine of FIG. 36, the main CPU 41 of the gaming terminal 10 performs a terminal process routine of FIG. 37. Through this terminal process routine executed by the main CPU 41, a game is run.

As illustrated in FIG. 37, in the terminal process routine, it is determined whether a coin is bet (C1). In this step, it is determined whether a signal from the 1-bet switch 26S entered by pressing of the 1-bet button 26 is received. Meanwhile, it is determined whether a signal from the maximum bet switch 27S entered by pressing of the maximum bet button 27 is received. If no coin is bet (C1: NO), C1 is repeated until a coin is bet.

On the other hand, if a coin is bet (C1: YES), the credit value stored in the RAM 43 is reduced according to the number of coins bet (C2). When the number of coins bet surpasses the number of coins equivalent to the credit value stored in the RAM 43, the process goes to later-described C3 without the reduction of the credit value. When the number of coins bet exceeds the maximum number of coins bettable for one game (50 pieces in Embodiment 2), the process goes to a later-described step C3 without the reduction of the credit value.

Then, it is determined whether a spin button 23 is pressed (C3). If the spin button 23 is not pressed (C3: NO), the process returns to C1. Here, if the spin button 23 is not pressed (for example, the spin button 23 is not pressed but a command to end the game is input), the reduction of the credit value in C2 is canceled.

On the other hand, when the spin button 23 is pressed (C3: YES), a progressive transmission process is executed (C4). In other words, a progressive signal indicating a part of the game value bet is transmitted to the center controller 200.

Next executed is a symbol determining process (C5). That is, the stop symbol determining program stored in the RAM 43 is run to determine symbols 180 to be arranged in the matrix 156. Through this, a symbol combination to be formed along the payline L is determined.

Then, the scrolling process is executed to scroll symbols 180 on the terminal display 101 (C6). The scrolling process is a process in which the symbols 180 determined in C5 are stopped (rearranged) in the matrix 156 after scrolling of symbols 180 in a direction indicated by an arrow symbol.

Next, it is determined whether a winning is resulted with symbols 180 rearranged in the matrix 156 (C7). When it is determined that a winning is resulted (C7: YES), a payout process is executed (C8). More specifically, when a winning is resulted, the number of coins according to the combination is calculated. On the other hand in C7, when it is determined that no winning is resulted (C7: NO), C11 is executed.

After a payout process in C8 is executed, the main CPU 41 determines whether a bonus game is running, and whether a predetermined winning is resulted (C9). When a bonus game start signal is received from the center controller 200, the CPU 41 determines that the bonus game is running. If a bonus game is running, and if it is determined that a predetermined winning is resulted (C9, YES), the main CPU 41 outputs a winning signal to the center controller 200 (C10), and the main CPU executes a process of C11. Meanwhile, if a bonus game is not running, or if it is determined that a predetermined winning is not resulted (C9, NO), a process of C11 is executed.

Next, the main CPU 41 determines whether a bonus award signal is received from the center controller 200 (C11). When it is determined that a bonus award signal is received (C11, YES), a payout is awarded based on the bonus award signal (C12). When it is determined that a bonus award signal is not received after C12 or in C11 (C11, NO), it is determined whether a bonus end signal is received (C13). When it is determined that a bonus end signal is not received (C13, NO), the process returns to C1.

Meanwhile, when it is determined that a bonus end signal is received (C13, YES), an emission color determination process is run (C14). The emission color determination process is described later in detail with reference to FIG. 38. Afterwards, the process returns to C1.

(Operation of Gaming Terminal 10: Emission Color Determination Routine)

Figure 38:
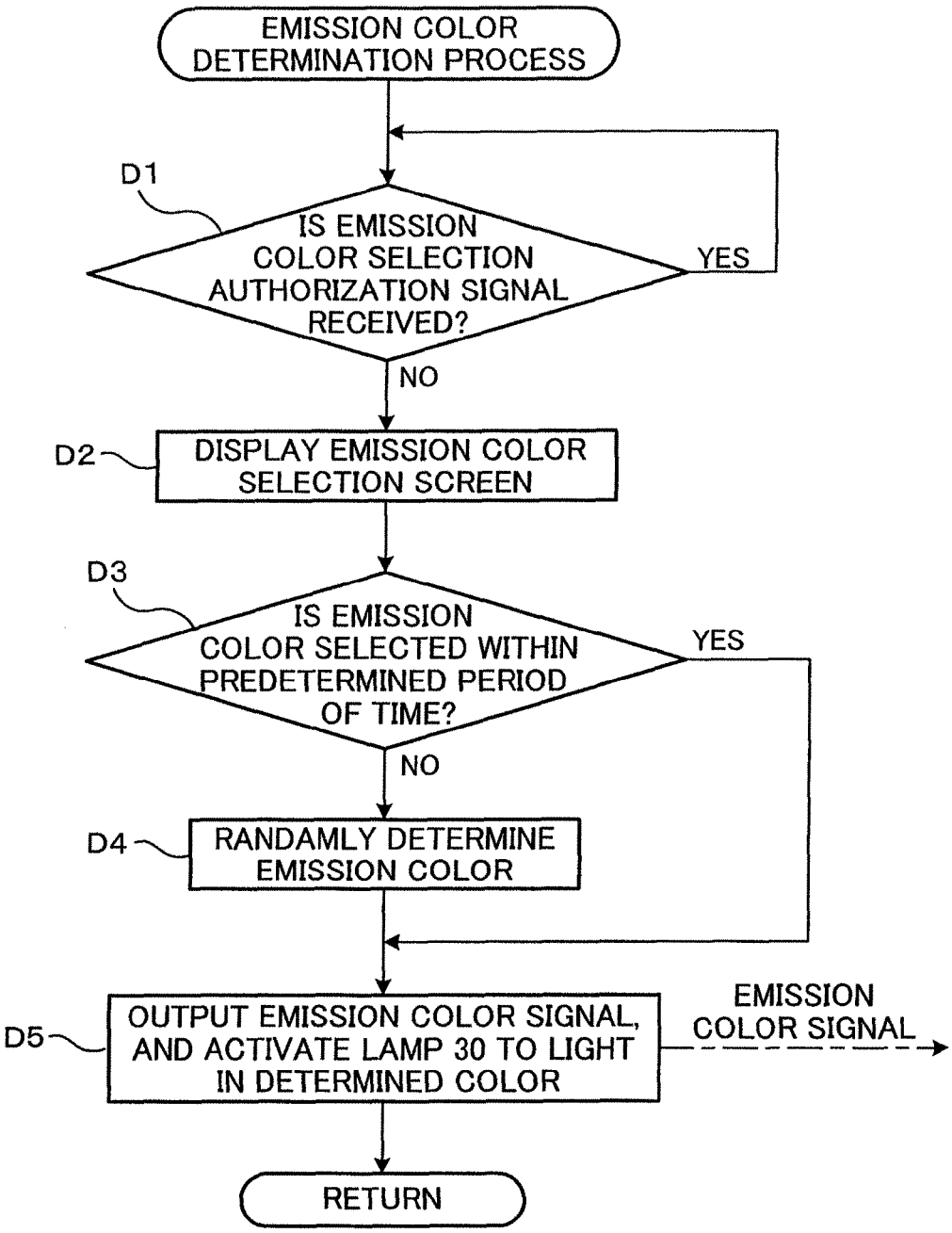
FIG. 38 is a flowchart illustrating an emission color determination process routine executed in the gaming terminal.

The following describes an emission color determination process routine run by the main CPU 41 of the gaming terminal 10 with reference to FIG. 38. First, the main CPU 41 determines whether an emission color selection authorization signal is received (D1). When the emission color selection signal is not received (D1, NO), D1 is repeated. When the emission color selection signal is received (D1, YES), an emission color selection screen such as the one illustrated in FIG. 39 is displayed on the upper image display panel 33 (D2).

Note that the emission color selection signal includes information about an emission color (hereinafter, refer to as emission color information) of the lamp 30, already selected and stored in the emission color management table.

Figure 39:
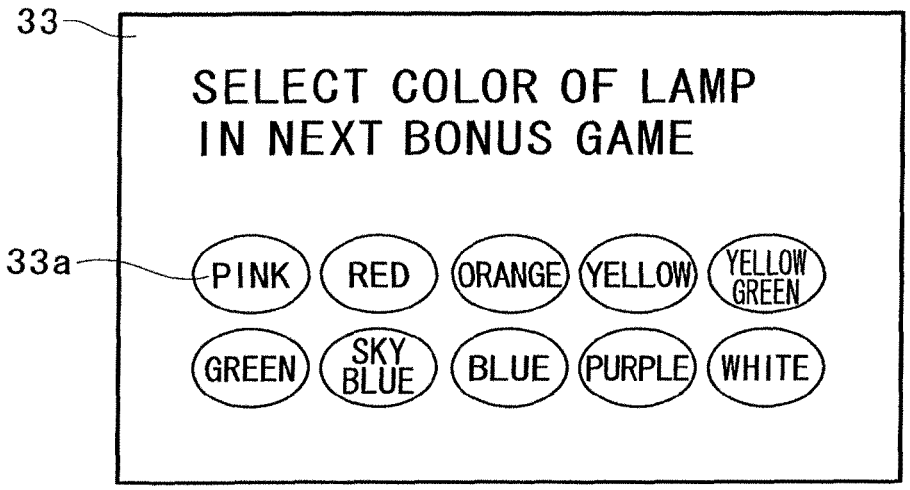
FIG. 39 is a front view illustrating an emission color selection screen displayed on an upper image display panel 33.
Figure 40:
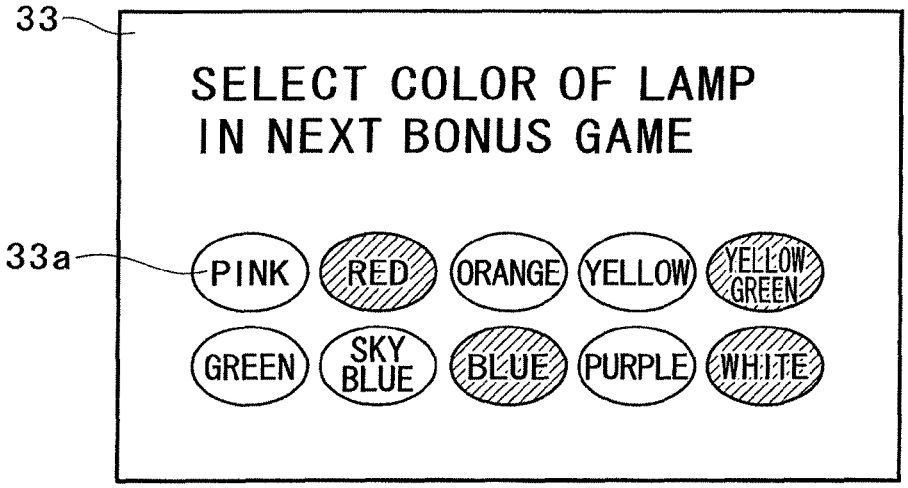
FIG. 40 is a front view illustrating an emission color selection screen displayed on the upper image display panel 33.

The following describes an emission color selection screen with reference to FIGS. 39 and 40. As illustrated in FIG. 39, a text image reading "SELECT COLOR OF LAMP IN NEXT BONUS GAME" as well as emission color selection button images 33*a* are displayed as an emission color selection screen displayed on the upper image display panel 33. An emission color selection button image 33*a* has a text image indicating a selectable emission color. An emission color of the lamp 30 is selected when, for example, a player or the like touches the emission color selection button 33*a*.

Further, as illustrated in FIG. 40, if a color is already selected by another gaming terminal 10, an emission color selection button image 33*a* corresponding to the already selected emission color is grayed out to indicate the emission color is unselectable.

Now back to FIG. 38, emission color information of an emission color selection signal is referred to in D2, and the emission color selection button image 33*a* corresponding to the already selected emission color is controlled to be grayed out.

Then, it is determined whether the emission color is selected within a predetermined period of time (D3). When it is determined that the emission color is not selected within a predetermined period of time (D3, NO), an emission color is randomly determined (D4). Whether an emission color is selected is determined by whether screen position information is transmitted to the main body PCB 60 through the touch panel 103 as an input device. The main body PCB 60 determines a selected emission color referring to screen position information and a corresponding emission color. After D4, or when an emission color is selected within a predetermined period of time (D3, YES), an emission color signal including information about the determined color is output to the center controller 200, and control is performed to activate the lamp 30 in the determined color (D5). Then, the routine ends.

(Operation of Center Controller 200: Center Process Routine)

Figure 41:
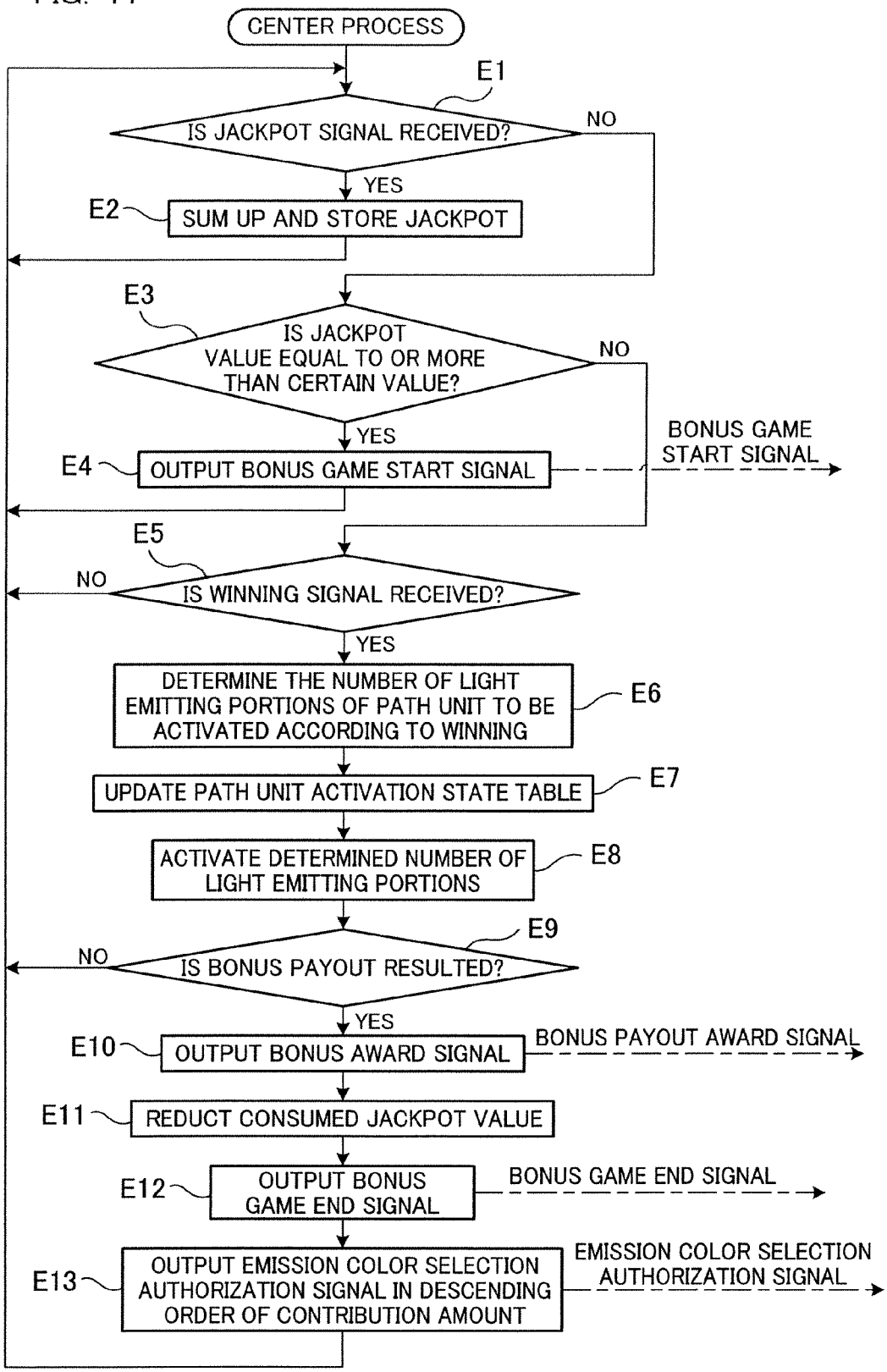
FIG. 41 is a flowchart illustrating a center process routine executed in the center controller.

After the center side initial setting routine of FIG. 36, the main CPU 241 of the center controller 200 executes a center process routine of FIG. 41. The main CPU 241 executes the center process routine to run a bonus game.

As illustrated in FIG. 41, in the center process routine, the main CPU 241 determines whether a jackpot signal is received from the gaming terminal 10 (E1). When it is determined that a jackpot signal is received (E1, YES), a game value indicated by the jackpot signal is summed up and stored (E2). Then the process returns to E1.

On the other hand in E1, if the main CPU 241 determines no progressive signal is received (E1: NO), the main CPU 241 determines if the jackpot value equals or surpasses a predetermined value (E3). When the main CPU 241 determines that the jackpot value equals or surpasses the predetermined value (E3: YES), a bonus game start signal is output to each of the gaming terminals 10 (E4). Next, a process of E1 is executed.

Meanwhile, when the main CPU 241 determines that the jackpot value is less than a predetermined value (E3, NO), the main CPU 241 determines whether a winning signal is received from the terminal controller 100 (E5). If the main CPU 241 determines that no winning signal is received (E5: NO), the process returns to E1. On the other hand, when the main CPU 241 determines that a winning signal is received (E5, YES), the main CPU 241 determines the number of light emitting portions 303 of a path unit 301 to be activated, based on a winning (E6). Then, the main CPU 241 updates the path unit activation state table based on the determined number of light emitting portions 303 to be activated (E7). Then, the main CPU 241 activates the determined number of light emitting portions 303 towards the bonus payout display unit 300 (E8).

Next, it is determined whether a bonus payout is to be awarded, by determining whether the light emitting portions 303 of any of the path units 301 have been lighted up to the bonus payout display unit 300 (E9). When it is determined that a bonus payout is not to be awarded (E9, NO), the process returns to E1. On the other hand, when it is determined that a bonus payout is to be awarded (E9, YES), a bonus award process is run to award a bonus payout, a bonus award signal is output to a gaming terminal 10 through which a bonus payout is awarded (E10). Then, consumed jackpot value is deducted from the RAM 243 (E11), a bonus game end signal is output to each of the gaming terminals 10 (E12). Afterwards, emission color selection authorization signal is output to each of the gaming terminals 10 in descending order of contribution amount. Specifically, an emission color selection authorization signal including information about the emission color management table shown in FIG. 30, is output to a gaming terminal 10 whose contribution amount is the highest, with reference to the contribution amount management table shown in FIG. 32. When an emission color signal is received from the gaming terminal 10 to which the emission color selection authorization signal is output, the emission color management table is updated based on the information received. Afterwards, the same process is repeated to another gaming terminal 10 whose contribution amount is the second highest. The same process is repeated for all the gaming terminals 10 to determine an emission color of the lamp 30 of each of the gaming terminals 10. Then, the process returns to E1.

As described above, each of the gaming terminals 10 are allowed to receive an input through the touch panel 103 in descending order of how much value each of the gaming terminals have entered as a bet, which is stored in the contribution amount memory. The lamp 30 is activated to light in a color according to an input through the touch panel 103, at a predetermined timing. A base game is run in response to a bet in the each of the gaming terminals 10, independently of another gaming terminal 10, and a payout according to a predetermined winning is awarded. Further, a bonus game is run based on a predetermined condition. For the each of the gaming terminals 10, one or more light emitting portions 303 of associated one of the path units 301 are additionally activated according to a predetermined winning, sequentially from one end of the path unit 301 closer to the associated gaming terminal 10, so as to light in the same color as the lamp 30 of the gaming terminal 10, each time a winning is resulted in the gaming terminal 10. When the path unit 301 is activated up to the light emitting portions 303 at an end of the path unit 301 closer to the bonus payout display unit 300, a bonus payout is awarded through the gaming terminal 10 associated with the path unit 301.

Thus, a path unit 301 lights in the same color as the lamp 30 of the associated one of the gaming terminals 10. As a result, the gaming terminals 10 are easily associated with path units 301 respectively. Further, an emission color of the light emitting portions 303 in addition to the emission color of the lamp 30 are determined according to an input through the touch panel 103. Yet further, an emission color of the lamp 30, and an emission color of the associated light emitting portions 303 are determined in descending order of the contribution amount to the bonus payout. This realizes a new entertainment characteristic.

Hereinabove, Embodiment 2 of the present invention is described. The present invention is not limited to the above Embodiment 2. The below-described another version of Embodiment 2 may be applied to the present invention. The following describes a base game according to the other version of Embodiment 2 of the present invention.

Figure 42:
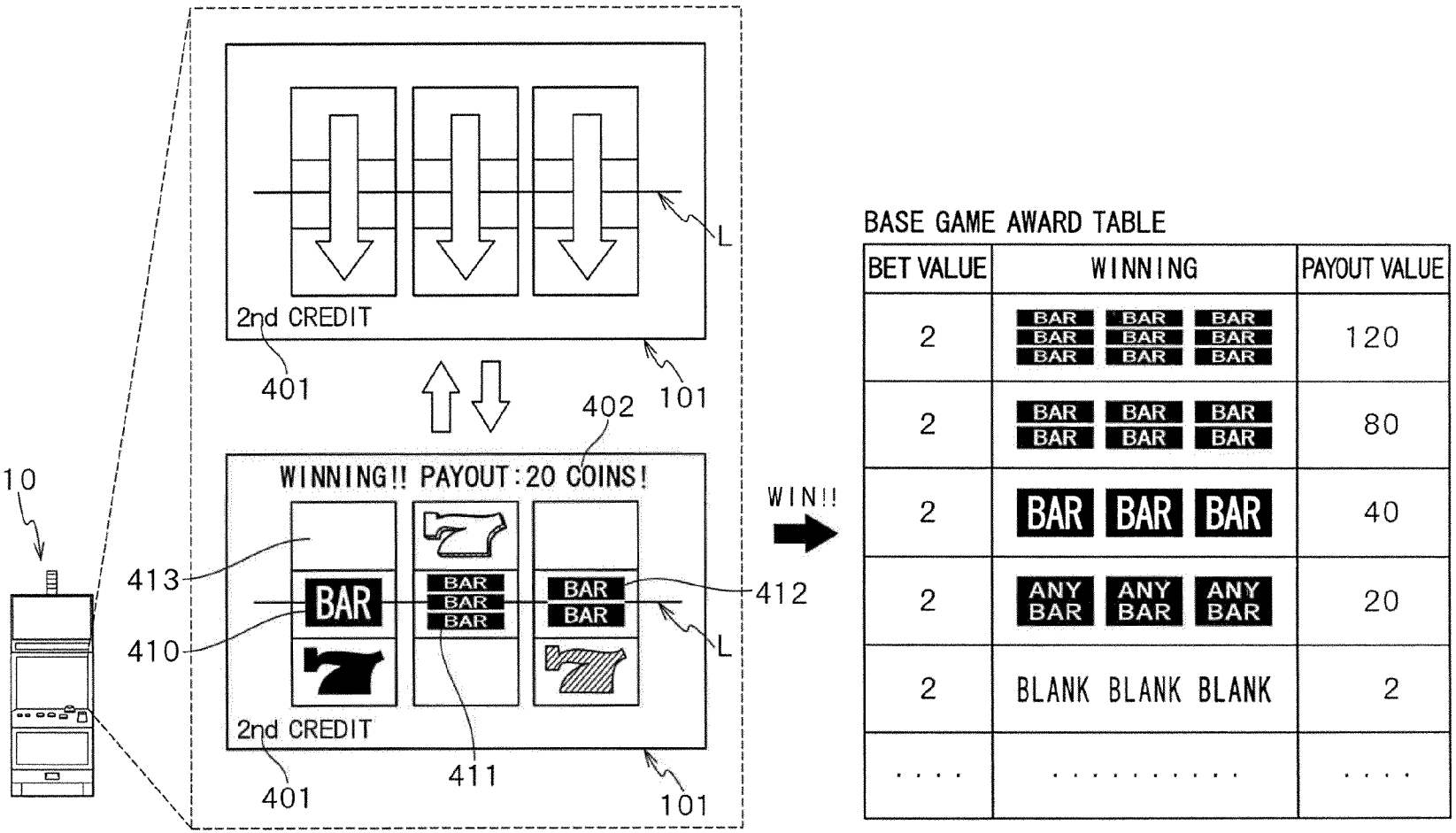
FIG. 42 is an explanatory diagram illustrating a base game according to another version of Embodiment 2 of the present invention.

As illustrated in FIG. 42, the terminal display 101 according to the other version of Embodiment 2 has arrangement areas forming a matrix of three rows/three columns. The arrangement areas of the middle row are set as a payline L. When the relation among the symbols rearranged on the payline L results in winning, a payout according to the resulted winning is awarded. Further, the terminal display 101 displays a credit 401 indicating an amount of a bet game value.

For example, as shown in FIG. 42, when the credit indicated by the credit 401 is "2st CREDIT," the amount of a game media bet is two coins. As a result of symbol rearrangement, a "1BAR" as a symbol 410, a "3BAR" as a symbol 411, and a "2BAR" as a symbol 412 are rearranged on the payline L. These symbols form a winning of "ANY-BAR" "ANY-BAR" "ANY-BAR," which is resulted when the credit 401 indicates two coins. Twenty coins are paid out as a payout for this winning.

FIG. 43 illustrates a base game payout table. The base game payout table is used when the main CPU 41 determines that a winning is resulted in a base game, and awards a payout according to the resulted winning. The base game payout table has a bet value column, a winning column, and a payout value column. The bet value column indicates the number of coins bet. The winning column indicates a combination of symbols to be rearranged on the payline L, which is a condition for a winning to be resulted. The payout value column indicates the number of coins to be paid out when a winning is resulted. The following describes an example indicated in FIG. 43. When three symbols "3BAR" are rearranged on the payline L, and the bet value is 1 or 2, the payout amount is 60 or 120, respectively. When three symbols "2BAR" are rearranged on the payline L, and the bet value is 1 or 2, the payout amount is 40 or 80, respectively. When three symbols "1BAR" are rearranged on the payline L, and the bet value is 1 or 2, the payout amount is 20 or 40, respectively. When three symbols "ANY-BAR" are rearranged on the payline L, and the bet value is 1 or 2, the payout amount is 10 or 20, respectively. When three symbols "BLANK" are rearranged on the payline L, and the bet value is 1 or 2, the payout amount is 1 or 2, respectively. When three symbols "blue 7" are rearranged on the payline L, and the bet value is 3, the payout amount is 1,800. When three symbols "red 7" are rearranged on the payline L, and the bet value is 3, the payout amount is 100. When three symbols "ANY-7" are rearranged on the payline L, and the bet value is 3, the payout amount is 100. Thus, the greater the bet value, the greater the payout amount for a resulted winning. Hence, a player may bet a greater amount of game value (bet value).

The following describes a bonus game of the gaming machine according to yet another version of Embodiment 2 of the present invention. The bonus game according to this version of Embodiment 2 is configured to award a payout according to a predetermined winning. The number of the light emitting portions 303 according to accumulated points awarded are activated towards the bonus payout display unit 300.

Figure 44:
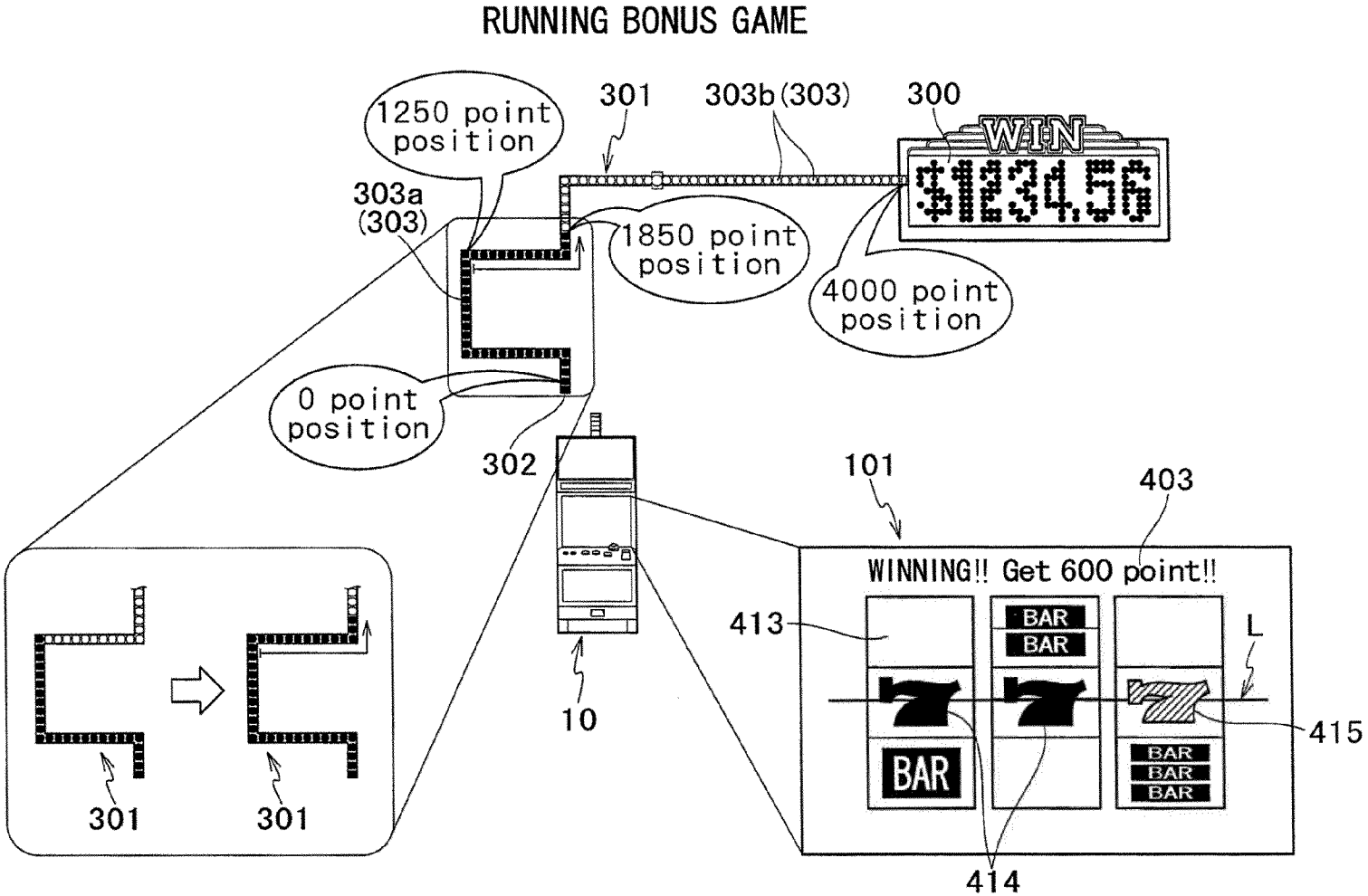
FIG. 44 is an explanatory diagram illustrating a bonus game according to the other version of Embodiment 2 of the present invention.

The following describes an example illustrated in FIG. 44. The position 302 of the gaming terminal 10 of the FIG. 44 indicates zero points, and the position of the bonus payout display unit 300 indicates 4,000 points. Accumulated points awarded in the gaming terminal 10 is 1,250 points, so that the light emitting portions 303 of the path unit 301 are lighted up to a position indicating 1,250 points. In this example, a winning is resulted with a "red 7" as a symbol 414, a symbol 414, and a "blue 7" as a symbol 415 rearranged. In this case, three winnings are resulted. Two winnings out of the three winnings are resulted by rearranging a symbol 414 on the payline L, and the other one winning is resulted by rearranging a symbol 415 on the payline L. The payout for a winning resulted with a symbol 414 is a hundred fifty (150) points, and the payout for a winning resulted with a symbol 415 is three hundred (300) points. Thus, the total points for the three winnings is six hundred (600) points. These six hundred points are paid out through the gaming terminal 10, so the accumulated points of the gaming terminal 10 is 1,250+600=1,850 points. The light emitting portions 303 are activated up to the position indicating 1,850 points. Thus, a point according to a resulted predetermined winning is awarded during the bonus game. A jackpot is awarded when the accumulated points including a newly awarded point reach a predetermined amount (i.e., 4,000 points).

FIG. 45 illustrates a bonus game payout table. The bonus game payout table is used when the main CPU 41 determines that a winning is resulted in the bonus game, and awards a payout point according to the resulted winning. The bonus game payout table has a winning column and a payout point column. The winning column indicates a combination of symbols to be rearranged on the payline L, which is a condition for a winning to be resulted. The payout point column indicates an amount of points to be awarded for a resulted winning. The following describes an example illustrated in FIG. 45. When three symbols "blue 7" are rearranged on the payline L, the payout point is 7,000. When one symbol "blue 7" is rearranged on the payline L, the payout point is 300. When one symbol "red 7" is rearranged on the payline L, the payout point is 150. When one symbol "3 BAR" is rearranged on the payline L, the payout point is 30. When one symbol "2 BAR" is rearranged on the payline L, the payout point is 20. When one symbol "1BAR" is rearranged on the payline L, the payout point is 10.

Hereinabove, a gaming machine according to yet other version of Embodiment 2 of the present invention is described. Embodiment 2 deals with a case where a timing of starting a bonus game is a timing at which a progressive value stored reaches or exceeds a certain amount (e.g., two hundred dollars as a fixed value); however, such timing of starting a bonus game is not limited to this. For example, the gaming machine may randomly change, within a predetermined range (e.g., two hundred to three hundred dollars), the threshold progressive value where the gaming machine starts running the bonus game Further, although the gaming machine of Embodiment 2 of the present invention awards a jackpot when the accumulated points including a newly awarded point reach a predetermined amount, it is not limited to this. The gaming machine may, for example, award a jackpot when the accumulated points including a newly awarded point reach an amount which changes in each bonus game within a predetermined range (e.g., 3,000 to 5,000).

Further, the gaming machine may be capable of selecting and setting a necessary amount of points for awarding a jackpot through a gaming terminal. Specifically, the gaming machine may be capable of selecting any one of the values (e.g., 3,000 points, 4,000 points, and 5,000 points), through an input from outside or the like, as points necessary for awarding a jackpot.

As yet other version of Embodiment 2 of the present invention, each of the gaming terminals of the gaming machine may have the same difficulty (winning percentage in a bonus game) for the associated path units to be activated up to the bonus payout display unit. Further, the gaming terminal may set the difficulty (winning percentage in a bonus game) for each of the gaming terminals based on the contribution amount to the jackpot of each of the gaming terminals.

Embodiment 3

The following describes Embodiment 3 of a gaming machine and a playing method thereof according to the present invention. Note that reference numerals respectively given to members in the figures referred to in this embodiment, reference symbols (such as "S") respectively representing steps in flowcharts in the figures, and description using these reference numerals and reference symbols are effective only in this embodiment. Each of these numerals and symbols does not represent a member or step in other embodiments.

Figure 46:
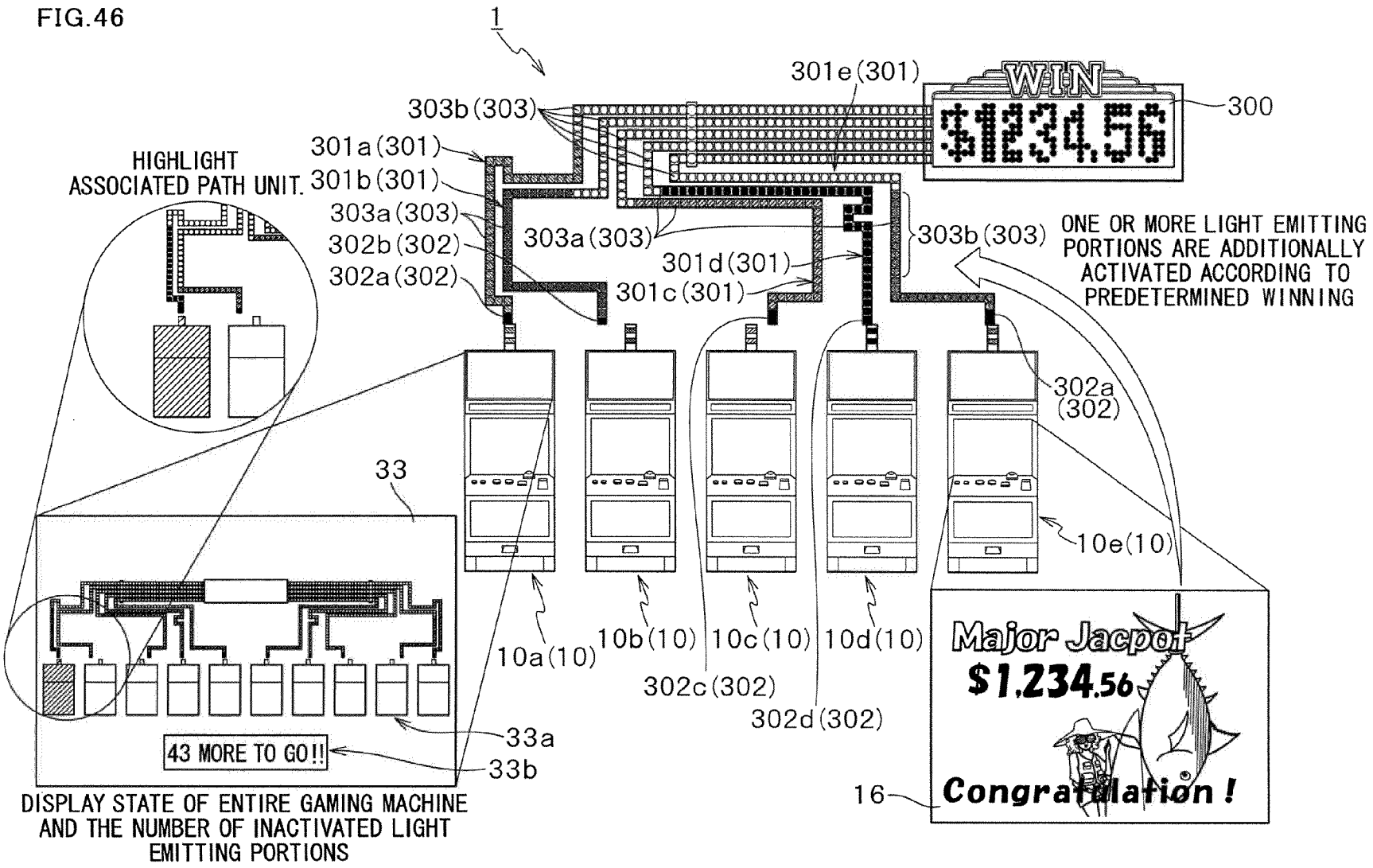
FIG. 46 is an explanatory diagram illustrating a gaming machine and a playing method thereof, according to Embodiment 3 of the present invention.

As illustrated in FIG. 46, a gaming machine 1 realizes a playing method including the steps of: for each of the plurality of gaming terminals 10, running a base game which awards a payout according to a predetermined winning independently of another gaming terminal, and awarding a payout according to a predetermined winning; running a bonus game configured to award a bonus payout greater than the payout awarded in the base game; for each of the plurality of gaming terminals, additionally activating one or more of the associated light emitting portions 303 according to a predetermined winning, sequentially from a light emitting portion closest to the gaming terminal 10; having a light emission mode obtain unit obtain a light emission mode of each of the plurality of path units 301; and when the path unit 301 is activated up to a light emitting portion 303 at an end of the path unit 301 closer to a bonus payout display unit 300, awarding a bonus payout through the gaming terminal 10.

Figure 47:
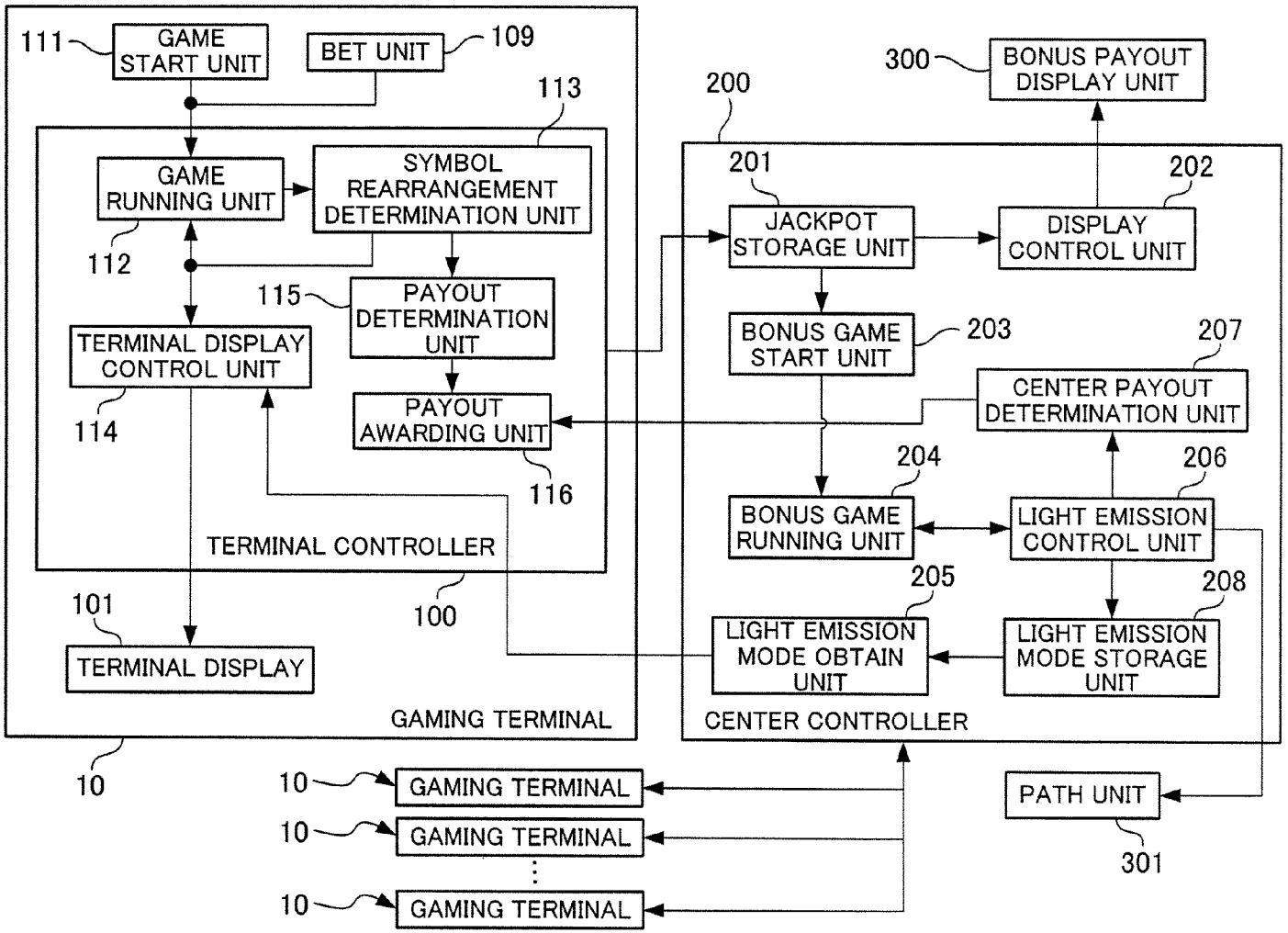
FIG. 47 is a block diagram of the gaming machine.

As illustrated in FIG. 47, the gaming machine 1 which executes the above playing method has the bonus payout display unit 300, a center controller 200, the gaming terminals 10, and the path units 301. Each of the path units 301 is formed with light emitting portions 303. Each of the gaming terminals 10 includes a terminal display 101 and a terminal controller 100.

Figure 48:
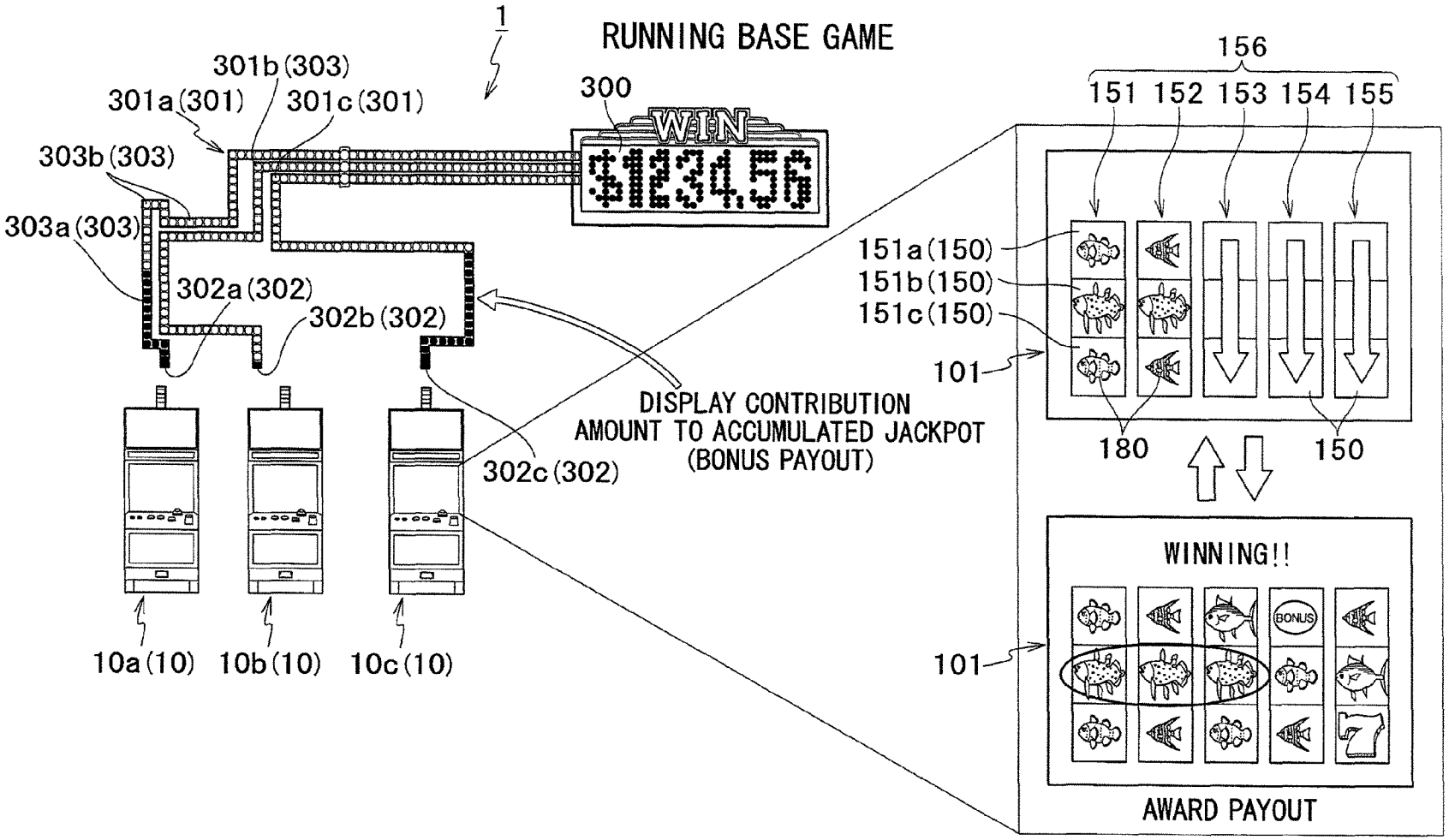
FIG. 48 is an explanatory diagram of a base game.

As illustrated in FIG. 48, the terminal display 101 has arrangement areas 150, and symbols 180 are arranged in the arrangement areas 150.

The "arranging" in this specification means a state where the symbols 180 can be visually observed by a player. That is, the wording means a state where the symbols 180 are displayed in the arrangement areas 150, in FIG. 48. Arranging the symbols 180 again after dismissing the symbols 180 is referred to as "rearranging".

The terminal display 101 may have a mechanical structure adopting a reel device which rotates a reel to arrange the symbols 180. Alternatively, the terminal display 101 may have an electric structure in which a video reel is displayed as an image and symbols 180 on the video reel are arranged in the form of an image. Further, the terminal display 101 may adopt a combination of the mechanical structure (reel) and the electrical structure (video reel). Examples of the electrical structure include a liquid crystal display device, a CRT (cathode-ray tube), a plasma display device, or the like. Further, the number of arrangement areas 150 is not limited. A specific structure of the terminal display 101 will be detailed later.

The bonus payout display unit 300 displays an amount of a bonus payout to be awarded in the bonus game. An example shown in FIG. 48 illustrates that an amount of a progressive jackpot is $1,234.56. In Embodiment 3, the bonus payout display unit 300 has an arrangement of a plurality of LEDs as illuminants; however, the bonus payout display unit 300 may be structured as one liquid crystal display. A light emitting portion is not limited to an LED (light-emitting diode) as long as the light emitting portion emits light.

The path units 301 are respectively associated with the gaming terminals 10. Specifically, each of the path units 301 having an alignment of light emitting portions 303 has one end provided to a nearby portion of associated one of the gaming terminals 10, and the other end provided to a nearby portion of the bonus display unit 300. That is, one path unit 301 has light emitting portions 303 aligned to form a path from the associated gaming terminal 10 to the bonus payout display unit 300.

An example indicated in FIG. 48 illustrates that a path unit 301*a* forms a path from a position 302*a* of a nearby portion of a gaming terminal 10*a* to the bonus payout display unit 300. Likewise, a path unit 301*b* forms a path from a position 302*b* of a nearby portion of a gaming terminal 10*b* to the bonus payout display unit 300. Other path units 301*c* to 301*j* are formed in the same manner. Thus, the path units 301 are respectively associated with the gaming terminals 10.

Each of the light emitting portions 303 is an LED (light-emitting diode), and controlled to light in multicolor. The each of the light emitting portions 303 turns off when inactivated, and turns on when activated. In FIG. 48, activated light emitting portions 303 are indicated as light emitting portions 303*a*, and inactivated light emitting portions 303 as light emitting portions 303*b*. The light emitting portions 303 are controlled to be sequentially activated from the light emitting portion 303 of one end of one path unit closer to the associated one of the gaming terminals 10, to the light emitting portion 303 of the other end of the path unit closer to the bonus payout display unit 300. That is, the path unit 301 is controlled so that one or more of the light emitting portions 303 are additionally activated sequentially from the gaming terminal 10 to the bonus payout display unit 300.

Note that a light emitting portion 303 is not limited to an LED, as long as the light emitting portion 303 emits light. Further, an activation of the light emitting portion 303 is not limited to turning on the light emitting portion 303, but activation may be blinking the light emitting portion 303. In addition, the light emitting portion 303 may be capable of lighting only in one color; however, the light emitting portion 303 is preferably capable of lighting in multicolor in order to achieve a colorful effect.

(Terminal Controller 100)

The terminal controller 100 of each of the gaming terminals 10 is configured to execute: a first process of running a base game which awards a payout according to a predetermined winning, independently of another gaming terminal 10, and awarding a payout according to a predetermined winning; and a second process of awarding a bonus payout based on a command from the center controller 200. In other words, the terminal controller 100 has a first processing unit and a second processing unit.

The terminal controller 100 is connected to the center controller 200 and is in communication with the center controller 200.

As illustrated in FIG. 47, the terminal controller 100 is connected to a game start unit 111. The game start unit 111 has a function of outputting a game start signal in response to an operation by a player. The game start signal output is then input to a later-described game running unit 112.

Further, the terminal controller 100 is connected to a bet unit 109. The bet unit 109 has functions of receiving a bet entered through an operation by the player, and outputting a BET signal in response to the bet entered. The bet signal output is input to a later-described game running unit 112.

The terminal controller 100 has a game running unit 112, a symbol rearrangement determining unit 113, and a terminal display control unit 114. The game running unit 112 runs a base game, triggered by a game start signal from the game start unit 111. In the base game, symbols 180 are rearranged in the arrangement areas 150 of the terminal display 101. Further, the terminal controller 100 outputs a progressive signal, triggered by the game start signal. The progressive signal indicates a game value.

The symbol rearrangement determination unit 113 determines, based on the state of game run by the game running unit 112, symbols 180 to be rearranged in the arrangement areas 150.

The terminal display control unit 114 displays the symbols 180 on the terminal display 101 under control of the game running unit 112 and on the basis of a determination of the symbol rearrangement determining unit 113. A specific display state will be detailed later.

Further, the terminal controller 110 has a payout determination unit 115 and a payout awarding unit 116. The payout determination unit 115 determines whether or not to award a payout, based on a relation among the symbols 180 rearranged in the arrangement areas 150 of the terminal display 101. In short, the payout determination unit 115 determines whether a predetermined winning is resulted. The payout awarding unit 116 awards a payout on the basis of a determination of the payout determination unit 115. Further, the payout awarding unit 116 awards a payout based on a command from the center controller 200.

Each block of the game controller 100 may be realized with hardware or with software as needed.

(Operation of Terminal Controller 100)

The following describes an operation of the terminal controller 100 in the above structure. First, the BET unit 109 accepts a BET entered through an operation by a player. Then, in response to the operation, the game start unit 111 outputs a game start signal to cause the game running unit 112 to start a base game. When the base game is started, the symbol rearrangement determining unit 113 determines symbols 180 to be rearranged in the arrangement areas 150. The symbols 180 determined by the symbol rearrangement determining unit 113 undergo an image processing in the terminal display control unit 114, and are displayed on the terminal display 101. The terminal display control unit 114 rearranges the symbols 180 in the arrangement areas 150, according to the arrangement determined.

The payout determination unit 115 determines whether a predetermined winning has been resulted, based on a relation among the symbols 180 rearranged in the arrangement areas 150. When it is determined that a predetermined winning has been resulted, the payout awarding unit 116 awards a payout. Thus, the terminal controller 100 of the gaming terminal 10 executes the first process of, running a base game which awards a payout according to a predetermined winning, independently of another gaming terminal 10, and awarding a payout according to a predetermined winning.

Further, when a predetermined winning is resulted, the terminal controller 100 transmits, to the center controller 200, a winning signal indicating that a predetermined winning has been resulted, based on a predetermined condition that a bonus game as a shared game is being run, or the like.

The payout awarding unit 116 awards a bonus payout when receiving a command from the center controller 200 to award a bonus payout. Thus, the terminal controller 110 executes the second process of awarding a bonus payout based on a command from the center controller 200.

(Center Controller 200)

The center controller 200 is configured to execute: a third process of running a bonus game configured to award a bonus payout greater than a payout awarded in a base game, based on a predetermined condition; a fourth process of additionally activating one or more of the light emitting portions 303 according to a predetermined winning, sequentially from one light emitting portion closest to the associated gaming terminal 10; a fifth process of, having the light emission mode obtain unit 205 obtain a light emission mode of each of the path units 301; a sixth process of displaying, on the terminal display of each of the gaming terminal 10, a light emission mode image and the number of inactivated light emitting portions 303 of associated one of the path units 301, based on a light emission mode; seventh process of, when the path unit 301 is activated up to a light emitting portion 303 at an end of the path unit 301 closer to the bonus payout display unit 300, commanding the terminal controller 100 of the gaming terminal 10 associated with the path unit 301 to award a bonus payout. In other words, the center controller 200 has a third processing unit, a fourth processing unit, fifth processing unit, sixth processing unit, and a seventh processing unit.

As illustrated in FIG. 47, the center controller 200 is connected to the terminal controller 100 and is in communication with the terminal controller 100.

The center controller 200 has the jackpot storage unit 201, a display control unit 202, a bonus game start unit 203, a bonus game running unit 204, a light emission control unit 206, and a center payout determination unit 207.

The jackpot storage unit 201 stores and sums up a game value indicated by a progressive signal received from the terminal controller 100. The bonus game start unit 203 outputs a bonus game start signal, when the predetermined condition is met. The game start signal output is then input to a later-described bonus game running unit 204. An example of meeting the predetermined condition is a situation where a game value stored in the jackpot storage unit 201 sums up to a predetermined value or greater.

The bonus game running unit 204 runs a bonus game where players compete against one another for a jackpot, triggered by a bonus game start signal received from the bonus game start unit 203.

The display control unit 202 displays, on the bonus payout display unit 300, the sum of the value of the jackpot stored in the jackpot storage unit 201.

The light emission control unit 206 activates the number of light emitting portions 303 determined by the bonus game running unit 204. The light emission control unit 206 may activate the one or more light emitting portions 303 so as to indicate how much each of the gaming terminals 10 has contributed to the accumulated jackpot stored in the jackpot storage unit 201, in a form of the number of the light emitting portions 303 activated.

Further, the light emission control unit 206 stores, to a later-described light emission mode storage unit 208, a light emission mode of the light emitting portions 303 of each of the path units 301, each time the light emission control unit 206 controls the light emitting portions 303.

The center payout determination unit 207 determines, for each of the path units 301, whether the light emitting portions 303 are activated up to the bonus payout display unit 300. When the center payout determination unit 207 determines that the light emitting portions 303 of a path unit 301 are activated up to the bonus payout display unit 300, the center payout determination unit 207 commands the terminal controller 100 of the game terminal 10 associated with the path unit 301 to award a bonus payout.

The light emission mode obtain unit 205 obtains a light emission mode of each of the path units 301. Specifically, the light emission mode obtain unit 205 obtains information from the light emission mode storage unit 208, on whether each of the light emitting portions 303 of each of the path units 301 is activated.

The light emission mode storage unit 208 stores an activation state of the light emitting portions 303 of each of the path units 301, based on a signal from the light emission control unit 206.

Meanwhile, each block of the center controller 200 may be realized with hardware or with software as needed.

(Operation of Center Controller 200)

The following describes an operation of the center controller 200 in the above structure. First, a game value is stored and summed up in the jackpot storage unit 201. A bonus game starts when the stored game value sums up to a predetermined value or greater. Thus, the center controller 200 executes the third process of running a bonus game configured to award a bonus payout greater than the payout awarded in the base game, based on a predetermined condition.

The center controller 200 receives a winning signal from the terminal controller 100 each time a predetermined winning is resulted in a gaming terminal 10. When the center controller 200 receives a winning signal, the bonus game running unit 204 determines, based on a predetermined winning, the number of the light emitting portions 303 to be activated. Then, the light emission control unit 206 activates the determined number of light emitting portions 303 in addition to the one or more light emitting portions 303 which have been activated. Thus, the center controller 200 executes the fourth process of, when each time a predetermined winning is resulted in a gaming terminal 10, additionally activating one or more of the associated light emitting portions 303 according to a predetermined winning, sequentially from one end of the path unit closer to the gaming terminal 10.

Further, the light emission control unit 206 controls activation of the light emitting portions 303. The light emission control unit 206 also stores an activation state of each of the light emitting portions 303 in the light emission mode storage unit 208. The light emission mode obtain unit 205 obtains a stored activation state of each of the light emitting portions 303. In other words, the light emission mode obtain unit 205 executes the fifth process of obtaining a light emission mode of each of the path units 301.

Based on the obtained light emission mode of each of the activated light emitting portions 303 of the associated path unit 301, the terminal display control unit 114 displays on the terminal display 101, a light emission mode image 33*a* and an inactivated light emitting portion quantity image 33*b* as indicated in FIG. 46. The inactivated light emitting portion quantity image 33*b* indicates the number of inactivated light emitting portions 303 of the path unit 301 associated with the gaming terminal 10. Note that the display state of the terminal display 101 is not limited to the above. In addition, the light emission mode image 33*a* of Embodiment 3 of the present invention indicates the entire gaming machine 1, as well as the path units 301 of the gaming machine; however, the light emission mode image 33*a* is not limited to this.

As it is obvious from the above explanation, the gaming machine 1 realizes a playing method including the steps of: running a base game which awards a payout according to a predetermined winning in each of the gaming terminal 10 independently of another gaming terminal 10, and awarding a payout according to a predetermined winning; awarding a bonus payout based on a command from the center controller 200; running a bonus game configured to award a bonus payout greater than the payout awarded in the base game, based on a predetermined condition; additionally activating, one or more light emitting portions 303 according to the predetermined winning, sequentially from one light emitting portion closest to the associated gaming terminal 10, each time a predetermined winning is resulted in the gaming terminal 10; having the light emission mode obtain unit 205 obtain a light emission mode of each of the path units 301; displaying, on the terminal display 101 of each of the gaming terminals 10, a light emission mode image based on a light emission mode, and the number of inactivated light emitting portions 303 of the path unit 301 associated with the gaming terminal 10; when the path unit 301 is activated up to the light emitting portion 303 at the end of the path unit closer to the bonus payout display unit 300, commanding the terminal controller of the gaming terminal 10 associated with the path unit 301 to award a bonus payout.

According to the playing method, a base game which awards a payout according to a predetermined winning is run in each of the gaming terminals 10, independently of another gaming terminal 10, and a payout according to a predetermined winning is awarded. Further, a bonus game configured to award a bonus payout greater than the base game is run based on a predetermined condition. For the each of the gaming terminals 10, one or more of the associated light emitting portions 303 are additionally activated according to a predetermined winning, sequentially from one light emitting portion 303 closest to the associated gaming terminal 10, each time a winning is resulted in the gaming terminal 10. The light emission mode obtain unit 205 obtains a light emission mode of each of the path units 301. A light emission mode image based on the light emission mode is displayed on the terminal display 101. When the path unit 301 is activated up to the light emitting portions 303 at an end of the path unit 301 closer to the bonus payout display unit 300, a bonus payout is awarded through the gaming terminal 10 associated with the path unit 301. Thus, a state of a bonus game configured to award a bonus payout greater than the payout awarded in the base game is exhibited by displaying on the terminal display 101, a light emission mode of the each of the path units 301 as a light emission image. Further, the number of inactivated light emitting portions 303 of the path unit 301 associated with the gaming terminal 10 is displayed on the terminal display 101. As a result, a new entertainment characteristic is realized.

(Running Base Game)

The following specifically describes an example of a base game of the gaming machine and the playing method thereof. Note that the following example deals with a case where the terminal display 101 adopts a video reel and arranges symbols on a video reel, as illustrated in FIG. 48.

As illustrated in FIG. 48, a matrix 156 is in the center of the terminal display 101. The matrix 156 includes a symbol column having symbols 180 which is scroll-displayed. The display windows 151 to 155 are respectively divided into upper stages 151*a* to 155*a*, central stages 151*b* to 155*b*, and lower stages 151*c* to 155*c*. The symbols 180 are stopped (arranged) in the stages 151*a* to 155*a*, 151*b* to 155*b*, and 151*c* to 155*c*, respectively. The matrix 156 is a symbol matrix including five columns/three rows. The matrix 156 however is not limited to the one with the five-columns/three-rows.

As is illustrated in FIG. 48, the terminal display 101 variably displays symbols 180 when a base game is started in the gaming terminal 10. When this variable-displaying of symbols 180 stops, symbols 180 are rearranged in the arrangement areas 150. A winning is resulted based on a relation among the symbols 180, and a payout according to the winning is awarded.

Note that a part of a bet entered by a player is stored as a jackpot, each time a bonus game is started. An accumulated amount of a jackpot value is displayed on the bonus payout display unit 300, as illustrated in FIG. 48. Further, one or more light emitting portions 303 of the path unit 301 may be activated in accordance with the amount of the accumulated distribution amount to the jackpot, as illustrated in FIG. 48.

(Running Bonus Game)

The following specifically describes an example of a bonus game of the gaming machine 1 and the playing method thereof.

When an accumulated jackpot value exceeds a certain amount, a bonus game is started. Symbols 180 are rearranged in the matrix 156 in each of the gaming terminals 10 during the bonus game. When a winning is resulted in a gaming terminal 10 with the rearranged symbols 180, the number of the light emitting portions 303 of the associated path unit 301 corresponding to the winning are activated. These operations are repeated until the light emitting portions 303 of any one of the path units 301 are activated up to the bonus payout display unit 300.

Figure 49:
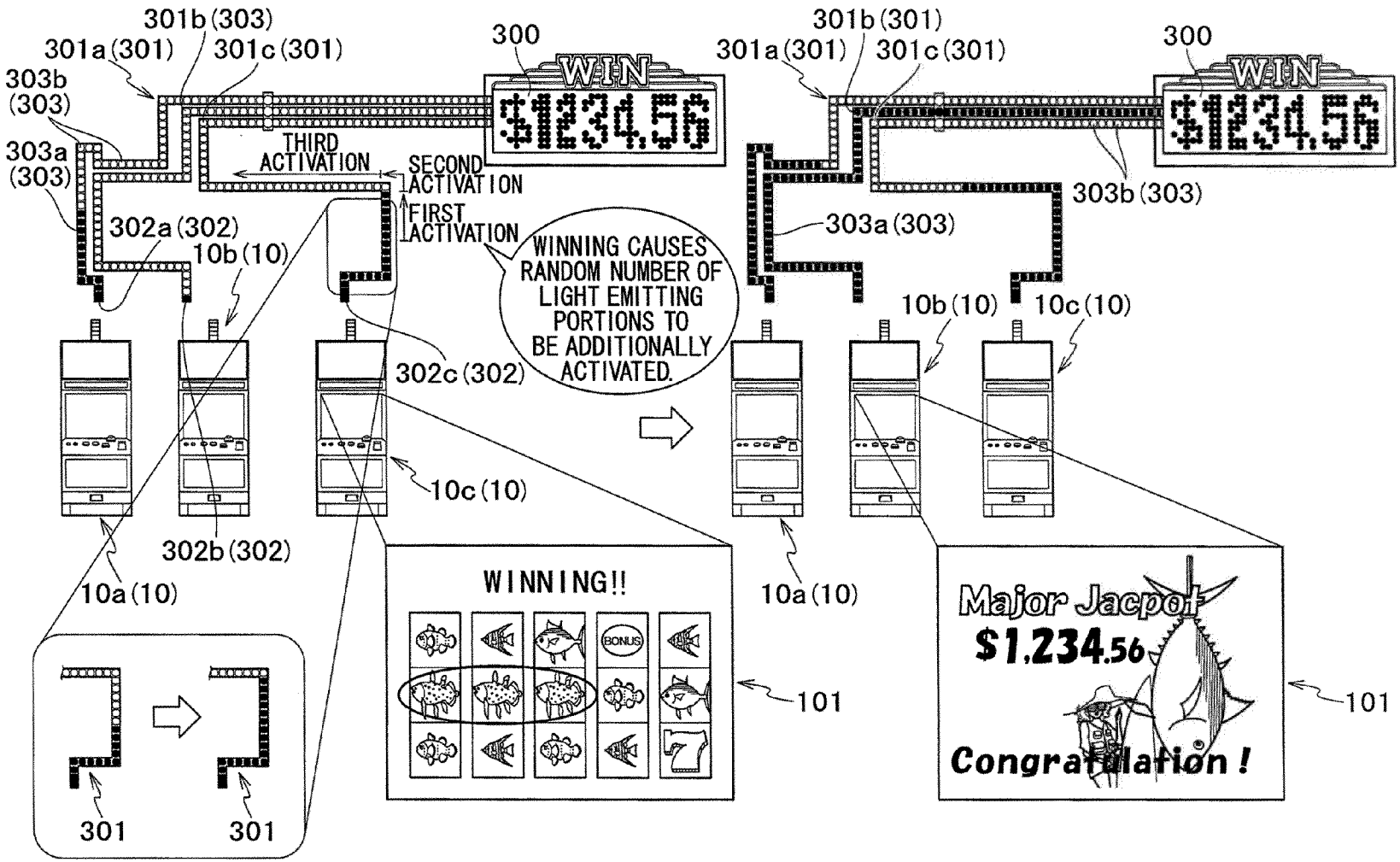
FIG. 49 is an explanatory diagram of a bonus game.

As illustrated in FIG. 49, for instance, when a predetermined winning is resulted in the gaming terminal 10*c* (10), six additional light emitting portions 303 are activated. Then, when another winning is resulted in the same gaming terminal 10*c* (10), one additional light emitting portion 303 is activated. Then, when yet another predetermined winning is resulted in the same gaming terminal 10*c* (10), eighteen additional light emitting portions 303 are activated. Thus, the number of light emitting portions 303 corresponding to a winning are activated towards the bonus payout display unit 300 each time a winning is resulted. Note that how to determine the number of light emitting portions 303 to be activated is not limited as it is determined in Embodiment 3.

When the light emitting portions 303 of a path unit 301 are activated up to the bonus payout display unit 300, a jackpot as a bonus payout is awarded through the gaming terminal 10 associated with the path unit 301. In the example illustrated in FIG. 49, a jackpot is awarded through the gaming terminal 10*b* (10) associated with the path unit 301*b* (301) whose light emitting portions 303 are activated up to the bonus payout display unit 300.

(Symbol, Combination, or the Like)

A terminal display 101 has a matrix 156 including symbol columns each having twenty two symbols 180 as illustrated in FIG. 52. To each of the symbols constituting the columns is given one of code numbers 0 to 21. Each symbol column has a combination of symbols of "Angelfish," "Clownfish," "7," "Tuna," "Coelacanth," and "Bonus."

Of the symbols in the symbol columns, the display windows 151 to 155 each displays (arranges) three successive symbols. The symbols arranged in the upper stages 151*a* to 155*a*, the central stages 151*b* to 155*b*, and the lower stages 151*c* to 155*c* form a symbol matrix having five columns and three rows. When a bet button and a start button are sequentially pressed in this order to start a game, symbols constituting the symbol matrix start scrolling. This scrolling of the symbols stops (rearrangement) after a predetermined period from the beginning of the scrolling.

Further, for each symbol, a predetermined scatter symbol is determined in advance. Scatter symbols are such symbols that a player is put in an advantageous position when a predetermined number or more of them are displayed in the matrix 156. For example, the advantages includes: a state where coins corresponding to the scatter symbols are paid out, a state where the number of coins to be paid out is added to a credit, a state where a bonus game is started.

Here, a bonus game is a gaming state which provides a larger advantage than a base game. In Embodiment 3, the bonus game is a jackpot game. No particular limitation is put on the bonus game, as long as it is a gaming state advantageous to the player, that is, it is more advantageous than the base game. For example, the bonus game may include a state where more game media are obtainable than in the base game, a state where a game medium is obtainable with higher probability than in the base game, a state where a game medium is less consumed than in the base game, and the like. Specifically, a free game, a second game, a feature game, and the like may be mentioned as examples of the bonus game.

(Mechanical Structure of Gaming Machine 1)

Next, the following describes a specific example of mechanical and electrical structures of the gaming machine 1 thus structured.

A gaming machine 1 is placed in a gaming facility such as a casino. This gaming machine 1 runs a unit game which involves a game medium. The game medium is a coin, bill, or a value in the form of electronic information. However, the game medium in the present invention is not particularly limited. For example, a medal, token, electronic money, ticket or the like are also possible. Further, the ticket is not particularly limited and may be a later-described ticket with a barcode or the like ticket.

Figure 51:
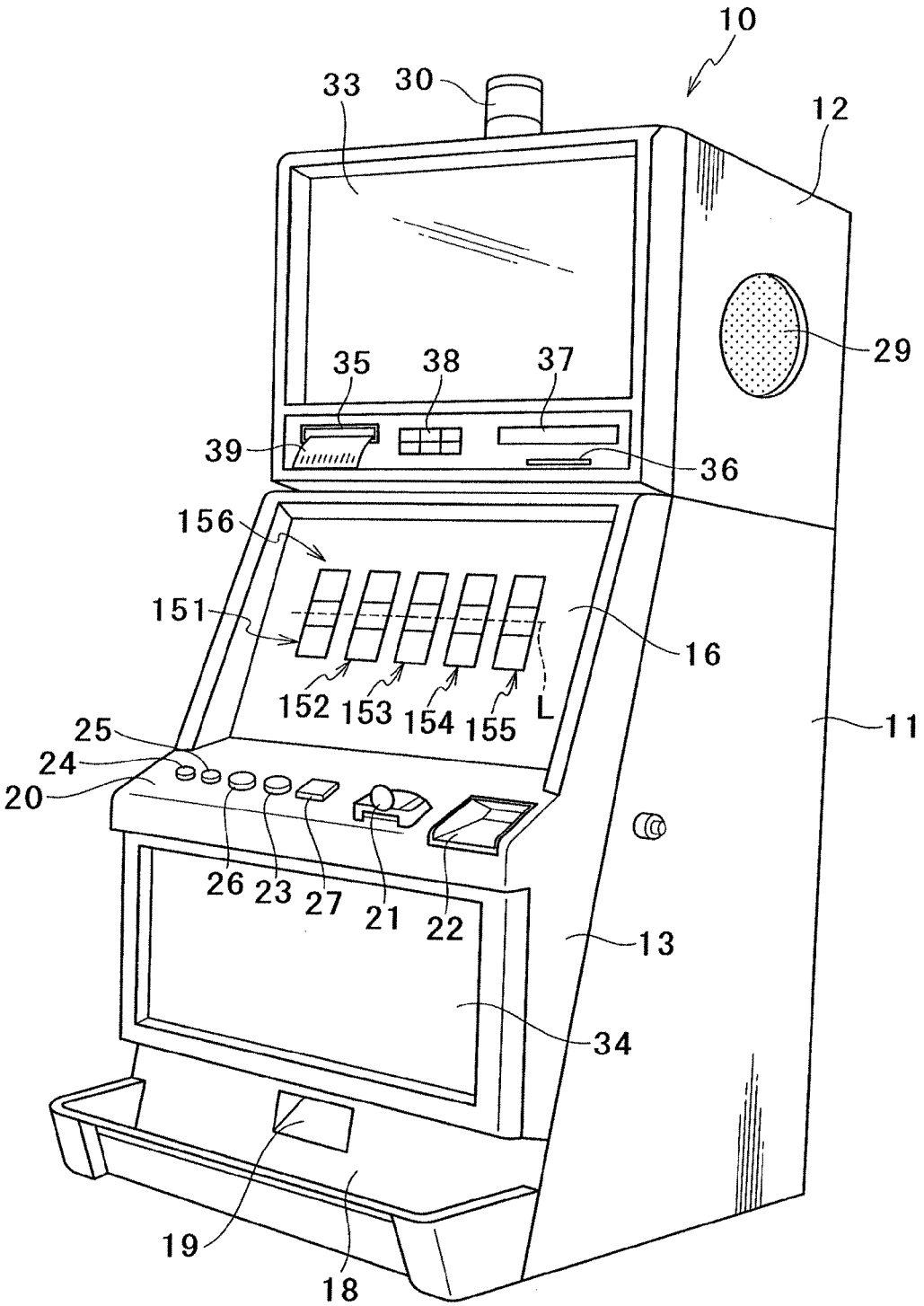
FIG. 51 is a perspective view illustrating an external appearance of a gaming terminal.

As illustrated in FIG. 51, the gaming machine 1 has: gaming terminals 10 which runs a base game independently of one another; a center controller 200 which runs a bonus game, is connected to the gaming terminals 10 and is in communication with the gaming terminals 10; a bonus payout display unit 300 which displays an amount of a bonus payout awarded in a bonus game; path units 301 respectively associated with the gaming terminals 10, each path unit 301 having light emitting portions 303 aligned to form a path from a corresponding position 302 allotted to the associated one of the gaming terminals 10 to the bonus payout display unit 300.

As illustrated in FIG. 52, the gaming terminal 10 has: a cabinet 11, a top box 12 provided above the cabinet 11, and a main door 13 provided on the front surface of the cabinet 11. The main door 13 has a lower image display panel 16. The lower image display panel 16 has a transparent liquid crystal panel for displaying various kinds of information. The lower image display panel 16 displays display windows 151 to 155 and a matrix 156 for arranging therein symbols 180. Further, the lower image display panel 16 displays as needed various information and effect images related to a game.

Embodiment 3 deals with a case where the lower image display panel 16 electrically displays symbols 180 arranged in five rows/three columns. However, the present invention is not limited to this.

The lower image display panel 16 displays a single activated pay line L. Note that the number of pay lines L may be two or more. When the number of pay lines L is two or more, the number of pay lines L to be activated may be determined according to a predetermined condition, such as the number of coins placed as a bet.

Note that the lower image display panel 16 may have a credit value indicator and a payout amount indicator. The credit value indicator displays a total value (hereinafter also referred to as total credit value) which a gaming terminal 10 can pay out to a player. When symbols stopped along a pay line L form a winning combination, the payout amount indicator displays the number of coins to be paid out.

Further, a scatter symbol may be adopted, and the number of coins to be paid out may be determined, according to the number of scatter symbols displayed on the matrix 156. Note that the pay line L does not necessarily have to be displayed.

Below the lower image display panel 16 provided are a control panel 20, a coin insertion slot 21, and a bill validator 22. The control panel 20 is provided with various buttons 23 to 27. These buttons 23 to 27 allow a player to input instructions related to a game played by the player. Through the coin insertion slot 21, a coin is received in the cabinet 11.

The control panel 20 has: a spin button 23, a change button 24, a cashout button 25, a 1-bet button 26, and a maximum bet button 27. The spin button 23 is for inputting an instruction to start symbol scrolling. The change button 24 is used to ask a staff in the gaming facility for exchange of money. The cash out button 25 is for inputting an instruction to pay out coins corresponding to the total credit-value into the coin tray 18.

The 1-bet button 26 is used for betting one coin out of those corresponding to the total credit value. The maximum bet button 27 is used for betting, out of those corresponding to the total credit value, a maximum number of coins (e.g., fifty coins) which can be bet in one game.

The bill validator 22 validates whether a bill is genuine or not and receives the genuine bill into the cabinet 11. Note that the bill validator 22 is capable of reading a barcode attached to a later-mentioned ticket 39 having a bar-code (hereinafter simply referred to as ticket 39). When the bill validator 22 reads the ticket 39, it outputs to the main CPU 41 a read signal representing information having read from the barcode.

On the lower front surface of the main door 13, that is, below the control panel 20, a belly glass 34 is provided. On the belly glass 34, a character of a gaming terminal 10 or the like is drawn. On the front surface of top box 12 is provided an upper image display panel 33. The upper image display panel 33 has a liquid crystal panel and displays an effect image, introduction to the game, rules of the game, or the like.

Further, the upper image display panel 33 displays the light emission image 33*a* based on a light emission mode of the path units 301, and the inactivated light emitting portion quantity image 33*b*, as the terminal display 101. The following describes a displayed light emission mode of the path units 301 in detail with reference to FIG. 53.

Figure 53:
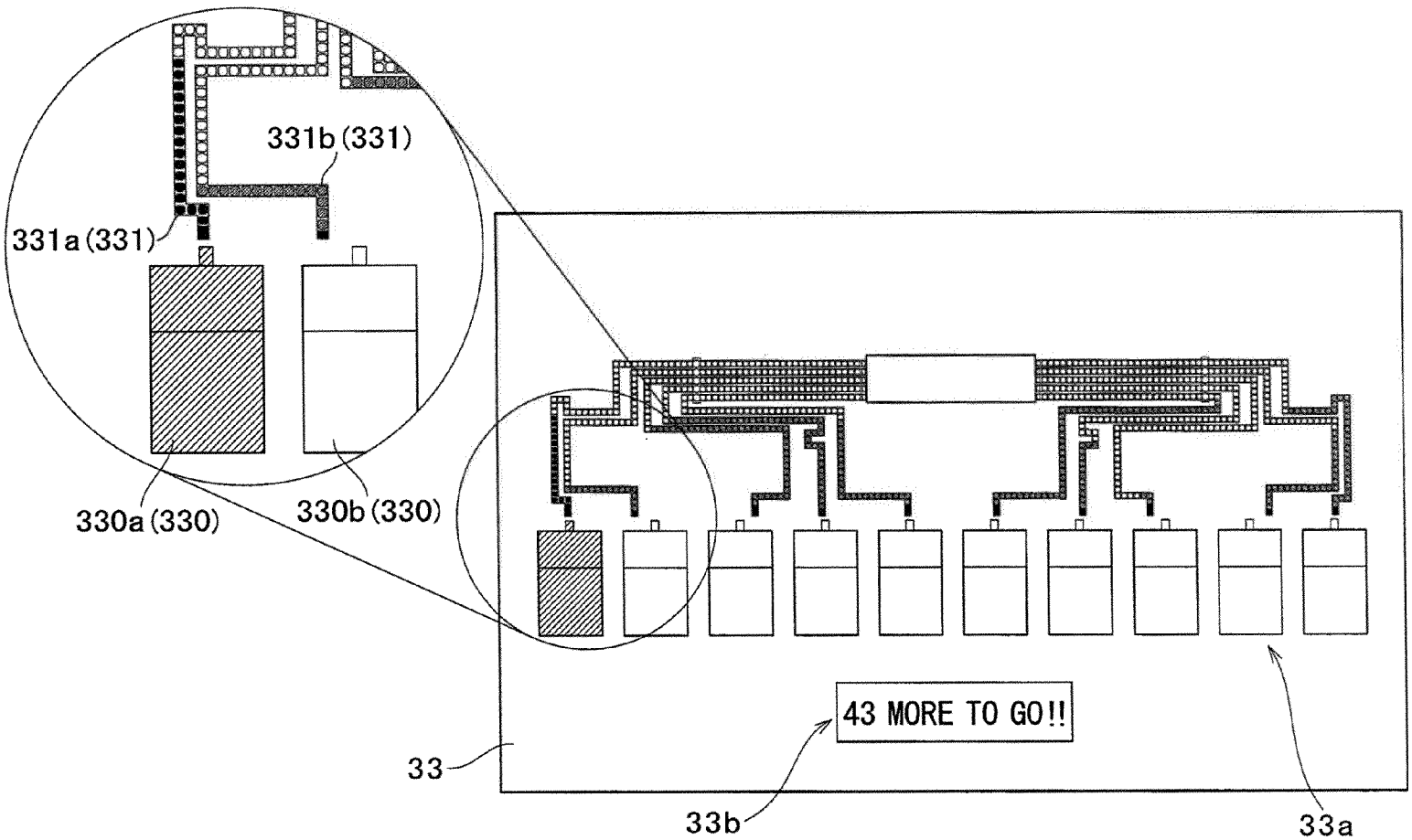
FIG. 53 is a front view of an upper image display panel which displays a light emission mode.

FIG. 53 is a front view of the upper image display panel 33 displaying a light emission mode. The light emission mode image 33*a* is displayed at the center of the upper image display panel 33, and the inactivated light emitting portion quantity image 33*b* is displayed at the lower part of the upper image display panel 33. The light emission mode image 33*a* and the inactivated light emitting portion quantity image 33*b* are formed by a later-described graphic board 68 with a dotted image stored in a ROM 42.

The light emission mode image 33*a* indicates the entire gaming machine 1. The light emission mode image 33*a* includes gaming terminal images 330 and light emitting portion images 331. Among the gaming terminal images 330, one gaming terminal 10 is indicated as a gaming terminal image 330*a*, and the other gaming terminals 10 are indicated as gaming terminal image 330*b*, as illustrated in FIG. 53. While a gaming terminal image 330*b* indicates only a contour of a gaming terminal 10, the gaming terminal image 330*a* is entirely highlighted with one color.

Among the light emitting portion images 331, light emitting portion image 331*a* indicates the light emitting portions 303 of one path unit 301 associated with one gaming terminal 10, and light emitting portion images 331*b* indicate the light emitting portions 303 of other path units 301 associated with other gaming terminals 10. The light emitting portion image 331*a* is highlighted by being displayed in different color from the light emitting portion image 331*b*.

The inactivated light emitting portion quantity image 33*b* displays a test image indicating the number of light emitting portions 303 necessary to be activated in order to acquire a bonus payout. For example in FIG. 53, the inactivated light emitting portion quantity image 33*b* displays a text image reading "43 more to go!," indicating on the upper image display panel that a bonus payout is acquired by activating the left forty three more light emitting portions 303.

Although the light emission mode is displayed on the upper image display panel 33 in Embodiment 3, the display is not limited to this. Further, a light emission mode is displayed with a light emission mode image 33*a* and an inactivated light emitting portion quantity image 33*b*, which are dotted images; however, the display is not limited to this. Light emission mode of the gaming machine 1 may be shown by displaying a photograph/video image of the front aspect of the gaming machine 1. Further, highlighting the light emission mode image 33*a* is not limited to highlighting the image in one color.

Further, the top box 12 has a speaker 29 for performing an audio output. Below the upper image display panel 33 are provided a ticket printer 35, a card reader 36, a data displayer 37, and a keypad 38. The ticket printer 35 prints, on to a ticket, a barcode having encoded data containing credit-value, date and time, identification number of a gaming terminal 10 or the like, thereby issuing a ticket 39 having a barcode attached thereto. A player can play a game in another gaming terminal 10 with the ticket 39 having the barcode, or exchange the ticket 39 having the barcode with bill or the like at a change booth or the like of the game arcade.

The card reader 36 reads/writes data from/into a smart card. The smart card is carried by a player, and stores therein data for identifying the player, data relating to a history of games played by the player, or the like.

The data displayer 37 includes a fluorescent display or the like, and displays the data read by the card reader 36 and the data input by the player through the keypad 38. The keypad 38 is for entering instructions or data relating to issuing of a ticket or the like.

(Electrical Structure of Gaming Machine 1)

Figure 56:
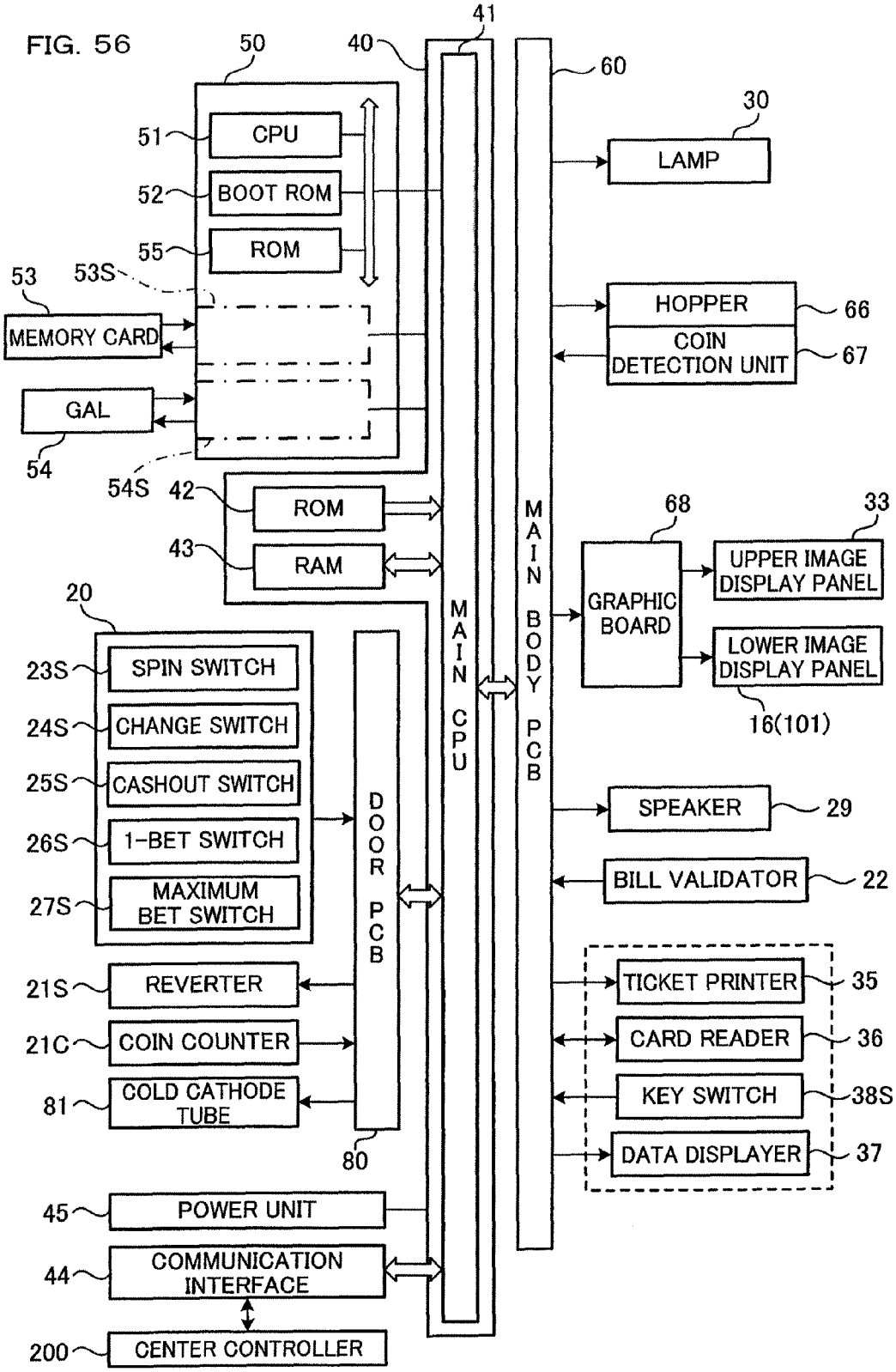
FIG. 56 is a block diagram illustrating an electrical structure of the gaming terminal.
Figure 57:
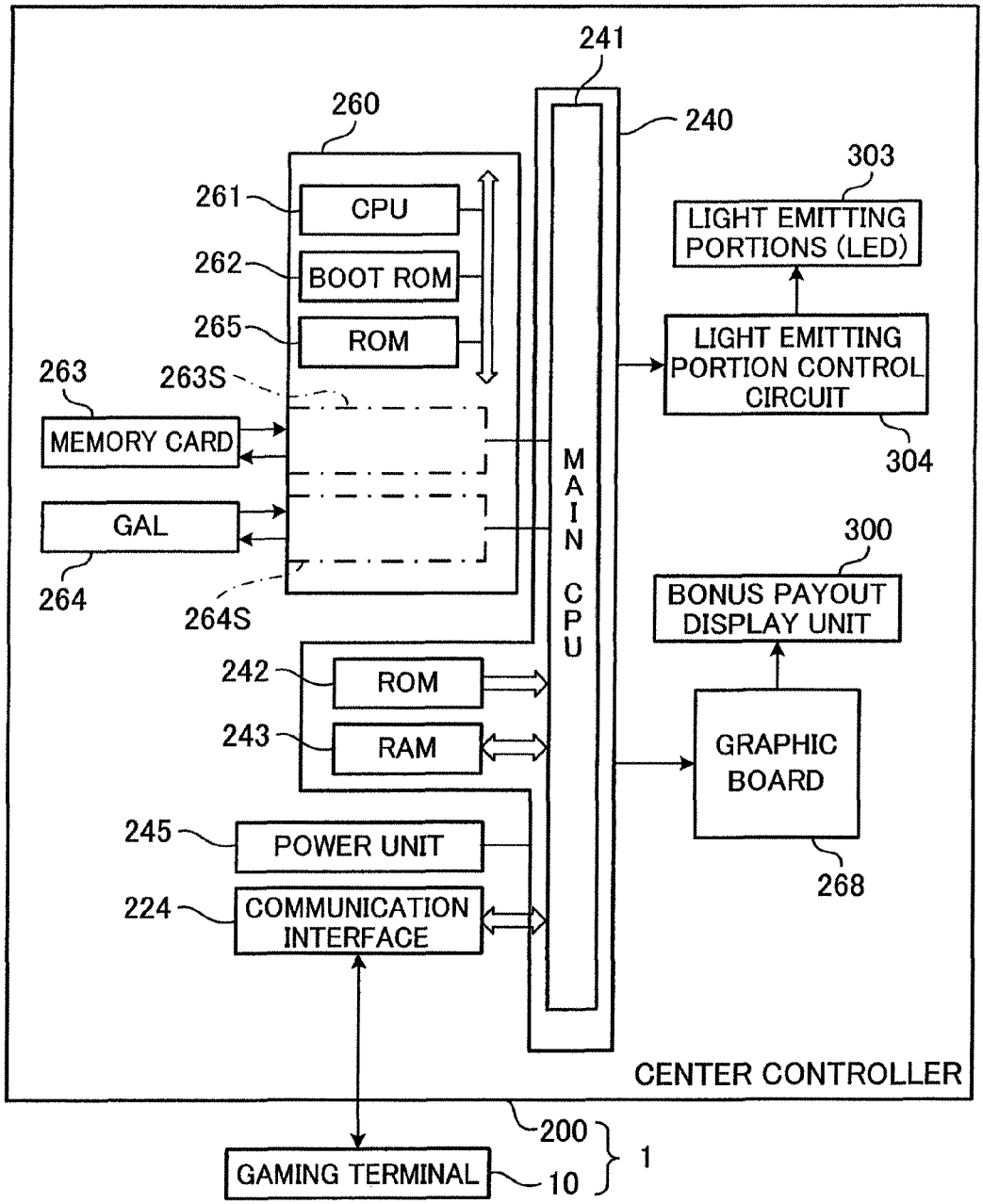
FIG. 57 is a block diagram illustrating an electrical structure of a center controller.

FIGS. 56 and 57 are block diagrams each illustrating an electrical structure of the entire gaming machine 1.

(Electrical Structure of Gaming Terminal 10)

FIG. 56 is a block diagram illustrating an electrical structure of a gaming terminal 10. As illustrated in FIG. 56, the cabinet 11 includes a control unit having a terminal controller 100. As illustrated in FIG. 56, the control unit includes a motherboard 40, a main body PCB (Printed Circuit Board) 60, a gaming board 50, a door PCB 80, various switches, sensors, or the like.

The gaming board 50 is provided with a CPU (Central Processing Unit) 51, a ROM 55, a boot ROM 52, a card slot 53S corresponding to a memory card 53, and an IC socket 54S corresponding to a GAL (Generic Array Logic) 54. The CPU 51, the ROM 55, and the boot ROM 52 are connected to one another through an internal bus.

The memory card 53 stores therein a game program and a game system program. The game program contains a stop symbol determining program. The stop symbol determining program determines symbols (code number corresponding to the symbol) to be stopped in the arrangement areas 150. This stop symbol determining program contains sets of symbol weighting data respectively corresponding to various payout rates (e.g., 80%, 84%, 88%). Each set of the symbol weighting data indicates, for each of the display windows 151 to 155, a code number of each symbol and at least one random numerical value allotted to the code number. The numerical value is a value within a predetermined range of 0 to 256 for example.

The payout rate is determined based on payout rate setting data output from the GAL 54. Based on a set of the symbol weighting data corresponding to the payout rate determined, a symbol to be stopped is determined.

The memory card 53 stores therein various types of data for use in the game programs and the game system programs. For example, the memory card 53 stores a table listing combinations of a symbol 180 to be displayed on the display windows 151 to 155 of FIG. 46 and an associated range of random numerical values. This data is transferred to the RAM 43 of the motherboard 40, at the time of running a game program.

The card slot 53S is structured so as to allow the memory card 53 to be attached/detached to/from the card slot 53S. This card slot 53S is connected to the motherboard 40 through an IDE bus. Thus, the type and content of a game run by a gaming terminal 10 can be modified by detaching the memory card 53 from the card slot 53S, write a different game program and a different game system program into the memory card 53, and inserting the memory card 53 back into the card slot 53S.

Each of the game programs includes a program related to the progress of the game and/or a program for causing a transition to a bonus game. Each of the game programs includes image data and audio data output during the game.

The GAL 54 has input and output ports. When the GAL 54 receives data via an input port, it outputs data corresponding to the input data from its output port. This data from the output port is the payout rate setting data described above.

IC socket 54S is structured so as to allow the GAL 54 to be attached/detached to/from the IC socket 54S. The IC socket 54S is connected to the motherboard 40, via a PCI bus. Thus, the payout rate setting data to be output from GAL 54 can be modified by: detaching the GAL 54 from the IC socket 54S, overwriting the program stored in the GAL 54, and attaching the GAL 54 back to the IC socket 54S.

The CPU 51, the ROM 55 and the boot ROM 52 connected through an internal bus are connected to the motherboard 40 through the PCI bus. The PCI bus communicates signals between the motherboard 40 and the gaming board 50 and supplies power from the motherboard 40 to the gaming board 50. The ROM 55 stores country identification information and an authentication program. The boot ROM 52 stores a preliminary authentication program and a program (boot code) for enabling the CPU 51 to run the preliminary authentication program.

The authentication program is a program (falsification check program) for authenticating the game program and the game system program. The authentication program is a program for confirming and verifying that the game program and the game system program are not falsified. In other words, the authentication program is described in accordance with a procedure for authenticating the game program and the game system program. The preliminary authentication program is a program for authenticating the authentication program. The preliminary authentication program is described in accordance with a procedure for verifying that the authentication program to be authenticated is not falsified. In short, the preliminary authentication program authenticates the authentication program.

The motherboard 40 is provided with a main CPU 41 (terminal controller 100), a ROM (Read Only Memory) 42, a RAM (Random Access Memory) 43, and a communication interface 44.

The main CPU 41 serves as a terminal controller 100 and has a function of controlling the entire gaming terminal 10. In particular, the main CPU 41 controls the following operations: an operation of outputting a signal instructing variable-displaying of symbols 180 to the graphic board 68, which is performed in response to pressing of the spin button 23 after betting of credit; an operation of determining symbols 180 to be stopped after the variable-displaying of symbols 180; and an operation of stopping the symbols 180 thus determined in the display window 151 to 155.

In other words, the main CPU 41 serves as an arrangement controller which arranges symbols to form a new symbol matrix through scrolling of symbols displayed on the lower image display panel 16. This main CPU 41 therefore determines symbols to be arranged in a symbol matrix by selecting symbols to be arranged from various kinds of symbols. Then, the main CPU 41 executes arrangement control to stop scrolling the symbols to present the symbols thus determined.

The ROM 42 stores a program such as BIOS (Basic Input/Output System) run by the main CPU 41, and permanently-used data. When the BIOS is run by the main CPU 41, each of peripheral devices is initialized and the game program and the game system program stored in the memory card 53 are read out through the gaming board 50. The RAM 43 stores data or a program used for the main CPU 41 to perform a process.

The communication interface 44 is provided to communicate with a host computer or the like equipped in the gaming facility, through the network (communication line). The communication interface 44 is also for communicating with the center controller 200 through a communication line. Further, a main body PCB (Printed Circuit Board) 60 and a door PCB 80 are connected to the motherboard 40, through USB (Universal Serial Bus). Further, the motherboard 40 is connected to a power unit 45. The power unit 45 supplies power to the motherboard 40 to boot the main CPU 41 thereof. Meanwhile, the power unit 45 supplies power to the gaming board 50 through the PCI bus to boot the CPU 51 thereof.

The main body PCB 60 and door PCB 80 are connected to various devices or units which generate signals to be input to the main CPU 41, and various devices or units whose operations are controlled by signals from the main CPU 41. Based on a signal input to the main CPU 41, the main CPU 41 runs the game program and the game system program stored in the RAM 43, to perform an arithmetic process. Then, the CPU 41 stores the result of the arithmetic process in the RAM 43, or transmits a control signal to the various devices and units to control them based on the result.

The main body PCB 60 is connected with the lamp 30, a hopper 66, a coin sensor 67, the graphic board 68, the speaker 29, the bill validator 22, the ticket printer 35, the card reader 36, a key switch 38S, and the data displayer 37.

The lamp 30 is turned on/off on the basis of a control signal from the main CPU 41.

The hopper 66 is mounted in the cabinet 11 and pays out a predetermined number of coins from a coin outlet 19 to the coin tray 18, based on a control signal from the main CPU 41. The coin sensor 67 is provided inside the coin outlet 19, and outputs a signal to be input to the main CPU 41 upon sensing that a predetermined number of coins have been delivered from the coin outlet 19.

The graphic board 68 controls image displaying of the upper image display panel 33 and the lower image display panel 16, based on a control signal from the main CPU 41. Further, the graphic board 68 is provided with a VDP (Video Display Processor) for generating image data on the basis of a control signal from the main CPU 41, a video RAM for temporarily storing the image data generated by the VDP, or the like. Note that image data used at the time of generating the image data by the VDP is in a game program which is read out from the memory card 53 and stored in the RAM 43.

The bill validator 22 reads an image on a bill and takes only those recognized as genuine into the cabinet 11. When taking in a genuine bill, the bill validator 22 outputs an input signal indicating the value of the bill to the main CPU 41. The main CPU 41 stores into the RAM 43 a credit-value corresponding to the value of the bill indicated by the signal.

The ticket printer 35 prints a barcode on to a ticket to issue a ticket 39 having the barcode. The barcode contains encoded data such as credit-value stored in the RAM 43, date and time, identification number of the gaming terminal 10, or the like, based on a control signal from the main CPU 41.

The card reader 36 reads out data from the smart card and transmits the data to the main CPU 41. Further, the card reader 36 writes data into the smart card based on the control signal output from the main CPU 41. The key switch 38S is mounted to the keypad 38, and outputs a signal to the main CPU 41 in response to an operation of the keypad 38 by the player. The data displayer 37 displays, based on a control signal from the main CPU 41, the data read by the card reader 36 or the data input by the player through the key pad 38.

The door PCB 80 is connected to the control panel 20, a reverter 21S, a coin counter 21C, and a cold cathode tube 81. The control panel 20 is provided with: a spin switch 23S associated with the spin button 23; a change switch 24S associated with the change button 24; a cashout switch 25S associated with the cashout button 25; a 1-bet switch 26S associated with the 1-bet button 26; and a maximum bet switch 27S associated with the maximum bet button 27. Each of the switches 23S to 27S outputs a signal to the main CPU 41, when a player presses the associated button.

The coin counter 21C is provided within the coin insertion slot 21, and identifies whether the coin inserted into the coin insertion slot 12 by the player is genuine. A coin except the genuine coin is discharged from the coin outlet 19. In addition, the coin counter 21C outputs an input signal to the main CPU 41 upon detection of a genuine coin.

The reverter 21S is operated on the basis of the control signal output from the main CPU 41 and distributes a coin, which is recognized as a genuine coin by the coin counter 21C, to a not-shown cash box or hopper 66 mounted in the gaming terminal 10. In other words, when the hopper 66 is full of the coins, the genuine coin is distributed into the cash box by the reverter 21S. On the other hand, when the hopper 66 is not yet full of the coins, the genuine coin is distributed into the hopper 66. The cold cathode tube 81 functions as a backlight mounted to rear sides of the lower image display panel 16 and the upper image display panel 33. This cold cathode tube 81 turns on according to a control signal from the main CPU 41.

(Electrical Structure of Center Controller 200)

FIG. 57 is a block diagram illustrating an electrical structure of the center controller 200. The center controller 200 is provided therein with a control unit. As illustrated in FIG. 57, the control unit includes a motherboard 240, a gaming board 260, an actuator, or the like.

The gaming board 260 has the same structure as that of the gaming board 50. The motherboard 240 has the same structure as that of the motherboard 40. The communication interface 244 communicates with the terminal controller 100 through a communication line.

The graphic board 268 has the same structure as that of the graphic board 68, except in that the graphic board 268 controls displaying of the bonus payout display unit 300 based on a control signal from the main CPU 241.

A light emitting portion control circuit 304 controls an activation of an LED as a light emitting portion 303. Specifically, the light emitting portion control circuit 304 activates and inactivates the light emitting portions 303 based on a control signal output from the main CPU 241.

(Path Unit Table)

FIG. 54 is a path unit table. The path unit table is stored in a ROM 242, and indicates the number of light emitting portions 303 aligned on each of the path units 301. For example, the path unit table indicates that a hundred light emitting portions are aligned on the path unit 301*a*, a hundred ten on the path unit 301*b*, a hundred twenty on the path unit 301*c*, and a hundred on the path unit 301*d*.

(Path Unit Activation State Table)

FIG. 55 is a path unit activation state table. The path unit activation state table is stored in the RAM 243. The path unit activation state table illustrates the number of activated light emitting portions 303, and the number of light emitting portions 303 left inactivated, for each of the path units 301. The path unit activation state table indicates, for instance, that there are fifty seven activated light emitting portions 303 and forty three light emitting portions 303 are left inactivated on the path unit 301*a*. In this case, as indicated in FIG. 53, a text image reading "43 more to go!" is displayed as the inactivated light emitting portion quantity image 33*b*.

(Operation of Gaming Machine 1: Boot Process)

The following describes a boot process routine which takes place in the gaming machine 1. Upon powering on the gaming machine 1, a boot process routine illustrated in FIG. 58 starts in: the mother board 240 and gaming board 260 in the center controller 200, and in the mother board 40 and the gaming board 50 in the terminal controller 100. The memory cards 53 and 263 are assumed to be inserted into the card slots 53S and 263S of the gaming boards 50 and 260, respectively. Further, the GAL 54 and 264 are assumed to be attached to the IC socket 54S and 264S, respectively.

First, turning on the power switch of (powering on) the power units 45 and 245 boots the motherboards 40 and 240, and the gaming boards 50 and 260. Booting the motherboards 40 and 240 and the gaming boards 50 and 260 starts separate processes in parallel. Specifically, the CPUs 51 and 261 read out preliminary authentication programs stored in the boot ROMs 52 and 262, respectively. Then, preliminary authentication is performed according to the read out programs so as to confirm and verify that no falsification is made to authentication programs, before reading them in the motherboards 40 and 240, respectively (S1). Meanwhile, the main CPUs 41 and 241 of the motherboards 40 and 240 run BIOS stored in the ROMs 42 and 242 to load into the RAMs 43 and 243 compressed data built in the BIOS, respectively (S2). Then, the main CPUs 41 and 241 run a procedure of the BIOS according to the data loaded into the RAMs 43 and 243 so as to diagnose and initialize various peripheral devices (S3).

The main CPUs 41 and 241, which are respectively connected to the ROMs 55 and 265 of the gaming boards 50 and 260 via PCI buses, read out authentication programs stored in the ROMs 55 and 265 and stores them in the RAMs 43 and 243 (S4). During this step, the main CPUs 41 and 241 each derives a checksum through ADDSUM method (a standard check function) which is adopted in a standard BIOS, and store the authentication programs into RAMs 43 and 243 while confirming if the operation of storing is carried out without an error.

Next, the main CPUs 41 and 241 each checks what connects to the IDE bus. Then, the main CPUs 41 and 241 access, via the IDE buses, to the memory cards 53 and 263 inserted into the card slots 53S and 263S, and read out game programs and game system programs from the memory cards 53 and 263, respectively. In this case, the CPUs 41 and 241 each reads out four bytes of data constituting the game program and the game system program at one time. Next, the CPUs 41 and 241 authenticate the game program and the game system program read out to confirm and verify that these programs are not falsified (S5).

When the authentication properly ends, the main CPUs 41 and 241 write and store the authenticated game programs and game system programs in RAMs 43 and 243 (S6).

Next, the main CPUs 41 and 241 access, via the PCI buses, to the GALs 54 and 264 attached to the IC socket 54S·264S, and read out payout rate setting data from the GALs 54 and 264, respectively. The payout rate setting data read out is then written and stored in the RAMs 43 and 243 (S7).

Next, the main CPUs 41 and 241 read out, via the PCI buses, country identification information stored in the ROMs 55 and 265 of the gaming boards 50 and 265, respectively. The country identification information read out is then stored in the RAMs 43 and 243 (S8).

Figure 59:
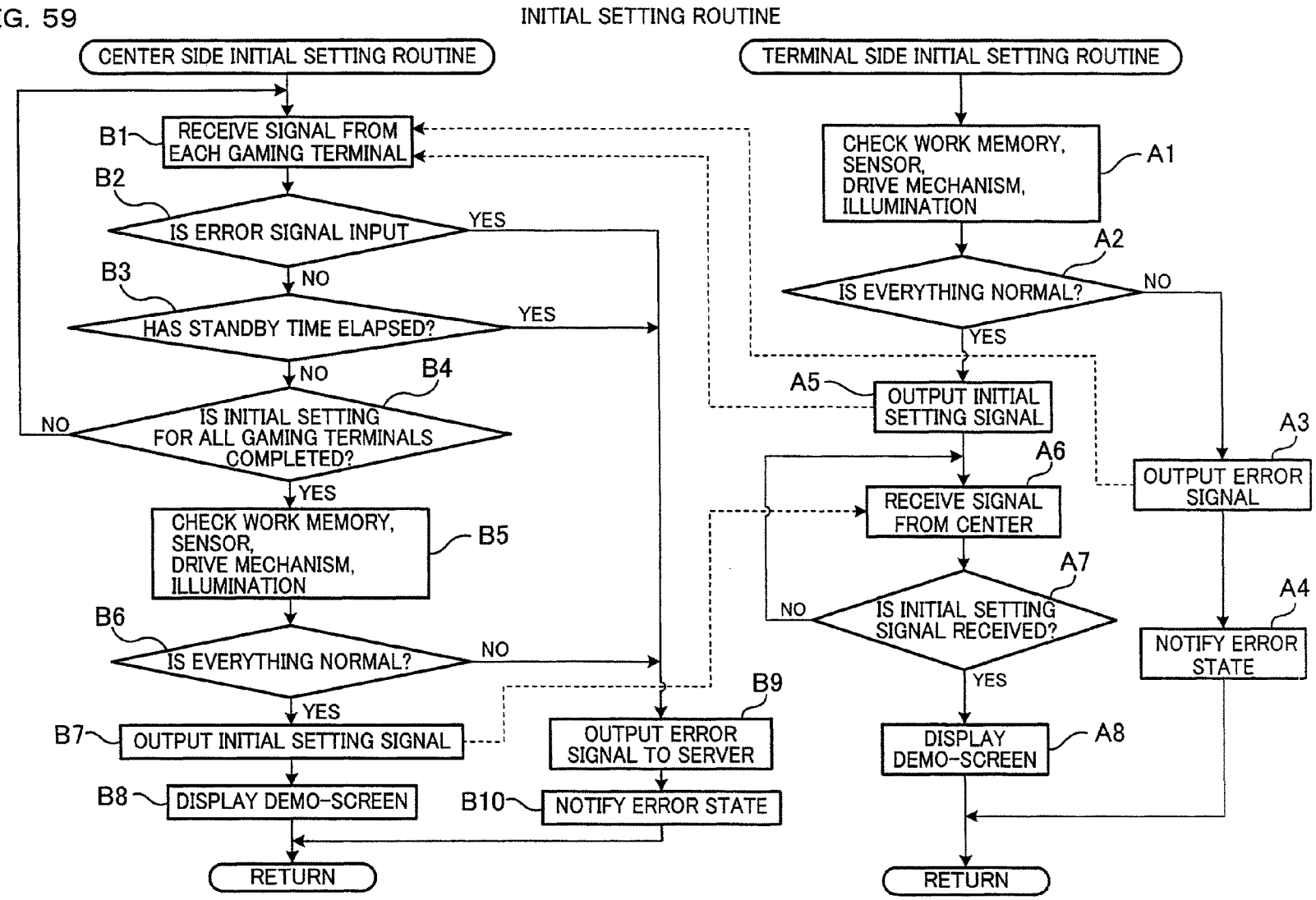
FIG. 59 is a flowchart illustrating an initial process executed in the gaming terminal and the center controller.

After this, the main CPU 41 and 241 each performs an initial process of FIG. 59.

(Operation of Gaming Machine 1: Initial Process)

Figure 58:
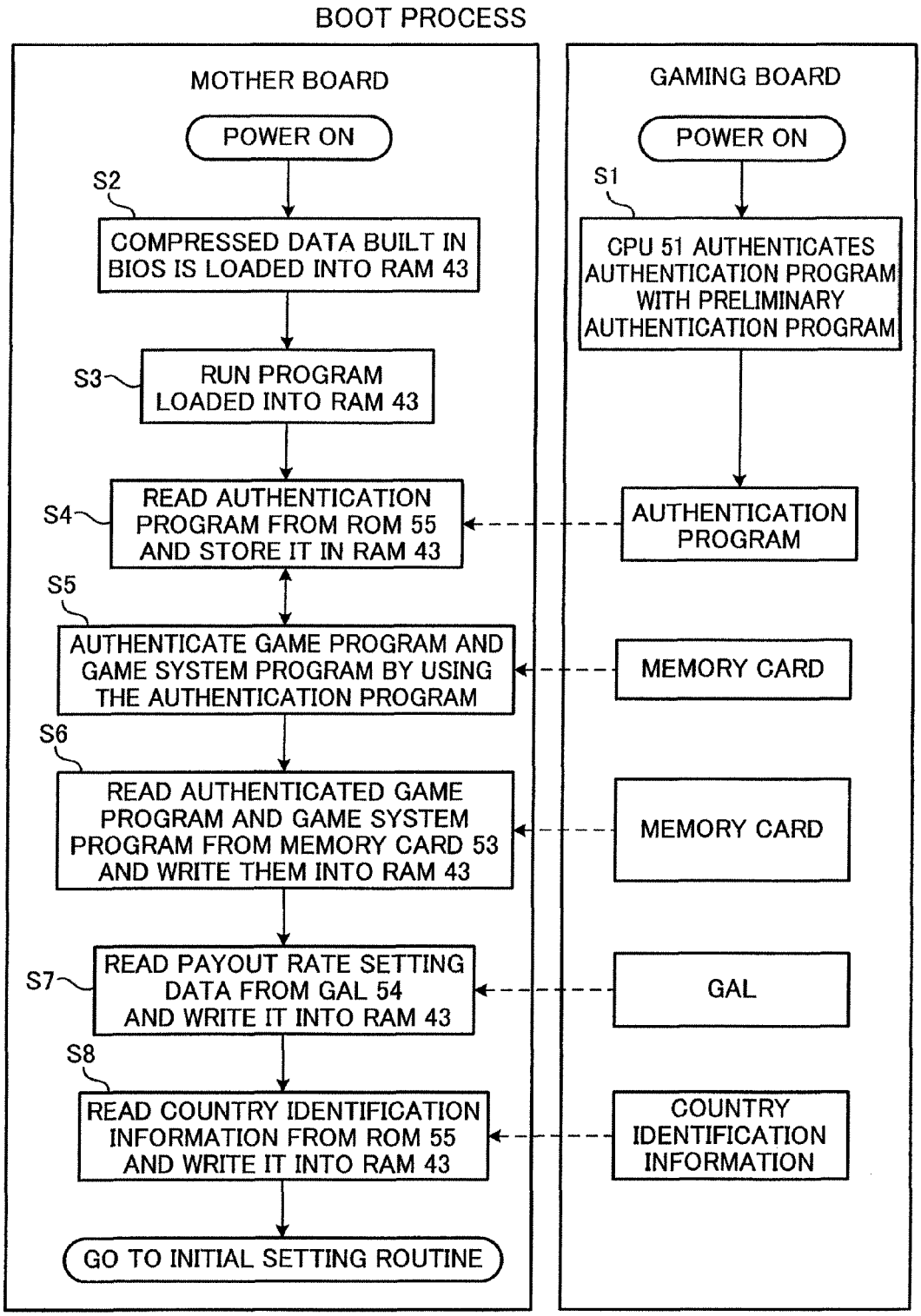
FIG. 58 is a flowchart illustrating a boot process executed in the gaming terminal and the center controller.

The following describes an initial process which takes place in the gaming machine 1. When the boot process of FIG. 58 is completed, the center controller 200 reads out from the RAM 243 a center side initial setting routine illustrated in FIG. 59 and executes the routine. Meanwhile, the gaming terminal 10 reads out from the RAM 43 a terminal side initial setting routine illustrated in FIG. 59 and executes the routine. The center side and terminal side initial setting routines are executed in parallel.

First, the main CPU 41 of each of the gaming terminals 10 checks operations of work memories such as the RAM 43, various sensors, various driving mechanisms, and various decorative illuminations (A1). Then, the main CPU 41 determines if all the check results are normal (A2). If the main CPU 41 determines that the check results contains an error (A2: NO), the main CPU 41 outputs a signal notifying the error (hereinafter, error signal) to the center controller 200 (A3) Further, the main CPU 41 reports the error in the form of illuminating the lamp 30 or the like (A4), and then ends the routine.

On the other hand in A2, if the main CPU 41 determines that all the check results are normal (A2: YES), an initial setting signal is output to the center controller 200 (A5). Then, an initial setting signal is waited from the center controller 200 (A6, A7: NO).

The main CPU 241 of the center controller 200 receives signals from each of the terminals (B1). Then, the main CPU 241 determines whether a signal received is an error signal (B2). If the main CPU 241 determines that the signal is an error signal (B2: YES), the main CPU 241 outputs the error signal to a server of a not-shown host computer or the like (B9) to report the error (B10), and ends the routine.

On the other hand in B2, if the main CPU 241 determines that the signal is not an error signal (B2: NO), the main CPU 241 determines whether a predetermined time (check time) has elapsed from the time of powering on (B3). If the main CPU 241 determines that the check time has elapsed (B3: YES), B9 is executed. On the other hand, if the main CPU 241 determines that the check time has not yet elapsed (B3: NO), it is determined whether an initial setting signal is received from each of the gaming terminals 3 (B4). If the main CPU 241 determines that an initial setting signal from any one of the gaming terminals 10 is not received (B4: NO), the process returns to B1. On the other hand, if it is determined that initial setting signals from all the gaming terminals 10 are received (B4: YES), the main CPU 241 checks operations of work memories such as RAM 243 or the like, various sensors, various driving mechanisms, and various decorative illuminations (B5). Then, the main CPU 241 determines whether all the check results are normal (B6). If the main CPU 241 determines the check results contain an error (B6: NO), the main CPU 241 executes B9.

Figure 50:
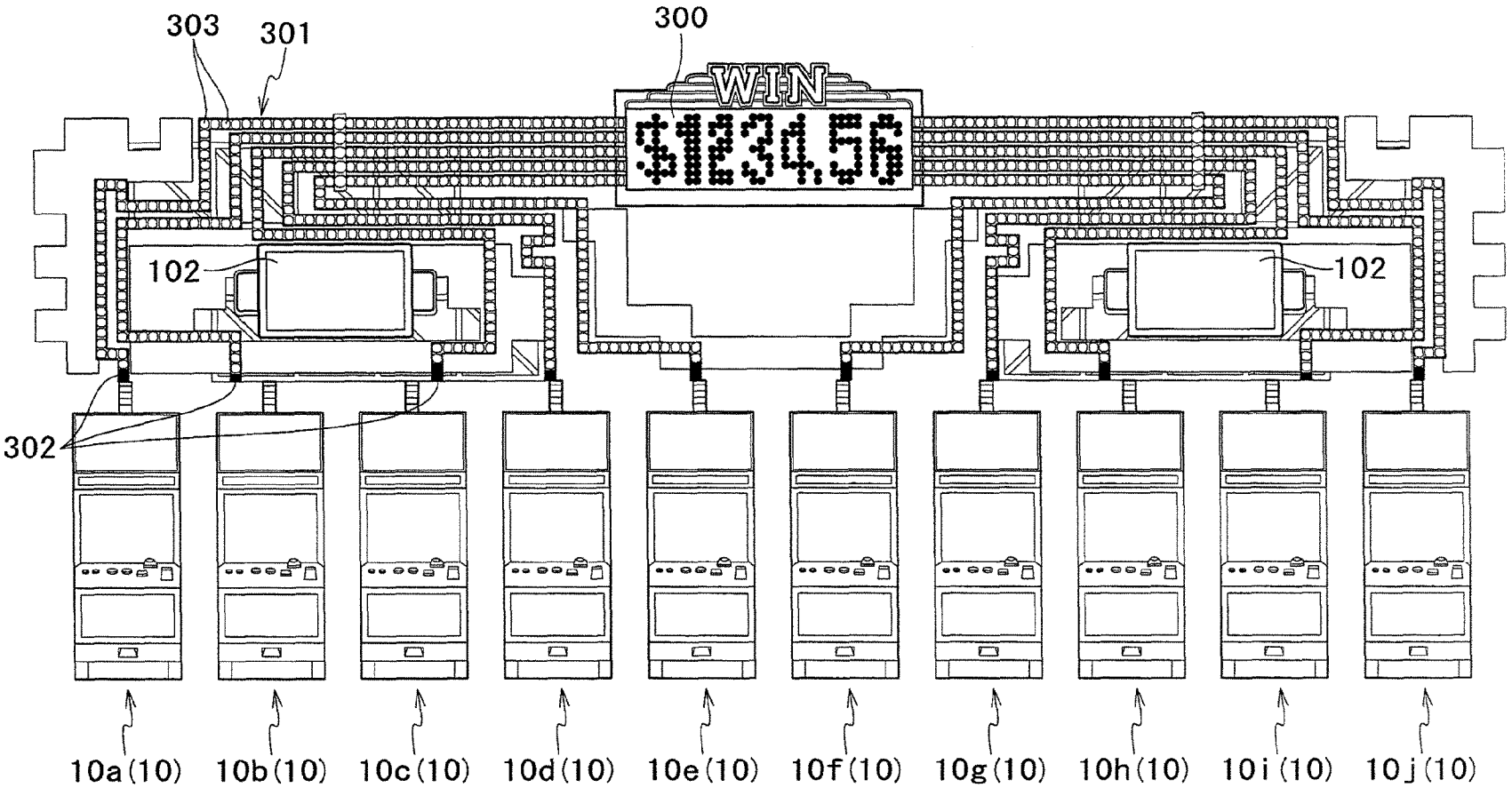
FIG. 50 is a front view illustrating an external appearance of the gaming machine.

On the other hand in B6, if the main CPU 241 determines that all the check results are normal (B6: YES), the main CPU 241 outputs an initial setting signal to all the gaming terminals 10 (B7), and causes the shared display 102 indicated in FIG. 50 to display a demo-screen (B8). Then, the main CPU 241 ends the routine.

In A7, the main CPU 41 of each of the gaming terminals 10 determines that an initial setting signal is received from the center controller 200 (A7: YES), and causes the terminal display 101 to display a demo-screen (A8). The main CPU 41 then ends the routine.

(Operation of Gaming Terminal 10: Terminal Process Routine)

Figure 60:
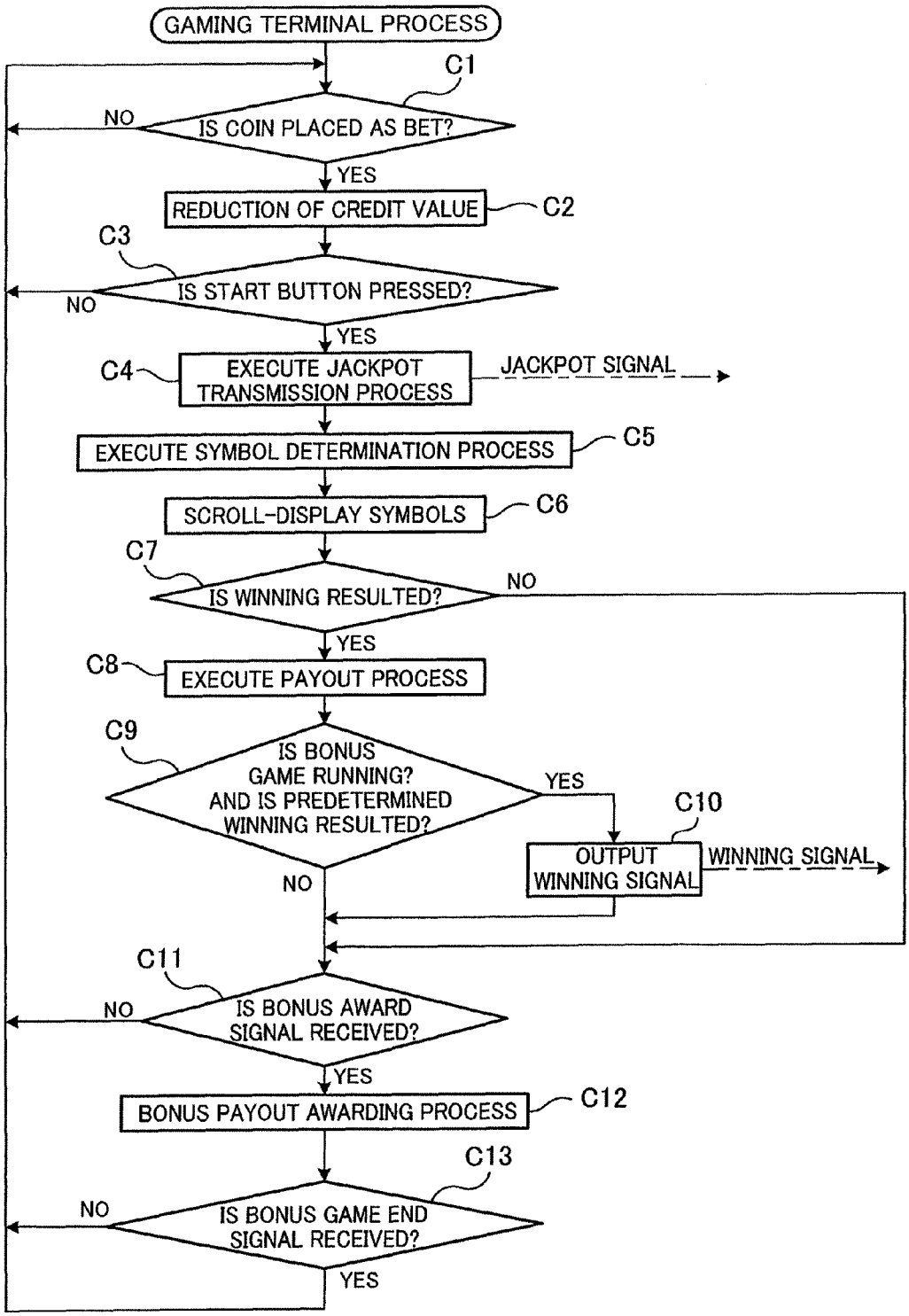
FIG. 60 is a flowchart illustrating a terminal process routine executed in the gaming terminal.

After the terminal side initial setting routine of FIG. 59, the main CPU 41 of the gaming terminal 10 performs a terminal process routine of FIG. 60. Through this terminal process routine executed by the main CPU 41, a game is run.

As illustrated in FIG. 60, in the terminal process routine, it is determined whether a coin is bet (C1). In this step, it is determined whether a signal from the 1-bet switch 26S entered by pressing of the 1-bet button 26 is received. Meanwhile, it is determined whether a signal from the maximum bet switch 27S entered by pressing of the maximum bet button 27 is received. If no coin is bet (C1: NO), C1 is repeated until a coin is bet.

On the other hand, if a coin is bet (C1: YES), the credit value stored in the RAM 43 is reduced according to the number of coins bet (C2). When the number of coins bet surpasses the number of coins equivalent to the credit value stored in the RAM 43, C2 is repeated without the reduction of the credit value. When the number of coins bet exceeds the maximum number of coins bettable for one game (50 pieces in Embodiment 3), the process goes to a later-described step C3 without the reduction of the credit value.

Then, it is determined whether a spin button 23 is pressed (C3). If the spin button 23 is not pressed (C3: NO), the process returns to C1. Here, if the spin button 23 is not pressed (for example, the spin button 23 is not pressed but a command to end the game is input), the reduction of the credit value in C2 is canceled.

On the other hand, when the spin button 23 is pressed (C3: YES), a jackpot transmission process is executed (C4). In other words, a jackpot signal indicating a part of the game value bet is transmitted to the center controller 200.

Next executed is a symbol determining process (C5). That is, the stop symbol determining program stored in the RAM 43 is run to determine symbols 180 to be arranged in the matrix 156. Through this, a symbol combination to be formed along the pay line L is determined.

Then, the scrolling process is executed to scroll symbols 180 on the terminal display 101 (C6). The scrolling process is a process in which the symbols 180 determined in C5 are stopped (rearranged) in the matrix 156 after scrolling of symbols 180 in a direction indicated by an arrow symbol.

Next, it is determined whether a winning is resulted with symbols 180 rearranged in the matrix 156 (C7). When it is determined that a winning is resulted (C7: YES), a payout process is executed (C8). More specifically, when a winning is resulted, the number of coins according to the combination is calculated. On the other hand in C7, when it is determined that no winning is resulted (C7: NO), C11 is executed.

After a payout process in C8 is executed, the main CPU 41 determines whether a bonus game is running, and whether a predetermined winning is resulted (C9). When a bonus game start signal is received from the center controller 200, the CPU 41 determines that the bonus game is running. If a bonus game is running, and if it is determined that a predetermined winning is resulted (C9, YES), the main CPU 41 outputs a winning signal to the center controller 200 (C10), and the main CPU executes a process of C11. Meanwhile, if a bonus game is not running, or if it is determined that a predetermined winning is not resulted (C9, NO), a process of C11 is executed.

Next, the main CPU 41 determines whether a bonus award signal is received from the center controller 200 (C11). When it is determined that a bonus award signal is received (C11, YES), a payout is awarded based on the bonus award signal (C12), and the process returns to C1. On the other hand in C11, if the CPU 41 determines that no bonus award signal is received (C11: NO), the process returns to C1.

(Operation of Gaming Terminal 10: Terminal Display Updating Process Routine)

Figure 61:
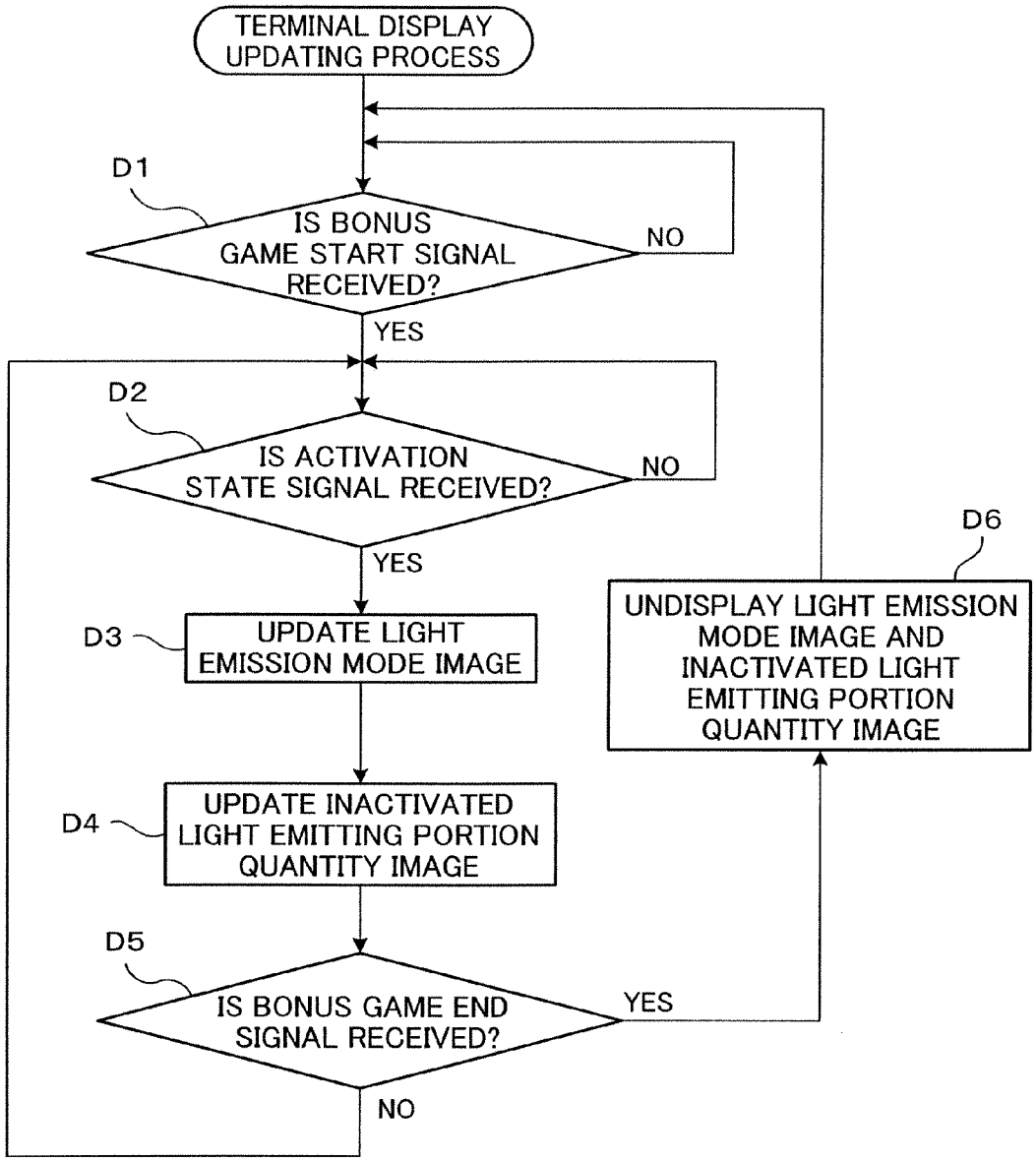
FIG. 61 is a flowchart illustrating a terminal display update process routine executed in the gaming terminal.
Figure 62:
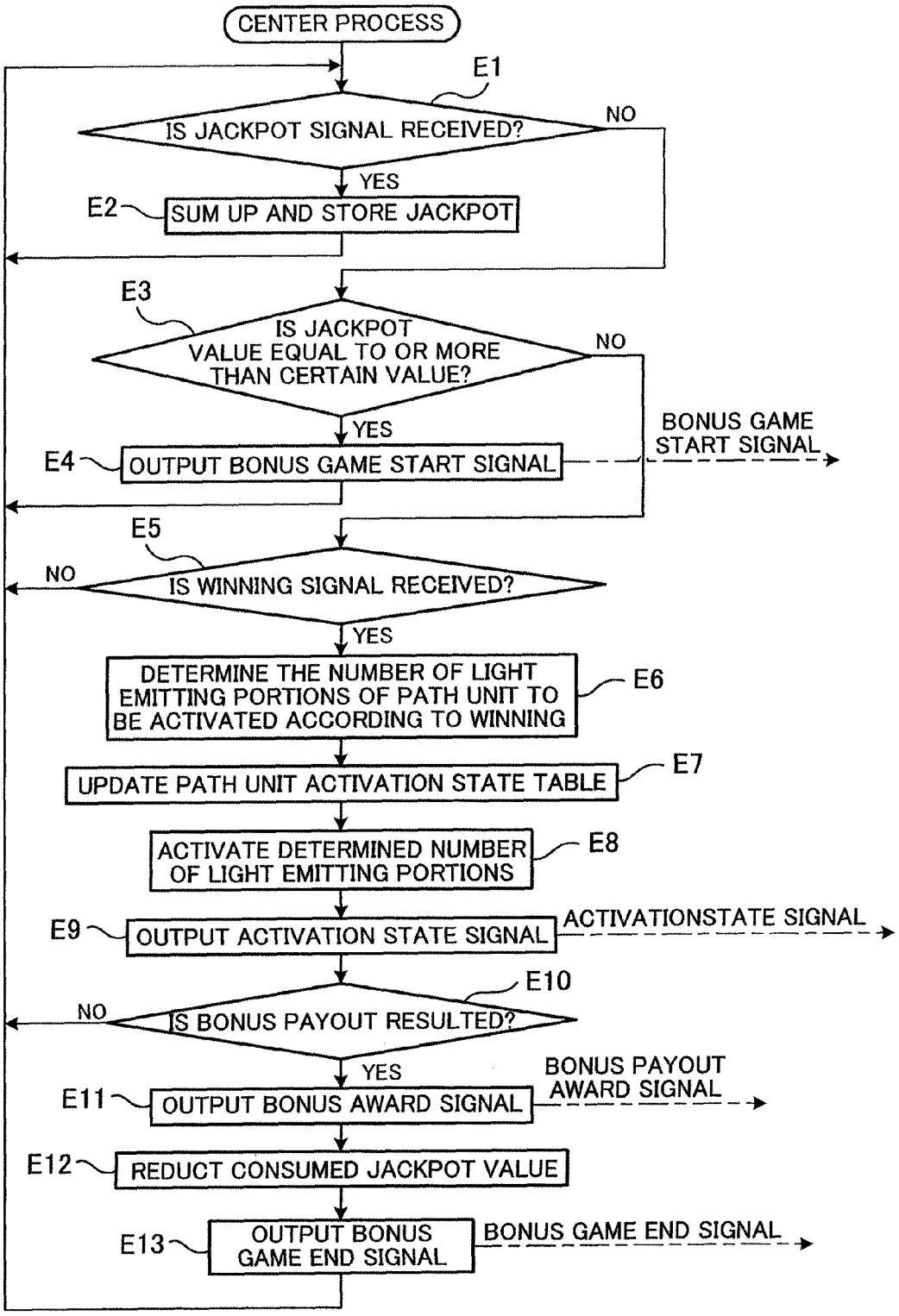
FIG. 62 is a flowchart illustrating a center process routine executed in the center controller.

The following describes a terminal display updating process routine run by the main CPU 41 of the gaming terminal 10 with reference to FIG. 61. First, it is determined whether a bonus game start signal is received (D1). When no bonus start signal is received (D1, NO), D1 is repeated. When a bonus start signal is received (D1, YES), it is determined whether an activation state signal is received (D2). Here, an activation state signal includes information regarding the path unit activation state table indicated in FIG. 55. Specifically, the activation state signal includes information regarding the number of activated and inactivated light emitting portions 303 of each of the path units 301.

When no activation state signal is received (D2, NO), the process of D2 is repeated. When an activation state signal is received (D2, YES), the light emission mode image 33*a* is updated based on the number of activated light emitting portions 303 of each of the path units 301, included in the received activation state signal. Then, the inactivated light emitting portion quantity image 33*b* is updated based on the number of inactivated light emitting portions of each of the path units 301 included in the received activation state signal (D4). Note that although it is not shown, when the light emission mode image 33*a* and the inactivated light emitting portion quantity image 33*b* are not displayed, an image is formed and displayed, based on a received inactivation state signal. When the light emission mode image 33*a* is updated or displayed, the gaming terminal image 330*a* and the light emitting portion image 331*a* corresponding to one gaming terminal 10 are highlighted and displayed.

Afterwards, it is determined whether a bonus game end signal is received (D5). When a bonus game end signal is received (D5, YES), the light emission mode image 33*a* and the inactivated light emitting portion quantity image 33*b* are not displayed (D6), and the process returns to D1. Meanwhile, when no bonus game end signal is received (D5, NO), the process returns to D2.

(Operation of Center Controller 200: Center Process Routine)

After the center side initial setting routine of FIG. 59, the main CPU 241 of the center controller 200 executes a center process routine of FIG. 61. The main CPU 241 executes the center process routine to run a bonus game.

As illustrated in FIG. 61, in the center process routine, the main CPU 241 determines whether a jackpot signal is received from the gaming terminal 10 (E1). When it is determined that a jackpot signal is received (E1, YES), a game value indicated by the jackpot signal is summed up and stored (E2). Then the process returns to E1.

On the other hand in E1, if the main CPU 241 determines no progressive signal is received (E1: NO), the main CPU 241 determines if the jackpot value equals or surpasses a predetermined value (E3). When the main CPU 241 determines that the jackpot value equals or surpasses the predetermined value (E3: YES), a bonus game start signal is output to each of the gaming terminals 10 (E4). Next, a process of E1 is executed.

Meanwhile, when the main CPU 241 determines that the jackpot value is less than a predetermined value (E3, NO), the main CPU 241 determines whether a winning signal is received from the terminal controller 100 (E5). If the main CPU 241 determines that no winning signal is received (E5: NO), the process returns to E1. On the other hand, when the main CPU 241 determines that a winning signal is received (E5, YES), the main CPU 241 determines the number of light emitting portions 303 to be additionally activated, based on a resulted winning (E6). Then, the main CPU 241 updates the path unit activation state table based on the determined number of light emitting portions 303 to be additionally activated (E7). Then, the main CPU 241 additionally activates the determined number of light emitting portions 303 towards the bonus payout display unit 300 (E8). Afterwards, an activation state signal is outputted to each of the gaming terminals 10, based on the updated path unit activation state table (E9).

Next, it is determined whether a bonus payout is to be awarded, by determining whether the light emitting portions 303 of any of the path units 301 have been lighted up to the bonus payout display unit 300 (E10). When it is determined that a bonus payout is not to be awarded (E10, NO), the process returns to E1. On the other hand, when it is determined that a bonus payout is to be awarded (E10, YES), a bonus award process to award a bonus payout is run, and a bonus award signal is output to a gaming terminal 10 through which a bonus payout is awarded (E11). Then, a consumed jackpot value is deducted from the RAM 243 (E12), a bonus game end signal is output to each of the gaming terminals 10 (E13). Then, the process returns to E1.

A base game is run in each of the gaming terminals 10, independently of another gaming terminal 10, and a payout according to a predetermined winning is awarded. Based on a predetermined condition, a bonus game configured to award a bonus payout greater than the payout awarded in the base game is run. For each of the gaming terminals 10, one or more associated light emitting portions 303 are additionally activated according to a predetermined winning, sequentially from one light emitting portion 303 closest to the associated gaming terminal 10, each time a winning is resulted in the gaming terminal 10. The light emission mode obtain unit 205 obtains a light emission mode of each of the path units 301. The light emission mode image 33*a* and the inactivated light emitting portion quantity image 33*b* based on the light emission mode, are displayed on the terminal display 101. The light emission mode image 33*a* indicating a path unit 301 associated with the gaming terminal 10 to which the terminal display 101 belongs, is highlighted and displayed. When the path unit 301 is activated up to the light emitting portions 303 at an end of the path unit 301 closer to the bonus payout display unit 300, a bonus payout is awarded through the gaming terminal 10 associated with the path unit 301. Thus, a state of the bonus game configured to award a bonus payout greater than the payout awarded in the base game is exhibited by displaying, on the terminal display 101, a light emission mode of each of the path units 301 as the light emission mode image 33*a*. Further, the inactivated light emitting portion quantity image 33*b* is displayed on the terminal display 101. Further, a part of the light emission mode image 33*a* where a path unit 301 associated with the gaming terminal 10 to which the terminal display 101 belongs, is highlighted and displayed. As a result, a new entertainment characteristic is realized.

Hereinabove, Embodiment 3 of the present invention is described. The present invention is not limited to the above Embodiment 3. The below-described another version of Embodiment 3 may be applied to the present invention. The following describes a base game according to the other version of Embodiment 3 of the present invention.

Figure 63:
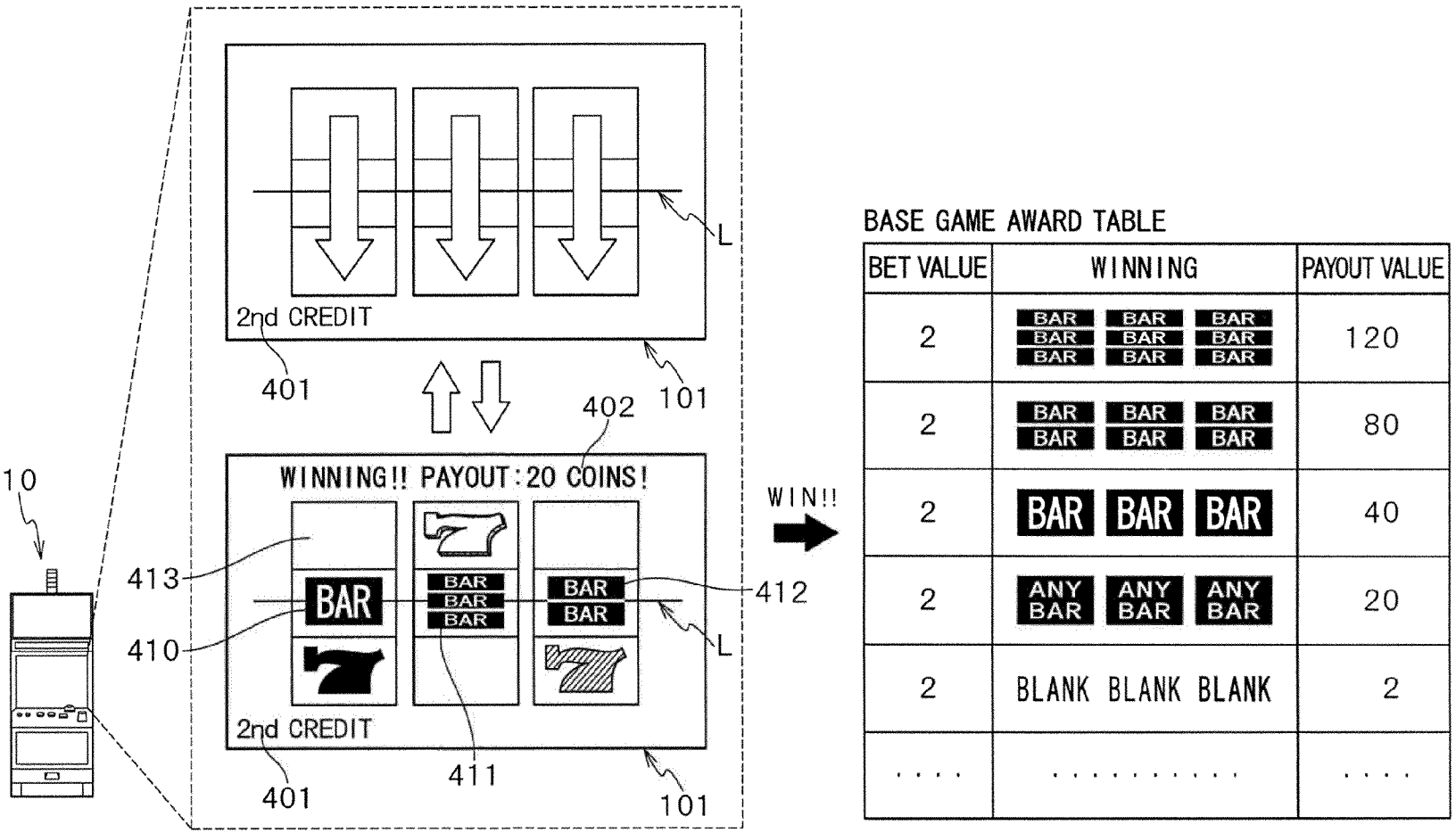
FIG. 63 is an explanatory diagram illustrating a base game according to another version of Embodiment 3 of the present invention.

As indicated in FIG. 63, the terminal display 101 according to the other version of Embodiment 3 has arrangement areas forming a matrix of three rows/three columns. The arrangement areas of the middle row are set as a pay line L. When the relation among the symbols rearranged on the pay line L results in winning, a payout according to the resulted winning is awarded. Further, the terminal display 101 displays a credit 401 indicating an amount of a bet game value.

For example, as indicated in FIG. 63, when the credit indicated by the credit 401 is "CREDIT: 2," the amount of a bet game media is two coins. As a result of symbol rearrangement, a "1BAR" as a symbol 410, a "3BAR" as a symbol 411, and a "2BAR" as a symbol 412 are rearranged on the pay line L. These symbols form a winning of "ANY-BAR" "ANY-BAR" "ANY-BAR," which is resulted when the credit 401 indicates two coins. Twenty coins are paid out as a payout for this winning.

FIG. 64 is a base game payout table. The base game payout table is used when the main CPU 41 determines that a winning is resulted in a base game, and awards a payout according to the resulted winning. The base game payout table has a bet value column, a winning column, and a payout amount column. The bet value column indicates the number of coins bet. The winning column indicates a combination of symbols to be rearranged on the pay line L, which is a condition for a winning to be resulted. The payout amount column indicates the number of coins to be paid out when a winning is resulted. The following describes an example indicated in FIG. 64. When three symbols "3BAR" are rearranged on the pay line L, and the bet value is 1 or 2, the payout amount is 60 or 120, respectively. When three symbols "2BAR" are rearranged on the pay line L, and the bet value is 1 or 2, the payout amount is 40 or 80, respectively. When three symbols "1BAR" are rearranged on the pay line L, and the bet value is 1 or 2, the payout amount is 20 or 40, respectively. When three symbols "ANY-BAR" are rearranged on the pay line L, and the bet value is 1 or 2, the payout amount is 10 or 20, respectively. When three symbols "BLANK" are rearranged on the pay line L, and the bet value is 1 or 2, the payout amount is 1 or 2, respectively. When three symbols "blue 7" are rearranged on the pay line L, and the bet value is 3, the payout amount is 1800. When three symbols "red 7" are rearranged on the pay line L, and the bet value is 3, the payout amount is 100. When three symbols "ANY-7" are rearranged on the pay line L, and the bet value is 3, the payout amount is 100. Thus, the greater the bet value, the greater the payout amount for a resulted winning. Hence, a player may bet a greater amount of game value (bet value).

The following describes a bonus game of the gaming machine according to yet another version of Embodiment 3 of the present invention. The bonus game according to this version of Embodiment 3 is configured to award a payout according to a predetermined winning. The number of the light emitting portions 303 according to accumulated points awarded are activated towards the bonus payout display unit 300.

Figure 65:
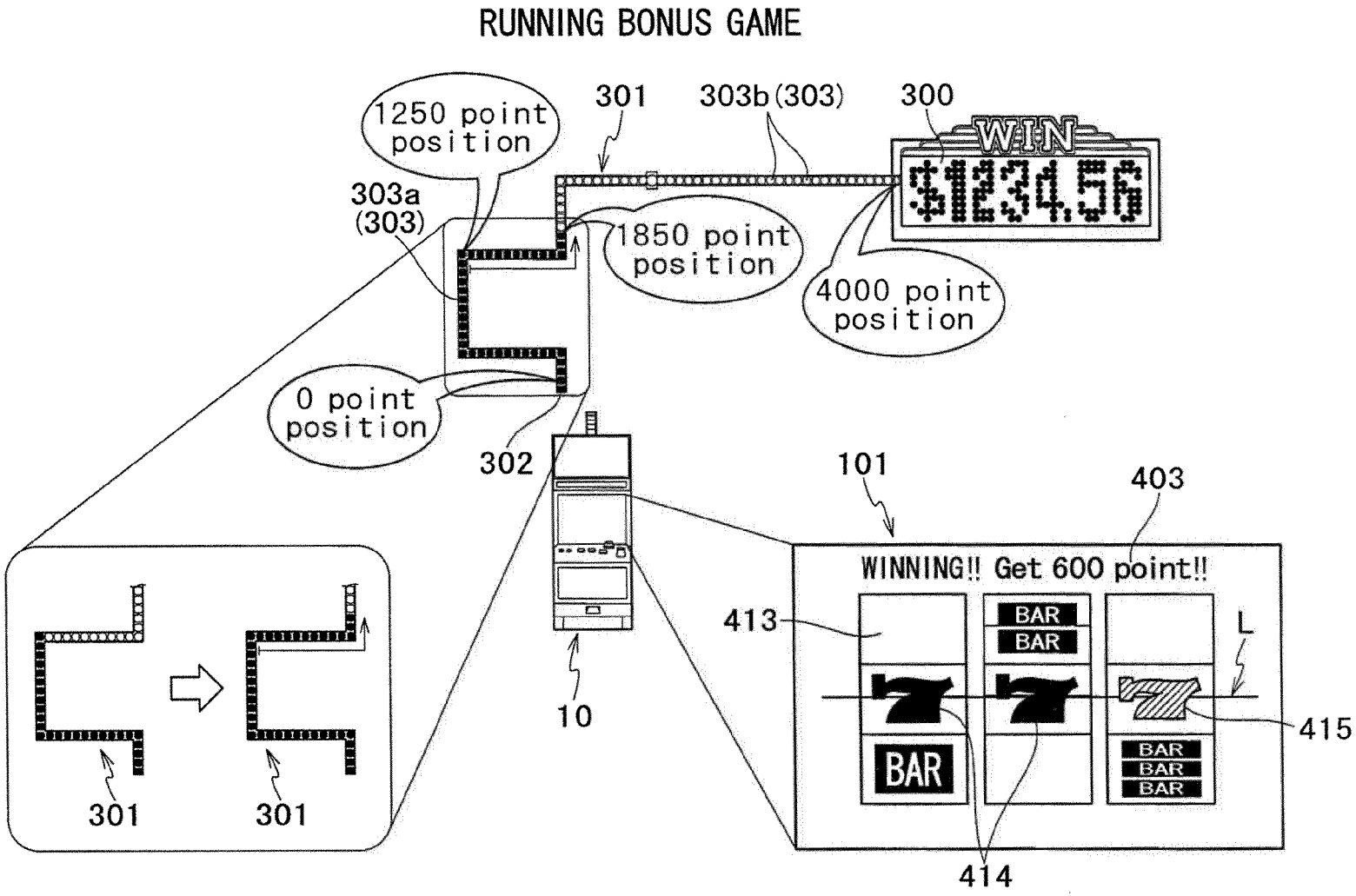
FIG. 65 is an explanatory diagram illustrating a bonus game according to the other version of Embodiment 3 of the present invention.

The following describes an example indicated in FIG. 65. The position 302 of the gaming terminal 10 of the FIG. 65 indicates zero points, and the position of the bonus payout display unit 300 indicates 4,000 points. Accumulated points awarded in the gaming terminal 10 is 1,250 points, so that the light emitting portions 303 of the path unit 301 are lighted up to a position indicating 1,250 points. In this example, a winning is resulted with a "red 7" as a symbol 414, a symbol 414, and a "blue 7" as a symbol 415 rearranged. In this case, three winnings are resulted. Two winnings out of the three winnings are resulted by rearranging a symbol 414 on the pay line L, and the other one winning is resulted by rearranging a symbol 415 on the pay line L. The payout for a winning resulted with a symbol 414 is a hundred fifty (150) points, and the payout for a winning resulted with a symbol 415 is three hundred (300) points. Thus, the total points for the three winnings is six hundred (600) points. These six hundred points are paid out through the gaming terminal 10, so the accumulated points of the gaming terminal 10 is 1,250+600=1,850 points. The light emitting portions 303 are activated up to the position indicating 1,850 points. Thus, a point according to a resulted predetermined winning is awarded during the bonus game. A jackpot is awarded when the accumulated points including a newly awarded point reach a predetermined amount (i.e., 4,000 points).

FIG. 66 is a bonus game payout table. The bonus game payout table is used when the main CPU 41 determines that a winning is resulted in the bonus game, and awards a payout point according to the resulted winning. The bonus game payout table has a winning column and a payout point column. The winning column indicates a combination of symbols to be rearranged on the pay line L, which is a condition for a winning to be resulted. The payout point column indicates an amount of points to be awarded for a resulted winning. The following describes an example indicated in FIG. 66. When three symbols "blue 7" are rearranged on the pay line L, the payout point is 7,000. When one symbol "blue 7" is rearranged on the pay line L, the payout point is 300. When one symbol "red 7" is rearranged on the pay line L, the payout point is 150. When one symbol "3 BAR" is rearranged on the pay line L, the payout point is 30. When one symbol "2 BAR" is rearranged on the pay line L, the payout point is 20. When one symbol "1BAR" is rearranged on the pay line L, the payout point is 10.

In the present version of Embodiment 3, for example, the light emission mode image 33*a* is highlighted; however, the display is not limited to this. Further, the number of inactivated light emitting portions 303 are indicated by displaying the inactivated light emitting portion quantity image 33*b*; however, the display is not limited to this.

Hereinabove, a gaming machine according to yet another version of Embodiment 3 of the present invention is described. Although a gaming machine of Embodiment 3 of the present invention starts running a bonus game when the accumulated jackpot value exceeds a certain amount (e.g., 200 dollars as a fixed value), it is not limited to this. For example, the gaming machine may randomly change, within a predetermined range (e.g., two hundred to three hundred dollars), the threshold progressive value where the gaming machine starts running the bonus game.

Further, although the gaming machine of Embodiment 3 of the present invention awards a jackpot when the accumulated points including a newly awarded point reach a predetermined amount, it is not limited to this. The gaming machine may, for example, award a jackpot when the accumulated points including a newly awarded point reach an amount which changes in each bonus game within a predetermined range (e.g., 3,000 to 5,000).

Further, the gaming machine may be capable of selecting and setting a necessary amount of points for awarding a jackpot through a gaming terminal. Specifically, the gaming machine may be capable of selecting any one of the values (e.g., 3,000 points, 4,000 points, and 5,000 points), through an input from outside or the like, as points necessary for awarding a jackpot.

As yet another version of Embodiment 3 of the present invention, each of the gaming terminals of the gaming machine may have the same difficulty (winning percentage in a bonus game) for the associated path units to be activated up to the bonus payout display unit. Further, the gaming terminal may set the difficulty (winning percentage in a bonus game) for each of the gaming terminals based on the contribution amount to the jackpot of each of the gaming terminals.

Embodiment 4

The following describes Embodiment 4 of a gaming machine and a playing method of the gaming machine according to the present invention. Note that reference numerals respectively given to members in the figures referred to in this embodiment, reference symbols (such as "S") respectively representing steps in flowcharts in the figures, and description using these reference numerals and reference symbols are effective only in this embodiment. Each of these numerals and symbols does not represent a member or step in other embodiments.

Figure 67:
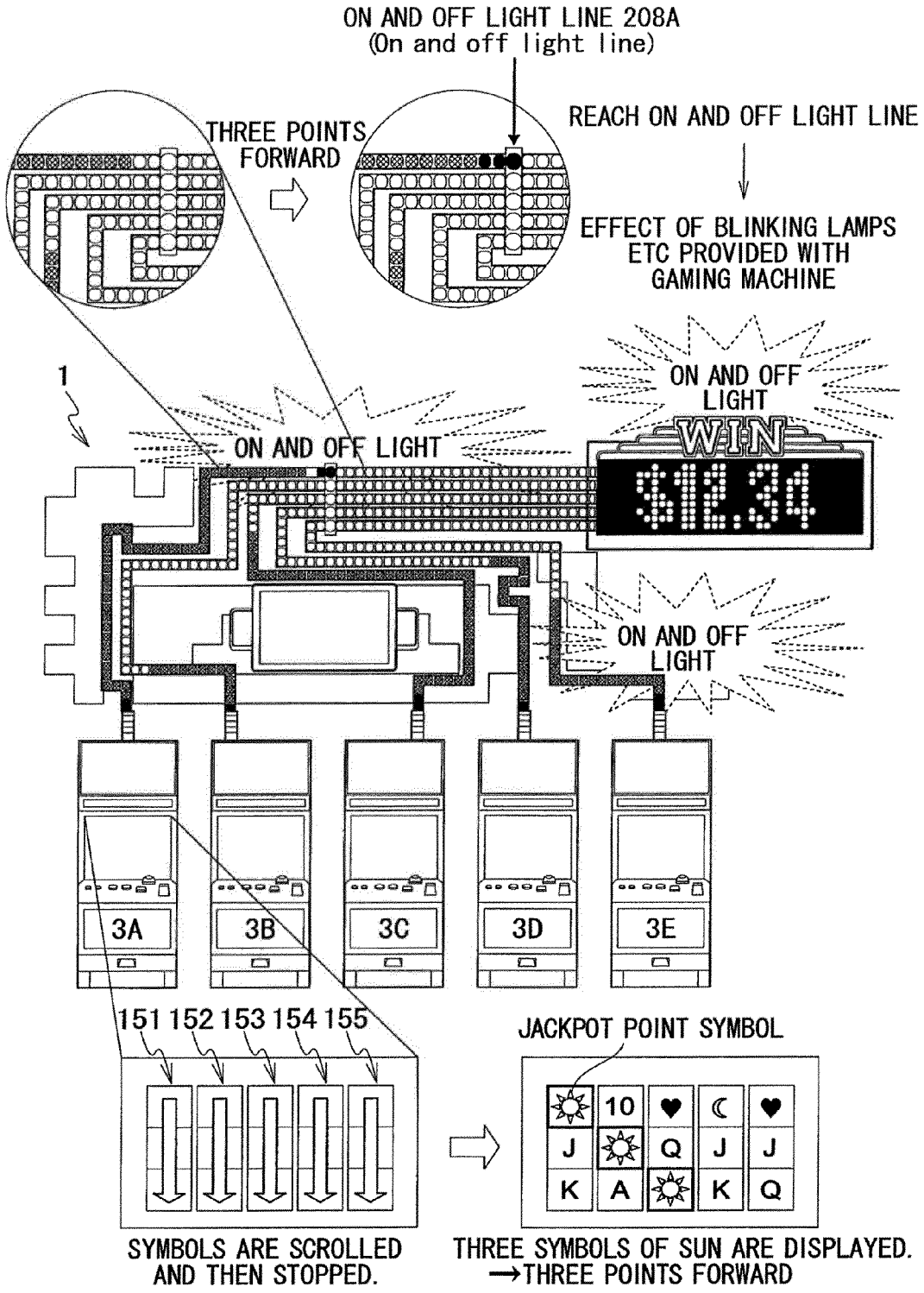
FIG. 67 is an explanatory view schematically showing the operation of a gaming machine.

As shown in FIG. 67, the present invention is a gaming machine including: a plurality of terminal devices each of which executes a base game with a game value being bet and is configured to award a prize according to a predetermined winning; a common display which displays thereon a predetermined content; a plurality of routes each of which is formed from a plurality of route light emitters disposed continuously from a corresponding terminal device out of the terminal devices to the common display; and a jackpot controller. The present invention is realized as a playing method of the gaming machine, including the steps of: accumulating a percentage of a game value which is bet in each base game executed at each of the terminal devices; causing the common display to display an amount of accumulated game values; after the amount of accumulated game values reaches a predetermined value, and every time a predetermined winning is achieved at a terminal device, causing a predetermined number of route light emitters, which are disposed along a route corresponding to the terminal device at which the predetermined winning is achieved, to be turned on toward the common display so as to emit light; when a predetermined number of route light emitters disposed along any one of the plurality of routes are turned on so as to emit light, causing all the route light emitters, which are disposed along each of the routes and are turned on, to blink; and when all route light emitters disposed along any one of the plurality of routes are turned on, awarding the accumulated game values to a terminal device corresponding to the one of the routes along which all route light emitters are turned on.

In Embodiment 4, "jackpot game" is a game played for the purpose of obtaining coins corresponding to an accumulated value. The accumulated value is a value resulting from accumulative calculation of a percentage of an amount bet at each terminal device. A jackpot game is a sideshow game played independently of a main plot of a base game.

Figure 68:
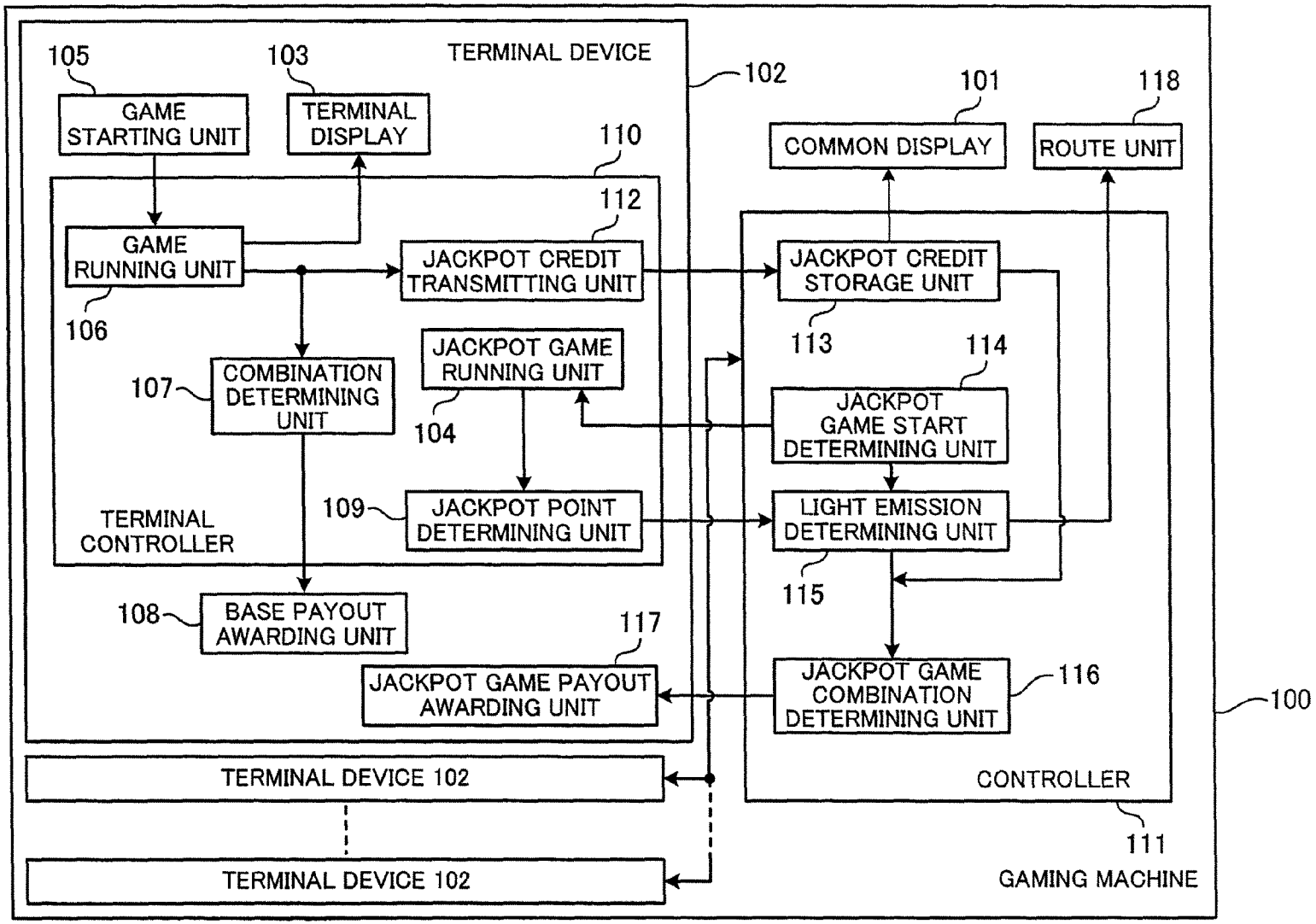
FIG. 68 is a block diagram of the gaming machine.

A gaming machine 100 which runs the above game includes a controller 111, a common display 101, a route unit 118, and two or more terminal devices 102, as shown in FIG. 68. The common display 101 displays thereon an image indicating an accumulated value resulting from accumulative calculation of a percentage of an amount bet at each of the terminal devices 102.

The controller 111 has a jackpot credit storage unit 113, a jackpot game start determining unit 114, a light emission determining unit 115, and a jackpot game combination determining unit 116. Each of the terminal devices 102 has a game starting unit 105, a terminal controller 110, a terminal display 103, a base payout awarding unit 108, and a jackpot game payout awarding unit 117.

Further, the terminal controller 110 has a game running unit 106, a jackpot credit transmitting unit 112, a combination determining unit 107, a jackpot game running unit 104, and a jackpot point determining unit 109.

The terminal display 103 may have a mechanical structure adopting a reel device which rotates a reel to arrange symbols 180. Alternatively, the terminal display 103 may have an electrical structure in which a video reel is displayed as an image to arrange symbols 180. Further, a combination of the mechanical structure (reel) and the electric structure (video reel) may also be possible. Examples of the electrical structure include a liquid crystal display device, a CRT (cathode-ray tube), a plasma display device, and the like. A specific structure of the terminal display 103 will be detailed later.

[Controller 111 and Terminal Controller 110]

The controller 111 and the terminal controller 110 are configured to execute: a first process of accumulating a percentage of a game value which is bet in each base game executed at each of the terminal devices 102; a second process of causing the common display 101 to display an amount of accumulated game values; a third process of, after the amount of accumulated game values reaches a predetermined value, and every time a predetermined winning is achieved at a terminal device 102, causing a predetermined number of route light emitters, which are disposed along a route corresponding to the terminal device 102 at which the predetermined winning is achieved, to be turned on toward the common display 101 so as to emit light; a fourth process of, when a predetermined number of route light emitters disposed along any one of the plurality of routes are turned on so as to emit light, causing all the route light emitters, which are disposed along each of the routes and are turned on, to blink; and a fifth process of, when all route light emitters disposed along any one of the plurality of routes are turned on, awarding the accumulated game values to a terminal device 102 corresponding to the one of the routes along which all route light emitters are turned on. In other words, the controller 111 and the terminal controller 110 include five process stages.

[Operations of Controller 111 and Terminal Controller 110]

A description will be given to operations of the controller 111 and the terminal controller 110 having the above-described structure. First, after a game value is bet, triggered by a game start signal from the game starting unit 105, the game running unit 106 starts to variably display the symbols 180 which have been arranged on the terminal display 103. That is, a base game is executed at each terminal device 102.

When the game running unit 106 executes a base game, the jackpot credit transmitting unit 112 transmits, to the controller 111, a percentage of a game value which has been bet. Then, the jackpot credit storage unit 113 accumulates that percentage of game value transmitted and stores the amount thereof. In short, the terminal controller 110 and the controller 111 execute the first process.

Next, the controller 111 causes the common display 101 to display thereon the amount of accumulated game values which is stored in the jackpot credit storage unit 113. In short, the controller 111 executes the second process.

Next, the jackpot game start determining unit 114 determines whether the amount of accumulated game values stored in the jackpot credit storage unit 113 reaches a predetermined value. When the amount of accumulated game values reaches the predetermined value, the jackpot game start determining unit 114 transmits a jackpot game start signal to the jackpot game running unit 104. Then, triggered by the jackpot game start signal, the jackpot game running unit 104 runs a jackpot game. Next, the jackpot point determining unit 119 determines whether a predetermined winning is achieved at a terminal device 102. When a predetermined winning is achieved, the light emission determining unit 115 turns on a predetermined number of route light emitters disposed along a route corresponding to that terminal device 102 at which the predetermined winning is achieved, so that the route light emitters emit light. In short, the terminal controller 110 and the controller 111 execute the third process.

In addition, when a predetermined number of route light emitters disposed along any one of the routes of the route unit 118 are turned on so as to emit light, the light emission determining unit 115 causes all the route light emitters, which are disposed along each of the routes and are turned on, to blink. In short, the controller 111 executes the fourth process.

When all the route light emitters along any one of the routes of the route unit 118 are turned on, the jackpot game combination determining unit 116 transmits a jackpot game winning signal to a jackpot game payout awarding unit 117 of a terminal device 102 corresponding to the route along which all the route light emitters are turned on. Triggered by reception of a jackpot game winning signal, the jackpot game payout awarding unit 117 awards the accumulated game values stored in the jackpot credit storage unit 113. In short, the terminal controller 110 and the controller 111 execute the fifth process.

Each block of the controller 111 and the terminal controller 110 may be formed by hardware or by software as needed.

As seen from the above-described operations, the present invention is the gaming machine 100 including: the plurality of terminal devices 102 each of which executes a base game with a game value being bet and awards a prize according to a predetermined winning; the common display 101 which displays thereon a predetermined content; the route unit 118 having the routes each of which is formed from the plurality of route light emitters continuously disposed from a corresponding terminal device 102 out of the terminal devices 102 to the common display 101; and the controller 111 and the terminal controller 110. The present invention is realized as a playing method of the gaming machine 100, including the steps of: accumulating a percentage of a game value which is bet in each base game executed at each of the terminal devices 102; causing the common display 101 to display an amount of accumulated game values; after the amount of accumulated game values reaches a predetermined value, and every time a predetermined winning is achieved at a terminal device 102, causing a predetermined number of route light emitters, which are disposed along a route corresponding to the terminal device 102 at which the predetermined winning is achieved, to be turned on toward the common display 101 so as to emit light; when a predetermined number of route light emitters disposed along any one of the routes of the route unit 118 are turned on so as to emit light, causing all the route light emitters, which are disposed along each of the routes and are turned on, to blink; and when all route light emitters disposed along any one of the routes are turned on, awarding the accumulated game values to a terminal device 102 corresponding to the one of the routes along which all route light emitters are turned on.

With this structure, after the amount of accumulated game values reaches a predetermined value, and every time a predetermined winning is achieved at a terminal device 102, a predetermined number of route light emitters, disposed along a route corresponding to the terminal device 102 at which the predetermined winning is achieved, are turned on toward the common display 101 so as to emit light. When a predetermined number of route light emitters disposed along any one of the routes are turned on so as to emit light, all the route light emitters, which are disposed along each of the routes and are turned on, are caused to blink. For example, when a player who plays at a terminal device 102 achieves the predetermined winning in a base game with the result that the predetermined number of route light emitters along a route are turned on so as to emit light, all the route light emitters, which are disposed along each of the routes and are turned on, are caused to blink. This enables players and an audience around the gaming machine 100 to be aware that there is a player who almost obtains the accumulated game values displayed on the common display 101. In addition, the arrangement above enables the player who almost obtains the accumulated game values to increase an expectation for obtaining the accumulated game values. Also, the arrangement urges other players to achieve the predetermined winning early because the other players may fail to obtain the accumulated game values. Further, this arrangement can provide the audience with an excitement caused by predicting who obtains the accumulated game values displayed on the common display 101. That is, the players and the audience around the gaming machine 100 may be more excited.

Embodiment

[Mechanical Structure of Slot Machine 1]

The following describes Embodiment 4 (one version) where the gaming machine 100 having the above-described structure is applied to a slot machine 1 and specifically structured in mechanical, electrical, and operational senses.

The slot machine 1 is placed in a gaming facility or the like. The slot machine 1 performs a unit game by use of a game value. The game value is a coin, a bill, or a value in the form of electronic information. However, the game value in the present invention is not particularly limited. For example, a medal, token, electronic money, a ticket and the like are also possible. Further, the ticket is not particularly limited and may be a barcoded ticket which will be described later, and the like.

Figure 69:
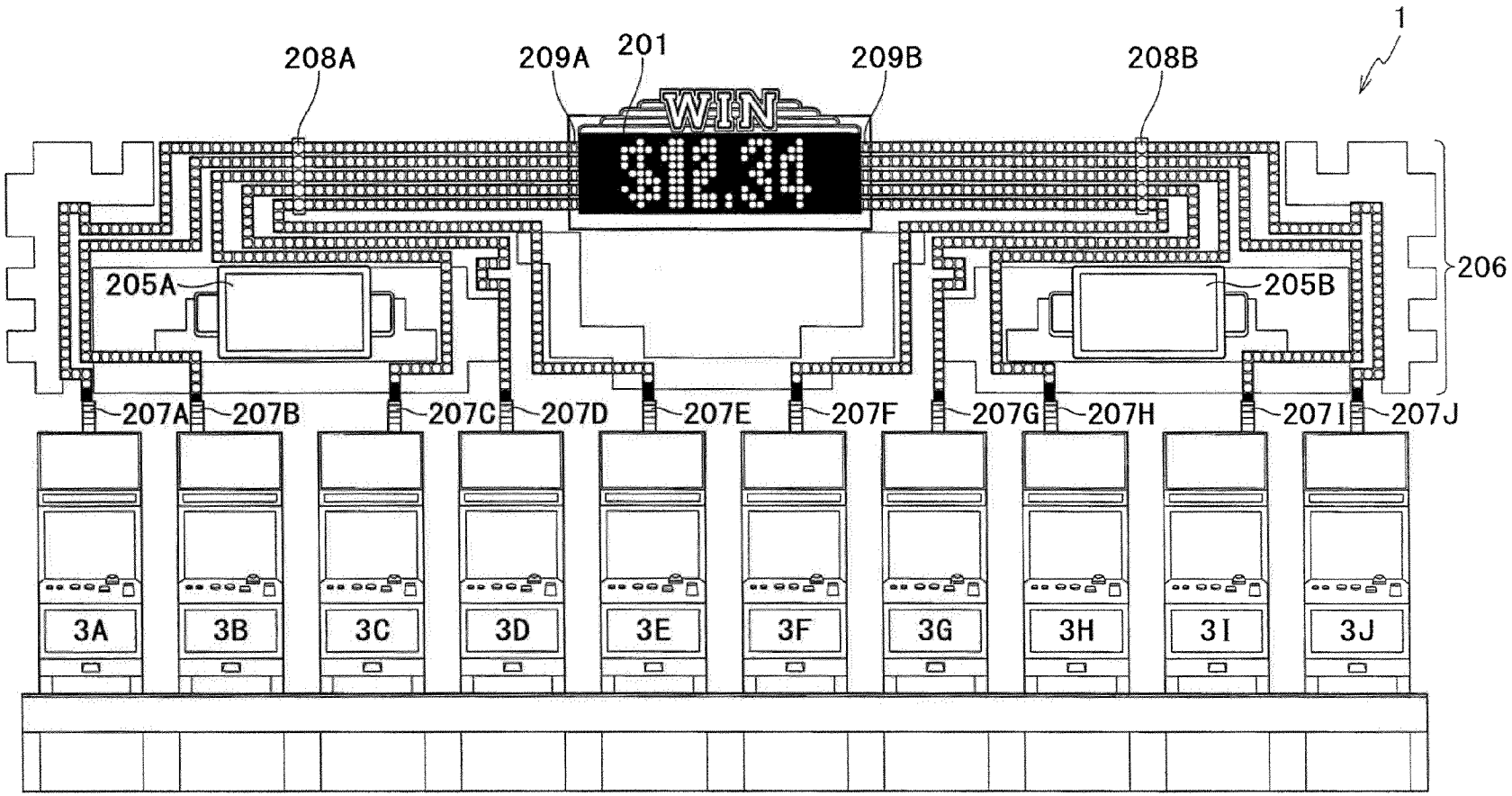
FIG. 69 is a front view showing an external appearance of a slot machine.

First, Embodiment 4 will be described with reference to FIG. 69. FIG. 69 is a front view of the slot machine 1 according to Embodiment 4 of the present invention.

As shown in FIG. 69, the slot machine 1 includes: ten terminal devices 3A to 3J; a shared display 201; two small shared displays 205A and 205B; a central control board 210 (see FIG. 75) provided to the shared display 201; and a route board 206. These components are connected to one another via a network.

On the route board 206, routes 207A to 207J are disposed so as to correspond to the terminal devices 3A to 3J respectively. Each of the routes 207A to 207J includes many LEDs continuously arranged from corresponding one terminal device out of the terminal devices 3A to 3J to the shared display 201. Note that the route board 206 and the routes 207A to 207J correspond to the route unit 118 of FIG. 68.

Each of the routes 207A to 207J is constituted of a linear portion and a bending portion. The linear portions are from goal lines 209A and 209B provided adjacent to the shared display 201 to on and off light lines 208A and 208B, respectively, and the bending portions are from the on and off light lines 208A and 208B to the terminal devices 3A to 3J, respectively.

In the slot machine 1 according to Embodiment 4, a percentage of an amount bet at each of the terminal devices 3A to 3J is accumulatively calculated, so that an accumulated value is obtained. An image showing the accumulated value resulting from the accumulative calculation is displayed on the shared display 201. For example, in FIGS. 67 and 69, "$12, 34" is displayed on the shared display 201, which indicates that the accumulated value is "$12, 34". When the accumulated value reaches a predetermined value, a jackpot game is run at the terminal devices 3A to 3J for the purpose of obtaining one or more coins equivalent to the accumulated value.

In a jackpot game, the positions corresponding to the respective connection points between the terminal devices 3A to 3J and the routes 207A to 207J are the 0 point positions, and the respective positions where the routes 207A to 207J intersect with the goal line 209A or 209B are the 50 point positions. For example, when a jackpot game is started, zero or more point is awarded according to the number of jackpot point symbols (described later) (see FIG. 74). Then, the thus awarded point is cumulated, and when the cumulative points reach a predetermined value (50 points), there is awarded coins equivalent to the accumulated value displayed on the shared display 201 (i.e. "$12, 34"). Here, the number of cumulative points awarded at each of the terminal devices 3A to 3J is indicated by the number of LEDs being in a light emitting state along a corresponding route out of the routes 207A to 207J.

Figure 70:
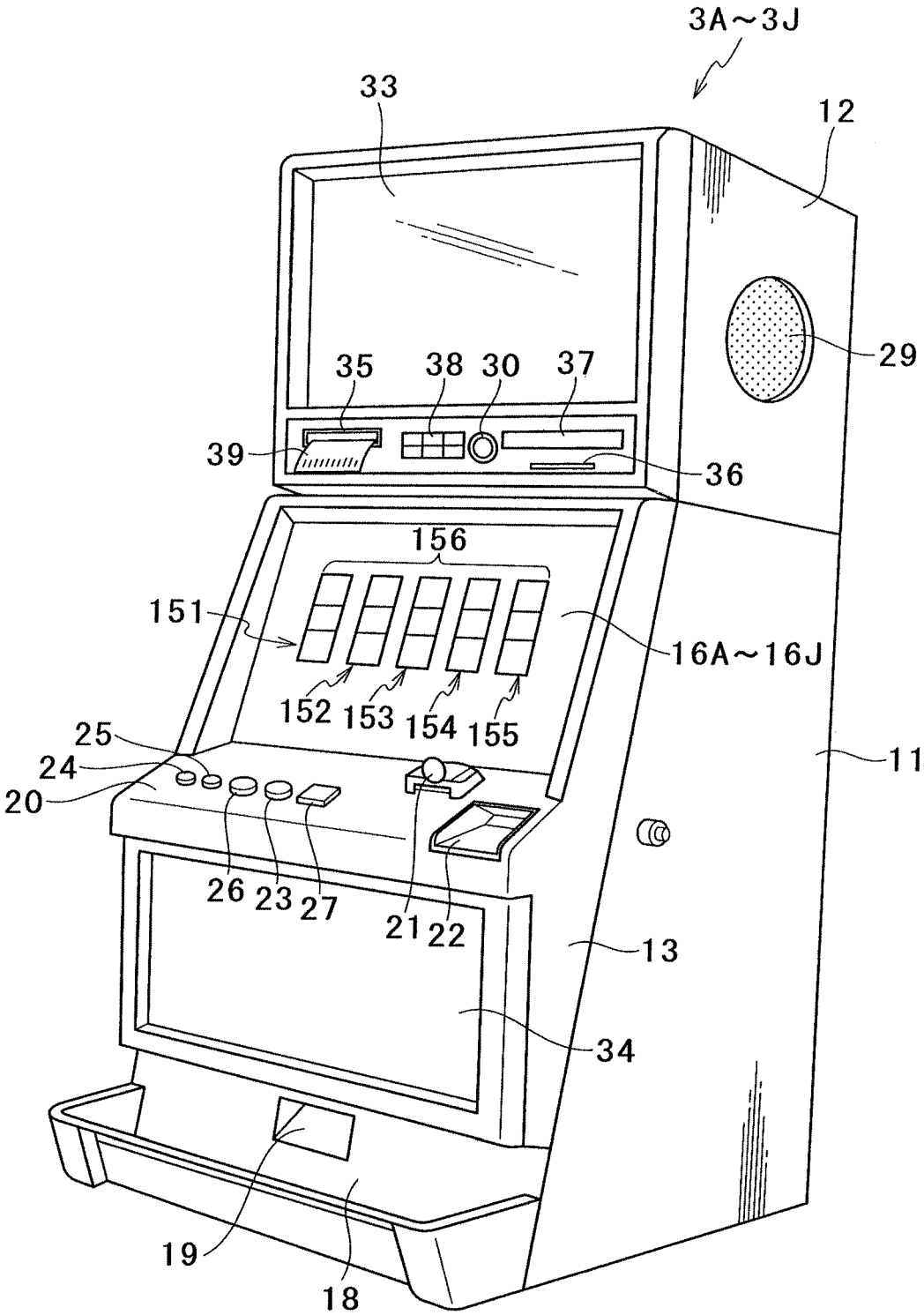
FIG. 70 is a perspective view showing an external appearance of a terminal device.

As shown in FIG. 70, the terminal device (3A to 3J) has a cabinet 11, a top box 12 placed on an upper side of the cabinet 11, and a main door 13 provided on a front surface of the cabinet 11. To the main door 13, a lower image display panel (16A to 16J) is provided. The lower image display panel (16A to 16J) has a transparent liquid crystal panel which displays various information. In addition, the lower image display panel (16A to 16J) displays thereon display windows 151 to 155 (a matrix 156) where more than one symbols 180 are arranged, and displays game-related various information, an effect image, and the like, as needed. Also, the shared display 201 and two small shared displays 201A and 201B have similar structures. Note that the terminal device (3A to 3J) corresponds to the terminal device 102 of FIG. 68. The lower image display panel (16A to 16J) serving as a terminal display corresponds to the terminal display 103 of FIG. 68.

Here, "arranging" means making a state where symbols 180 are visibly identifiable by a player. For example, in FIG. 67, it means making a state where symbols 180 are displayed in the display windows 151 to 155. Arranging symbols 180 again after dismissing symbols 180 is called "rearranging".

Embodiment 4 deals with, as an example, a case where the lower image display panel (16A to 16J) electrically displays symbols 180 to thereby display five columns and three rows of symbols. However, the present invention is not limited thereto. For example, three columns and three rows of symbols, or five columns and five rows of symbols, may be acceptable.

In this example, symbols 180 arranged in the display windows 151 to 155 are scatter symbols. Here, scatter symbols means such symbols that activation occurs (i.e., a payout is awarded, a bonus game is given, or the like) when a predetermined number of them stop in the matrix of arrangement areas made up of the five columns and three rows of the display windows 151 to 155. For example, in a base game where scatter symbols are adopted, a payout is awarded when a predetermined number (e.g., five or more) of scatter symbols are displayed in the display windows 151 to 155 (fifteen arrangement regions). That is, when a predetermined number of scatter symbols are displayed in the display windows 151 to 155, a payout is awarded regardless of display positions or an arrangement way of the scatter symbols.

Note that the lower image display panel (16A to 16J) may have a credit value indicator and a payout value indicator. The credit value indicator displays a total value (hereinafter also referred to as total credit value) which the terminal device (3A to 3J) can pay out to a player. The payout value indicator displays the number of coins to be paid out.

Below the lower image display panel (16A to 16J), provided are a control panel 20, a coin receiving slot 21, and a bill validator 22. The control panel 20 is provided with buttons 23 to 27. These buttons 23 to 27 allow a player to input commands relating to a game progress. The coin receiving slot 21 enables coins to be received into the cabinet 11.

The control panel 20 includes a spin button 23, a change button 24, a cashout button 25, a 1-BET button 26, and a MAX-BET button 27. The spin button 23 is for inputting a command to start scrolling the symbols 180. The change button 24 is used to ask a staff person of the gaming facility for money exchange. The cash out button 25 is for inputting a command to pay out coins corresponding to the total credit-value into a coin tray 18. Note that the control panel 20 corresponds to the game starting unit 105 of FIG. 68, which starts a base game.

The 1-BET button 26 is for inputting a command to bet, on a game, one coin among coins corresponding to the total credit value. The MAX-BET button 27 is for inputting a command to bet, on a game, the maximum number of coins bettable on one game (e.g., fifty coins) among coins corresponding to the total credit value.

The bill validator 22 validates whether a bill is genuine or not and receives the genuine bill into the cabinet 11. Note that the bill validator 22 is capable of reading a barcoded ticket 39 which will be described later. When the bill validator 22 reads the barcoded ticket 39, the bill validator 22 outputs to the main CPU 41 a read signal relating to what has been read.

On a front surface of a lower part of the main door 13, that is, below the control panel 20, a belly glass 34 is provided. On the belly glass 34, a character of the terminal device (3A to 3J), or the like is drawn. On a front surface of the top box 12 is provided an upper image display panel 33. The upper image display panel 33 has a liquid crystal panel, and displays an effect image, an image representing game introduction or game rules, or the like.

Further, the top box 12 has a lamp 30 for presenting an effect, and a speaker 29 for performing an audio output. Below the upper image display panel 33 are provided a ticket printer 35, a card reader 36, a data displayer 37, and a keypad 38. The ticket printer 35 prints, on to a ticket, a barcode which is an encoded form of data such as a credit-value, time and date, identification number of the terminal device (3A to 3J), and the like. As a result, the ticket printer 35 issues a barcoded ticket 39. A player can play a game in another terminal device (3A to 3J) using the ticket 39 having the barcode, or can exchange the ticket 39 having the barcode with a bill or the like at a change booth of the game arcade.

The card reader 36 reads and writes data from and into a smart card. The smart card is carried by a player, and stores therein data for identifying the player and data relating to a history of games played by the player, for example.

The data displayer 37 includes a fluorescent display or the like, and displays the data read by the card reader 36 and the data input by the player through the keypad 38, for example. The keypad 38 is for entering a command or data relating to issuing of a ticket.

[Electrical Structure of Slot Machine]

Figure 71:
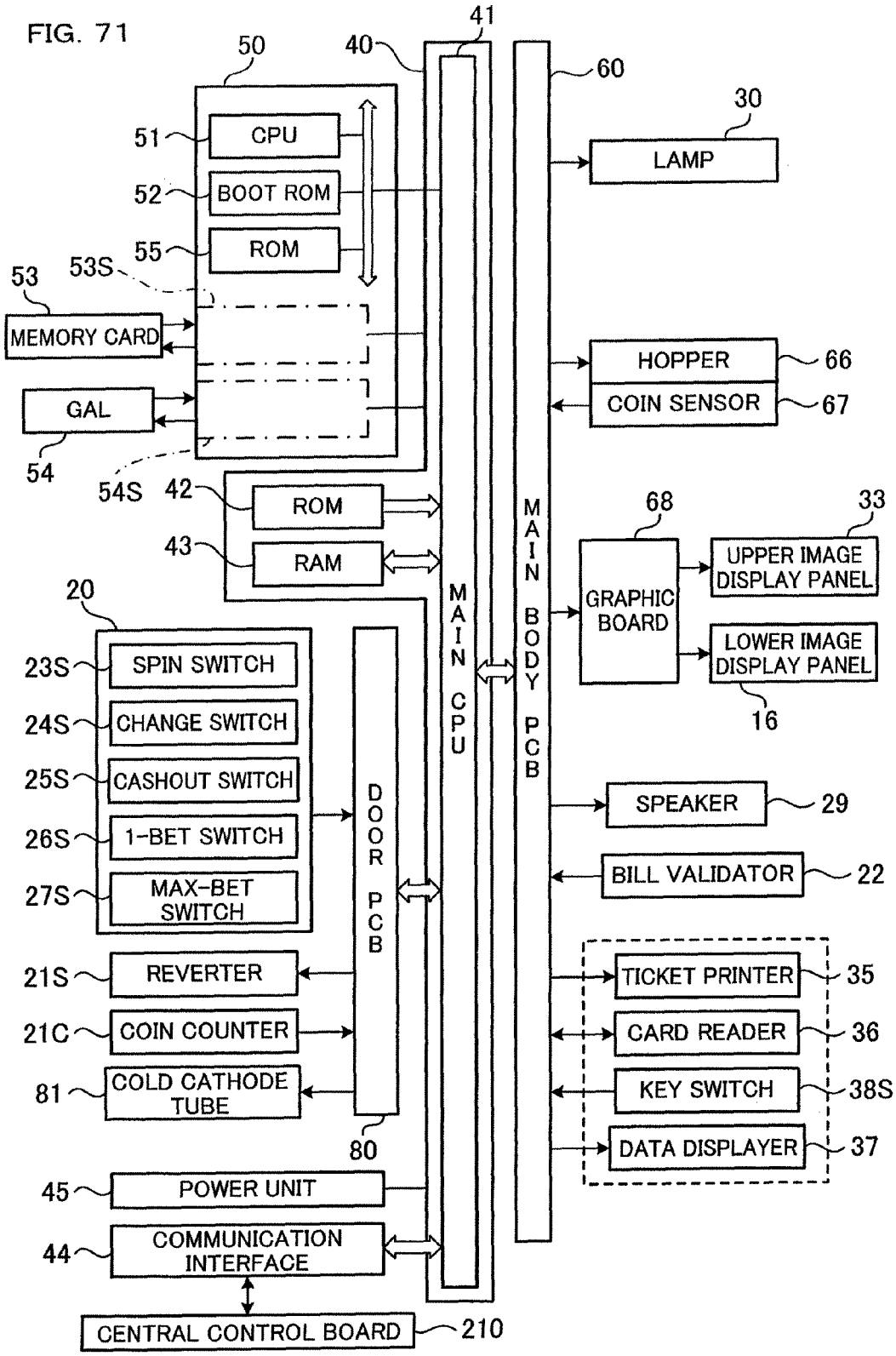
FIG. 71 is a block diagram showing an electrical structure of the terminal device.
Figure 75:
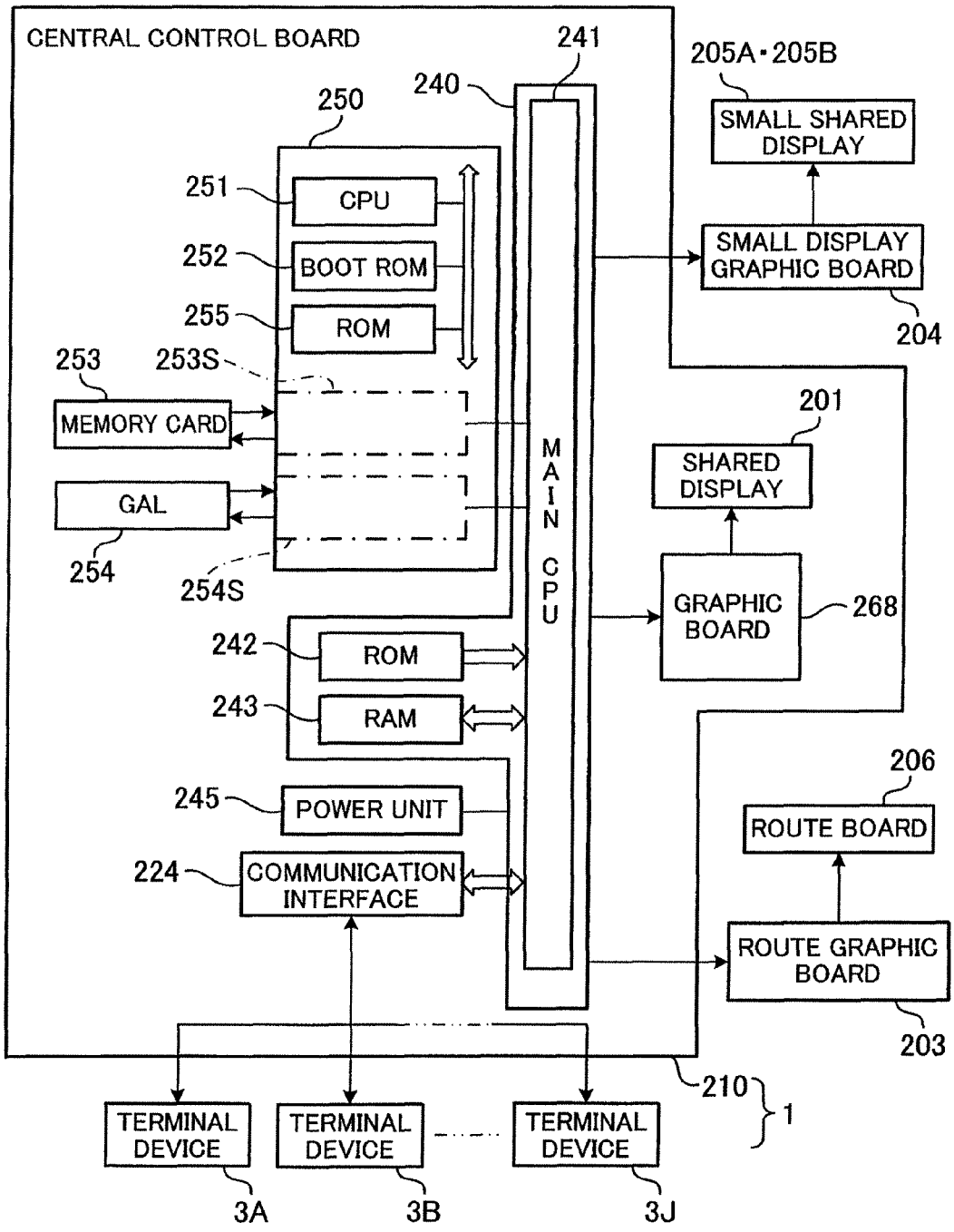
FIG. 75 is a block diagram showing an electrical structure of a central control board.

FIGS. 71 and 75 are block diagrams illustrating an electrical structure of the entire slot machine 1.

[Electrical Structure of Terminal Device]

FIG. 71 is a block diagram showing an electrical structure of the terminal device (3A to 3J). As illustrated in FIG. 71, a control unit is provided within the cabinet 11. As illustrated in FIG. 71, the control unit includes a motherboard 40, a main body PCB (Printed Circuit Board) 60, a gaming board 50, a door PCB 80, various switches, sensors, or the like.

The gaming board 50 has a CPU (Central Processing Unit) 51, a ROM 55, a boot ROM 52, a card slot 53S corresponding to a memory card 53, and an IC socket 54S corresponding to a GAL (Generic Array Logic) 54. The CPU 51, the ROM 55, and the boot ROM 52 are connected to one another through an internal bus.

The memory card 53 stores therein a game program and a game system program. The game program contains a stop symbol determining program. The stop symbol determining program determines symbols (code numbers corresponding to the symbols) to be stopped on the matrix 156.

This stop symbol determining program may contain sets of symbol weighting data respectively corresponding to various payout rates (e.g., 80%, 84%, and 88%). Each set of the symbol weighting data indicates, for each of the display windows 151 to 155, correspondence between a code number of each symbol column (symbol lines A to E) and at least one random number value belonging to a predetermined range. The payout rate is determined based on payout rate setting data output from the GAL 54. Based on a set of the symbol weighting data corresponding to the payout rate determined, symbols to be stopped are determined.

The memory card 53 stores therein various types of data for use in the game program and the game system program. For example, the memory card 53 stores data indicating correspondence between each of symbols 180 displayed in the display windows 151 to 155 and a range of random number values, in the form of a base game winning combination lottery table 130 (see FIG. 72). The memory card 53 also stores payout data which are based on a lottery result obtained from the base game winning combination lottery table 130, in the form of a base game payout table 131 (see FIG. 73). In addition, the memory card 53 stores, in the form of jackpot point table 132 (see FIG. 74), data indicating correspondence between the number of symbols of "SUN" 181 which are displayed in the display windows 151 to 155 in a jackpot game and the number of points to be obtained. These sets of data are transferred to a RAM 43 of the motherboard 40, at the time of running a base game.

The card slot 53S is structured so as to allow the memory card 53 to be attached and detached to and from the card slot 53S. This card slot 53S is connected to the motherboard 40 through an IDE bus. Thus, a type and contents of a game run at the terminal device (3A to 3J) can be changed by detaching the memory card 53 from the card slot 53S, writing a different game program and a different game system program into the memory card 53, and inserting the memory card 53 back into the card slot 53S.

The game program includes a program relating to a game progress. The game program also includes data of images and sounds to be output during a game.

The GAL 54 has input and output ports. When the GAL 54 receives data via the input port, it outputs, from its output port, data corresponding to the input data.

The IC socket 54S is structured so as to allow the GAL 54 to be attached and detached to and from the IC socket 54S. The IC socket 54S is connected to the motherboard 40, via a PCI bus. Thus, data to be output from the GAL 54 can be changed by detaching the GAL 54 from the IC socket 54S, overwriting the program stored in the GAL 54, and then attaching the GAL 54 back to the IC socket 54S.

The CPU 51, the ROM 55, and the boot ROM 52 connected to one another through the internal bus are connected to the motherboard 40 through a PCI bus. The PCI bus communicates signals between the motherboard 40 and the gaming board 50, and supplies power from the motherboard 40 to the gaming board 50. The ROM 55 stores country identification information and an authentication program. The boot ROM 52 stores a preliminary authentication program, a program (boot code) for enabling the CPU 51 to run the preliminary authentication program, and the like.

The authentication program is a program (falsification check program) for authenticating the game program and the game system program. The authentication program is a program for confirming and verifying that the game program and the game system program are not falsified. In other words, the authentication program is described in accordance with a procedure for authenticating the game program and the game system program. The preliminary authentication program is a program for authenticating the authentication program. The preliminary authentication program is described in accordance with a procedure for verifying that the authentication program to be authenticated is not falsified, that is, for authenticating the authentication program.

The motherboard 40 has the main CPU 41, a ROM (Read Only Memory) 42, a RAM (Random Access Memory) 43, and a communication interface 44. Note that the motherboard 40 corresponds to the terminal controller 110 of FIG. 68.

The main CPU 41 has a function of entirely controlling the terminal device (3A to 3J). In particular, the main CPU 41 controls the following operations of: outputting a command signal for making the graphic board 68 variably display symbols 180, at a time when the spin button 23 is pressed after betting of credit; determining symbols 180 to be stopped after the variable-displaying of symbols 180; and stopping the symbols 180 thus determined in the display windows 151 to 155. Note that the main CPU 41 corresponds to the game running unit 106, the combination determining unit 107, the jackpot credit transmitting unit 112, the jackpot game running unit 104, and the jackpot point determining unit 109 of FIG. 68.

In other words, the main CPU 41 serves to control arrangement, by scrolling symbols displayed on the lower image display panel (16A to 16J), then selecting and determining symbols to be rearranged from various kinds of symbols, to rearrange new symbols, and stopping scrolling of the symbols to present the symbols thus determined.

The ROM 42 stores a program such as BIOS (Basic Input/Output System) run by the main CPU 41, and permanently-used data. When the BIOS is run by the main CPU 41, each of peripheral devices is initialized, and the game program and the game system program stored in the memory card 53 are read out through the gaming board 50. The RAM 43 stores data or a program used for the main CPU 41 to perform a process. For example, the base game winning combination lottery table 130, the base game payout table 131, the jackpot point table 132, a game running processing program, and a terminal side jackpot game running processing program are stored in the RAM 43. In addition, a credit value is stored in the RAM 43.

The communication interface 44 communicates with a central control board 210 through a communication line. Further, a main body PCB (Printed Circuit Board) 60 and a door PCB 80 are connected to the motherboard 40, respectively through USBs (Universal Serial Buses). Further, a power unit 45 is connected to the motherboard 40. When the power unit 45 supplies power to the motherboard 40, the main CPU 41 of the mother board 40 is booted and in addition power is supplied to the gaming board 50 through the PCI bus so that the CPU 51 is booted.

Various devices or units which generate signals to be input to the main CPU 41, and various devices or units whose operations are controlled by signals output from the main CPU 41 are connected to the main body PCB 60 and the door PCB 80. Based on a signal input to the main CPU 41, the main CPU 41 runs the game program and the game system program stored in the RAM 43, to perform an arithmetic process. Then, the main CPU 41 stores a result of the arithmetic process in the RAM 43, or performs a control process on various devices and units by transmitting a control signal to the various devices and units.

A lamp 30, a hopper 66, a coin sensor 67, a graphic board 68, the speaker 29, a bill validator 22, a ticket printer 35, a card reader 36, a key switch 38S, and a data displayer 37 are connected to main body PCB 60.

The lamp 30 is turned on/off based on a control signal output from the main CPU 41.

The hopper 66 is mounted within the cabinet 11 and pays out a predetermined number of coins through a coin outlet 19 into the coin tray 18, based on a control signal output from the main CPU 41. The coin sensor 67 is provided inside the coin outlet 19. When the coin sensor 67 senses that a predetermined number of coins have been delivered from the coin outlet 19, the coin sensor 67 outputs a signal to be input to the main CPU 41. Note that the hopper 66 corresponds to the base payout awarding unit 108 and the jackpot game payout awarding unit 117 of FIG. 68.

The graphic board 68 controls image display on the upper image display panel 33 and the lower image display panel (16A to 16J), based on a control signal from the main CPU 41. Further, the graphic board 68 is provided with a VDP (Video Display Processor) for generating image data based on a control signal output from the main CPU 41, a video RAM for temporarily storing the image data generated by the VDP, and the like. Note that image data used at the time when the VDP generates the image data are included in the game program which has been read out from the memory card 53 and stored into the RAM 43.

The bill validator 22 reads an image on a bill and takes only one recognized to be genuine into the cabinet 11. When taking in a genuine bill, the bill validator 22 outputs, to the main CPU 41, an input signal based on a value of the bill. The main CPU 41 stores into the RAM 43 a credit value equivalent to the value of the bill indicated by the signal.

Based on a control signal output from the main CPU 41, the ticket printer 35 prints a barcode on a ticket, and outputs it as a barcoded ticket 39. The barcode contains encoded data of the credit value stored in the RAM 43, time and date, an identification number of the terminal device (3A to 3J), and the like.

The card reader 36 reads out data from the smart card and transmits the data to the main CPU 41. Further, the card reader 36 writes data into the smart card based on a control signal output from the main CPU 41. The key switch 38S is mounted to the keypad 38, and outputs a signal to the main CPU 41 in response to a player's operation on the keypad 38. The data displayer 37 displays, based on a control signal output from the main CPU 41, data read by the card reader 36 or data input by the player through the key pad 38.

The door PCB 80 is connected to a control panel 20, a reverter 21S, a coin counter 21C, and a cold cathode tube 81. The control panel 20 is provided with: a spin switch 23S associated with the spin button 23; a change switch 24S associated with the change button 24; a cashout switch 25S associated with the cashout button 25; a 1-BET switch 26S associated with the 1-BET button 26; and a MAX-BET switch 27S associated with the MAX-BET button 27. Each of the switches 23S to 27S outputs a signal to the main CPU 41, when a player presses the associated button.

The coin counter 21C is provided within the coin receiving slot 21, and identifies whether a coin inserted into the coin receiving slot 21 by the player is genuine. A coin other than a genuine coin is discharged from the coin outlet 19. The coin counter 21C outputs an input signal to the main CPU 41 upon detection of a genuine coin.

The reverter 21S is operated based on a control signal output from the main CPU 41. The reverter 21S distributes a coin, which the coin counter 21C has recognized as a genuine coin, to the hopper 66 or a cash box (not shown) mounted in the terminal device (3A to 3J). In other words, when the hopper 66 is full of coins, a genuine coin is distributed into the cash box by the reverter 21S. On the other hand, when the hopper 66 is not yet full of coins, a genuine coin is distributed into the hopper 66. The cold cathode tube 81 functions as a backlight mounted to the rear side of the lower image display panel (16A to 16J) and the rear side of the upper image display panel 33. The cold cathode tube 81 turns on based on a control signal output from the main CPU 41.

[Base Game Winning Combination Lottery Table]

A base game winning combination lottery table 130 which is used in a game running process executed by the terminal device (3A to 3J) will be described with reference to FIG. 72. FIG. 72 is an explanatory view showing a base game winning combination lottery table. The base game winning combination lottery table 130 is stored in the RAM 43, and read during a symbol determining process of the game running process which will be described later.

As shown in FIG. 72, random number values used in the base game winning combination lottery table 130 range from 0 to 5998. When a random number value sampled by the main CPU 41 is 0 to 29, a winning combination of "SUN" 181 is made. Then, five symbols 180 of "SUN" 181 are stopped in the display windows 151 to 155. When a random number value sampled by the main CPU 41 is 30 to 51, a winning combination of "HEART" 182 is made. Then, five symbols 180 of "HEART" 182 are stopped in the display windows 151 to 155. When a random number value sampled by the main CPU 41 is 52 to 107, a winning combination of "MOON" 183 is made. Then, five symbols 180 of "MOON" 183 are stopped in the display windows 151 to 155. Likewise, when a random number value is 108 to 207, a winning combination of "K" 186 is made. When a random number value is 208 to 407, a winning combination of "A" 184 is made. When a random number value is 408 to 807, a winning combination of "Q" 187 is made. When a random number value is 808 to 1477, a winning combination of "J" 185 is made. When a random number value is 1478 to 1807, a winning combination of "10" 188 is made. When a random number value sampled by the main CPU 41 is 1808 to 5998, it means a loss, and a losing combination of symbols 180, which is different from any of the above-mentioned winning combinations, is stopped in the display windows 151 to 155. Here, making any of these winning combinations means that a winning combination is achieved.

[Base Game Payout Table]

Next, a base game payout table 131 will be described with reference to FIG. 73. The base game payout table 131 indicates the number of coins to be paid out for a winning combination determined using the base game winning combination lottery table 130 shown in FIG. 72. FIG. 73 shows a base game payout table. The base game payout table 131 is stored in the RAM 43, and is read during a base game payout process of the game running process which will be described later.

For a result of sampling using the base game winning combination lottery table 130, zero or more coins are paid out in accordance with a winning combination displayed in the display windows 151 to 155 based on the base game payout table 131.

More specifically, when five symbols 180 of "SUN" 181 are stopped in the display windows 151 to 155, seventy coins are paid out. When five symbols 180 of "HEART" 182 are stopped in the display windows 151 to 155, fifty coins are paid out. When five symbols 180 of "MOON" 183 are stopped in the display windows 151 to 155, thirty coins are paid out as a payout. Likewise, when five symbols 180 of "K" 186 are stopped in the display windows 151 to 155, twenty-five coins are paid out as a payout. When five symbols 180 of "A" 184 are stopped in the display windows 151 to 155, twenty coins are paid out as a payout. When five symbols 180 of "Q" 187 are stopped in the display windows 151 to 155, fifteen coins are paid out as a payout. When five symbols 180 of "J" 185 are stopped in the display windows 151 to 155, ten coins are paid out as a payout. When five symbols 180 of "10" 188 are stopped in the display windows 151 to 155, five coins are paid out as a payout. When a lottery results in losing, and a losing combination of symbols 180, which is different from any of the above-mentioned winning combinations, is stopped in the display windows 151 to 155, zero coin is paid out as a payout. Note that, when one coin is inserted for a game, the above-mentioned number of coins are paid out as a payout. When two or more coins are inserted for one game, the number of coins actually paid out is calculated by multiplying the number of inserted coins by each of the above-mentioned numbers of coins paid out.

[Jackpot Point Table]

With reference to FIG. 74, the following describes a jackpot point table 132 which is referred to in a jackpot game. The jackpot point table 132 is a table showing the number of points to be awarded to a player, at a time of execution of a jackpot game, in accordance with the number of jackpot point symbols ("SUN" 181) displayed in the display windows 151 to 155. FIG. 74 shows the jackpot point table. In the meantime, the total number of points awarded to each of the terminal devices 3A to 3J is indicated by the number of LEDs being in a light emitting state along a corresponding route out of the routes 207A to 207J.

Specifically, when the total number of jackpot point symbols ("SUN" 181) displayed in the display windows 151 to 155 at a time of execution of a jackpot game is zero, zero point is obtained. When the total number of jackpot point symbols ("SUN" 181) is one, one point is obtained. When the total number of jackpot point symbols ("SUN" 181) is two, two points are obtained. When the total number of jackpot point symbols ("SUN" 181) is three, three points are obtained. When the total number of jackpot point symbols ("SUN" 181) is four, four points are obtained. When the total number of jackpot point symbols ("SUN" 181) is five, five points are obtained. When the total number of jackpot point symbols ("SUN" 181) is six, six points are obtained. When the total number of jackpot point symbols ("SUN" 181) is seven, seven points are obtained. When the total number of jackpot point symbols ("SUN" 181) is eight, eight points are obtained. When the total number of jackpot point symbols ("SUN" 181) is nine, nine points are obtained.

[Electrical Structure of Central Control Board]

FIG. 75 is a block diagram showing an electrical structure of the central control board 210. A control unit is provided within the central control board 210. As shown in FIG. 75, the control unit includes a motherboard 240, a gaming board 250, an actuator, and the like. The central control board 210 functioning as a controller corresponds to the controller 111 of FIG. 68.

The gaming board 250 has a CPU (Central Processing Unit) 251, a ROM 255, a boot ROM 252, a card slot 253S corresponding to a memory card 253, and an IC socket 254S corresponding to a GAL (Generic Array Logic) 254. The CPU 251, the ROM 255, and the boot ROM 252 are connected to one another through an internal bus. In other words, the gaming board 250 has the same structure and the same functions as those of the gaming board 50.

The motherboard 240 includes: a main CPU 241, a ROM (Read Only Memory) 242, a RAM (Random Access Memory) 243, a power unit 245, a graphic board 268, a shared display 201 connected to the graphic board 268, a route graphic board 203, a route board 206 connected to the route graphic board 203, a small display graphic board 204, the small shared displays 205A and 205B each connected to the small display graphic board 204, and a communication interface 224. The RAM 243 stores therein a center side jackpot game running processing program. The RAM 243 also stores therein an accumulated value resulting from accumulative calculation of a percentage of an amount bet at the terminal device (3A to 3J) (jackpot credit information). Note that the RAM 243 corresponds to the jackpot credit storage unit 113 of FIG. 68.

The shared display 201 has a transparent liquid crystal panel which displays various information. The shared display 201 displays thereon an image indicating an accumulated value resulting from accumulative calculation of a percentage of an amount bet at each of the terminal devices 3A to 3J. For example, as shown in FIGS. 67 and 69, "$12, 34" is displayed on the shared display 201, which indicates that the accumulated value is "$12, 34". When the accumulated value reaches a predetermined value, a jackpot game is run at each of the terminal devices 3A to 3J, for the purpose of obtaining coins corresponding to the accumulated value. In addition, the shared display 201 is capable of displaying thereon various information relating to a game, an effect image, or the like, when needed. Note that the shared display 201 corresponds to the common display 101 of FIG. 68.

The main CPU 241 controls the entire central control board 210. Particularly, when a jackpot game is executed, the main CPU 241 controls, through the route graphic board 203, operations of turning on, blinking, and turning off of LEDs provided on each of the routes 207A to 207J disposed on the route board 206. Note that, the main CPU 241 corresponds to the jackpot game start determining unit 114, the light emission determining unit 115, and the jackpot game combination determining unit 116 of FIG. 68.

The communication interface 224 communicates with the communication interfaces 44 of the terminal device (3A to 3J) through a communication line.

The graphic board 268 has the same structure as that of the graphic board 68, except that the graphic board 268 controls image displaying on the shared display 201 based on a control signal output from the main CPU 241. Also the small display graphic board 204 controls image displaying on the small shared displays 205A and 205B based on a control signal output from the main CPU 241.

Based on a control signal output from the main CPU 241, the route graphic board 203 controls operations of turning on, blinking, and turning off of LEDs provided along each of the routes 207A to 207J disposed on the route board 206.

[Display State of Display Windows 151 to 155 of Terminal Device]

Figure 76:
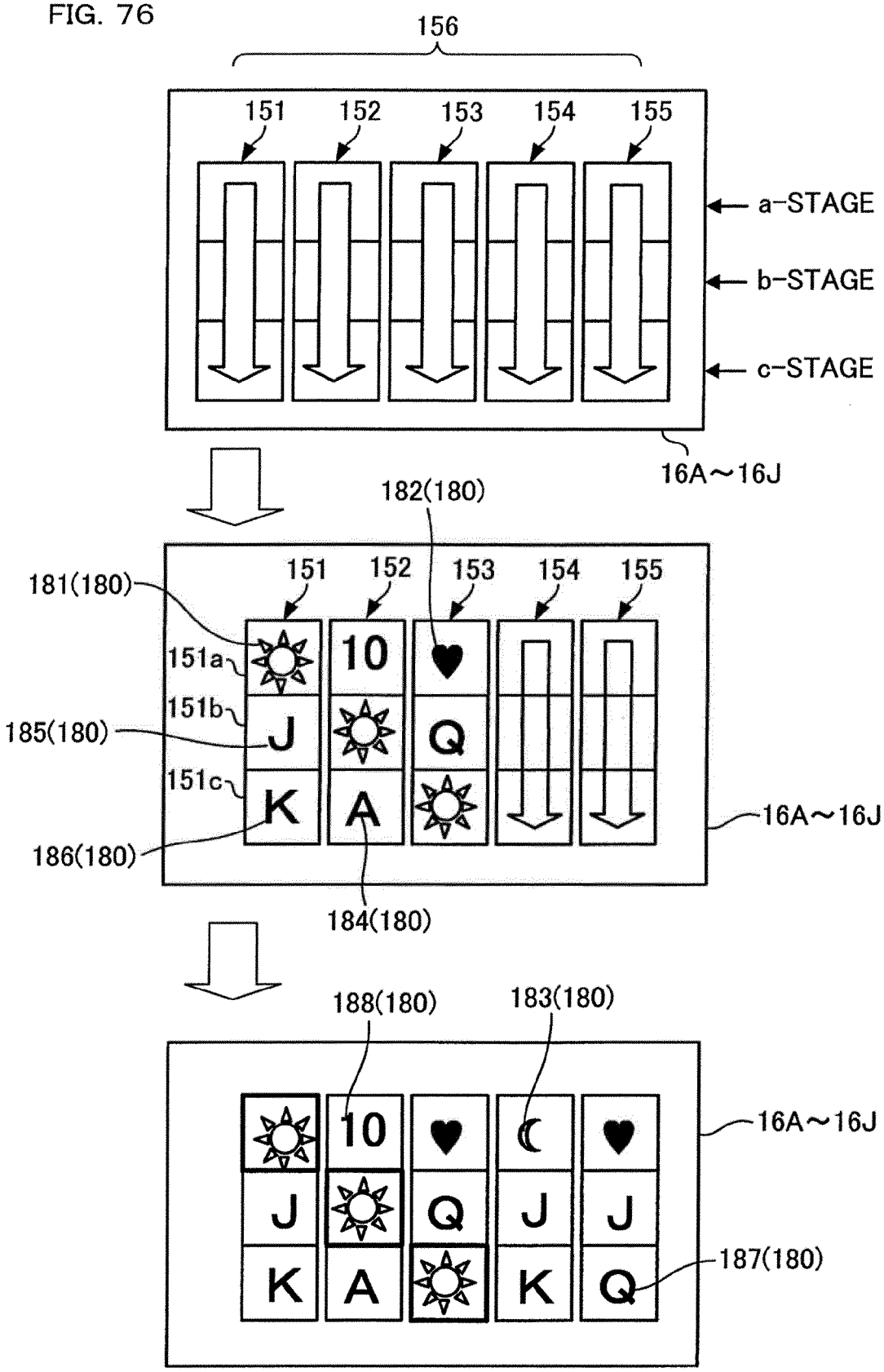
FIG. 76 is an explanatory view for a display screen.

The following details an exemplary display state of the lower image display panel (16A to 16J) of the terminal device (3A to 3J) during operations of the slot machine 1 and the playing method thereof. Note that the following example deals with a case where symbols 180 are arranged in the display windows 151 to 155 by means of a video reel method, as shown in FIGS. 67, 76 and 77.

The lower image display panel (16A to 16J) has display windows 151 to 155 where symbols 180 are arranged. The display windows 151 to 155 are disposed at a center part of the lower image display panel (16A to 16J). In the display windows 151 to 155, symbol columns (symbol lines A to E: see FIG. 77) each made up of symbols 180 are scroll-displayed (see FIG. 76). The display windows 151 to 155 are respectively divided into a-stages 151*a* to 155*a*, b-stages 151*b* to 155*b*, and c-stages 151*c* to 155*c*. The symbols 180 are stopped (arranged) in the stages 151*a* to 155*a*, 151*b* to 155*b*, and 151*c* to 155*c*, respectively. For example, in FIG. 76, a symbol of "SUN" 181 is stopped in 151*a* which is a-stage of the display window 151, a symbol of "J" 185 is stopped in 151*b* which is b-stage of the display window 151, and a symbol of "SUN" 181 is stopped in 153*c* which is c-stage of the display window 153. In short, the display windows 151 to 155 displays a matrix 156 as arrangement regions made up of five columns and three rows. The matrix 156 however is not limited to the matrix of five columns and three rows.

In a base game, a payout awarding process such as paying out coins is executed when a predetermined number of symbols 181 to 188 called scatter symbols are displayed on the lower image display panel (16A to 16J) as a winning combination. Scatter symbols are symbols which provide an effective result (such as awarding a payout, giving a bonus game, or the like) merely when a predetermined number of them are stopped on any of the display areas of the arrangement regions made up of five columns and three rows of the display windows 151 to 155. For example, when five symbols of "J" 185, which is one of the scatter symbols shown in FIG. 76, are rearranged (displayed) in the display windows 151 to 155, ten coins are paid out as a payout. When five symbols of "HEART" 182, which is one of the scatter symbols, are rearranged (displayed) in the display windows 151 to 155, fifty coins are paid out as a payout.

Although in Embodiment 4 the symbols 181 to 188 are defined as scatter symbols, this is not limitative and only a specific symbol may be defined as a scatter symbol. Alternatively, a player may select a scatter symbol. It may also be possible that a coin payout process or the like is executed when a predetermined combination of symbols is stopped on a payline L extending horizontally through the b-stages (151*b* to 155*b*) of the display windows 151 to 155. That is, the payline L is for determining a combination of symbols 180. When symbols 180 are rearranged on the payline L and outside the payline L, only the symbols 180 rearranged on the payline are judged for a combination. It may be possible that, when a winning combination is met as a result of the determination of a combination, a coin payout process or the like is executed.

[Symbol Column, etc.]

Symbols 180 displayed in the display windows 151 to 155 of the lower image display panel (16A to 16J) of the terminal device (3A to 3J) form five symbol columns (symbol lines A to E) each including twenty-two symbols, as shown in FIG. 77. To each of the symbols 180 constituting each column is given one of code numbers 00 to 21. Each of the symbol columns has a combination of picture symbols of "SUN" 181, "HEART" 182, and "MOON" 183, and letter symbols of "A" 184, "J" 185, "K" 186, "Q" 187, and "10" 188.

Three successive symbols in the symbol columns are displayed (arranged) in the upper stages 151*a*, 152*a*, 153*a*, 154*a*, 155*a*, the center stages 151*b*, 152*b*, 153*b*, 154*b*, 155*b* and the lower stages 151*c*, 152*c*, 153*c*, 154*c*, 155*c* of the display windows 151 to 155, respectively, to form a matrix of five columns and three rows in the display windows 151 to 155. When the 1-BET button 26 or the MAX-BET button 27 is pushed and then the spin button 23 is pushed to start a game, the symbols 180 forming the matrix are started to scroll. When the symbols 180 are scrolled for a predetermined period of time, the scroll of the symbols 180 is stopped (rearranged).

The symbols 181 to 188 are set as scatter symbols. Scatter symbols are such symbols that a player is put into an advantageous position when a predetermined number or more of them are displayed in the display windows 151 to 155. The advantageous position is a state where coins corresponding to the scatter symbols are paid out, a state where the number of coins to be paid out is added to a credit value, or the like.

For example, when five or more symbols of "MOON" 183 are stopped in the display windows 151 to 155, thirty coins (game value) per bet are paid out.

In Embodiment 4, a game value is paid out when a predetermined number of predetermined symbols are stopped in the display windows 151 to 155. However, a bonus game may be given instead. The bonus game is a gaming state which is more advantageous than a basic game. For example, the bonus game is a free game. The free game is a game allowing a player to play a game a predetermined number of times without betting a coin. No particular limitation is put on the bonus game, as long as it is a gaming state advantageous to the player, that is, it is more advantageous than the basic game. For example, the bonus game may include a state where more game value are obtainable than in the basic game, a state where a game value is obtainable with higher probability than in the basic game, a state where a game value is less consumed than in the basic game, and the like. Specifically, a free game, a second game, a feature game, and the like may be mentioned as examples of the bonus game.

In a jackpot game, a symbol of "SUN" 181 is a jackpot point symbol. When a predetermined number of symbols of "SUN" 181 are displayed in the display windows 151 to 155, a player can obtain one or more points in accordance with the number of jackpot point symbols of "SUN" 181 displayed in the display windows 151 to 155.

[Operation of Slot Machine]

Next, various processes executed in the slot machine 1 will be described. As the main CPU 41 and the main CPU 241 read out and execute programs stored in the ROM 42, the RAM 43, the ROM 242, and the RAM 243, processes relating to various games are run.

[Operation of Slot Machine: Boot Process]

The following describes a boot process which takes place in the slot machine 1. Upon powering on the slot machine 1, a boot processing routine shown in FIG. 78 starts in the motherboard 240 and the gaming board 250 in the central control board 210, and in the motherboard 40 and the gaming board 50 in the terminal device (3A to 3J). The memory cards 53 and 253 are assumed to be inserted into the card slots 53S and 253S of the gaming boards 50 and 250, respectively. Further, the GALs 54 and 254 are assumed to be attached to the IC sockets 54S and 254S, respectively.

First, turning on the power switch of (powering on) the power units 45 and 245 boots the motherboards 40 and 240, and the gaming boards 50 and 250. Booting the motherboards 40 and 240 and the gaming boards 50 and 250 starts separate processes in parallel. Specifically, in the gaming board 50 and 250, the CPUs 51 and 251 read out preliminary authentication programs stored in the boot ROMs 52 and 252, respectively. Then, preliminary authentication is performed according to the read out programs so as to confirm and authenticate that no modification is made to authentication programs, before reading them into the motherboards 40 and 240, respectively (S1). Meanwhile, the main CPUs 41 and 241 of the motherboards 40 and 240 run BIOS stored in the ROMs 42 and 242 to load into the RAMs 43 and 243 compressed data built in the BIOS, respectively (S2). Then, the main CPUs 41 and 241 run a procedure of the BIOS according to the data loaded into the RAMs 43 and 243 so as to diagnose and initialize various peripheral devices (S3).

The main CPUs 41 and 241, which are respectively connected to the ROMs 55 and 255 of the gaming boards 50 and 250 via PCI buses, read out authentication programs stored in the ROMs 55 and 255 and store them into the RAMs 43 and 243 (S4). During this step, the main CPUs 41 and 241 each derives a checksum through ADDSUM method (a standard check function) which is adopted in a standard BIOS, and store the authentication programs into the RAMs 43 and 243 while confirming if the operation of storing is carried out without an error.

Next, the main CPUs 41 and 241 each checks what connects to the IDE bus. Then, the main CPUs 41 and 241 access, via the IDE buses, to the memory cards 53 and 253 inserted into the card slots 53S and 253S, and read out game programs and game system programs from the memory cards 53 and 253, respectively. In this case, the CPUs 41 and 241 each reads out four bytes of data constituting the game program and the game system program at one time. Next, in accordance with the authentication programs stored in the RAMs 43 and 243, the CPUs 41 and 241 authenticate the game programs and the game system programs read out to confirm and prove that these programs are not modified (S5).

When the authentication process properly ends, the main CPUs 41 and 241 write and store the authenticated game programs and game system programs into RAMs 43 and 243 (S6).

Next, the main CPUs 41 and 241 access, via the PCI buses, to the GALs 54 and 254 attached to the IC sockets 54S and 254S, and read out data from the GALs 54 and 254, respectively. The data read out is then written and stored in the RAMs 43 and 243 (S7).

Next, the main CPUs 41 and 241 read out, via the PCI buses, country identification information stored in the ROMs 55 and 255 of the gaming boards 50 and 250, respectively. The country identification information read out is then written and stored in the RAMs 43 and 243 (S8).

Figure 79:
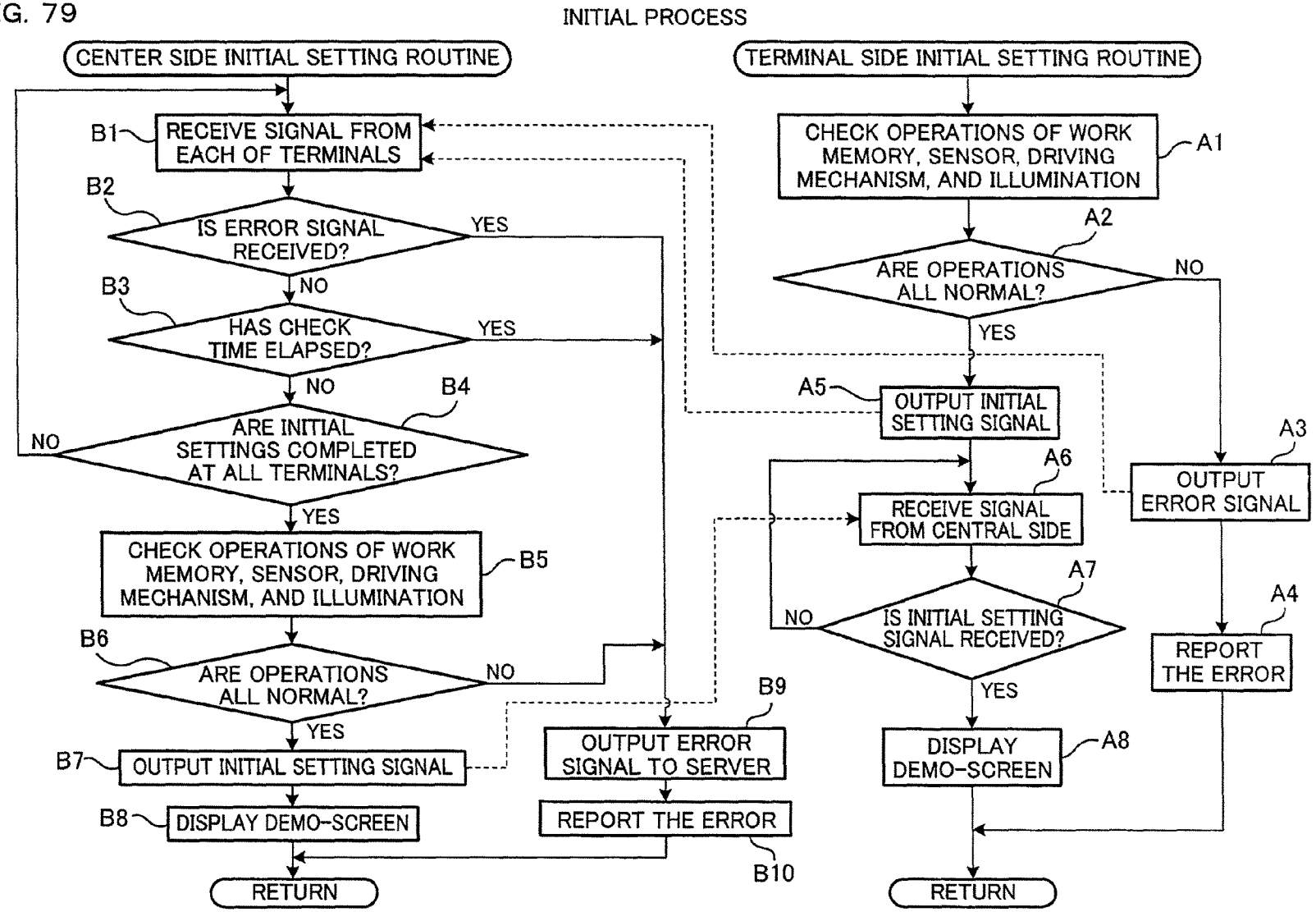
FIG. 79 is a flowchart of an initial process executed in the slot machine.

After this, the main CPUs 41 and 241 each performs an initial process shown in FIG. 79.

[Operation of Slot Machine: Initial Process]

Figure 78:
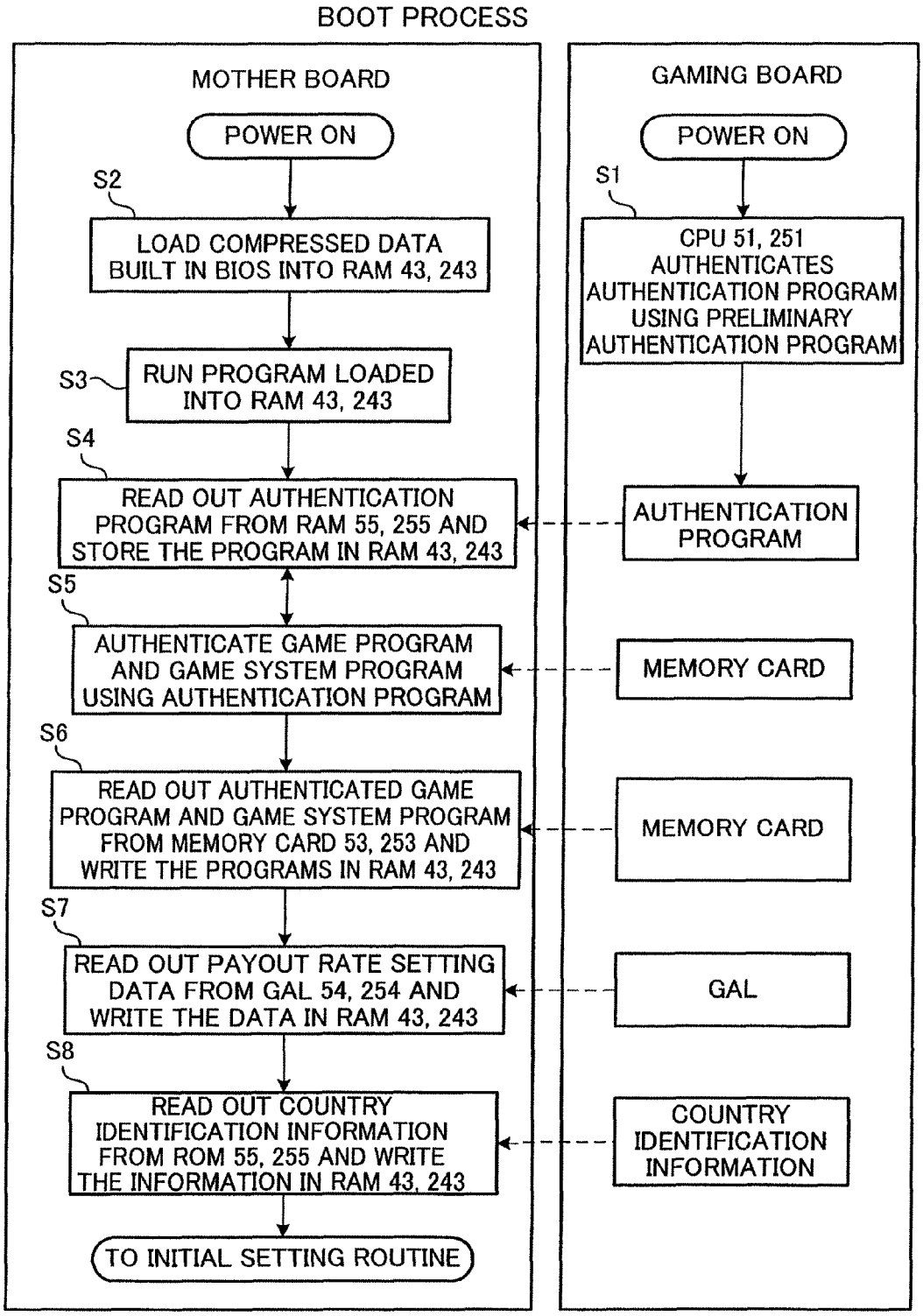
FIG. 78 is a flowchart of a boot process executed in the slot machine.

The following describes an initial process which takes place in the slot machine 1. When the boot process of FIG. 78 is completed, the central control board 210 reads out from the RAM 243 a center side initial setting routine illustrated in FIG. 79 and executes the routine. Meanwhile, after the boot process shown in FIG. 78 is completed, the terminal device (3A to 3J) reads out from the RAM 43 a terminal side initial setting routine illustrated in FIG. 79 and executes the routine. The center side and terminal side initial setting routines are executed in parallel.

First, the main CPU 41 of the terminal device (3A to 3J) checks operations of work memories such as the RAM 43, various sensors, various driving mechanisms, and various decorative illuminations (A1). Then, the main CPU 41 determines if all the check results are normal (A2). When the main CPU 41 determines that the check results are not all normal (A2: NO), the main CPU 41 outputs an error signal to the central control board 210 (A3), reports the error in the form of illuminating the lamp 30 or the like (A4), and then ends the routine.

On the other hand, in A2, when the main CPU 41 determines that all the check results are normal (A2: YES), an initial setting signal is output to the central control board 210 (A5). Then, an initial setting signal is waited from the central control board 210 (A6, A7: NO).

The main CPU 241 of the central control board 210 receives a signal from each of the terminals (B1). Then, the main CPU 241 determines whether a signal received is an error signal (B2). When the main CPU 241 determines that the signal is an error signal (B2: YES), the main CPU 241 outputs an error signal to a management server such as a not-shown host computer (B9) to report the error (B10), and ends the routine.

On the other hand, in B2, when the main CPU 241 determines that the signal is not an error signal (B2: NO), the main CPU 241 determines whether a predetermined time (check time) has elapsed from the time of powering on (B3). When the main CPU 241 determines that the check time has elapsed (B3: YES), the step B9 is executed. On the other hand, when the main CPU 241 determines that the check time has not yet elapsed (B3: NO), the main CPU 241 determines whether initial setting signals are received from all of the terminal devices 3A to 3J (B4). When the main CPU 241 determines that initial setting signals are not received from all the terminal devices 3A to 3J (B4: NO), the process returns to the step B1. On the other hand, when it is determined that initial setting signals are received from all the terminal devices 3A to 3J (B4: YES), the main CPU 241 checks operations of work memories such as RAM 243 or the like, various sensors, various driving mechanisms, and various decorative illuminations (B5). Then, the main CPU 241 determines whether all the check results are normal (B6). When the main CPU 241 determines the check results contains an error (B6: NO), the main CPU 241 executes the step B9.

On the other hand, in the step B6, when the main CPU 241 determines that all the check results are normal (B6: YES), the main CPU 241 outputs an initial setting signal to all the terminal devices 3A to 3J (B7), and causes the shared display 201 to display a demo-screen (B8). Then, the main CPU 241 ends this routine.

In the step A7, the main CPU 41 of each of the terminal devices 3A to 3J determines that an initial setting signal is received from the central control board 210 (A7: YES), and causes the upper image display panel 33 to display a demo-screen (A8). The main CPU 41 then ends the routine.

[Operation of Slot Machine: Game Running Process]

Figure 80:
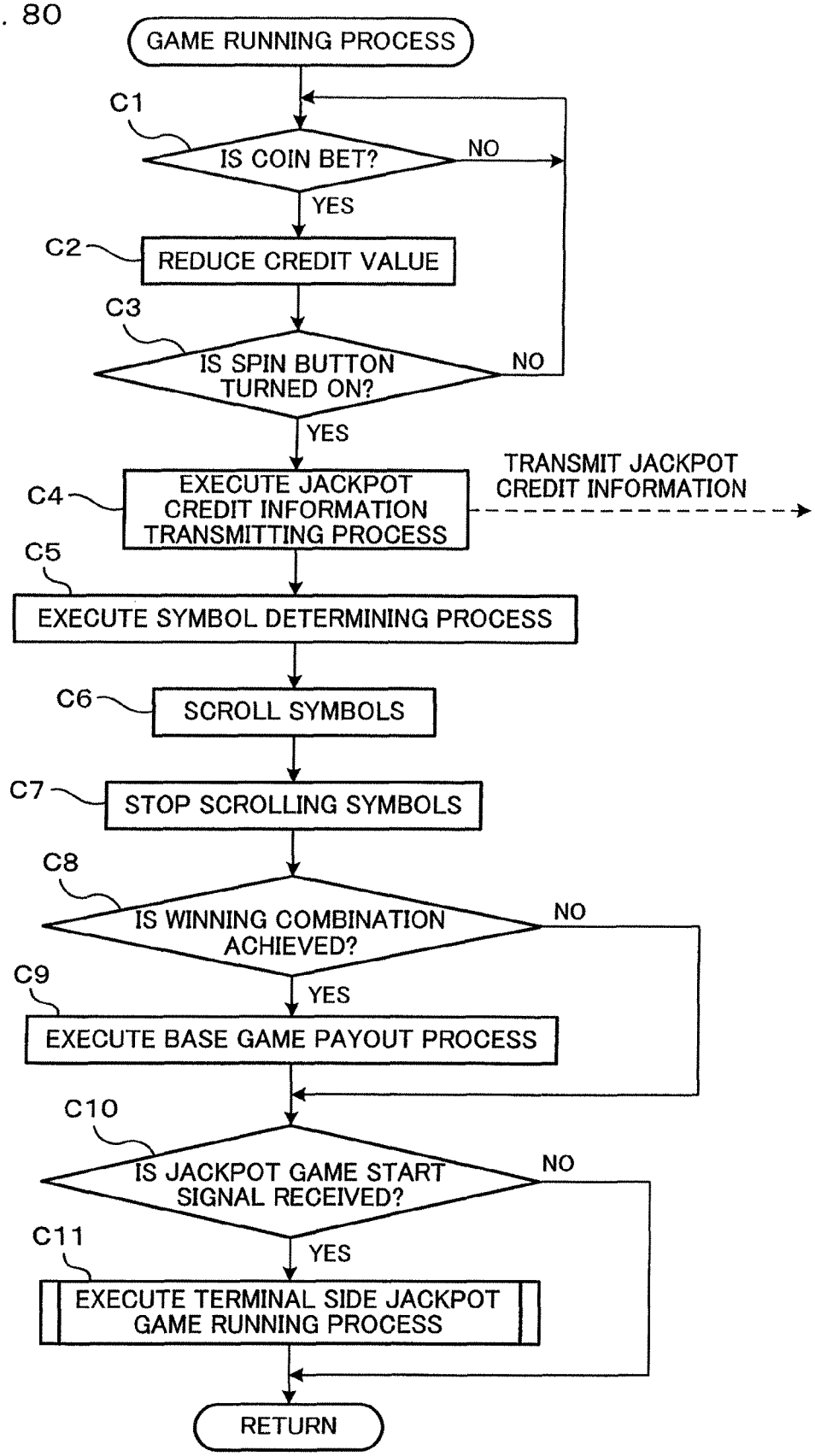
FIG. 80 is a flowchart of a game running process executed in the terminal device.

After the terminal side initial setting routine of FIG. 79 is completed, the main CPU 41 of each of the terminal devices 3A to 3J reads out and executes the game program and the game system program sequentially, thereby executing a game running process shown in FIG. 80. A game running processing program is stored in the RAM 43.

The main CPU 41 of each of the terminal devices 3A to 3J executes the game running process shown in FIG. 80. When the game running process is run, first, the main CPU 41 determines whether a coin is bet or not (C1). In this step, whether an input signal from the 1-BET switch 26S entered by pressing of the 1-BET button 26 is received or not is determined. Meanwhile, whether an input signal from the MAX-BET switch 27S entered by pressing of the MAX-BET button 27 is received or not is determined. When no coin is bet (C1: NO), C1 is repeated so that a standby state continues until a coin is bet.

On the other hand, when it is determined that a coin is bet (C1: YES), the credit value stored in the RAM 43 is reduced according to the number of coins bet (C2). When the number of coins bet surpasses the number of coins equivalent to the credit value stored in the RAM 43, the credit value is reduced to zero and the step C3 is performed. When the number of coins bet exceeds the maximum number of coins bettable on one game (50 pieces in Embodiment 4), the credit value is reduced by fifty and the step C3 is performed.

Then, whether a spin button 23 is turned on or not is determined (C3). When the spin button 23 is not turned on (C3: NO), the process returns to C1. Here, if the spin button 23 is not turned on (for example, the spin button 23 is not turned on but a command to end the game is input), the reduction of the credit value in the step C2 is canceled.

On the other hand, when it is determined that the spin button 23 is turned on (C3: YES), executed is a jackpot credit information transmitting process (C4). In other words, the main CPU 41 transmits, to the central control board 210, a percentage (5% in Embodiment 4) of one or more coins bet in the step C1, as jackpot credit information.

Then, a symbol determining process is executed (C5). In other words, a stop symbol determining program is executed based on the base game winning combination lottery table 130 stored in the RAM 43, to determine fifteen symbols 180 to be stopped in the display windows 151 to 155.

Then, symbols 180 in the symbol columns (symbol lines A to E) in the display windows 151 to 155 are scrolled (C6). When a predetermined period of time (base time) has elapsed after the scroll of the symbols 180 is started, the symbols 180 determined in the step C5 are stopped (rearranged) in the display windows 151 to 155 (C7).

Then, whether a winning combination is achieved or not, that is, whether a combination of symbols 180 stopped in the display windows 151 to 155 corresponds to a winning combination listed in the base game payout table 131 or not, is determined (C8). When it is determined that a winning combination is not achieved (C8: NO), the process proceeds to the step C10. On the other hand, when it is determined that a winning combination is achieved (C8: YES), a base game payout process is executed (C9). More specifically, the number of coins to be paid out which corresponds to the kind of the winning combination is calculated based on the base game payout table 131 shown in FIG. 73. When coins to be paid out are reserved, a credit value equivalent to the coins to be paid out is added to the credit value stored in the RAM 43. When the coins are paid out, a control signal is transmitted to the hopper 66 so that a predetermined number of coins are paid out to the coin tray 18. That is, a base payout is awarded in accordance with the winning combination.

Then, it is determined whether a jackpot game start signal which is transmitted in a later-mentioned center side jackpot game running process is received or not (C10). When the jackpot game start signal is not received (C10: NO), this process ends. On the other hand, when the jackpot game start signal is received (C10: YES), a later-mentioned terminal side jackpot game running process is executed (C11). Then, this process once ends.

[Operation of Slot Machine: Terminal Side Jackpot Game Running Process]

Figure 81:
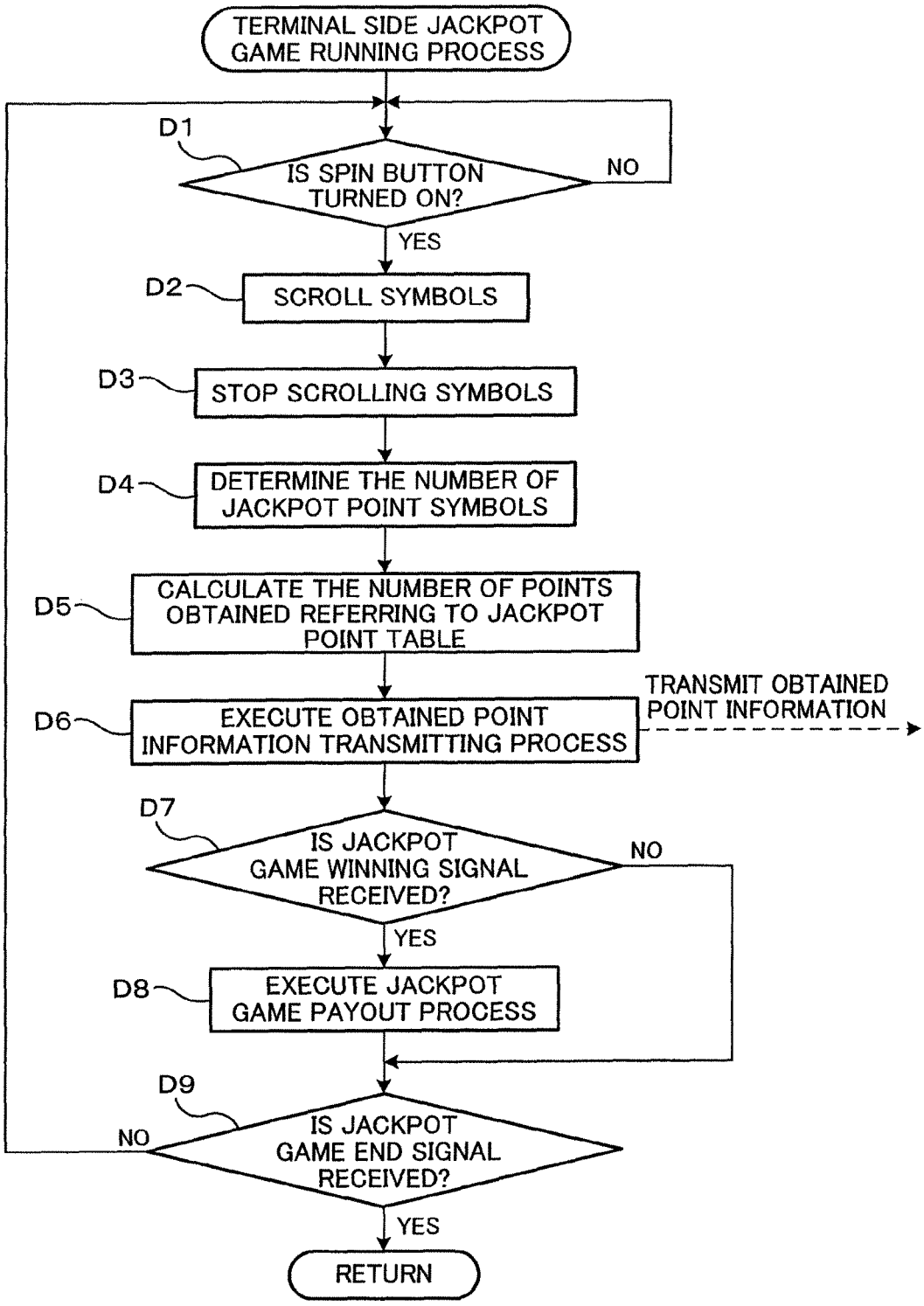
FIG. 81 is a flowchart of a terminal side jackpot game running process executed in the terminal device.

When the terminal side jackpot game running process is executed in the step C11 of FIG. 80, the main CPU 41 of the terminal device (3A to 3J) executes the terminal side jackpot game running process shown in FIG. 81. A terminal side jackpot game running processing program is stored in the RAM 43.

When the terminal side jackpot game running process is executed, first, whether the spin button 23 is turned on or not is determined (D1). When it is determined that the spin button 23 is not turned on (D1: NO), the process returns to D1.

On the other hand, when it is determined that the spin button 23 is turned on (D1: YES), symbols 180 are scroll-displayed in the display windows 151 to 155 (D2). When a predetermined period of time (base time) has elapsed after the scroll of the symbols 180 is started, symbols 180 are stopped (rearranged) in the display windows 151 to 155 (D3).

Then, it is determined how many symbols of "SUN" 181 each acting as a jackpot point symbol appear among the symbols 180 stopped in the display windows 151 to 155 (D4).

Then, the number of points obtained is calculated, based on the number of symbols of "SUN" 181 each acting as a jackpot point symbol, which number is determined in the step D4, as well as referring to the jackpot point table 132 (D5). After that, executed is an obtained point information transmitting process (D6). That is, the main CPU 41 transmits to the central control board 210 the number of points obtained which is calculated in the step D5, as obtained point information.

Then, whether a jackpot game winning signal is received or not is determined, which signal is transmitted in the later-mentioned center side jackpot game running process (D7) When the jackpot game winning signal is not received (D7: NO), the process proceeds to the step D9.

On the other hand, when the jackpot game winning signal is received (D7: YES), a jackpot game payout process is executed (D8). In other words, paid out are one or more coins equivalent to an accumulated value resulting from accumulative calculation of a percentage of an amount bet at each of the terminal devices 3A to 3J. For example, as shown in FIGS. 67 and 69, "$12, 34" is displayed on the shared display 201, and coins equivalent to this accumulated value of "$12, 34" are to be paid out. When coins to be paid out are reserved, a credit value equivalent to the accumulated value is added to the credit value stored in the RAM 43. When the coins are paid out, a control signal is transmitted to the hopper 66 so that coins equivalent to the accumulated value are paid out to the coin tray 18.

Then, it is determined whether a jackpot game end signal is received or not, which signal is transmitted in the later-mentioned center side jackpot game running process (D9). When the jackpot game end signal is not received (D9: NO), the process returns to the step D1. On the other hand, when the jackpot game end signal is received (D9: YES), this process once ends.

[Operation of Slot Machine: Center Side Jackpot Game Running Process]

Figure 82:
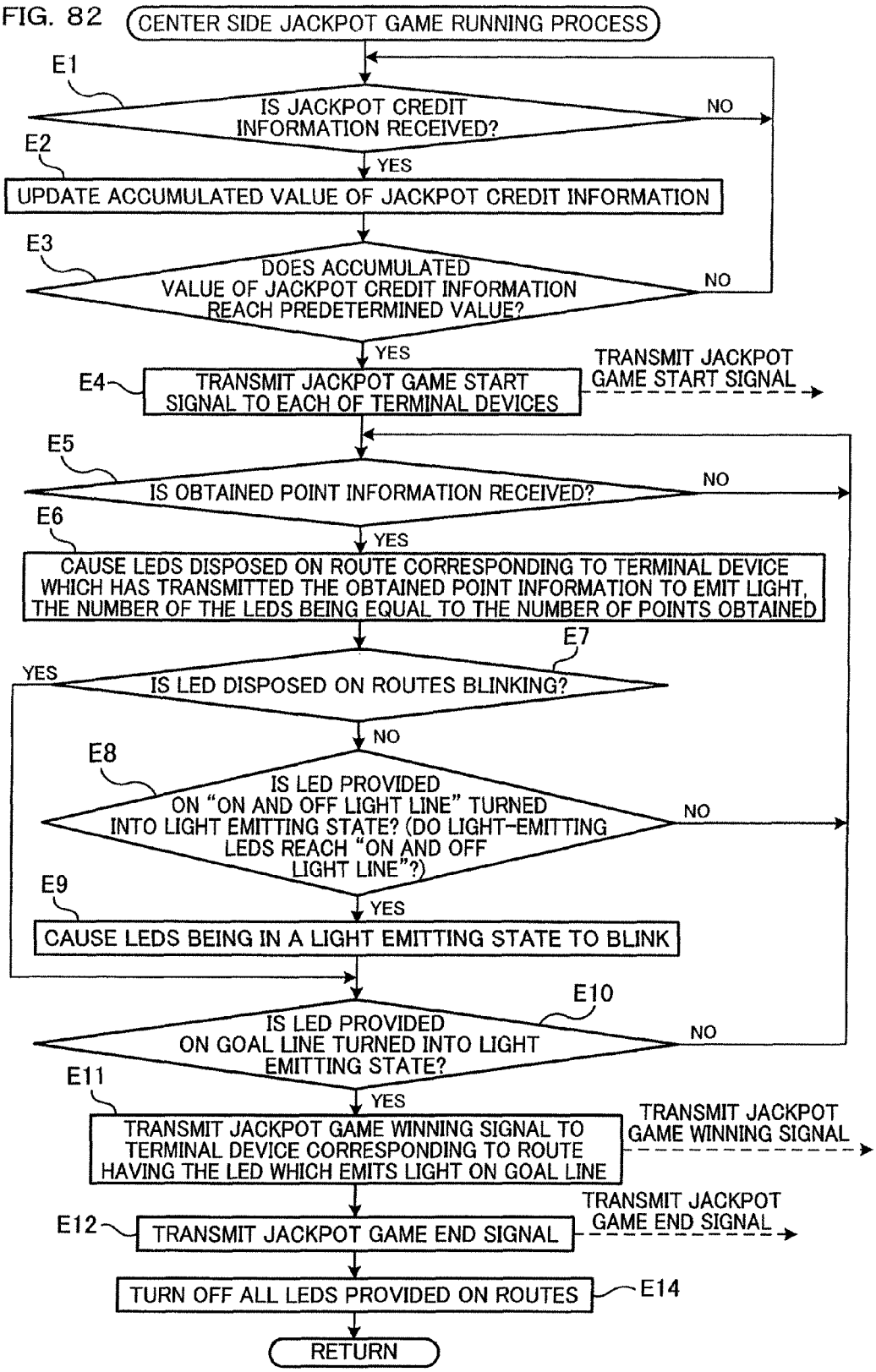
FIG. 82 is a flowchart of a center side jackpot game running process executed in the central control board.

After the center side initial setting routine shown in FIG. 79 ends, the main CPU 241 of the central control board 210 reads out and executes the game program and the game system program sequentially, thereby running the center side jackpot game running process shown in FIG. 82. This center side jackpot game running processing program is stored in the RAM 243.

When the center side jackpot game running process is executed, first, it is determined whether the jackpot credit information transmitted in the before-mentioned game running process is received or not (E1). When the jackpot credit information is not received (E1: NO), the step E1 is repeated. On the other hand, when the jackpot credit information is received (E1: YES), the accumulated value of the jackpot credit information is updated (E2). In other words, based on the jackpot credit information transmitted from each of the terminal devices 3A to 3J, the main CPU 241 adds a percentage (5% in Embodiment 4) of an amount bet at each of the terminal devices 3A to 3J to the accumulated value of jackpot credit information stored in the RAM 243, and stores the thus obtained value.

Next, the main CPU 241 determines whether the accumulated value of jackpot credit information stored in the RAM 243 reaches a predetermined value ("$12, 34" in Embodiment 4) (E3). When the accumulated value does not reach the predetermined value (E3: NO), the process returns to the step E1. On the other hand, when the accumulated value reaches the predetermined value (E3: YES), a jackpot game start signal which triggers a jackpot game is transmitted to each of the terminal devices 3A to 3J (E4).

In Embodiment 4, a jackpot game is started when the accumulated value of jackpot credit information exceeds a predetermined value (e.g., a fixed value of "$12, 34"), however, Embodiment 4 is not limited thereto. For example, the slot machine 1 may have a structure that a threshold value, for triggering a jackpot game, of the accumulated value of jackpot credit information is randomly varied in each jackpot game within a predetermined range (e.g., $200 to $300).

Next, it is determined whether the obtained point information is received or not, which information is transmitted in the before-mentioned terminal side jackpot game running process (E5). When the obtained point information is not received (E5: NO), the step E5 is repeated. On the other hand, when the obtained point information is received (E5: YES), LEDs disposed along a route corresponding to a terminal device which has transmitted the obtained point information are caused to turned on toward the shared display 201 so as to emit light, the number of the LEDs caused to turned on being equal to the number of points obtained (E6).

Next, it is determined whether an LED disposed along the routes is blinking or not (E7). When an LED is blinking (E7: YES), the process proceeds to the step E10. On the other hand, when an LED is not blinking (E7: NO), it is determined whether a predetermined number of LEDs disposed along any one of the routes corresponding to the terminal devices 3A to 3J are turned into a light emitting state (E8). Specifically, it is determined whether an LED provided on the on and off light line 208A or 208B shown in FIGS. 67 and 69 is turned into a light emitting state. When an LED provided on the on and off light line 208A or 208B is not turned into a light emitting state (E8: NO), the process returns to the step E5. On the other hand, when an LED provided on the on and off light line 208A or 208B is turned into a light emitting state (E8: YES), all the LEDs that have been already in a light emitting state are caused to blink, as shown in FIG. 67 (E9).

Next, it is determined whether an LED provided on the goal line 209A or 209B is turned into a light emitting state (E10). In other words, it is determined whether the number of points awarded in a jackpot game reaches a predetermined value (50 points). (That is, whether there is a player who has won the jackpot game is determined). When an LED provided on the goal line 209A or 209B is not turned into a light emitting state (E10: NO), the process returns to the step E5. On the other hand, when an LED provided on the goal line 209A or 209B is turned into a light emitting state (E10: YES), a jackpot game winning signal is transmitted to a terminal device corresponding to a route having the LED which emits light on the goal line 209A or 209B (E11).

In Embodiment 4, a fixed value (50 points) is set as the number of points required to receive, at the terminal device (3A to 3J), an award of the accumulated value of jackpot credit information (in Embodiment 4, a predetermined value of "$12, 34"). However, the required number of points may be set by selection. For example, the number of points required to receive an award of the accumulated value of jackpot credit information may be selected, by an input from outside, from several values (e.g., 50 points, 100 points, and 150 points)

Next, a jackpot game end signal is transmitted to the terminal devices 3A to 3J (E12). Then, all the LEDs provided along the routes 207A to 207J are turned off (E13). Then, this process once ends.

With this structure, after the amount of accumulated game values reaches a predetermined value, and every time a predetermined winning is achieved at a terminal device (3A to 3J), a predetermined number of LEDs, which are disposed along a route (207A to 207J) corresponding to the terminal device (3A to 3J) at which the predetermined winning is achieved, are turned on toward the shared display 201 so as to emit light. When a predetermined number of LEDs disposed along any one of the routes 207A to 207J are turned on so as to emit light, all the LEDs, which are disposed along each of the routes 207A to 207J and are turned on, are caused to blink. For example, when a player who plays at the terminal device 3A achieves the predetermined winning in a base game with the result that the predetermined number of LEDs along the route 207A are turned on so as to emit light, all the LEDs, which are disposed along the routes 207A to 207J and are turned on, are caused to blink. This enables players and an audience around the slot machine 1 to be aware that there is a player who almost obtains the accumulated game values displayed on the shared display 201. In addition, the arrangement above enables the player who almost obtains the accumulated game values to increase an expectation for obtaining the accumulated game values. Also, the arrangement urges other players to achieve the predetermined winning early because the other players may fail to obtain the accumulated game values. Further, this arrangement can provide the audience with an excitement caused by predicting who obtains the accumulated game values displayed on the shared display 201. That is, the players and the audience around the slot machine 1 may be more excited.

Note that, in the step E8 of Embodiment 4, when an LED provided on the on and off light line 208A or 208B is turned into a light emitting state, all the LEDs, which are disposed along each of the routes 207A to 207J and are in the light emitting state, are caused to blink. However, this is not limitative. For example, when an LED provided on the on and off light line 208A or 208B is turned into a light emitting state, only the LEDs that are in the light emitting state and disposed along the route having the LED which emits light on the on and off light line 208A or 208B, may be caused to blink.

With this structure, after the amount of accumulated game values reaches a predetermined value, and every time a predetermined winning is achieved at a terminal device (3A to 3J), a predetermined number of LEDs, which are disposed along a route (207A to 207J) corresponding to the terminal device (3A to 3J) at which the predetermined winning is achieved, are turned on toward the shared display 201 so as to emit light. When a predetermined number of LEDs disposed along a route (207A to 207J) are turned on so as to emit light, only the LEDs, which are disposed along that route and are turned on, are caused to blink. For example, when a player who plays at the terminal device 3A achieves the predetermined winning with the result that the predetermined number of LEDs, which are disposed along the route 207A corresponding to the terminal device 3A at which the predetermined winning is achieved, are turned on so as to emit light, only the LEDs, which are turned on and are disposed along the route 207A corresponding to the terminal device 3A at which the predetermined winning is achieved, are caused to blink. This enables players and an audience around the slot machine 1 to know the terminal device (3A to 3J) of the player who almost obtains the accumulated game values displayed on the shared display 201. In addition, the arrangement above enables the player who almost obtains the accumulated game values to increase an expectation for obtaining the accumulated game values. Also, the arrangement urges other players to achieve the predetermined winning early because the other players may fail to obtain the accumulated game values. Further, this arrangement can provide the audience with an excitement caused by predicting who obtains the accumulated game values displayed on the shared display 201. That is, the players and the audience around the slot machine 1 may be more excited.

[Operation of Slot Machine: Effect Operation]

When the above-described various processes are executed in the slot machine 1, results or contents corresponding to the processes are, in the form of commands or data, input to respective actuators. For example, when a jackpot game winning signal is received at a terminal device (3A to 3J), the main CPU 41 controls the lamp 30 so as to blink. When a jackpot game winning signal is transmitted, effect images are displayed on the upper image display panel 33 of each of the terminal devices 3A to 3J and the small shared displays 205A and 205B. Moreover, an effect is presented through audio output from the speaker 29, together with or independently of the above-described effects.

In addition, when an LED provided on the on and off light line 208A or 208B is turned into a light emitting state, an effect is presented such that an effect sound is output from the speaker 29 in response to turning on of the LED.

With this structure, it is possible to generate an effect sound when a predetermined number of LEDs disposed along any one route out of the routes 207A to 207J are turned on so as to emit light. This enables the players and audience to be aware that there is a player who almost obtains the accumulated game values displayed on the shared display 201. Accordingly, it is possible to grab the attention of the players and the audience around the slot machine 1.

Note that the present invention is not limited to the above-described Embodiment 4. The below-described another version of Embodiment 4 may also be possible. Hereinafter, described is a base game of a slot machine 1 according to the other version of Embodiment 4 of the present invention.

Figure 83:
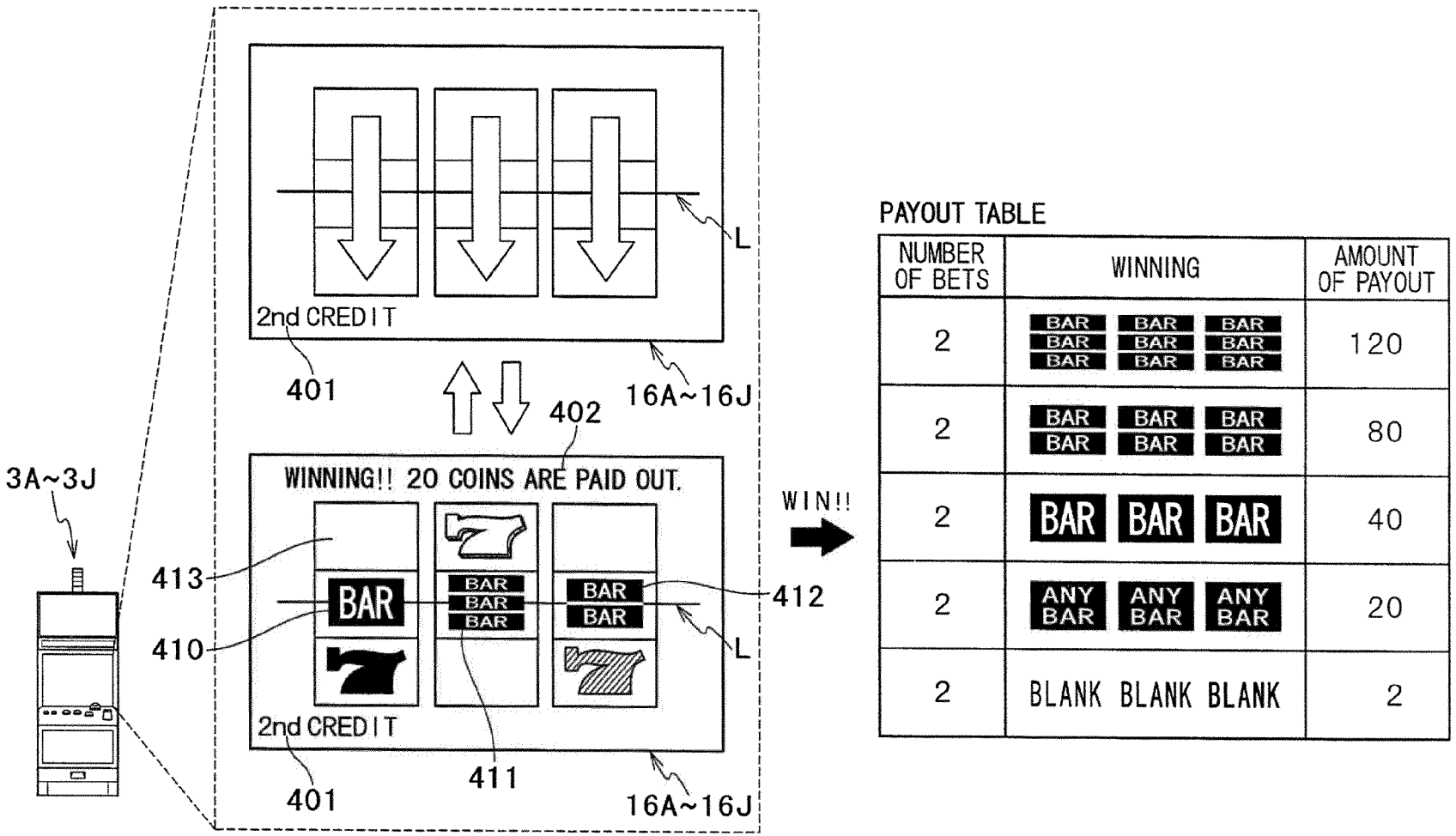
FIG. 83 is an explanatory view concerning a base game in a slot machine according to another version of Embodiment 4 of the present invention.

As shown in FIG. 83, each of lower image display panels 16A to 16J according to the other version of Embodiment 4 has arrangement regions in the form of matrix of three rows and three columns. The arrangement regions located in a middle row make up a payline L. When a predetermined winning is achieved by the relation between the symbols rearranged on the payline L, a payout is awarded according to the winning achieved. The lower image display panel (16A to 16J) displays thereon a credit-number 401 which indicates the amount of game value bet.

In the example shown in FIG. 83, the credit-number 401 indicates "2nd CREDIT", meaning that the amount of game value bet is equivalent of two coins. As a result of symbol rearrangement, symbols 410, 411, and 412 are rearranged as "1BAR", "3BAR", and "2BAR", respectively, on the payline L. These symbols make a winning of "ANY-BAR" "ANY-BAR" "ANY-BAR", which is a winning combination for credit-number 401 equivalent of two coins. As a payout for this winning, twenty coins are awarded.

FIG. 84 shows a second base game payout table. The second base game payout table is used when the main CPU 41 determines a winning in a base game, and when the main CPU 41 awards a payout according to the winning. The second base game payout table contains fields for the number of bets, winning, and the amount of payout. In the field for the number of bets, the number of coins bet is shown. In the field for winning, combinations of symbols rearranged in the payline L are shown, which are conditions necessary for achieving a winning. The field for the amount of payout shows the number of coins paid out when a winning is achieved. An example shown in FIG. 84 will be described below. When the symbols "3BAR" "3BAR" "3BAR" are rearranged in the payline L, the amount of payout is 60 when the number of bets is 1, and 120 when the number of bets is 2. When the symbols "2BAR" "2BAR" "2BAR" are rearranged in the payline L, the amount of payout is 40 when the number of bets is 1, and 80 when the number of bets is 2. When the symbols "1BAR" "1BAR"

"1BAR" are rearranged in the payline L, the amount of payout is 20 when the number of bets is 1, and 40 when the number of bets is 2. When the symbols "ANY-BAR" "ANY-BAR" "ANY-BAR" are rearranged in the payline L, the amount of payout is 10 when the number of bets is 1, and 20 when the number of bets is 2. When the symbols "BLANK" "BLANK" "BLANK" are rearranged in the payline L, the amount of payout is 1 when the number of bets is 1, and 2 when the number of bets is 2. When the symbols "Blue 7" "Blue 7" "Blue 7" are rearranged in the payline L, the amount of payout is 1800 when the number of bets is 3. When the symbols "Red 7" "Red 7" "Red 7" are rearranged in the payline L, the amount of payout is 100 when the number of bets is 3. When the symbols "ANY-7" "ANY-7" "ANY-7" are rearranged in the payline L, the amount of payout is 100 when the number of bets is 3. Like this, the amount of payout awarded at a time of achieving a winning increases as the number of bets is increased. This may increase the game value (number of bets) bet by a player.

The following describes a bonus game in a slot machine 1 according to the other version of Embodiment 4 of the present invention. In a bonus game according to the other version of Embodiment 4, points are awarded that reflect a predetermined winning. LEDs provided along a route (207A to 207J) are configured to be turned on, toward a goal line 209A or 209B, so as to emit light. The number of LEDs which emit light corresponds to the accumulated number of points awarded.

Figure 85:
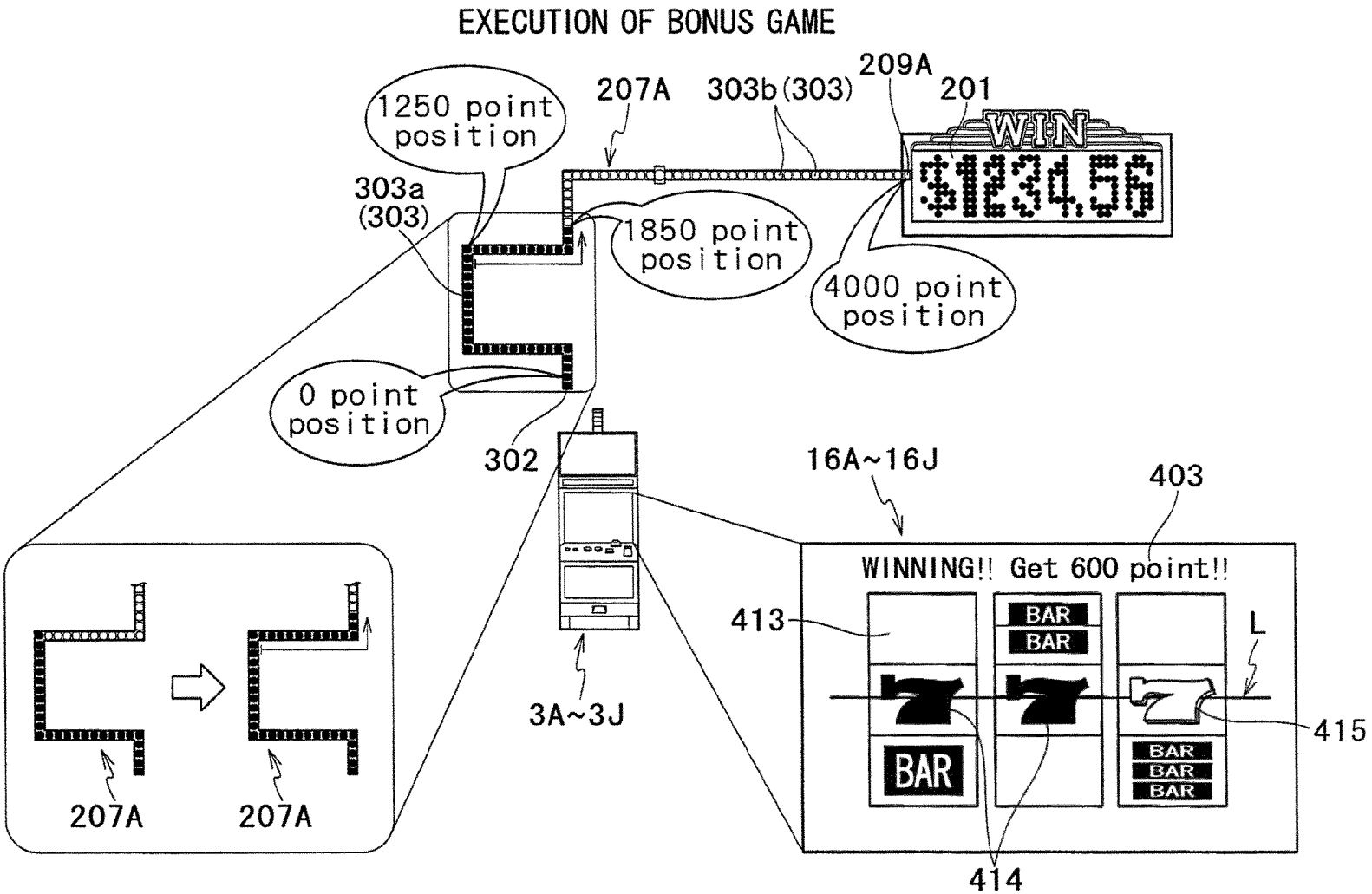
FIG. 85 is an explanatory view concerning a bonus game in the slot machine according to the other version of Embodiment 4 of the present invention.

An example shown in FIG. 85 will be described below. The positions 302 respectively connected to the terminal devices 3A to 3J are 0 point positions, and the respective positions where the routes 207A to 207J intersect with the goal line 209A or 209B are 4000 point positions. The number of points awarded and accumulated at the terminal device 3A is 1250 points and, along the route 207A, a leading one of the LEDs being in a light emitting state reaches the position corresponding to 1250 points. Here, winnings are achieved by the rearrangement of symbol 414, symbol 414, and symbol 415 as "Red 7", "Red 7", and "Blue 7", respectively, in the pay line L. Three winnings are achieved. Rearrangement of the symbols 414 in the payline L makes two winnings, and rearrangement of the symbol 415 in the payline L makes one winning. The payout for the winning achieved by each symbol 414 is 150 points, and the payout for the winning achieved by the symbol 415 is 300 points. Accordingly, the three winnings make a total payout of 600 points. Awarding the above 600 points to the terminal device 3A makes the accumulated points of 1250+600=1850 points. Then, a leading one of the LEDs being in a light emitting state reaches the position corresponding to 1850 points. Thus, during a bonus game, points are awarded according to a predetermined winning achieved, and a jackpot is awarded when the number of points awarded and accumulated reaches a predetermined value (4000 points).

FIG. 86 shows a bonus game payout table. The bonus game payout table is used when the main CPU 41 determines a winning in a bonus game, and when the main CPU 241 awards payout-points according to the winning. The bonus game payout table contains fields for winning and fields for payout-points. In the field for winning, combinations of symbols rearranged in the payline L are shown, which are conditions necessary for achieving a winning. The field for payout-points indicates the number of points paid out when a winning is achieved. An example shown in FIG. 86 is described below. When symbols "Blue 7" "Blue 7" "Blue 7" are rearranged in the payline L, 7000 points are paid out. When a symbol "Blue 7" is rearranged in the payline L, 300 points are paid out. When a symbol "Red 7" is rearranged in the payline L, 150 points are paid out. When a symbol "3BAR" is rearranged in the payline L, 30 points are paid out. When a symbol "2BAR" is rearranged in the payline L, 20 points are paid out. When a symbol "1BAR" is rearranged in the payline L, 10 points are paid out.

The foregoing described a slot machine (gaming machine 100) according to the other version of Embodiment 4 of the present invention. The slot machine 1 according to the other version of Embodiment 4 of the present invention has a structure that a bonus game is started when the accumulated value of jackpot credit information exceeds a predetermined value (e.g., a fixed value of "$12, 34"). However, the other version of Embodiment 4 is not limited thereto. For example, the slot machine 1 may have a structure that a threshold value, for triggering a bonus game, of the accumulated value of jackpot credit information is randomly varied in each bonus game within a predetermined range (e.g., $200 to $300).

In addition, in the other version of Embodiment 4 of the present invention, a fixed value (4000 points) is set as the number of points required to receive, at the terminal device (3A to 3J), an award of accumulated value of jackpot credit information (in the other version of Embodiment 4, a predetermined value of "$12, 34"). However, the required number of points may be set by selection. For example, the slot machine 1 (gaming machine) may have a structure that the accumulated value of jackpot credit information is awarded when the number of points award and accumulated reaches a value which is varied in each bonus game within a predetermined range (e.g., 3000 to 5000 points)

In addition, in the other version of Embodiment 4, a fixed value (4000 points) is set as the number of points required to receive, at the terminal device (3A to 3J), an award of accumulated value of jackpot credit information (in the other version of Embodiment 4, a predetermined value of "$12, 34"). However, the required number of points may be set by selection. For example, the number of points required to receive an award of the accumulated value of jackpot credit information may be selected, by an input from outside, from several values (e.g., 3000 points, 4000 points, and 5000 points).

The detailed description of the present invention provided hereinabove mainly focused on characteristics thereof for the purpose of easier understanding; however, the scope of the present invention shall be construed as broadly as possible, encompassing various forms of other possible embodiments, and therefore the present invention shall not be limited to the above description. Further, the terms and phraseology used in the present specification are adopted solely to provide specific illustration of the present invention, and in no case should the scope of the present invention be limited by such terms and phraseology. Further, it will be obvious for those skilled in the art that the other structures, systems, methods or the like are possible, within the spirit of the invention described in the present specification. The description of claims therefore shall encompass structures equivalent to the present invention, unless otherwise such structures are regarded as to depart from the spirit and scope of the present invention. Further, the abstract is provided to allow, through a simple investigation, quick analysis of the technical features and essences of the present invention by an intellectual property office, a general public institution, or one skilled in the art who is not fully familiarized with patent and legal or professional terminology. It is therefore not an intention of the abstract to limit the scope of the present invention which shall be construed on the basis of the description of the claims. To fully understand the object and effects of the present invention, it is strongly encouraged to sufficiently refer to disclosures of documents already made available.

The detailed description of the present invention provided hereinabove includes a process executed on a computer or computer network. The above descriptions and expressions are provided to allow the one skilled in the art to most efficiently understand the present invention. A process performed in or by respective steps yielding one result or blocks with a predetermined processing function described in the present specification shall be understood as a process with no self-contradiction. Further, the electrical or magnetic signal is transmitted/received and written in the respective steps or blocks. It should be noted that such a signal is expressed in the form of bit, value, symbol, text, terms, number, or the like solely for the sake of convenience. Although the present specification occasionally personifies the processes performed in the steps or blocks, these processes are essentially executed by various devices. Further, the other structures necessary for the steps or blocks are obvious from the above descriptions.

What is claimed is:

1. A gaming machine comprising:

a base game that awards a payout according to a predetermined winning condition;

a plurality of gaming terminals each including a terminal controller programmed to perform operations (a1) and (a2);

a bonus game that awards a bonus payout greater than the payout in the base game;

a bonus payout indicator that displays the bonus payout;

a center controller programmed to perform operations (b1) through (b3); and a plurality of paths formed from a plurality of light emitting portions connecting each of the gaming terminals to the bonus payout indicator, and including a bent portion provided proximate the gaming terminal, and a straight portion in which each path is provided in parallel configuration proximate the bonus payout indicator, the terminal controller in each gaming terminal (a1) running the base game independently from the other gaming terminals and awarding the payout according to the predetermined winning condition, and (a2) awarding the bonus payout based on an instruction from the center controller, and the center controller (b1) running the bonus game based on a predetermined condition, (b2) causing the light emitting portions of a path to undergo state changes toward the bonus payout indicator, in numbers fewer in the straight portion than in the bent portion, when the predetermined winning condition is met in one of the gaming terminals, and (b3) instructing the terminal controller of the gaming terminal, corresponding to a path in which the light emitting portions underwent state changes up to the bonus payout indicator, to award the bonus payout.

2. A gaming machine comprising:

a base game which awards a payout according to a predetermined winning condition;

a plurality of gaming terminals each having a first light emitting portion which is activated to light, and a terminal controller programmed to carry out the following steps of (a1) to (a3);

a bonus game configured to award a bonus payout greater than the payout awarded in the base game;

a bonus payout display unit which displays the bonus payout;

a plurality of paths, each respectively associated with one of the plurality of gaming terminals, each of the paths having one end provided to an associated one of the gaming terminals, and a second end provided to the bonus payout display unit, wherein the each of the paths has a plurality of second light emitting portions aligned along the path, and wherein each of the second light emitting portions is capable of lighting up in the same color as the first light emitting portion of the associated gaming terminal;

and a center controller programmed to carry out the following steps of (b1) to (b3), wherein the terminal controller carries out the steps of:

(a1) activating the first light emitting portion in a predetermined color;

(a2) running the base game independently of another gaming teiminal, and awarding a payout according to the predetermined winning condition; and (a3) awarding the bonus payout based on a command from the center controller, and wherein the center controller carries out the steps of:

(b1) running the base game based on a predetermined condition:

(b2) for each of the gaming terminals, additionally activating one or more second light emitting portions of the associated one of the paths according to the predetermined winning condition, sequentially from a first end of the path closer to the associated gaming terminal, so as to light in the same color as the first light emitting portion of the associated gaming terminal, each time a winning condition is resulted in the associated gaming terminal; and (b3) when the associated one of the paths is activated up to a second light emitting portion at a second end of the path closer to the bonus payout display unit, commanding the terminal controller of the gaming terminal associated with that path to award the bonus payout.

3. A gaming machine comprising:

a base game which awards a payout according to a predetermined winning condition:

a plurality of gaming terminals each having a display which displays an effect image, and a terminal controller programmed to carry out the following steps of (a1) to (a2);

a bonus game configured to award a bonus payout greater than the payout awarded in the base game;

a bonus payout display unit which displays the bonus payout;

a plurality of paths, each respectively associated with one of the plurality of gaming terminals, each of the plurality of paths having a first end provided to an associated one of the gaming terminals, and a second end provided to the bonus payout display unit, wherein the each of the paths has a plurality of light emitting portions activated to light;

a light emission mode obtain unit which obtains an activation state of each of the plurality of light emitting portions; and a center controller programmed to carry out the following steps of (b1) to (b5), wherein the terminal controller carries out the steps of (a1) running the base game independently of another gaming terminal, and awarding the payout according to the predetermined winning condition; and (a2) awarding the bonus payout based on a command from the center controller, and wherein the center controller carries out the steps of:

(b1) running the bonus game based on a predetermined condition;

(b2) for each of the gaming terminals, additionally activating one or more of the light emitting portions associated with that gaming terminal according to the predetermined winning condition, sequentially from one light emitting portion closest to the associated gaming terminal, each time a winning is resulted in the gaming terminal;

(b3) having the light emission mode obtain unit obtain the activation state of each of the plurality of light emitting portions;

(b4) displaying, on the display of each of the gaming terminals, a light emission mode image based on the activation state of each of the plurality of light emitting portions; and (b5) when a path is activated up to a light emitting portion at the second end of the path, commanding the terminal controller of the gaming terminal associated with that path to award the bonus payout.

4. A gaming machine comprising:

a plurality of terminal devices each of which executes a base game with a game value being bet and awards a prize according to a predetermined winning condition;

a common display which displays thereon a predetermined content;

a plurality of routes each of which is formed from a plurality of route light emitters disposed continuously from a corresponding terminal device out of the terminal devices to the common display; and a jackpot controller which is programmed to execute the steps of:

(a1) accumulating a percentage of a game value which is bet in each base game executed at each of the terminal devices;

(a2) causing the common display to display an amount of accumulated game values;

(a3) after the amount of accumulated game values reaches a predetermined amount, and every time the predetermined winning condition is achieved at a terminal device, causing a first predetermined number of route light emitters, which are disposed along a route corresponding to the terminal device at which the predetermined winning condition is achieved, to be turned on toward the common display so as to emit light;

(a4) when a second predetermined number of route light emitters disposed along any one of the plurality of routes are turned on so as to emit light, causing all the route light emitters, which are disposed along each of the routes and are turned on, to blink; and (a5) when all route light emitters disposed along any one of the plurality of routes are turned on, awarding the accumulated game values to a terminal device corresponding to the one of the routes along which all route light emitters are turned on.

5. The gaming machine according to claim 4, wherein the jackpot controller generates an effect sound when, in (a4), the second predetermined number of route light emitters disposed along any one of the plurality of routes are turned on so as to emit light.

* * * * *